United States Patent [19]

Cutler et al.

[11] Patent Number: 4,789,932

[45] Date of Patent: Dec. 6, 1988

[54] APPARATUS AND METHOD FOR AUTOMATICALLY SCORING A DART GAME

[75] Inventors: Royce L. Cutler, Austin; Edward A. Hohmann, Houston, both of Tex.

[73] Assignee: Austin T. Musselman, Houston, Tex.

[21] Appl. No.: 652,846

[22] Filed: Sep. 21, 1984 (Under 37 CFR 1.47)

[51] Int. Cl.[4] ..... G06F 15/44

[52] U.S. Cl. ..... 364/411; 364/410; 273/371; 273/348; 273/DIG. 26; 273/DIG. 28

[58] Field of Search ..... 364/410, 411, 517; 250/215–216, 221, 222.1, 222.2; 340/323 R; 273/317, 348, 373–374, 376, 403–404, 408, 410, 416, DIG. 24, DIG. 26, DIG. 28, 371

[56] References Cited

U.S. PATENT DOCUMENTS

| | | | |
|---|---|---|---|
| 2,165,147 | 7/1939 | Moss | 273/102.2 |
| 2,506,475 | 5/1950 | Traub | 273/102.2 |
| 2,523,773 | 9/1950 | Metzger | 273/102.2 |
| 3,047,723 | 7/1962 | Knapp | 250/222 |
| 3,235,738 | 2/1966 | Kress et al. | 250/221 |
| 3,401,937 | 9/1968 | Rockwood et al. | 273/102.2 |
| 3,454,276 | 7/1969 | Brenkert et al. | 273/102.2 |
| 3,590,225 | 6/1971 | Murphy | 235/92 GA |
| 3,619,630 | 11/1971 | McLeod et al. | 250/222 R |
| 3,624,401 | 11/1971 | Stoller | 273/371 X |
| 3,727,069 | 4/1973 | Crittenden, Jr. et al. | 250/222 R |
| 3,790,173 | 2/1974 | Callaway | 273/102.2 R |
| 3,807,858 | 4/1974 | Finch | 356/1 |
| 3,836,148 | 9/1974 | Manning | 273/95 R |
| 4,057,251 | 11/1977 | Jones et al. | 273/95 R |
| 4,097,800 | 6/1978 | Kuchmas, Jr. et al. | 250/222.2 X |
| 4,129,299 | 12/1978 | Busch | 364/411 X |
| 4,216,968 | 8/1980 | Yeeda | 273/376 |
| 4,267,443 | 5/1981 | Carroll et al. | 250/221 |
| 4,272,189 | 6/1981 | Bailey et al. | 250/222.1 X |

OTHER PUBLICATIONS

"*English Mark Darts*" *Series* 5000 *Parts Manual*, Arachnid, Inc., Rockford, Illinois, 1984, pp. 1–12.

"*English Mark Darts*" *Machine Owner's Manual*, Arachnid, Inc., Rockford, Illinois, 1983, pp. 1–8.

*Primary Examiner*—Gary V. Harkcom

*Attorney, Agent, or Firm*—Vinson & Elkins

[57] ABSTRACT

An automatic scoring apparatus for a dart game utilizing a plurality of light detecting elements situated on the periphery of a dart board. These light detecting elements are aligned to receive light emitted by a plurality of light sources so that a dart embedded in the dart board will block the path of light from the light sources to the light detecting elements. A microprocessor and associated electronic circuitry continually scan the light detecting elements to detect a decrease in the amount of light incident on any particular light detecting elements indicative of the presence of a dart in the dart board. The location of the dart is calculated mathematically from the shadow location information.

26 Claims, 13 Drawing Sheets fig.3
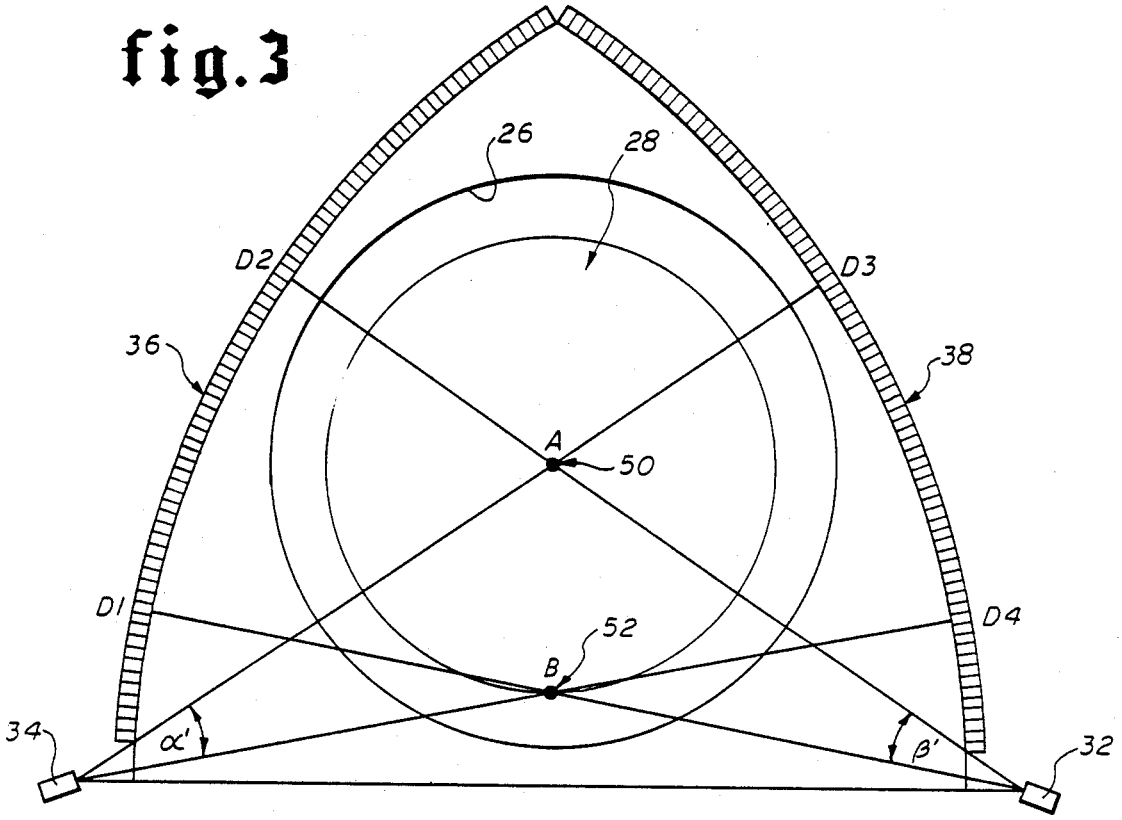
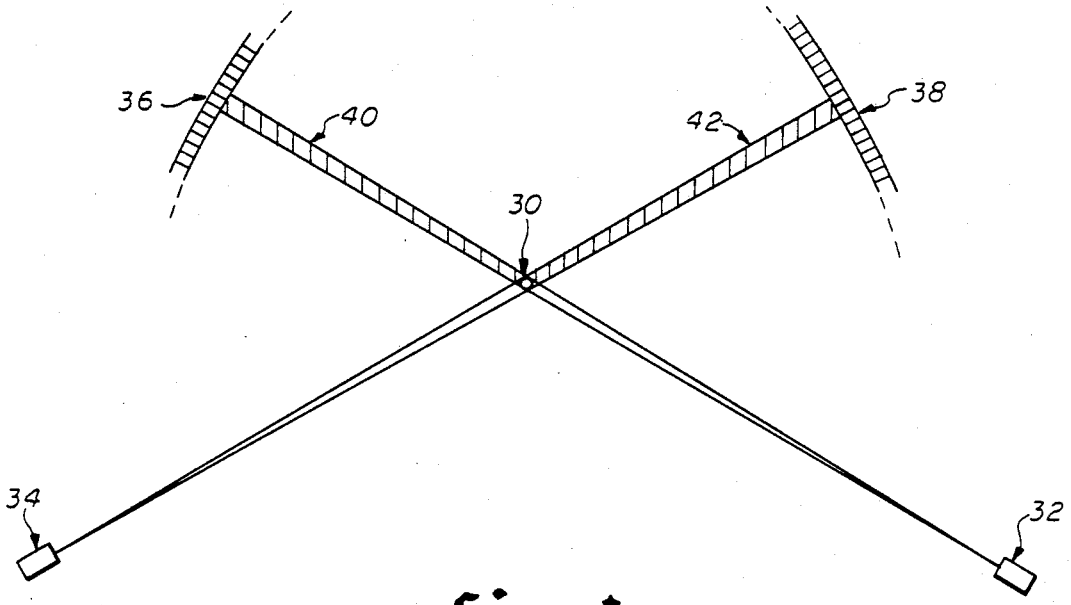
fig.4 fig.5
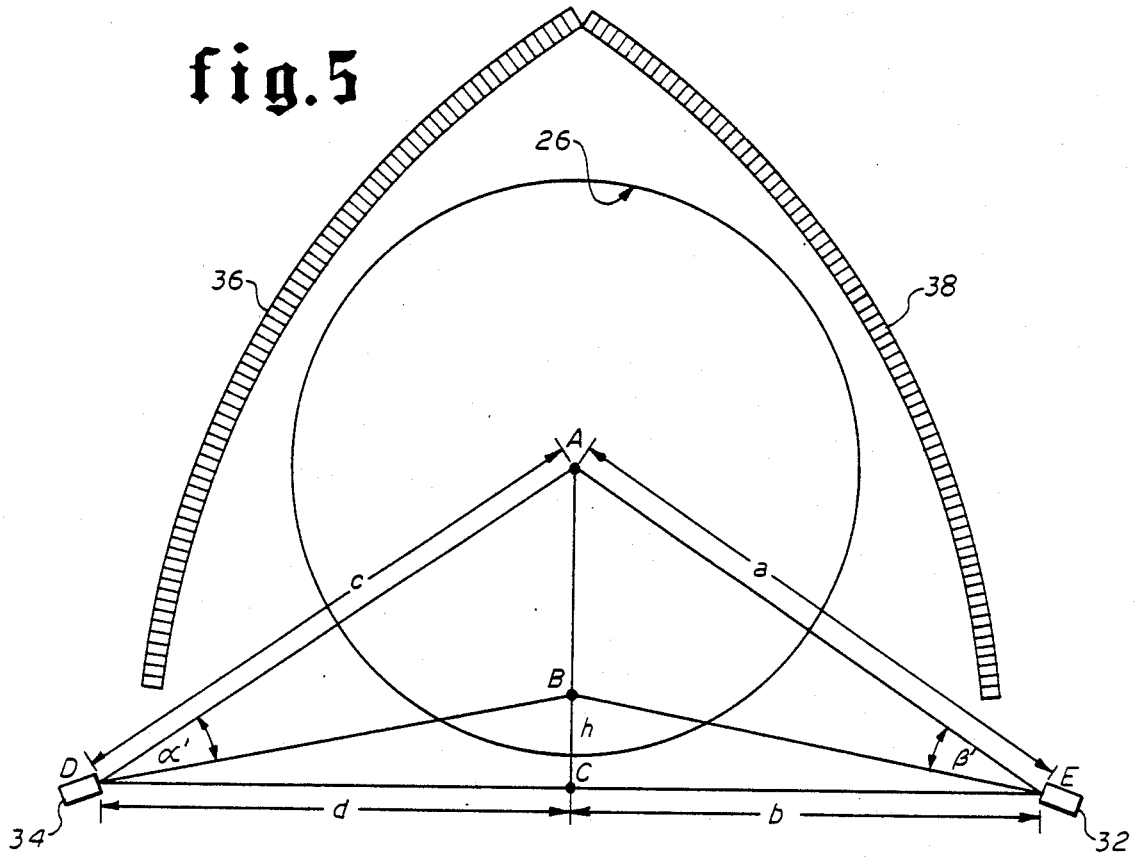
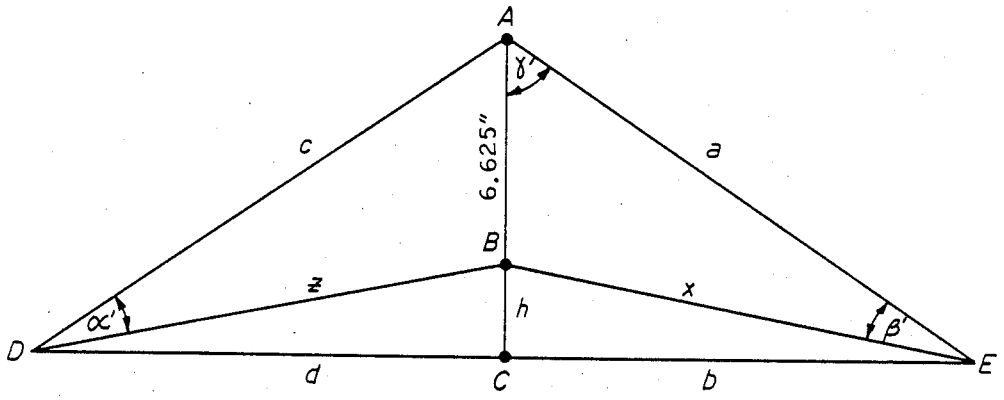
fig.6

APPARATUS AND METHOD FOR AUTOMATICALLY SCORING A DART GAME

This invention relates to dart games, and more particularly, to the automatic calculation of the position of a dart embedded in a dart board to permit the dart game to be automatically scored as the darts are thrown.

BACKGROUND OF THE INVENTION

Numerous automatic scoring systems exist for dart games. For example, U.S. Pat. No. 3,836,148 for "Rotatable Dart Board, Magnetic Darts and Magnetic Scoring Switches" discloses an automatic scoring dart board apparatus utilizing magnetic darts. A rotatably mounted dart board rotates to bring the magnetic darts embedded in the dart board into alignment with a plurality of magnetic actuatable switches located behind the dart board. U.S. Pat. No. 3,790,173 for "Coin Operated Dart Game" discloses a dart game which automatically and electrically accumulates the score of a thrown dart. A special surface for the dart board is required to electrically register the position at which the dart strikes the target. U.S. Pat. No. 3,454,276 for "Self Scoring Dart Game" discloses impact actuated electrical switches which activate relays to total the score of the thrown darts. Other automatically scored dart games are disclosed in U.S. Pat. No. 2,523,773; in U.S. Pat. No. 2,506,475; and in U.S. Pat. No. 2,165,147. The automatically scoring dart games disclosed in the prior art utilize either special darts or a special dart board surface. The present invention, on the other hand, provides a fast and accurate automatic system to calculate the position of an ordinary dart embedded within an ordinary dart board. A special dart board and/or special darts are not needed.

SUMMARY OF THE INVENTION

The present invention overcomes the disadvantages inherent in the dart board systems disclosed in the prior art by providing an automatic dart board scoring system which requires neither a specially constructed dart board nor specially constructed darts. The dart board system of the present invention utilizes a plurality of light emitting elements and a plurality of light detecting elements situated on the periphery of a standard dart board. Each light source emits light across the surface of the dart board in a manner that enables a number of the light detecting elements on the opposite side to respond to the emitted light. A dart embedded in the dart board will block the path of the light from two or more of the light sources to the associated light detecting elements. A microprocessor and associated electronic circuitry continually scan the outputs of the light detecting elements in order to detect a decrease in the amount of light incident on any of the light detecting elements. A decrease in the amount of incident light is indicative of the presence of a dart in the dart board.

After detecting the presence of a dart, the system mathematically determines the position of the embedded dart, using the observed positions of those light detecting elements in the shadow of the dart and the known positions of the associated light sources. After the position of the dart is calculated, the system computes the points scored by that dart, and updates the game score. The system detects additional darts by detecting a difference in the results of a new scan of the outputs of the light detecting elements from the results from the prior scan that are stored in memory. The position of the new dart is then mathematically determined in the same manner as before, and the game score is updated accordingly.

An object of the present invention is to provide means for automatically scoring a dart game. A further object of the invention is to provide means for automatically calculating the position of a dart embedded in a dart board. Yet another object of the invention is to provide an automatic dart board scoring system which utilizes an ordinary dart board and ordinary darts. Still another object of the invention is to provide means for automatically calibrating the process of determining the dart position, so that the need for maintenance of the system is minimized. A further object of the invention is to provide means for automatically calculating the positions of a plurality of darts sequentially thrown and simultaneously embedded in a dart board.

Other objects of the invention will become readily apparent from the following detailed description and the drawings herein.

BRIEF DESCRIPTION OF THE DRAWINGS

FIG. 3 is a schematic view of the dart board showing the relative position of two arrays of light detecting elements and two light sources used to detect the location of darts embedded in the dart board.

FIG. 4 is a schematic view of the blockage of light from two light sources to two arrays of light detecting elements by a dart embedded in the dart board.

FIG. 5 is a schematic view showing the distances from the two calibration points of the dart board to the two light sources and showing the relative position of the two calibration points with respect to the two light sources.

FIG. 6 is a schematic view of a set of triangles representing the distances shown in FIG. 5 showing certain angles and distances which must be calculated in order to calibrate the exact position of the dart board when the dart board is initially positioned within the automatic scoring apparatus.

DESCRIPTION OF THE PREFERRED EMBODIMENT

Figure 1:
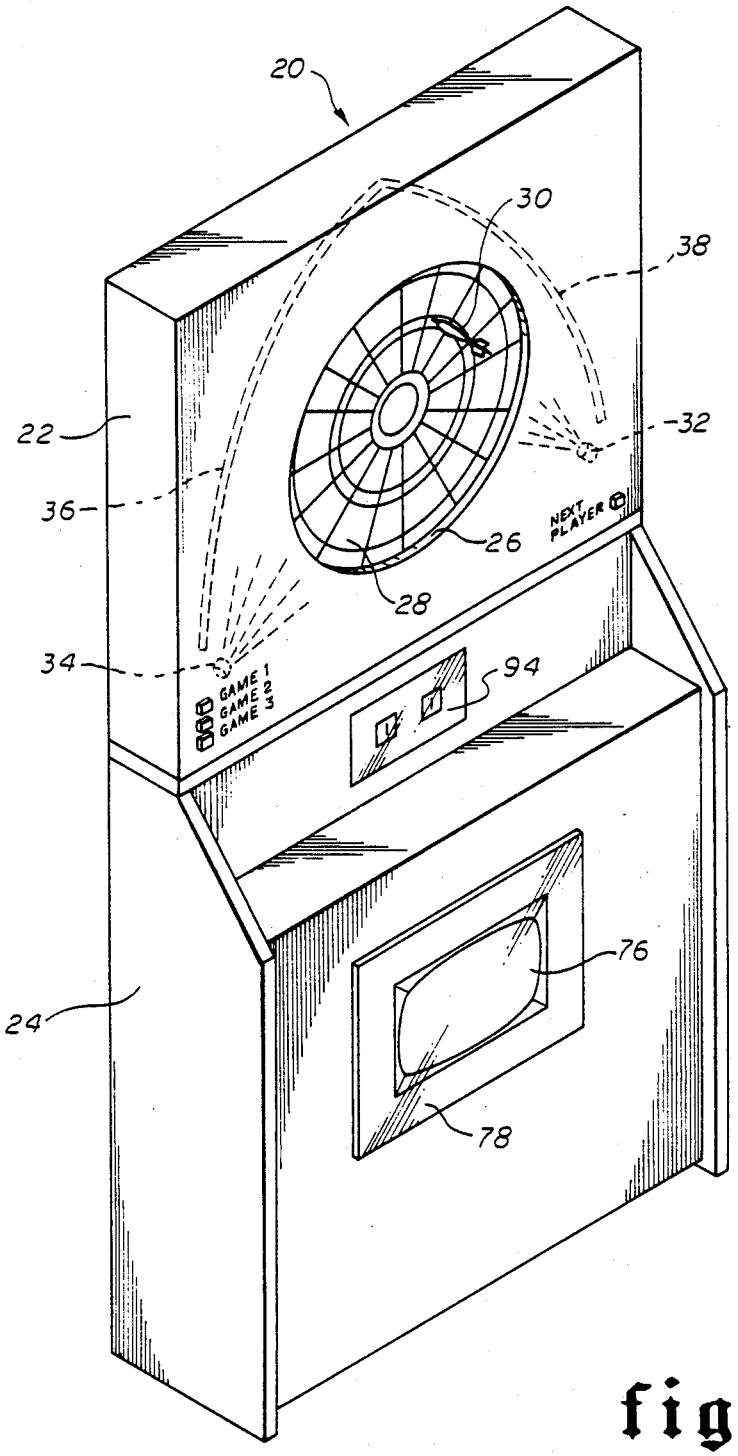
FIG. 1 is a perspective view of the automatic scoring apparatus of the invention showing the placement of a dart board within said apparatus.

The automatic scoring apparatus of the present invention will be denoted generally by the numeral 20. As shown in FIG. 1 automatic scoring apparatus 20 may be contained within an automatic scoring apparatus housing 22 supported by an automatic scoring apparatus base 24. As shown in FIG. 1, one wall of said housing 22 possesses a circular aperture 26 having dimensions slightly larger than the dimensions of a regulation size dart board. A regulation size dart board 28 may be mounted within said housing 22 through said circular aperture 26 and inset inwardly from the inner surface of the associated wall to define a space therebetween. After dart board 28 has been mounted within housing 22, one or more darts 30 may be thrown at dart board 28 during the course of a dart game. FIG. 1 illustrates a dart 30 embedded in dart board 28.

FIG. 1 also illustrates in dotted outline the placement of a first light source 32 and a second light source 34 within housing 22 on opposite sides of dart board 28. First light source 32 is placed within housing 22 so that light from first light source 32 will illuminate a space immediately above and adjacent to the surface of dart board 28. The light from first light source 32 passes through illuminated space and over the surface of dart board 28 in a generally horizontal direction. The light from first light source 32 is then incident upon a first array of light detecting elements 36 such as photoelectric cells mounted within housing 22 on one side of dart board 28. Said first array of light detecting elements 36 is arranged in a circular arc with respect to first light source 32. That is, the distance from first light source 32 to each of the light detecting elements in said first array of light detecting elements 36 is the same. Thus, the light detecting elements in said first array of light detecting elements 36 define a circular arc. The relative position of said first array of light detecting elements 36 within housing 22 is shown in dotted outline in FIG. 1.

Similarly, second light source 34 is located within housing 22 on one side of dart board 28 so that second light source 34 may horizontally illuminate the space immediately above and adjacent to dart board 28 from a second direction. Light from second light source 34 is incident upon a second array of light detecting elements 38 positioned on the side of dart board 28 opposite second light source 34. Said second array of light detecting elements 38 is arranged in a circular arc with respect to second light source 34 in a manner identical to that described for the first array of light detecting elements 36. The relative position of the second array of light detecting elements 38 within housing 22 is shown in dotted outline in FIG. 1.

The construction and operation of first light source 32 and first array of light detecting elements 36 is identical to the construction and operation of second light source 34 and second array of light detecting elements 38. The light sources, 32 and 34, and the arrays of light detecting elements, 36 and 38, define a system for generating and receiving light which is symmetrical with respect to a straight line passing from the bottom of dart board 28 to the top of dart board 28. FIGS. 3 and 5 illustrate the symmetry of the light generating and receiving system.

When a dart 30 is thrown into dart board 28, then dart 30 embeds itself within dart board 28. As shown schematically in FIG. 4, the presence of dart 30 embedded within dart board 28 interrupts the light passing from first light source 32 to first array of light detecting elements 36 thereby casting a first shadow 40 on the first array of light detecting elements 36. Said dart 30 simultaneously interrupts the light passing from second light source 34 to second array of light detecting elements 38 thereby casting a second shadow 42 on the second array of light detecting elements 38.

The light detecting elements in the first array of light detecting elements 36 and in the second array of light detecting elements 38 may be photoelectric cells such as phototransistors or the like. As is well known, a phototransistor will cause a small amount of current to flow in the circuit in which it is connected when light is incident on said phototransistor. The presence of dart 30 embedded within dart board 28 may be detected when the shadows created by dart 30 fall upon and eclipse some of the phototransistors of the first array of light detecting elements 36 and eclipse some of the phototransistors of the second array of light detecting elements 38. The ambient light incident on the eclipsed phototransistors will be less than that light which the phototransistors would otherwise have received directly from an oppositely located light source. Therefore the current that the eclipsed phototransistors generate is less than the current generated by the phototransistors that are located immediately adjacent to the eclipsed phototransistors.

In one embodiment of the apparatus, two hundred fifty-six (256) phototransistors are positioned within said first array of light detecting elements 36 and two hundred fifty-six (256) phototransistors are positioned within said second array of light detecting elements 38. The individual phototransistors in arrays 36 and 38 are spaced at a distance of one tenth of an inch (0.10") inch from each other. The close spacing of the individual phototransistors with respect to the dimensions of a regulation size dart board (a circle with a diameter of approximately eighteen inches) causes a dart 30 to cast a shadow that will eclipse approximately three to five phototransistors. As will be more fully described below, the apparatus of the present invention comprises a microprocessor 4 having the capacity to detect the location of each of the eclipsed phototransistors and to store in its memory the identity of each of the eclipsed phototransistors. Microprocessor 44 also has the capacity to calculate the location of the center of a shadow that eclipses a group of phototransistors thereby establishing an accurate figure for calculating the position of dart 30.

The microprocessor 44 mathematically creates a model of the scoring areas of dart board 28 and correlates the actual position of dart board 28 with the mathematical model. In order that there be an exact correspondence between the actual dart board 28 and the mathematical model of the dart board residing in microprocessor 44 it is necessary for microprocessor 44 to have information giving it the exact location of dart board 28. Accordingly, whenever a new dart board 28 is placed within housing 22, it is necessary to calibrate the apparatus as described below.

A pin (not shown) fixedly mounted within housing 22 is formed to fit within a complementarily shaped recess (not shown) within the rear surface of dart board 28. When dart board 28 is mounted within housing 22 said pin fits within said recess to guide dart board 28 to a centered position within circular aperture 26 of housing 22. The fit between said pin and its complementarily shaped recess is tight enough to insure that dart board 28 will be located in the desired position to within a tolerance of plus or minus one fourth of an inch (¼").

Figure 2:
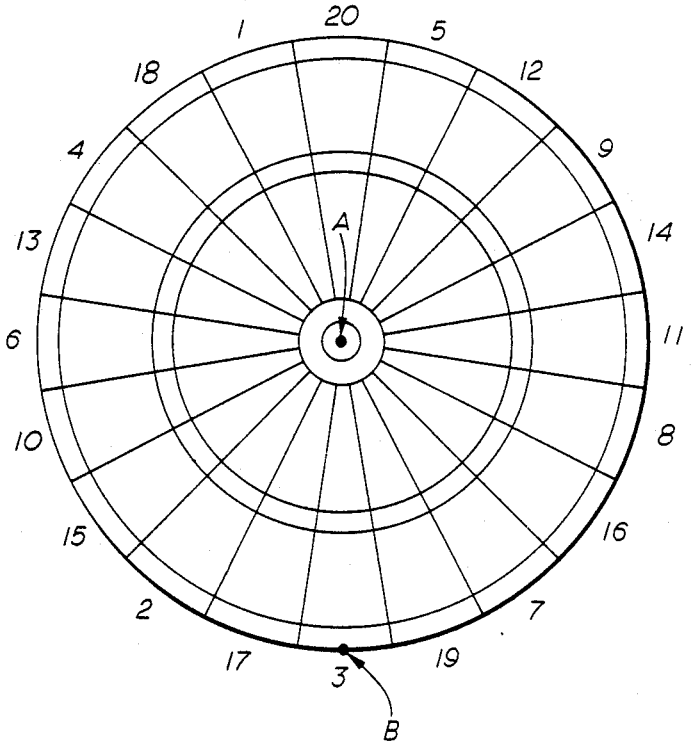
FIG. 2 is a schematic view of the dart board showing the location of two calibration points and the scoring value of various sectors of said dart board.

Next, a first calibration pin 50 is pushed into the exact center of the dart board 28. The location of first calibration pin 50 in dart board 28 will be denoted by the letter A as shown in FIG. 2. Then a second calibration pin 52 is pushed into dart board 28 at the bottom edge of dart board 28. The location of second calibration pin 52 is denoted by the letter B as shown in FIG. 2.

Turning now to FIG. 3, one can see that the light illuminating first array of light detecting elements 36 from first light source 32 is interrupted by both first calibration pin 50 and by second calibration pin 52. Second calibration pin 52 causes a shadow to be thrown upon first array of light detecting elements 36 at location D1. First calibration pin 50 causes a shadow to be thrown on first array of light detection elements 36 at location D2.

Similarly, the light illuminating second array of light detecting elements 38 from second light source 34 is interrupted by both first calibration pin 50 and by second calibration pin 52. First calibration pin 50 causes a shadow to be thrown on second array of light detecting elements 38 at location D3. Second calibration pin 52 causes a shadow to be thrown on second array of light detecting elements 38 at location D4.

The locations D1, D2, D3 and D4 may be used to calculate the numerical value of the angles $\alpha'$ and $\beta'$ shown in FIG. 3. Angle $\alpha'$ is the angle between a line extending from second light source 34 through the center of the dart board 28 and a line extending from second light source 34 through the bottommost point of dart board 28. Angle $\beta'$ is the angle between a line extending from first light source 32 through the center of dart board 28 and a line extending from first light source 32 through the bottommost point of dart board 28. The distance from first light source 32 to second light source 34 is a fixed constant and in this particular embodiment of the invention is exactly equal to thirty inches (30.00"). The radius of curvature of the first array of light detecting elements 36 is also a fixed constant and in this particular embodiment of the invention is equal to twenty-seven and one-fourth inches (27.25"). The radius of curvature of the second array of light detecting elements is also a fixed constant and is equal to the radius of curvature of the first array of light detecting elements which in this particular embodiment of the invention is equal to twenty-seven and one-fourth inches (27.25").

Angle $\alpha''$ may be calculated in radians by dividing the arcuate distance from point D3 to point D4 by 27.25 inches. Because the light detecting elements are located 0.10 inches apart, the distance from D3 to D4 is equal to the number of light detecting elements between point D3 and point D4 times 0.10 inches. Therefore, angle $\alpha'$ can be determined by making the calculation:

$$\alpha'(\text{radians}) = \frac{(D4 - D3)(0.10)}{(27.25)} \quad (1)$$

Similarly, angle $\beta'$ can be determined by making the calculation:

$$\beta'(\text{radians}) = \frac{(D2 - D1)(0.10)}{(27.25)} \quad (2)$$

FIG. 5 is a schematic view showing the distances from the two light sources, 32, and 34, to the two calibration pins, 50 and 52, located at points A and B, respectively. As shown in FIGS. 5 and 6, the letter E denotes the location of first light source 32 and the letter D denotes the location of second light source 34. The letter C denotes the point of intersection of a line drawn through points A and B with a line drawn through points D and E. Let the letter b denote the distance from point E to point C and let the letter d denote the distance from point C to point D. Similarly, let the letter a denote the distance from point E to point A and let the letter c denote the distance from point A to point D.

In this embodiment of the invention the distance between first calibration pin 50 (point A) and second calibration pin 52 (point B) is six and five eighths inches (6.625"). This distance is noted in FIG. 6. The letter h denotes the distance between point B and point C. As shown in FIG. 6, the letter x denotes the distance between point E and point B and the letter z denotes the distance between point B and point D.

The object of the calibration procedure is to provide microprocessor 44 with information for locating the center of dart board 28 to within the desired tolerance. At the beginning of the calibration procedure, microprocessor 44 knows the location of point E and point D. Microprocessor 44 also knows that point A is 6.625 inches away from point B. Microprocessor 44 also knows that the sum of the distances d and b equals 30.00 inches. The unknowns to be determined are the distances h and b. After microprocessor 44 knows the distances h and b, then microprocessor 44 has information exactly locating the center of dart board 28 (point A). With the center of dart board 28 located, microprocessor 44 can cause its mathematical model to exactly coincide with the physical dart board 28 mounted within housing 22, thereby permitting the darts 30 embedded within dart board 28 to be accurately located.

Turning now to the actual calculation of the values h and b, one sees that it is convenient to solve the problem by successive approximation. Microprocessor 44 first assumes that the distance represented by the letter x (the distance from point E to point B) is exactly fifteen inches (15.00"). From the law of sines:

$$\frac{\sin\gamma'}{x} = \frac{\sin\beta'}{6.625} \quad (3)$$

$$\sin\gamma' = \frac{x\sin\beta'}{6.625}$$

$$\gamma' = \sin^{-1}\frac{x\sin\beta'}{6.625} \text{ (radians)}$$

but the angle $\beta'$ is known from Equation (2) and x has been assumed to be 15.00 inches. Therefore, the angle $\gamma'$ can be calculated from Equation (3).

Once the angle $\gamma'$ is known, then the distance represented by the letter a (the distance from point E to point A) can be calculated from the law of sines as follows:

$$\frac{\sin(180° - \beta' - \gamma')}{a} = \frac{\sin\beta'}{6.625} \quad (4)$$

$$[6.625]\,[\sin(180° - \beta' - \gamma')] = a\sin\beta'$$

$$a = \frac{[6.625]\,[\sin(180° - \beta' - \gamma')]}{\sin\beta'}$$

Because the angle $\beta'$ and $\gamma'$ are known from Equations (2) and (3), the value of a may be calculated from Equation (4).

Now the values b and h are calculated:

$$b = a\sin\gamma' \quad (5)$$

$$h = \sqrt{x^2 - b^2} \quad (6)$$

These values of b and h are the values obtained by assuming that the distance x was equal to 15.00 inches. Using these values of b and h, one then calculates the distances represented by the letters d, z and c:

$$d = 30.00 - b \quad (7)$$

$$z = \sqrt{h^2 + d^2} \quad (8)$$

$$c = \sqrt{(h + 6.625)^2 + d^2} \quad (9)$$

These values of d, z and c are then used to calculate an approximated value for angle $\alpha'$ which shall be denoted as $\alpha''$. the value of the approximated angle $\alpha''$ may be derived from the law of cosines as follows:

$$\text{Let } s = \tfrac{1}{2}[c+z+6.625] \quad (10)$$

$$\text{then } r = \sqrt{\frac{(s-c)(s-z)(s-6.625)}{s}} \quad (11)$$

and then $$\alpha'' = 2\tan^{-1}[r/(s-6.625)] \quad (12)$$

The value of approximately angle $\alpha''$ is then compared to the value of $\alpha'$ obtained from the calibration measurement and from Equation (1). If the calculated value of $\alpha''$ is less than $\alpha'$, then the value for x was assumed too large. If the calculated value of $\alpha''$ is greater than $\alpha'$, then the value for x was assumed too small. If x was assumed too large, then its value is decreased by 0.05 inch and the series of calculations described above is performed again. Similarly, if x was assumed too small, then its value is increased by 0.05 inch and the series of calculations described above is performed again.

As each value of $\alpha''$ is recalculated it is compared with the empirically determined value of $\alpha'$. When $\alpha''$ and $\alpha'$have values within one thousandth of a radian (0.001 radian) of each other, the successive approximation calculations performed by microprocessor 44 are terminated and the values of b and h that were last calculated are stored in microprocessor 44. The values of b and h calculated when the angles $\alpha''$ and $\alpha'$ are within 0.001 radian of each other locate the center of dart board 28 to within a tolerance of approximately twenty-five thousandths of an inch (0.025").

The calibration process described above must be performed each time a new dart board 28 is mounted within housing 22. First calibration pin 50 and second calibration pin 52 are removed from dart board 28 after calibration process has been completed. At this point, microprocessor 44 by using the last calculated values of b and h can mathematically correlate a model of the scoring areas of a dart board with the actual dart board 28. In short, microprocessor 44 now "knows" the location of dart board 28 with respect to housing 22.

Figure 7:
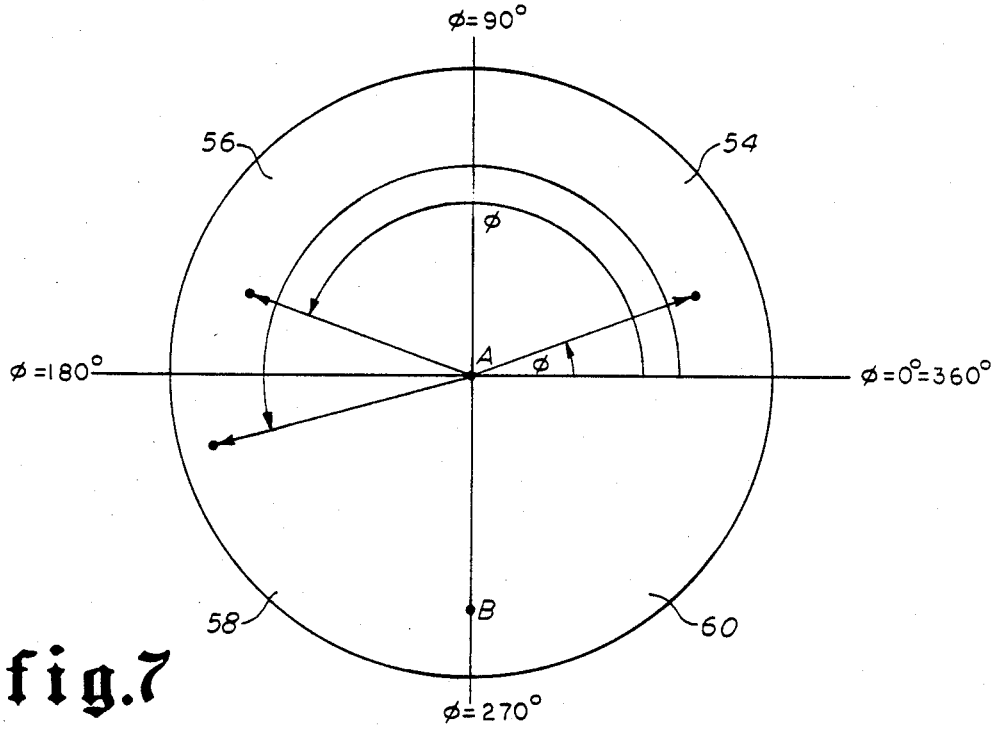
FIG. 7 is a schematic view showing the dart board circle divided into four sectors and showing the line from which an angular coordinate for locating the position of a dart is measured.

Microprocessor 44 can use this information to calculate the location of a dart 30 embedded anywhere in the surface of dart board 28. Dart 30 may be located by using polar coordinates. FIG. 7 shows a schematic representation of dart board 28 divided into four equal sectors by two perpendicular lines passing through the center of dart board 28. The four sectors correspond exactly to the four well-known quadrants in trigonometry. That is, first sector 54 corresponds to Quadrant I in trigonometry (0° to 90°), second sector 56 corresponds to Quadrant II (90° to 180°), third sector 58 corresponds to Quadrant III (180° to 270°), and fourth sector 60 corresponds to Quadrant IV (270° to 360°). The location of dart 30 in dart board 28 may be represented in polar coordinates by giving a radial coordinate (denoted by a') equal to the distance from the center of dart board 28 (point A) to the location of dart 30 within said dart board 28 and by giving an angular coordinate (denoted by $\phi$) measuring the angle between said radius a' and the line between first sector 54 and fourth sector 60 as shown in FIG. 7.

Figure 8:
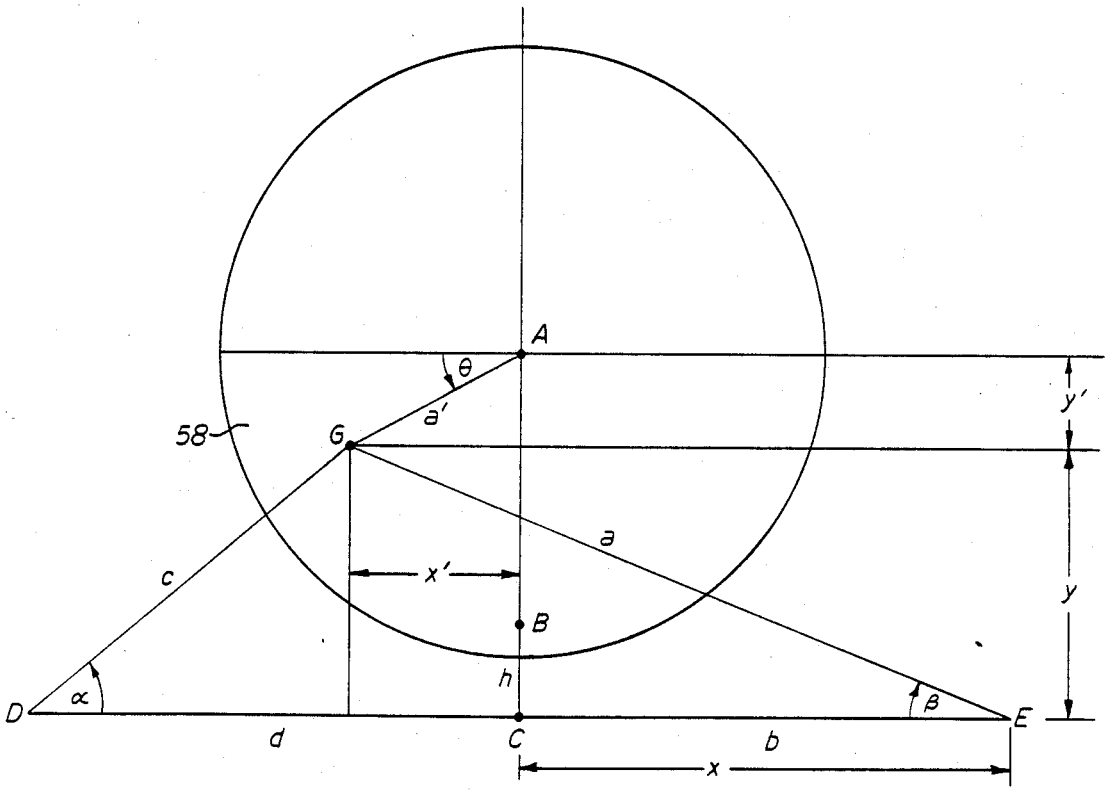
FIG. 8 is a schematic view of a set of triangles representing the distances from the two light sources to a dart embedded in the third sector of the dart board showing certain angles and distances which must be calculated in order to determine the exact position of said dart embedded in the dart board.
Figure 9:
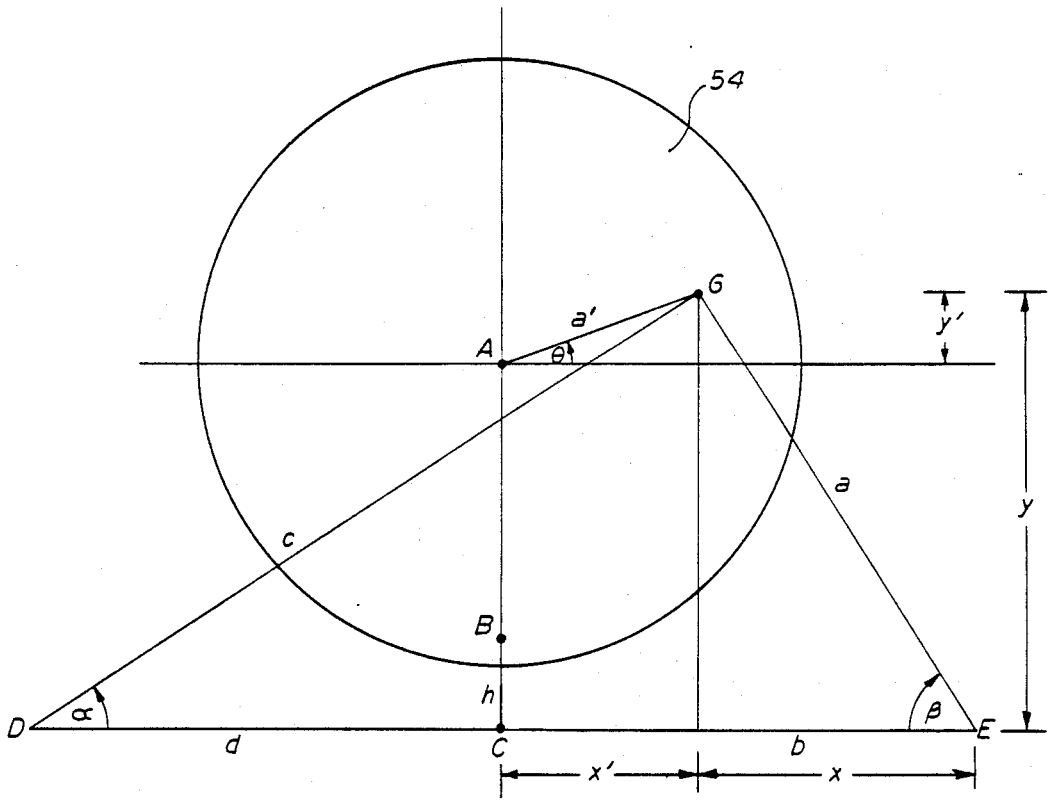
FIG. 9 is a schematic view of a set of triangles representing the distances from the two light sources to a dart embedded in the first sector of the dart board showing certain angles and distances which must be calculated in order to determine the exact position of said dart embedded in the dart board.

FIGS. 8 and 9 illustrate the method of calculation used by microprocessor 44 to find the locating coordinates of the position of dart 30 in dart board 28. Turning first to FIG. 8, one sees that when the dart 30 is located in third sector 58 the dart is in the lower left hand portion of dart board 28. Let the location of the dart 30 in third sector 58 be denoted by the letter G and let the distance from point A to point G be denoted by the letter a'. As shown in FIG. 8, the radius a' is disposed at angle $\theta$ with respect to the boundary line between second sector 56 and third sector 58.

Let the distance between point E (the location of first light source 32) and point G be denoted by the letter a and let the distance between point D (the location of second light source 34) and point G be denoted by the letter c. The letters d, b and h have the meanings previously assigned to them in the description of the calibration process.

The electronic circuitry of the apparatus (which will be more fully described below) scans the first array of light detecting elements 36 and the second array of light detecting elements 38 to determine the location of the first shadow 40 and the second shadow 42 on the arrays of the light detecting elements. The angles $\alpha$ and $\beta$ shown in FIG. 8 are calculated from the location of said shadows on said arrays of light detecting elements in the same manner as previously described for the calibration process.

Specifically, the angle $\alpha$ in radians equals the arcuate distance along the arc from point E to the point of intersection of the second shadow 42 with the second array of light detecting elements 38 divided by the radius of arc, here 27.25 inches.

$$\alpha(\text{radians}) = \frac{(D5 - D6)(0.10)}{(27.25)} \tag{13}$$

where D5 equals the number of the light detecting element in the second array of light detecting elements 38 corresponding to the location of the second shadow 42 and where D6 equals the number of the light detecting element in the second array of light detecting elements 38 corresponding to the location of the first light source 32.

Similarly, the angle $\beta$ in radians equals the arcuate distance along the arc from point D to the point of intersection of the first shadow 40 with the first array of light detecting elements 36 divided by the radius of arc, here 27.25 inches.

$$\beta(\text{radians}) = \frac{(D7 - D8)(0.10)}{(27.27)} \tag{14}$$

where D7 equals the number of the light detecting element in the first array of light detecting elements 36 corresponding to the location of the first shadow 40 and where D8 equals the number of the light detecting element in the first array of light detecting elements 36 corresponding to the location of the second light source 34.

After microprocessor 44 has calculated the values of the angles $\alpha$ and $\beta$ as described above, the values of the unknown coordinates a' and $\theta$ are calculated as will now be described. First, the radial distance from point E to point G is calculated from the law of sines as follows:

$$\frac{\sin\alpha}{a} = \sin\frac{[180° - (\alpha + \beta)]}{d + b} \tag{15}$$

$$a = \frac{(d + b)\sin\alpha}{\sin[180° - (\alpha + \beta)]}$$

Because the values of $\alpha$, $\beta$, d and b are known, the value of a may be found using Equation (15).

The values of the rectilinear coordinates of a (x and y) shown in FIG. 8 are then calculated using the calculated value of a.

$$x = a \sin\beta \tag{16}$$

$$y = a \cos\beta \tag{17}$$

Then, the values of the rectilinear coordinates of a' (x' and y') shown in FIG. 8 are calculated from the calculated values of x and y.

$$x' = x - b \tag{18}$$

$$y' = y - (6.625 + h) \tag{19}$$

The rectilinear coordinates x' and y' may then be transformed into polar coordinates using the equations:

$$a' = \sqrt{(x')^2 + (y')^2} \tag{20}$$

and $$\theta = \sin^{-1}(|y'|/a') \tag{21}$$

where $|y'|$ is the absolute value of y'.

Note that in this example the value of y' is negative. This indicates that the dart 30 is located in either the third sector 58 or the fourth sector 60 of dart board 28. Also note that the conversion of the angle $\theta$ derived from Equation (21) to a corresponding angle $\phi$ as described and shown in FIG. 7 may be accomplished by adding 180° to the angle $\theta$. This is because the angle $\theta$ lies in the third sector 58 of dart board 28.

The equations derived above for the example shown in FIG. 8 of a dart 30 embedded in the third sector 58 of dart board 28 have general applicability. For example, consider the additional case of a dart 30 embedded in the first sector 54 of dart board 28 as shown in FIG. 9. In this example, the location of dart 30 in the first sector 54 of dart board 28 is denoted by the letter G, the distance from point A to point G is denoted by the letter a', and the radius a' is disposed at angle $\theta$ with respect to the boundary line between first sector 54 and fourth sector 60. The letters a, b, c, d and h have the meanings previously assigned to them in the earlier example.

As before, the angles $\alpha$ and $\beta$ shown in FIG. 9 are calculated from the location of the shadows on the arrays of photodetectors in the same manner as in the previous example. Equation (15) is used to calculate the appropriate value of a from the values of $\alpha$ and $\beta$. Inspection of FIG. 9 shows that Equations (16) and (17) give the correct value of the rectilinear coordinates of a (x and y) in terms of a and $\beta$.

Further inspection of FIG. 9 shows that Equations (18) and (19) give the correct value of the rectilinear coordinates of a' (x' and y'). In this case, however, the value of x' is negative which indicates that dart 30 is located in either the first sector 54 or the fourth sector 60 of dart board 28. In this example, the value of y' is positive because the dart is located in the first sector 54 of dart board 28. The values of a' and $\theta$ may be calculated from Equations (20) and (21) as before to give the exact locations of dart 30 in the first sector 54 of dart board 28.

The positive and negative values of the coordinates x' and y' permit the correlation of each angle $\theta$ with its corresponding angle $\phi$. Specifically, if x' is negative and y' is positive, then the dart location is in the first sector 54 and $\phi$ equals $\theta$. If x' is positive and y' is positive, then the dart location is in the second sector 56 and $\phi$ equals 180° minus $\theta$. If x' is positive and y' is negative, then the dart location is in the third sector 58 and $\phi$ equals 180° plus $\theta$. If x' is negative and y' is negative, then the dart location is in the fourth sector 60 and $\phi$ equals 360° minus $\theta$.

The values of the angle $\phi$ and of the radius a' may be correlated to the scoring areas of dart board 28 shown in FIG. 2. With respect to the correlation of the angle $\phi$, one may see that if the value of the angle $\phi$ that is greater than 9° but less than 27° then the dart is in the sector numbered 14 as shown in FIG. 2. A value of the angle $\phi$ that is greater than 27° but less than 45° indicates a dart in the sector numbered 9 and so forth around the dart board up to the value of $\phi$ equal to 351°. If the value of the angle $\phi$ is greater than 351° but less than 360° or is equal to or greater than 0° but less than 9°, then the dart is in the sector numbered 11 as shown in FIG. 2. The various angles of $\phi$ corresponding to the various numbered sectors of the dart board shown in FIG. 2 are summarized below:

| If $\phi$ is greater than | but is less than | then dart is in sector |
|---|---|---|
| 9° | 27° | 14 |
| 27° | 45° | 9 |
| 45° | 63° | 12 |
| 63° | 81° | 5 |
| 81° | 99° | 20 |
| 99° | 117° | 1 |
| 117° | 135° | 18 |
| 135° | 153° | 4 |
| 153° | 171° | 13 |
| 171° | 189° | 6 |
| 189° | 207° | 10 |
| 207° | 225° | 15 |
| 225° | 243° | 2 |
| 243° | 261° | 17 |
| 261° | 279° | 3 |
| 279° | 297° | 19 |
| 297° | 315° | 7 |
| 315° | 333° | 16 |
| 333° | 351° | 8 |
| 351° | 9° | 11 |

With respect to the correlation of the radius a' to the scoring areas of dart board 28, one sees that if the value of a' is less than one-fourth inch (0.250"), then the dart is inside the double bullseye. If the value of a' is greater than one-fourth inch (0.250") but less than five-eighths inch (0.625"), then the dart is inside the single bullseye. Similarly, a value of a' between three and three-quarters inches (3.750") and four and one-eighth inches (4.125") indicates that the dart is inside the triple ring and a value of a' between six and one-fourth inches (6.250") and six and five eighths inches (6.625") indicates that the dart is inside the double ring. If a' is greater than six and five eighths inches (6.625"), then the dart is not within the scoring areas of the dart board. The various values of a' corresponding to the various concentric rings of the dart board shown in FIG. 2 are summarized below.

| If a' is greater than | but is less than | then dart is in |
|---|---|---|
| 0.000 inch | 0.250 inch | Double Bullseye |
| 0.250 inch | 0.625 inch | Single Bullseye |
| 0.625 inch | 3.750 inches | Single |
| 3.750 inches | 4.125 inches | Triple |
| 4.125 inches | 6.250 inches | Single |
| 6.250 inches | 6.625 inches | Double |

For an example of how a score may be calculated, assume that $\phi$ has been found to be 250° and that a' has been found to be 3.86 inches. These values indicate that the dart is in numbered sector 17 within the triple ring. Therefore, the score of this particular dart would be calculated to be 3 times 17 or 51. As a second example, assume that $\phi$ has been found to be 65° and that a' has been found to be 5.2 inches. Then values indicate that the dart is in numbered sector 5 within a single ring. Therefore, the score of this particular dart would be calculated to be 5.

Of course, any system of scoring may be utilized in connection with the dart locating apparatus and method described herein. The underlying principles of the automatic scoring system of the invention may be adapted to any particular set of values that may be chosen. In order to use a different set of scoring values and scoring areas with the apparatus one would only have to provide microprocessor 44 with a different set of parameters relating the values of a' and $\phi$ to the appropriate scoring values and scoring areas. The values a' and $\phi$ would be determined in the same manner as previously described.

Figure 10:
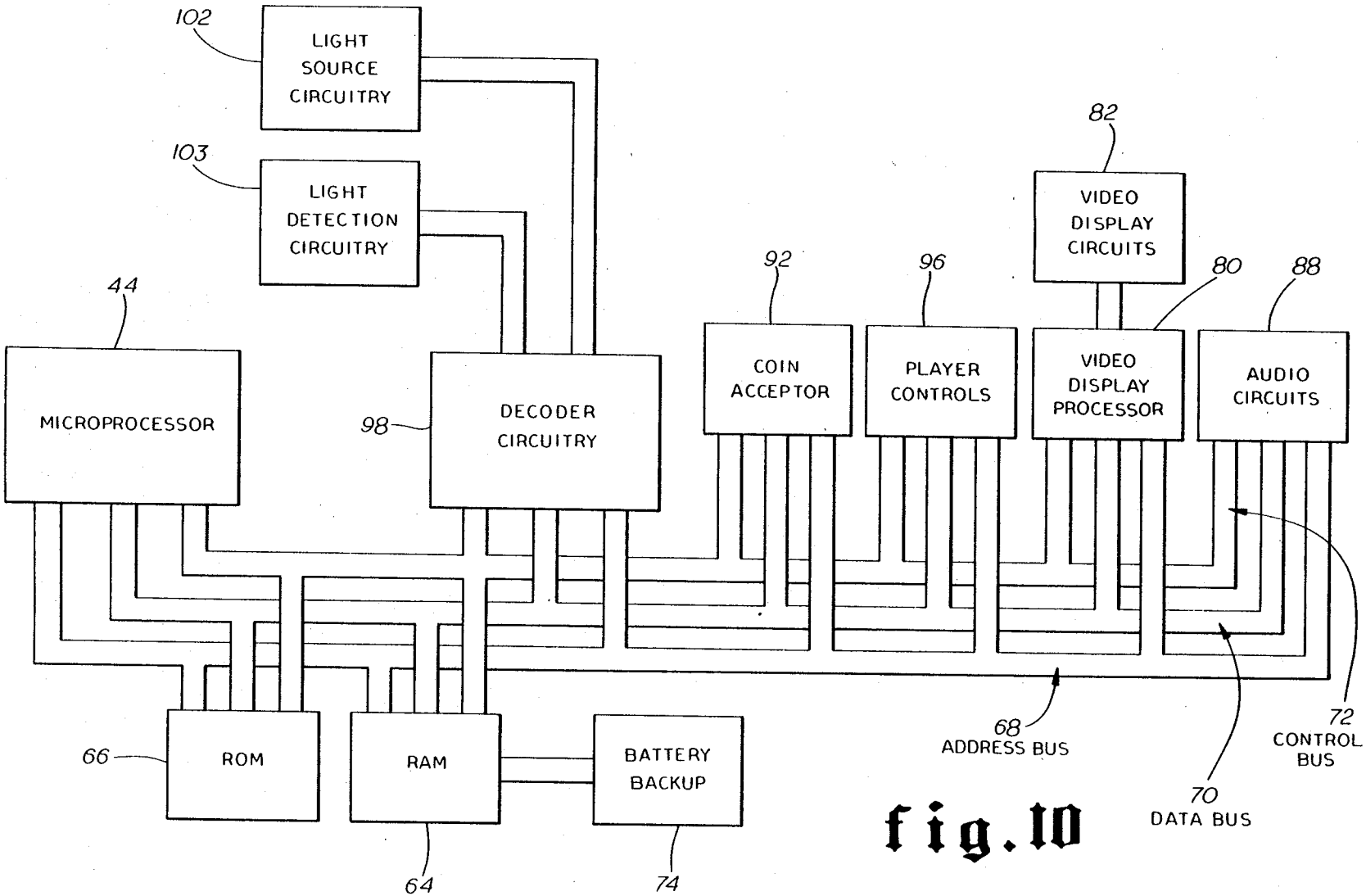
FIG. 10 is a block diagram illustrating the interconnection of various electronic circuits of the apparatus.

Turning now to a description of the microprocessor and associated electronic circuitry used in conjunction with the apparatus previously described, one sees with reference to FIG. 10 that the electronic portion of the apparatus may be symbolically represented in block diagram form. Specifically, FIG. 10 illustrates the interconnection of the various elements of the apparatus including a microprocessor 44 (containing a central processing unit or CPU), random access memory 64 (RAM), read only memory 66 (ROM), an address bus 68, a data bus 70 and a control bus 72. A battery back-up 74 may be optionally provided for operation during power failures.

Other electronic circuitry may be used with the apparatus as indicated in FIG. 10. For example, a cathode ray tube 76 (CRT) may be utilized to display scoring information or instructions to the players during the course of a game. CRT 76 is depicted in FIG. 1 mounted within base 24. A transparent non-breakable cover 78 must be used to protect the front of CRT 76 from being penetrated by a carelessly thrown dart. Such a cover 78 is also depicted in FIG. 1. A video display controller 80 and associated video display circuits 82 as shown in FIG. 10 may be connected to the address bus 68, data bus 70 and control bus 72 for controlling the operation of CRT 76.

The visually transmitted information imparted by CRT 76 may be supplemented with audibly transmitted information from a speaker (not shown) within apparatus 20. Audio circuits 88 may be connected to the address bus 68, data bus 70 and control bus 72 as shown in FIG. 10 to transmit information from microprocessor 44, RAM 64 or ROM 66 to said speaker. The audio circuits 88 cause the computer formatted information to be translated into an audibly intelligible form for transmission to the speaker.

Microprocessor 44 may control several different types of electronic circuitry via control bus 72. For example, coin acceptor circuitry 92 for monitoring the operation of a coin acceptor 94 mounted within base 24 may be controlled by microprocessor 44. The particular types of electronic circuitry used in apparatus 20 may include coin acceptor circuitry 92, player control circuitry 96 for keeping track of which player is next to play, decoder circuitry 98, light source circuitry 102, and light detection circuitry 103 for detecting the presence and location of a dart 30.

Turning now to a description of the decoder circuitry 98, light source circuitry 102, and light detection circuitry 103, one notes that the first array of light detecting elements 36 is mounted on a first detector board (not shown) and the second array of light detecting elements 38 is mounted on a second detector board (not shown). In this embodiment of the invention each detector board contains two hundred fifty-six (256) light detecting elements which may be phototransistors 104. The phototransistors 104 may be any of a number of well known types, including the germanium type or the silicon type or gallium-arsinide type. The phototransistors 104 used in the preferred embodiment of the invention are the n-p-n silicon type, specifically type LS600.

Associated with each phototransistor 104 is a field effect transistor switch. Any of a number of types of field effect transistor switches may be used in this particular application. In the preferred embodiment of the invention, however, an AM3705 switch set 106 containing selective decoding circuitry is used.

Figure 11:
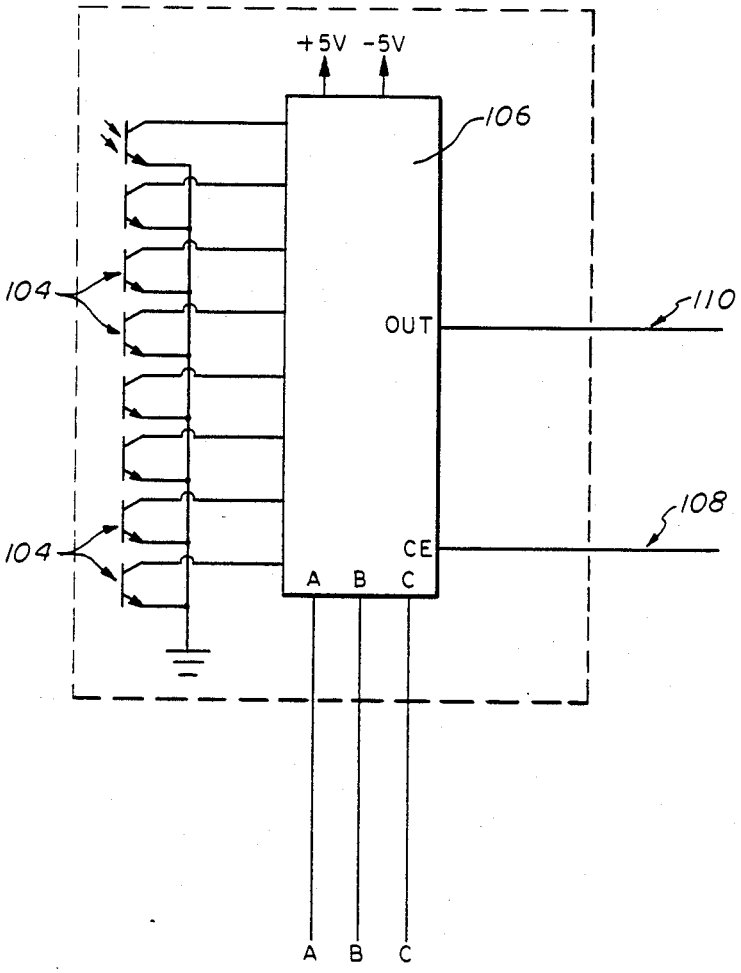
FIG. 11 is a circuit diagram showing a representation of a field effect transistor switch having decoding circuitry for decoding binary signals on input lines to individually activate one of eight phototransistors.

As shown in FIG. 11, said switch set 106 possesses a chip-enable input CE and three binary input lines A, B, and C. The switch set 106 is connected to eight (8) phototransistors 104. The switch set 106 contains a three line to eight line decoder for turning on each of the eight phototransistors 104 individually. Specifically, when a signal is received on the chip-enable CE line 108 the switch set 106 is receptive to a binary input on lines A, B, and C. The decoder in the switch set 106 reads the binary input from lines A, B, and C and decodes it to indicate which of the eight phototransistors 104 is to be activated.

Because there are two hundred fifty-six (256) phototransistors 104 on each detector board and because an individual switch set 106 is connected to and capable of reading eight phototransistors, there are thirty-two switch sets 106 on each detector board. The dotted line around the switch set 106 depicted in FIG. 11 indicates that it is only one of thirty-two such switch sets connected in parallel. That is, while each switch set 106 has its own switch set chip enable input line 108 and its own switch set output line 110, each switch set 106 has input from lines A, B, and C.

The decoder circuitry 98 of the present invention is designed to select one of said thirty-two switch sets 106 according to instructions received from the microprocessor 44. The decoder circuitry 98 also provides the binary input signals to lines A, B, and C of each switch set 106 for finding a particular phototransistor 104.

Figure 12:
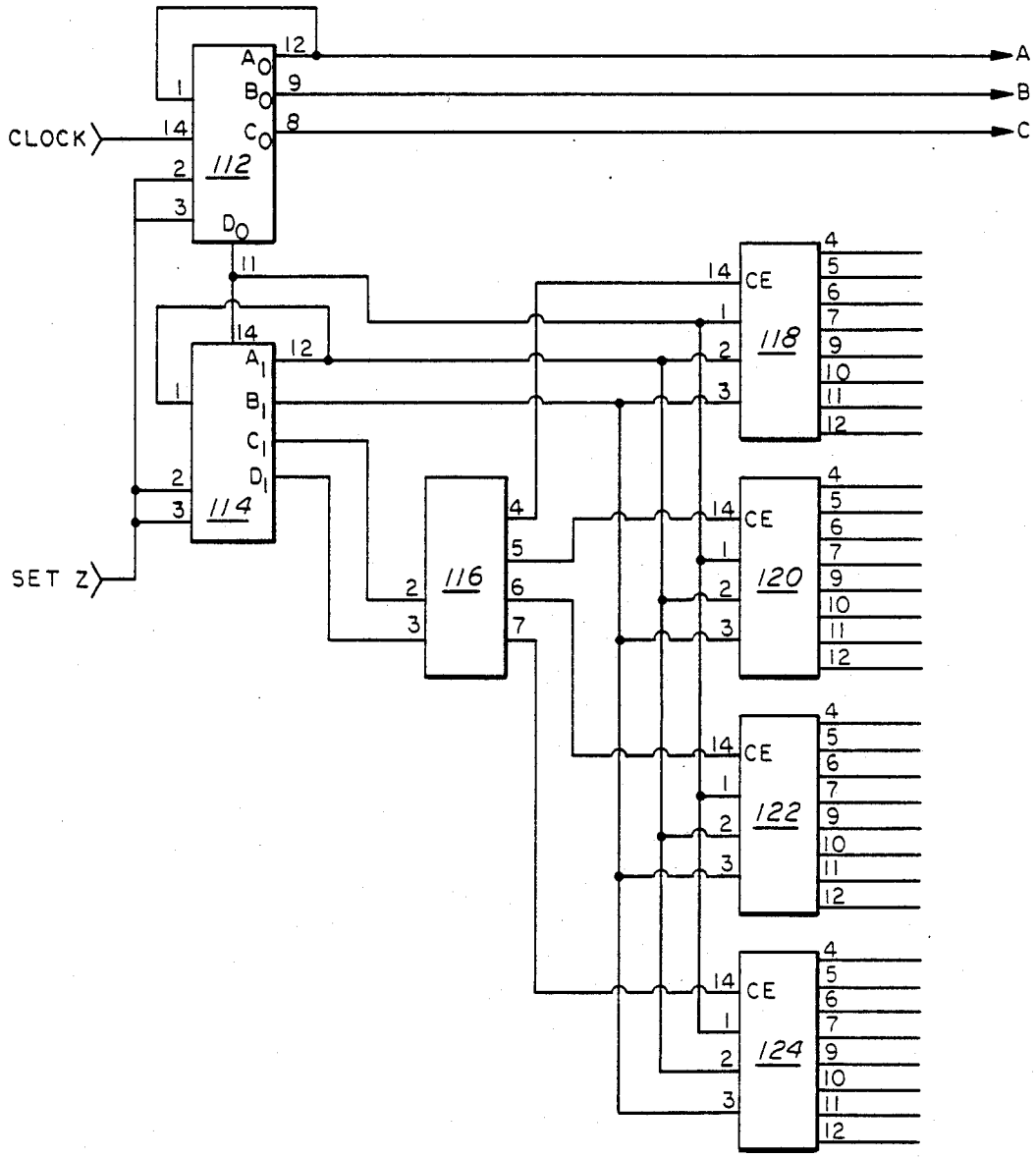
FIG. 12 is a circuit diagram showing the interconnection of various binary counters and decoders for sequentially selecting and activating light detecting elements such as phototransistors.

As shown in FIG. 12, the decoder circuitry 98 comprises binary counters and decoders. Prior to scanning the detector boards the microprocessor 44 sends out a signal on the line SET Z. A high signal on the line SET Z from the microprocessor 44 zeros the two four bit binary counters, 112 and 114 shown in FIG. 12. The binary counters 112 and 114 are reset to zero after each scan in order to assure that phototransistor number 0 is the first one read at the beginning of each scan.

As shown in FIG. 12, the output from ports Ao, Bo and Co from four bit binary counter 112 are fed to lines A, B, and C of each of the thirty-two switch sets 106. As the count from the four bit binary counter 112 increases from 0 to 7, the lines A, B, and C carry signals representative of the binary values 0 through 7 to each of the thirty-two switch sets 106. Only one of the thirty-two switch sets, however, is functional at any one time. It is that switch set which has its chip-enable turned on by the decoder as will be more fully described below.

Turning now to a description of the decoder, one sees that it comprises one two line to four line decoder 116, and four three line to eight line decoders 118, 120, 122 and 124. Decoder 116 is used to enable one of the four three line to eight line decoders at a time. Specifically, either decoder 118, 120, 122 or 124 will be enabled at any one time. The chip-enable line for each of the three line to eight line decoders is line fourteen as shown in FIG. 12. The remaining three input lines to each of the four three line to eight line decoders are connected to a common source. Thus, each of the three line to eight line decoders receives the same count information over the input lines labeled 1, 2, and 3 but only that particular three line to eight line decoder which has been selected by a high signal on its chip-enable line from the two line to four line decoder 116 may receive the set information.

By way of illustrative example, consider three line to eight line decoder 118 which is designed to scan or monitor the first sixty-four phototransistors 104 numbered from 0 to 63. At the beginning of the scanning process, a high signal was transmitted over line SET Z to zero the four bit binary counters 112 and 114. At that point, the output from binary counter 114 at ports $A_1$, $B_1$, $C_1$ and $D_1$ was 0. Zero inputs on lines two and three of two line to four line decoder 116 causes the output of line 4 to be high while the outputs of the remaining lines 5 through 7 are zero. The high signal on line 4 of decoder 116 enables three line to eight line decoder 118. Also at this time the input to three line to eight line decoder 118 on lines 1, 2 and 3 are all 0. This selects the first of the thirty-two switch sets 106 for reading the phototransistors 0 through 7.

Specifically, the output from three line to eight line decoder 118 on lines 4 through 7 and lines 9 through 12 is as follows. Line 4 is high and lines 5 through 7 and lines 9 through 12 are 0. Line 4 of eight line to three line decoder 118 leads to the chip-enable input line 108 of the first of the thirty-two switch sets 106. The remaining lines 5 through 7 and lines 9 through 12 of the three line to eight line decoder 118 lead to the chip-enable inputs of the next seven switch sets 106 in sequential order. Thus, three line to eight line decoder 118 enables only one of each of the first eight switch sets 106, numbers 0 through 7 at a time.

To return to our example, at this point the inputs we have described have enabled the light detection circuitry 103 to detect the output of phototransistor number 0. After an appropriate amount of time has elapsed for data line settling, microprocessor 44 reads the detector output line 126 (described more fully below) and then sends out a clock pulse on clock line 14 of four bit binary counter 112 to switch the scanner to read the next phototransistor 104, in this case phototransistor number 1. The pulse on the clock line 14 causes four bit binary counter 112 to change from a binary 0 count to a binary 1 count, corresponding in this case to phototransistor number 1. This process is repeated for each phototransistor up through phototransistor number 7. The process of monitoring a phototransistor 104 occurs eight times for each switch set 106.

After phototransistor number 7 has been sampled, the next clock pulse causes the output on line 11 leading from port Do of four bit binary counter 112 to go high. At this point, three line to eight line decoder 118 is still selected. However, the input to decoder 118 now has a high signal on line 1. This causes output line 4 which was formerly high to go low and also causes output line 5 which was formerly low to go high. This combination causes the second switch set 106 for phototransistors 8 through 15 to be enabled. The process previously described for sampling the eight phototransistors 104 of a switch set 106 is repeated.

During the sampling of the eight phototransistors 104 of a particular switch set 106 the count on lines A, B, and C increments from 0 to 7 sequentially selecting each phototransistor 104 for sampling as previously described. In a similar manner, inputs on lines 1, 2 and 3 to three line to eight line decoder 118 are similarly incremented from 0 to 7 to sequentially enable switch sets numbers 0 through 7.

Once all the switch sets 106 under the control of decoder 118 have been sampled, the output from port C1 of four bit binary counter 114 goes high thereby causing decoder 116 to select decoder 120 by placing a high signal on output line 5 of decoder 116 thereby enabling decoder 120. Simultaneously, the output on line 4 from decoder 116 goes low, thereby turning off decoder 118.

Figure 13:
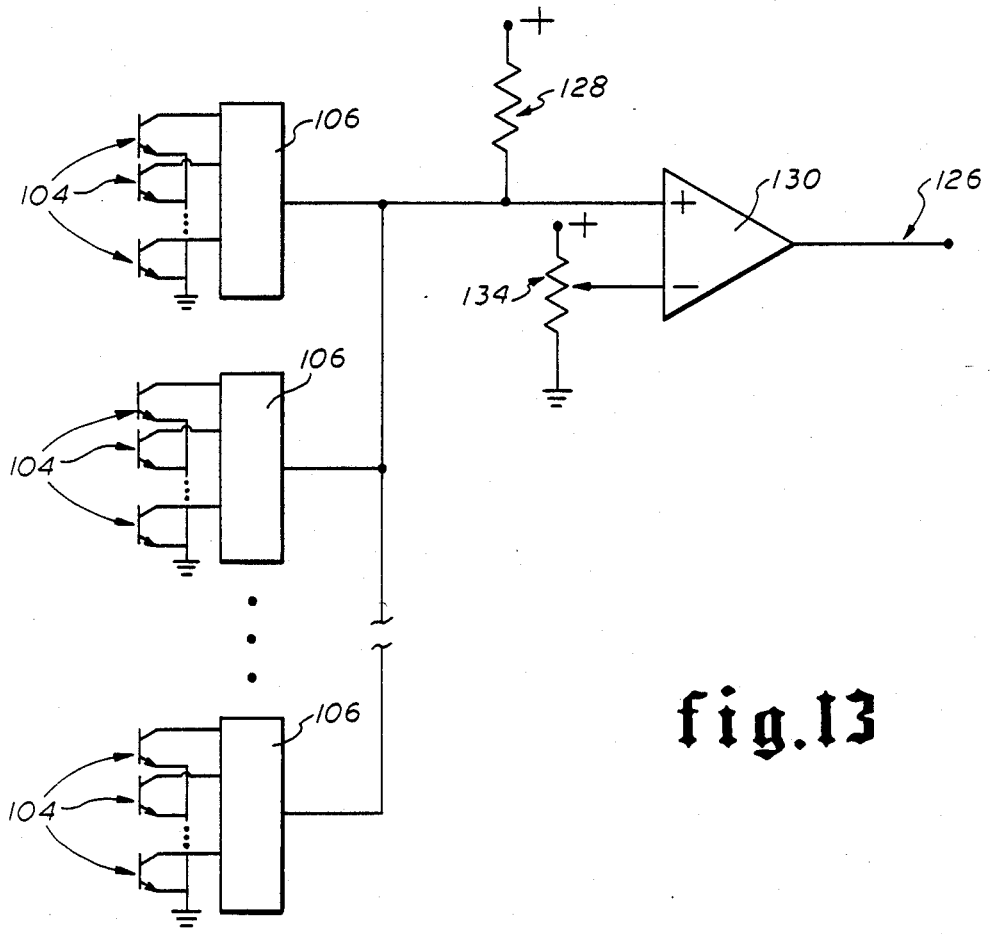
FIG. 13 is a circuit diagram showing the connection of the output of a series of field effect transistor switches to a comparitor circuit.
Figure 14:
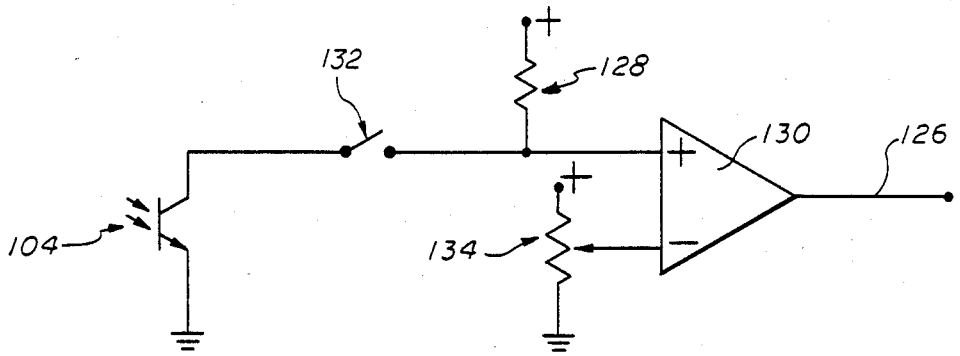
FIG. 14 is a circuit diagram symbolically showing the connection of a single phototransistor to a comparitor circuit.

All switch set outputs on a side are connected together to a common collector resistor 128 as shown in FIG. 13. Common collector resistor 128 is connected to the plus input side of a comparator 130 as shown in FIG. 13. As previously described, only one individual phototransistor 104 is sampled at a time. FIG. 14 schematically represents a circuit in which a single phototransistor 104 may be switched into series connection with comparator 130. Switch 132 symbolically represents an appropriate switch set 106. If at the time a phototransistor 104 is sampled, it is covered by a shadow, then its output will be high and a high level signal will be delivered to the plus input of the comparator 130. If at the time the phototransistor 104 is sampled it is not covered by a shadow, then its output signal will be low and a low level signal will be delivered to the plus input of the comparator 130.

The minus input of the comparator 130 as shown in FIGS. 13 and 14 is connected to a variable resistor 134. The voltage delivered to the minus input of comparator 130 by variable resistor 134 is adjusted by varying the resistance of variable resistor 134. The value of this voltage is chosen to provide a voltage level to the minus input of comparator 130 that will allow reliable detection of both high gain and low gain phototransistors.

The output of comparator 130 will be high in shadow conditions and low in non-shadow conditions. A high or low signal is indicative, respectively, of the presence or absence of a shadow on a particular phototransistor 104. The microprocessor 44 reads the signal on the detector output line 126 coming from comparator 130 and stores in its memory the number of the particular phototransistor 104 if the signal on the detect line indicates that a shadow was present on the phototransistor.

The foregoing description of the scanning and detection process has been directed to the operation of a single detector board. It has been discovered, however, that the light source circuitry 102, light detection circuitry 103, and microprocessor 44 can be adapted to monitor the outputs of both detector boards quickly enough so that the scanning of both detector boards may be done effectively simultaneously. The time required for the electronic circuitry 102 and 103, and microprocessor 44 to complete one complete scan is less than one second. Thus, during the course of a dart game the electronic circuitry 102 and 103 makes many scans looking for a dart 30 embedded in the dart board 28. When the scanner and detector electronic circuitry 102 and 103 indicates the presence of a dart 30 embedded in the dart board 28, the microprocessor 44 calculates the location of the dart 30 in the dart board 28 as previously described.

Figure 15:
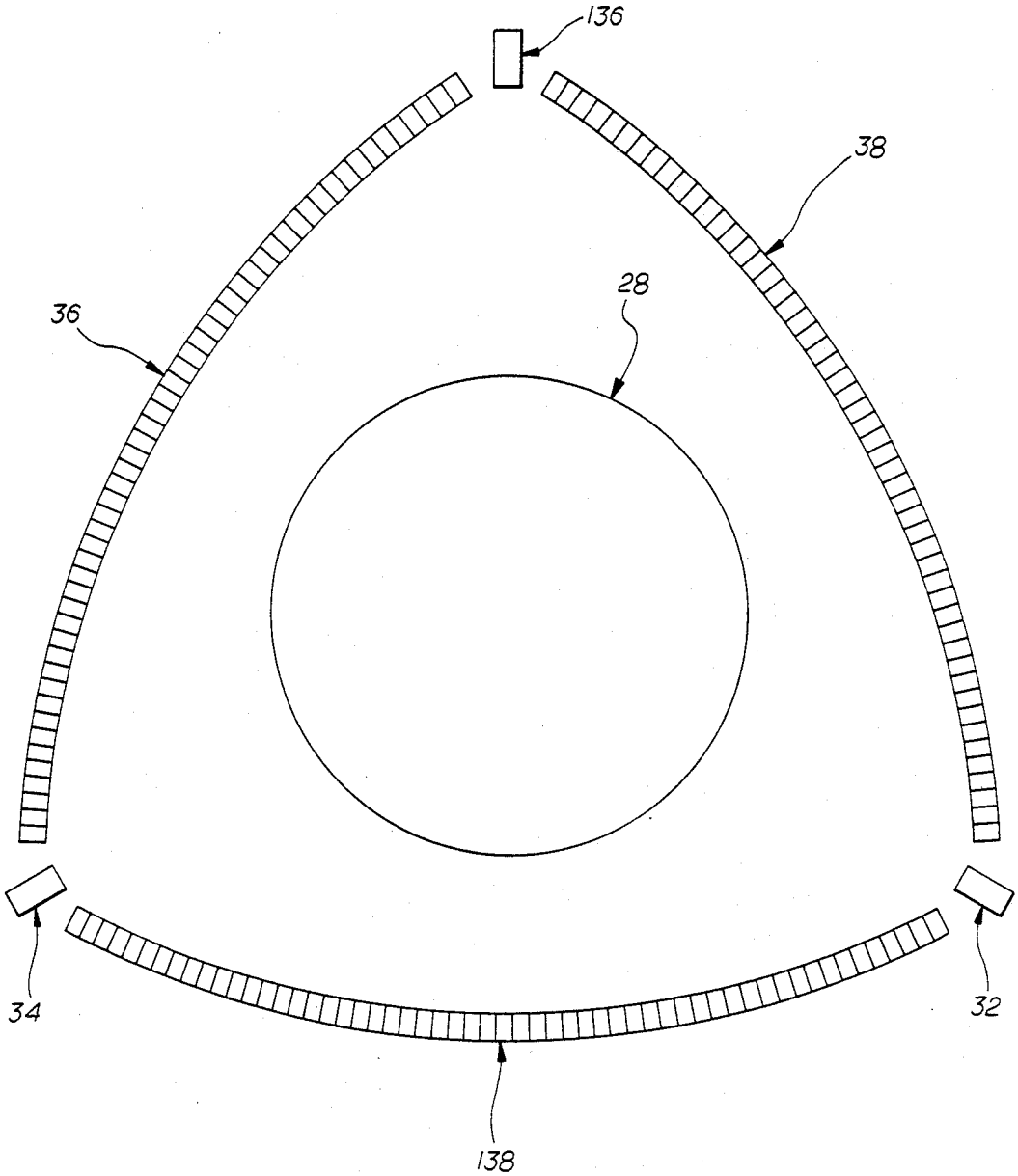
FIG. 15 is a schematic view of the dart board, varying the design shown in FIG. 3 by addition of a third light source and a third array of light detecting elements.

When more than one dart 30 is embedded in dart board 28 at the same time, the existence of multiple overlapping shadows may make it difficult to calculate the positions of the darts. This difficulty may be overcome by using a third light source 136 in conjunction with a third array of light detecting elements 138. FIG. 15 illustrates how the third light source 136 and the third array of light detecting elements 138 may be situated with respect to the first light source 32, the second light source 34, the first array of light detecting elements 36, the second array of light detecting elements 38 and the dart board 28.

In operation. first light source 32 and second light source 34 are turned on and the locations of the shadows of the darts 30 on the first array of light detecting elements 36 and on the second array of light detecting elements 38 are determined and stored in the memory of microprocessor 44 as previously described. Then second light source 34 and third light source 136 are turned on and the locations of the shadows of the darts 30 on the second array of light detecting elements 38 and on the third array of light detecting elements 138 are similarly determined and stored. Finally, first light source 32 and third light source 136 are turned on, and the locations of the shadows on the first array of light detecting elements 36 and on the third array of light detecting elements 138 are determined. The principle of operation for each of the three sets of two light sources is the same as that previously described for first light source 32 and second light source 34.

Figure 16:
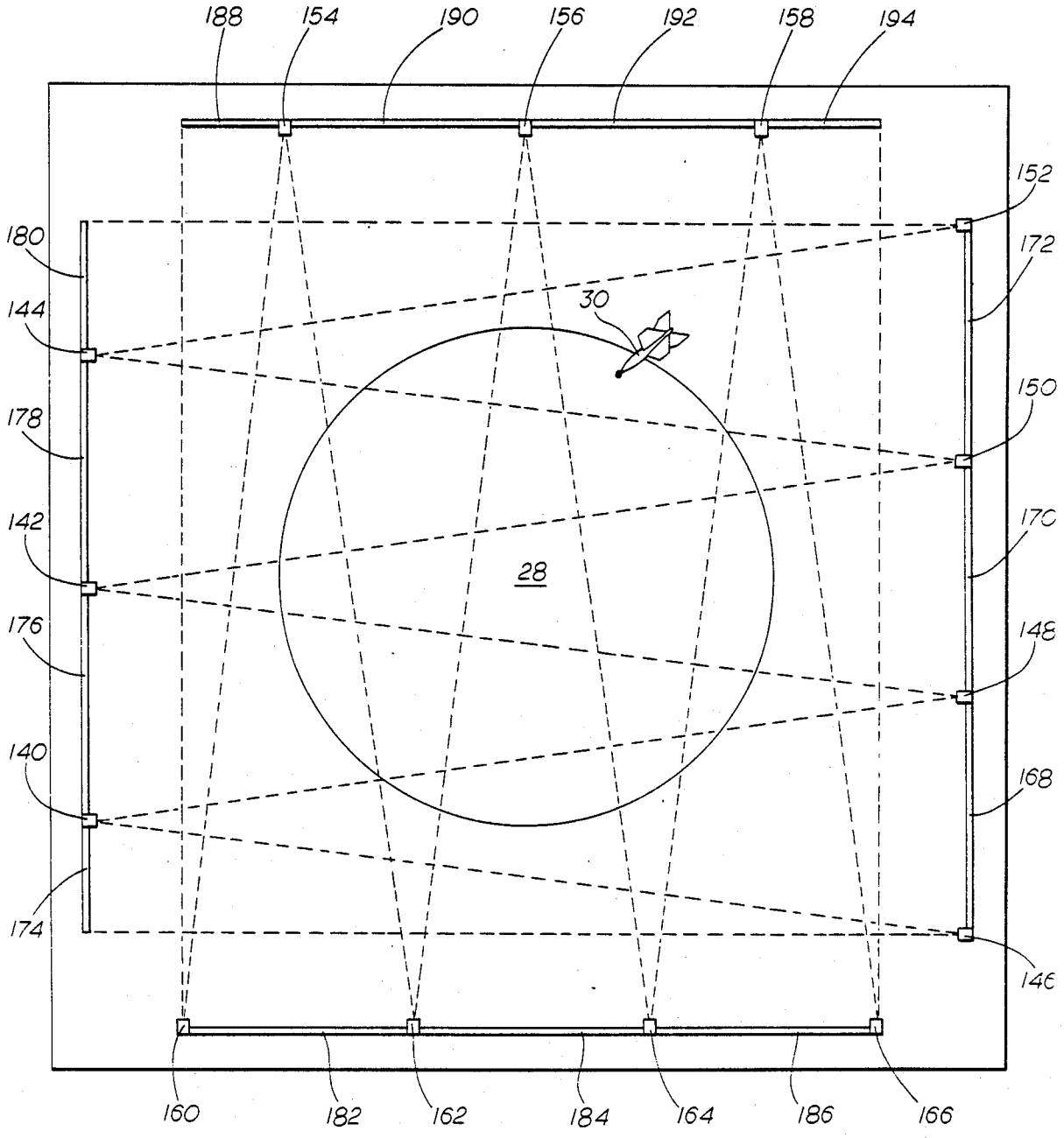
FIG. 16 is a schematic view of the dart board in an alternative embodiment of the invention, showing the placement of light sources and arrays of light detecting elements on all four sides of the dart board.

The present invention may also be embodied in alternate geometrical forms. For example, an alternate embodiment of the invention is shown in FIG. 16. While this embodiment of the invention is substantially similar in design and operation to the apparatus 20 shown in FIG. 1, the alternate embodiment uses a different physical configuration of light emitting and detecting elements, and therefore a different mathematical technique, to determine the position of an embedded dart.

FIG. 16 shows the physical configuration of the light sources 140 through 166 and their associated arrays of light detecting elements 168 through 194, both of which are situated along the four sides of the dart board 28, forming a square around the board. The distance between each phototransistor 104 within each array 168 through 194 is one tenth of one inch (0.10″). Sixty-four phototransistors 104 are in each array 168 through 194, with the exception of arrays 174, 180, 188 and 194 which contain only thirty-two phototransistors 104. Each light source 140 through 166 is associated to one and only one array of light detecting elements 168 through 194, so that the outputs of a given array 168 through 194 will correlate to the shadows blocking light from one and only one light source 140 through 166. For example, the outputs from the phototransistors 104 in array 168 will represent the presence or absence of light from light source 140 only.

The block diagram of FIG. 10 is equally applicable to this embodiment of the invention. After the microprocessor 44 has received inputs from the coin acceptor circuitry 92 and the player control circuitry 96 indicating that a game has begun, the microprocessor 44 then sequences the light sources 140 through 166 and associated arrays of light detecting elements 168 through 194 to look for a dart 30 embedded in the dart board 28. The sequence and data gathering routines are initiated by the microprocessor 44, and carried out through the decoder circuitry 98. The sequence begins by enabling the first light source 140 and disabling all others, so that only light source 140 emits light across the dart board 28. This light is received by its associated array of light detecting elements 168. During the time that light source 140 is emitting light, the microprocessor 44 via the decoder circuitry 98, sequentially enables the output from each phototransistor 104 in array 168 using a method functionally similar to that previously described in connection with the first embodiment of the invention. This embodiment uses decoder circuitry 98 and switch sets 106 functionally similar to, but organized differently from, the first embodiment of the invention because, at the most, only 64 phototransistors 104 are sequenced in each array, rather than 256 as in the first embodiment of the invention. The actual decoders used here to enable the individual phototransistor outputs are HEF4067B sixteen-to-one decoders. The outputs of the phototransistors 104 are serially received and stored in RAM 64 by the microprocessor 44 in the order that the phototransistors 104 are enabled, by a method functionally similar to the comparator technique of the first embodiment.

This process of enabling the light sources 140 through 166, during which the associated light detecting element arrays 168 through 194 are sequentially accessed and the output state fed back to the microprocessor 44, is repeated for each of the remaining light sources 142 through 166, in sequence. The phototransistors 104 in each array 168 through 194 are accessed only during the time its associated light source 140 through 166 is emitting light; each array 168 through 194 is associated with one and only one light source 140 through 166.

The microprocessor 44 detects the presence of an embedded dart 30 by comparing the results from the most recent sequence of enabling the light sources 140 through 166 and associated phototransistors 104 with those results from the next most recent sequence. Both sets of results are stored and retained in random access memory RAM 64. The results of the initial sequence, before the first dart 30 is thrown, represent the presence of light sensed by all phototransistors 104. As it performs this sequence, the microprocessor 44 treats light sources 140 through 152 (and the associated light detecting element arrays 168 through 180) as one "channel" and groups the remaining light sources 154 through 166 (and the associated light detecting arrays 182 through 194) into the second "channel". Note that the two channels represent light patterns perpendicular to one another. Because the arrays of light detecting elements 168 through 194 each are dedicated to one and only one light source so that each physical location on the dart board corresponds to one and only one light pattern from each channel, one and only one light detecting element array from each of the two channels will detect the absence of light due to the shadow of an embedded dart 30. The microprocessor 44 detects the presence of the first embedded dart 30 by detecting a difference in the results of the first scan after the dart 30 is embedded, from the initial scan with no dart present. The difference comes from one or more phototransistors 104 in one and only one array 168 through 194 in each of the two defined channels. If multiple phototransistors 104 in one array show the absence of light, these phototransistors 104 must be in sequence (i.e., one continuous shadow) or else the microprocessor 44 will perform an error routine and stop the game.

When an embedded dart 30 is detected by the microprocessor 44 as shown in FIG. 10, the microprocessor 44 begins the program routine which defines the position of the dart 30 in rectangular x-y coordinates. This routine begins by determining which of the light detecting element arrays 168 through 194, in this case 172 and 192, one from each of the two channels, detected the absence of light. For each of these two arrays 172 and 192, the routine next determines the length of the shadow, measured by the number of adjacent phototransistors 104 in each array 172 and 192 which detected the absence of light. Once this is determined, the routine finds the midpoint of the "shadow" by subtracting one from the number of phototransistors 104 detecting the absence of light, dividing this number by two (ignoring any remainder), and adding the resultant number to the numerical position representing the first phototransistor 104 detecting the absence of light from the shadow.

Figure 17:
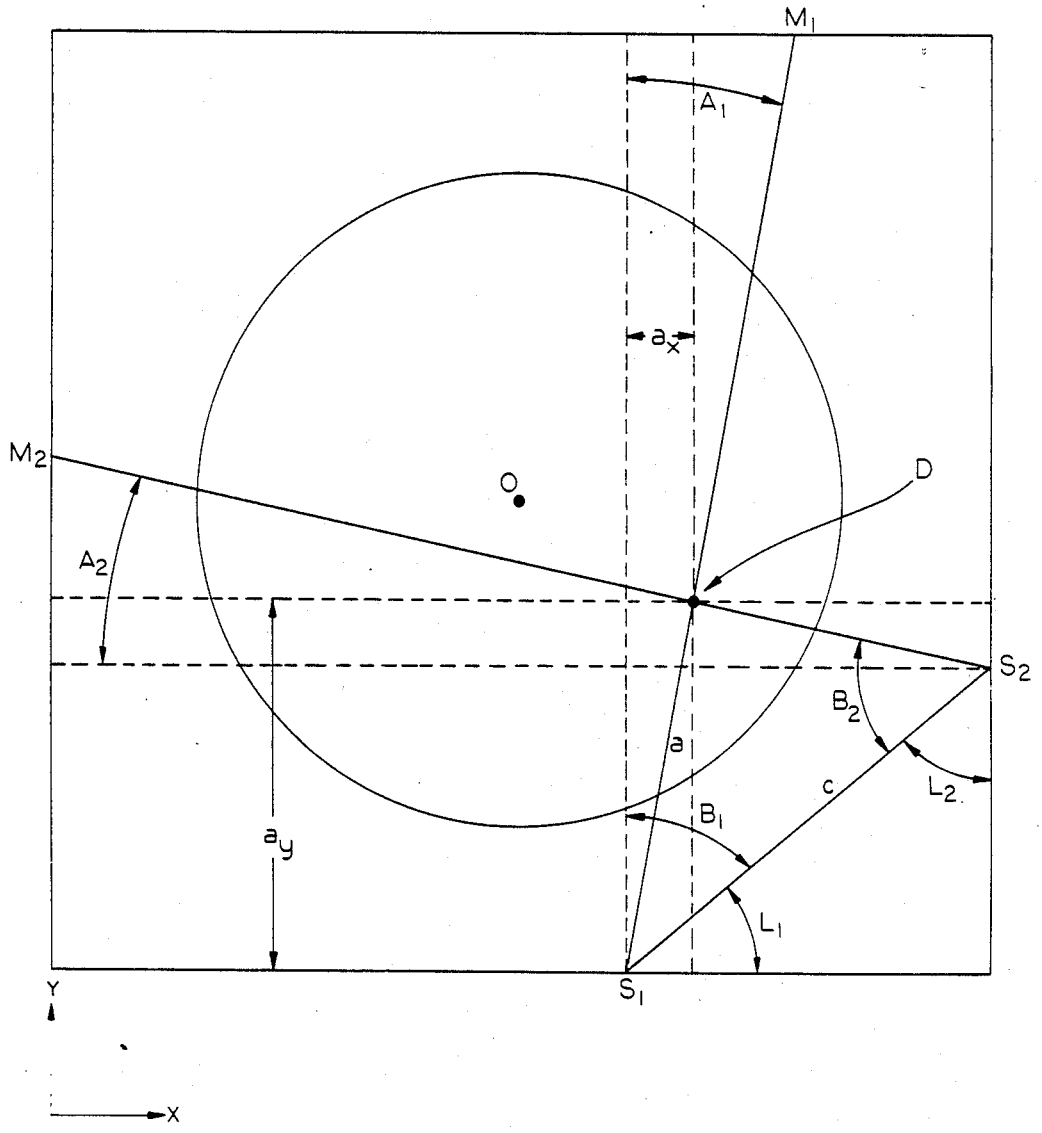
FIG. 17 is a schematic view of the angles and distances used in an alternative embodiment of the invention to compute the exact position of an embedded dart.

The program routine then calculates the position of the embedded dart 30 using the trigonometric relationships displayed in FIG. 17, and considering the dart board area as an x-y grid with origin O at the bullseye. The positions of the shadow midpoints $M_1$ and $M_2$ are known. The positions of the associated light sources $S_1$ and $S_2$ are known. The first step calculates angles $A_1$ and $A_2$ from the perpendicular using the shadow midpoint positions $M_1$ and $M_2$ relative to the light source positions $S_1$ and $S_2$, and the following relationships:

$$A_1 = \tan^{-1}\frac{(0.10)(M_{1x} - S_{1y})}{24.0} \tag{22}$$

and $$A_2 = \tan^{-1}\frac{(0.10)(M_{1x} - S_{2y})}{24.0} \tag{23}$$

where point $M_n$ has x-y components ($M_{nx}$, $M_{ny}$), where point $S_n$ has x-y components ($S_{nx}$, $S_{ny}$), where 0.10 is the distance in inches between the centers of phototransistors 104, and where 24.0 is the distance in inches between the lines of phototransistors 104 on opposite sides of the dart board 28. Next, the routine computes the distance between $S_1$ and $S_2$ (denoted by the letter "c"), and also the angles $L_1$ and $L_2$ as follows:

$$c = \sqrt{[(S_{2y} - S_{1x})^2 + (S_{2y} - S_{1y})^2]} \tag{24}$$

$$L_1 = \tan^{-1}\frac{(S_{2y} - S_{1y})}{(2_x - 1_x)} \tag{25}$$

$$L_2 = 90° - L_1 \tag{26}$$

The angles $B_1$ and $B_2$ are found, using previously calculated angles $L_1$, $L_2$, $A_1$, and $A_2$, and using the theorem which states that opposing angles created by a straight line intersecting two parallel lines are equal, as follows:

$$B_1 = L_2 + A_1 \tag{27}$$

$$B_2 = L_1 + A_2 \tag{28}$$

Note that $A_1$ and $A_2$ are signed angles, depending on their directions. In FIG. 17, $A_1$ is a negative angle. The triangle defined by the points $S_1$, $S_2$ and D (dart position) is then used to calculate the distance between $S_1$ and D (denoted by the letter "a") using the law of sines:

$$a = \frac{c[\sin(180° - (B_1 + B_2))]}{\sin B_2} \tag{29}$$

The displacements $a_x$ and $a_y$, relative to $S_1$, are then calculated as follows:

$$a_x = a \sin A_1 \quad (30)$$

$$a_y = a \cos A_2 \quad (31)$$

These displacements are signed as required. The displacements $a_x$ and $a_y$ are then adjusted to represent the position of the dart 30 from the origin O (i.e., the bullseye of the dart board 28) as follows:

$$x = a_x - S_{1x} \quad (32)$$

$$y = a_y - S_{1y} \quad (33)$$

The x-y coordinates of the dart position may be adjusted automatically using calibration constants in a manner similar to that previously described. The calibration technique used in this embodiment of the invention requires the player to place a dart 30 in the bullseye (and mathematical origin) of the dart board 28 at the time that the apparatus 20 is initially powered up. The microprocessor 44 automatically begins the calibration routine and determines the position of the dart 30 in the same manner as previously described. After the dart's position has been calculated, the values of the x-y displacements are stored in RAM 64. The x-y calibration displacements are subtracted from the calculated x-y coordinates of the thrown dart 30, so that the resultant x-y coordinates accurately correlate with the actual position of the dart board 28 within the apparatus 20.

After the microprocessor 44 has adjusted the x-y coordinates of the first embedded dart 30, the remaining routines compute the score value attributed to this dart. Using well-known trigonometric techniques, the rectangular x-y coordinates are converted into polar coordinates, namely, a radial distance and an angular displacement. These polar coordinates are then converted into a point value, with a multiplier for single, double, or triple values, in the same manner as previously described. The game score is then automatically updated.

After the score for the first dart 30 has been calculated and the game score updated, the microprocessor 44 begins to sequence the light sources 140 through 166 and light detecting element arrays 168 through 194 in the same manner as used in looking for the first dart, but now compares the results from each new sequence with the results stored in RAM 64 that denote the presence and position of the first dart 30. Any additional phototransistors 104 showing the absence of light in a new sequence, where that phototransistor showed the presence of light after the first dart 30 was embedded, will signal the microprocessor 44 to begin the position calculation routine again, after it analyzes the data to insure that no more than one continuous new shadow per channel has been detected. The position and score for this additional dart is computed in the same manner as the position and score of the first dart 30.

Special routines are used in this embodiment to preclude certain errors which are possible during a dart game. One such routine sequences the light source/detection sequence a second time, immediately after a dart has been detected. This prevents the microprocessor 44 from scoring the dart until two identical data patterns have occurred, thereby removing the possibility of error due to the vibration of the dart that occurs after the dart is embedded in the dart board. A second routine will properly adjust the game score if a shadow disappears, as it would if a dart fell out or was removed from the dart board, preventing the microprocessor 44 from executing an endless loop of software instructions. Also, the position-determining routine itself retains the angles and positions of previously thrown darts and uses them to compute the position of a new dart when the dart falls within a pre-existing shadow. The routine recognizes this event by detecting a new shadow on only one of the two channels and compensates by presuming that if only one new shadow exists, then the dart has fallen into the most recent dart's shadow for the unchanged shadow. The position-determining routine is also designed to detect and position a third dart in the rare event that its shadow is cast in such a way that the shadows from two prior darts appear to merge into a single shadow. The position routine, by looking only at changes in the data by operating sequentially on each dart after it is thrown, and by using only the positions of those phototransistors 104 which show a change in data, will treat the "single" shadow made by the three darts in sequence as three distinct shadows.

The assembly language program used by microprocessor 44 in the alternative embodiment is set forth below. The microprocessor 44 used in this embodiment is the Z8002, and the assembler used to generate this listing was the Z8002 assembler for the HP64000 computer. The assembly language program is stored in ROM 66 in the actual apparatus 20.

Although a number of embodiments of the invention have been particularly shown and described, it is to be understood by those skilled in the art that modifications in form and detail may be made therein without departing from the spirit and scope of the invention.

```
                TITLE   " MBF  Powerup and System Configuration"
*****************************************************************
*                                                               *
*                          BOOT                                 *
*                                                               *
*                AUTOMATIC SCORING SYSTEM                       *
*                          for                                  *
*                       DARTBOARDS                              *
*                                                               *
*****************************************************************

*          EXTERNAL REFERENCES:

                EXT     PLAY_DARTS
                EXT     STACK
```

```
                ORG     0000H

SP              EQU     R15
SYS_MODE        EQU     4000H

                WVAL    0
                WVAL    SYS_MODE
                WVAL    START

START           LDA     SP, STACK
                LDA     R0, STATUS_AREA
                LDCTL   PSAP, R0
                JP      PLAY_DARTS

BREAK           HALT
                JP      START

                ORG     100H

STATUS_AREA     LVAL    0                       ; Reserved area.

                WVAL    SYS_MODE                ; Special opcode trap.
                WVAL    BREAK

                WVAL    SYS_MODE                ; Privileged instruction trap.
                WVAL    BREAK

                WVAL    SYS_MODE                ; System Call trap.
                WVAL    BREAK

                WVAL    SYS_MODE                ; Unused.
                WVAL    BREAK

                WVAL    SYS_MODE                ; NMI.
                WVAL    START

                WVAL    SYS_MODE                ; NVI.
                WVAL    BREAK

                END
                TITLE   " MBF  Dartboard Calibraton Routine"
*************************************************************
*                                                           *
*                        CAL                                *
*                                                           *
*               AUTOMATIC SCORING SYSTEM                    *
*                          for                              *
*                      DARTBOARDS                           *
*                                                           *
*************************************************************

                PROG


*           ENTRY POINTS:

                GLB     CALIBRATE
                GLB     DISP_DART_POS
```

```
*       EXTERNAL ROUTINES:

            EXT     READ_SWITCH
            EXT     TERM_FUNCTION, APPEND_STR_
            EXT     SET_STANDARD
            EXT     PRT_INT, PRT_FPN, PRT_LINE, SPEAK_OUT
            EXT     SCAN, CAL_SCAN, CAL_RESET, DISPLAY_SHADOWS

            EXT     IOC_
            EXT     BUFFER_
            EXT     SWITCH_
            EXT     SCORE
            EXT     RECT
            EXT     NUMBER_FORMAT_
            EXT     FTOD_
            EXT     FCM_
            EXT     FAD_, FSB_
            EXT     FMP_, FDV_
            EXT     DFLOAT_, FLOAT_


*       EXTERNAL REFERENCES:

            EXT     FMT_TYPE
            EXT     X_CAL, Y_CAL
            EXT     N_PLAYERS
            EXT     CBLK_CON, CBLK_PSA, CBLK_PBS, CBLK_SPK
            EXT     BFR1, BFR_P, BFR_SW, BFR_SPK
            EXT     SOUND1, SOUND2, SOUND3
            EXT     SOUND4, SOUND5

            SKIP
*       EXTERNAL SYMBOLS:

            EXT     CLEAR, HOME, ERASE_EOS, ERASE_EOL
            EXT     CAL_SW, NXT_PLYR_SW

            EXT     CONSOLE_LU
            EXT     PSA_LU, PBS_LU
            EXT     STANDARD_FMT, FLOAT_FMT
            EXT     GET_NEXT_BFR
            EXT     PUT_CHAR_BFR
            EXT     GET_CHAR_BFR
            EXT     INIT_BFR
            EXT     CLEAR_BFR
            EXT     RESET_BFR
            EXT     SET_PTR_BFR
            EXT     MAX_LEN_BFR
            EXT     CUR_LEN_BFR
            EXT     GET_PTR_BFR
            EXT     BS_LEN_BFR
            EXT     BS_PTR_BFR

            EXT     READ_CODE
            EXT     WRITE_CODE
            EXT     STATUS_CODE
```

```
            EXT     INIT_CODE
            EXT     RD_CHAR_CODE
            EXT     WR_CHAR_CODE

            EXT     LEN1, LEN_P, LEN_SW, LEN_SPK

*       REGISTER DEFINITIONS:


FQ1         EQU     RQ0
FR1         EQU     R2
MANTH_FR1   EQU     R2
MANTL_FR1   EQU     R3
MANT_FR1    EQU     RR2
EXP_FR1     EQU     R4
FR2         EQU     R6
MANTH_FR2   EQU     R6
MANTL_FR2   EQU     R7
MANT_FR2    EQU     RR6
EXP_FR2     EQU     R8
FR3         EQU     R10
MANTH_FR3   EQU     R10
MANTL_FR3   EQU     R11
MANT_FR3    EQU     RR10
EXP_FR3     EQU     R12
SP          EQU     R15


            SKIP
*       MACROS:


SCREEN      MACRO   &FUNCTION
            CALL    TERM_FUNCTION
            WVAL    &FUNCTION
            MEND


STRING      MACRO   &STRING
            WVAL    LEN&&&&
STR&&&&     ASCII   &STRING
LEN&&&&     EQU     $-STR&&&&
            EVEN
            MEND
DISP        MACRO   &STRING
            PUSH    @SP, #BFR1
            PUSH    @SP, #STR&&&&
            CALL    APPEND_STR_
            JR      END&&&&
STR&&&&     STRING  &STRING
END&&&&     EQU     $
            MEND

PRINT       MACRO   &STRING
            DISP    &STRING
            CALL    PRT_LINE
            MEND
```

```
PLINE       MACRO   &LINES
            .IF     &LINES .NE. "" SET_CNT
LOOP_CNT    .SET    1
            .GOTO   LOOP_TOP
SET_CNT     .NOP
LOOP_CNT    .SET    &LINES
LOOP_TOP    .NOP
            CALL    PRT_LINE
LOOP_CNT    .SET    LOOP_CNT-1
            .IF     LOOP_CNT .GT. 0 LOOP_TOP
            MEND

SPEAK       MACRO   &STRING
            PUSH    @SP, #&STRING
            CALL    SPEAK_OUT
            MEND

            SKIP

FLD         MACRO   &FR_DST, &FR_SRC
            LDL     MANT_&FR_DST, MANT_&FR_SRC
            LD      EXP_&FR_DST, EXP_&FR_SRC
            MEND

FEX         MACRO   &FR_DST, &FR_SRC
            EX      MANTH_&FR_DST, MANTH_&FR_SRC
            EX      MANTL_&FR_DST, MANTL_&FR_SRC
            EX      EXP_&FR_DST, EXP_&FR_SRC
            MEND

FLT         MACRO   &INT
            PUSHL   @SP, RR0
            LD      R0, &INT
            CALL    FLOAT_
            POPL    RR0, @SP
            MEND

PUSHF       MACRO   &FR_SRC
            PUSH    @SP, EXP_&FR_SRC
            PUSHL   @SP, MANT_&FR_SRC
            MEND
POPF        MACRO   &FR_DST
            POPL    MANT_&FR_DST, @SP
            POP     EXP_&FR_DST, @SP
            MEND

BUFFER      MACRO   &BFR, &CODE
            PUSH    @SP, &BFR
            CALL    BUFFER_
            WVAL    &CODE
            MEND
```

```
                SKIP
*          MAIN PROGRAM:

*********************************************************************
*                                                                   *
*   CALIBRATE     - Calibration of the backboard and/or dartboard   *
*                   at power-up.                                    *
*                                                                   *
*********************************************************************


CALIBRATE       CALR    BRIGHTNESS_CAL
                CALR    BACKBOARD_CAL
                CALR    DARTBOARD_CAL
                RET



BRIGHTNESS_CAL  SCREEN  CLEAR
                SCREEN  HOME
                PRINT   "   TO ADJUST THE BRIGHTNESS"
                PRINT   " PRESS THE 'CALIBRATE' BUTTON."
                PRINT   " PRESS 'NEXT PLAYER' BUTTON WHEN DONE."
BRIGHTNESS_CAL1
                CALL    READ_SWITCH
                WVAL    BRIGHTNESS_CAL1
                WVAL    CAL_SW, BRIGHTNESS_CAL3
                WVAL    NXT_PLYR_SW, BRIGHTNESS_CAL5
                WVAL    -1

BRIGHTNESS_CAL3 CALL    CAL_RESET       ; Reset all brightness levels.
                SCREEN  CLEAR
BRIGHTNESS_CAL4 SCREEN  HOME
                PRINT   "      ADJUSTING THE BRIGHTNESS"
                PRINT   " PRESS 'NEXT PLAYER' BUTTON WHEN DONE."
                CALL    CAL_SCAN
                CALL    DISPLAY_SHADOWS
                SCREEN  ERASE_EOS
                PLINE
                CALL    READ_SWITCH
                WVAL    BRIGHTNESS_CAL4
                WVAL    NXT_PLYR_SW, BRIGHTNESS_CAL5
                WVAL    -1

BRIGHTNESS_CAL5
                RET

BACKBOARD_CAL   SCREEN  CLEAR
BACKBOARD_CAL1  SCREEN  HOME
                PRINT   "      CALIBRATE THE BACKBOARD"
                PRINT   " PRESS 'NEXT PLAYER' BUTTON WHEN DONE."
                CALL    SCAN
            ;   PLINE
            ;   DISP    "CHANNEL ONE"
            ;   CALL    CAL_ONE_SIDE
            ;   PLINE
            ;   DISP    "CHANNEL TWO"
```

```
;          CALL    CAL_ONE_SIDE
           CALL    DISPLAY_SHADOWS
           SCREEN  ERASE_EOS
           PLINE
           CALL    READ_SWITCH
           WVAL    BACKBOARD_CAL1
           WVAL    NXT_PLYR_SW, BACKBOARD_CAL2
           WVAL    -1

BACKBOARD_CAL2
           RET


;AL_ONE_SIDE   PUSHF   FR2
;              PUSHF   FR1
;              PUSHL   @SP, RR0
;              BUFFER  #BFR_P, GET_NEXT_BFR
;              CPB     RL0, #2
;              JR      NZ,CAL_ONE_ERR
;              CALL    GET_SHADOW
;              LD      R1, R0                  ; Save length.
;              CALL    SHADOW_CENTER
;              FLD     FR2, FR1                ; FR2 := center of first shadow.
;              DISP    " CENTER = "
;              CALL    PRT_FPN
;              LD      R0, R1                  ; R0 := length.
;              CLRB    RH0
;              DISP    "WIDTH = "
;              CALL    PRT_INT
;              PLINE
;              CALL    GET_SHADOW
;              CALL    SHADOW_CENTER           ; FR1 := center of second shadow.
;              DISP    "            DISTANCE = "
;              CALL    FSB_                    ; FR1 := distance between shadows.
;              CALL    PRT_FPN
;              PLINE
;              JR      CAL_ONE_EXIT
;
;AL_ONE_ERR    DISP    " ERROR - NUMBER OF SHADOWS = "
;              CLRB    RH0
;              CALL    PRT_INT
;              PLINE   2                       ; Print blank line as second line in message.
;              TEST    R0
;              JR      Z,CAL_ONE_EXIT
;              LD      R1, R0
;AL_ONE_SKIP   CALL    GET_SHADOW              ; Skip over shadow information.
;              DJNZ    R1,CAL_ONE_SKIP
;AL_ONE_EXIT   POPL    RR0, @SP
;              POPF    FR1
;              POPF    FR2
;              RET


              SKIP
DARTBOARD_CAL  PUSHF   FR2
               PUSHF   FR1
               PUSHL   @SP, RR0
               SCREEN  CLEAR
```

```
DART_CAL_0      SCREEN  HOME
                PRINT   "      CALIBRATE THE DARTBOARD"
                PRINT   " PRESS 'NEXT PLAYER' BUTTON WHEN DONE."
                PLINE   1
                PRINT   "PUT A DART IN THE BULL'S EYE"
                PRINT   "AND PRESS THE  'GAME 1'  BUTTON"
                PRINT   "TO SET NEW CALIBRATION CONSTANTS."
                PRINT   "VERIFY DARTBOARD ROTATION WITH A DART."
                PLINE   1
                CALR    DISPLAY_CAL
                CALL    SCAN
                CALL    CHECK_SHADOW            ; Ensure that there is one shadow on the board.
                JR      NE,DART_CAL_OFF
DART_CAL_1      CALL    READ_SWITCH
                WVAL    DART_CAL_2              ; If Game 1 button pushed
                WVAL    CAL_SW, DART_CAL_1_1
                WVAL    -1

DART_CAL_1_1
                CALR    GET_POSITION.           ;  then set
                CALL    RECT                    ;          new
                CALR    SET_NEW_CAL             ;              cal constants.
DART_CAL_2      CALR    GET_POSITION
                CALL    SCORE
                CALR    DISP_DART_POS
                TEST    R0                      ; Is the dart off the board ?
                JR      NZ,DART_CAL_3
                JR      DART_CAL_2_1

DART_CAL_OFF    EQU     $
                PRINT   "THE DART IS OFF THE BOARD."
DART_CAL_2_1    CALL    DISPLAY_SHADOWS

DART_CAL_3      SCREEN  ERASE_EOS
                PLINE   1
                CALL    READ_SWITCH
                WVAL    DART_CAL_0
                WVAL    NXT_PLYR_SW, DART_CAL_4
                WVAL    -1

DART_CAL_4
                POPL    RR0, @SP
                POPF    FR1
                POPF    FR2
                RET


SET_NEW_CAL     CALL    FCM_
                LDM     X_CAL, FR1, #3
                FEX     FR1, FR2
                CALL    FCM_
                FEX     FR1, FR2
                LDM     Y_CAL, FR2, #3
                RET

DISPLAY_CAL     PUSHF   FR1
                PRINT   "CALIBRATION CONSTANTS   ( X, Y );"
                LDM     FR1, X_CAL, #3
                CALL    DISP_CAL
```

```
            LDM     FR1, Y_CAL, #3
            CALL    DISP_CAL
            PLINE   1
            POPF    FR1
            RET

DISP_CAL    CP      EXP_FR1, #EXP_TEN_M6     ; If cal constants < 10e-6
            JR      GT,DISP_CAL_1            ;  then display 0.
            CLR     MANTH_FR1
            CLR     MANTL_FR1
            CLR     EXP_FR1
DISP_CAL_1  CALL    PRT_FPN
            RET

DISP_DART_POS TEST  R0                       ; Is the dart off the board ?
            JR      Z,DISP_D_P_OFF
            JR      PL,DISP_D_P_NEW
            SPEAK   SOUND5
            DISP    "THE DART FELL OUT OF THE "
            JR      DISP_D_P_0

DISP_D_P_NEW SPEAK  SOUND3
            DISP    "THE DART IS IN THE "
DISP_D_P_0  CALR    DISPLAY_FACTOR
            CALR    DISPLAY_SEGMENT
            JR      DISP_D_P_1

DISP_D_P_OFF SPEAK  SOUND4
            PRINT   "THE DART IS OFF THE BOARD."

DISP_D_P_1  SCREEN  ERASE_EOS
            RET

DISPLAY_FACTOR PUSH @SP, R1                  ; R1 = factor = switch variable.
            CALL    SWITCH_
            WVAL    3
            WVAL    DISP_SNGL
            WVAL    DISP_DBLE
            WVAL    DISP_TRPL

DISP_SNGL   DISP    "SINGLE "
            RET

DISP_DBLE   DISP    "DOUBLE "
            RET

DISP_TRPL   DISP    "TRIPLE "
            RET

DISPLAY_SEGMENT PUSHF FR1
            PUSHL   @SP, RR0
            TEST    R0
            JR      PL,DISP_SEG_1
            NEG     R0
DISP_SEG_1  LD      R2, R1                   ; R2 := factor.
            LD      R1, R0                   ; RR0 := points.
            CLR     R0
            DIV     RR0, R2                  ; R1 := segment value.
            CP      R1, #25
```

```
            JR      EQ,DISP_SEG_BULL
            LD      R0, R1
            CALL    PRT_INT
            JR      DISP_SEG_END

DISP_SEG_BULL  DISP    "BULL"

DISP_SEG_END   PLINE   2
               POPL    RR0, @SP
               POPF    FR1
               RET

CHECK_SHADOW   PUSH    @SP, R0
               CALR    N_SHADOWS
               CP      R0, #101H              ; 1 shadow per side.
               POP     R0, @SP
               RET

N_SHADOWS      PUSH    @SP, R1
               BUFFER  #BFR_P, RESET_BFR
               BUFFER  #BFR_P, GET_NEXT_BFR
               LD      R1, R0                 ; R1 := no. shadows on PSA 1.
               CLRB    RH1
               BUFFER  #BFR_P, GET_PTR_BFR
               ADD     R0, R1                 ; R0 := pointer + 3*no. of shadows.
               ADD     R0, R1
               ADD     R0, R1
               BUFFER  #BFR_P, SET_PTR_BFR
               BUFFER  #BFR_P, GET_NEXT_BFR
               LDB     RH0, RL1               ; R0 := no. of shadows on both sides.
               POP     R1, @SP
               RET

GET_POSITION   BUFFER  #BFR_P, RESET_BFR      ; Get the shadow information for
               BUFFER  #BFR_P, GET_NEXT_BFR   ;  one shadow.
               CALL    GET_SHADOW             ; R0 := PSA 1.
               LD      R1, R0                 ; R1 := PSA 2.
               BUFFER  #BFR_P, GET_NEXT_BFR
               CALL    GET_SHADOW
               EX      R0, R1
               RET

GET_SHADOW
               PUSHL   @SP, RR2
               PUSH    @SP, R1
               LD      R3, R0                 ; Save n shadows.
               BUFFER  #BFR_P, GET_PTR_BFR
               LD      R2, R0                 ; Save pointer.
               BUFFER  #BFR_P, GET_NEXT_BFR   ; RH1 := block.
               LDB     RH1, RL0
               BUFFER  #BFR_P, GET_NEXT_BFR   ; RL1 := start.
               LDB     RL1, RL0
               BUFFER  #BFR_P, GET_NEXT_BFR
               SLLB    RL1, #2                ; Pre-position start.
               SLL     R1, #5                 ; Position block & start.
               ORB     RL1, RL0               ; Merge length.
               LD      R0, R2                 ; Restore pointer
               ADD     R0, R3                 ;  and point to next channel.
               ADD     R0, R3
```

```
                ADD     R0, R3
                BUFFER  #BFR_P, SET_PTR_BFR
                LD      R0, R1
                POP     R1, @SP
                POPL    RR2, @SP
                RET


SHADOW_CENTER   PUSHL   @SP, RR0
                LDB     RL1, RH0
                CLRB    RH0                     ; R0 := length.
                CLRB    RH1                     ; R1 := start.
                DEC     R0                      ; R0 := length - 1.
                SLA     R1                      ; R1 := 2 * start.
                ADD     R0, R1                  ; R0 := 2*start + (length-1).
                FLT     R0                      ; FR1 := 2*start + (length-1).
                DEC     EXP_FR1                 ; FR1 := start + (length-1)/2.
                POPL    RR0, @SP
                RET


                SKIP
*               SYSTEM CONSTANTS :

MANT_TEN_M6     EQU     4318DEB0H
EXP_TEN_M6      EQU     0FFEDH

                END
                TITLE   " Z8000  CIO #1 I/O Routines"
*****************************************************************
*                                                               *
*                 <<<  CIO_1  >>>                               *
*                                                               *
*                CIO #1 I/O DRIVER                              *
*                     for the                                   *
*                     Z82/SBC                                   *
*                                                               *
*****************************************************************

                PROG

                INCLUDE IO_COM

*       ENTRY POINTS:

                GLB     DVR_CIO_1

*       EXTERNAL REFERENCES:

                EXT     SPEAKER1_SU

*       DRIVER CONSTANTS:

FREQ1           EQU     20000       ; 20 kHz.
FREQ2           EQU     50*FREQ1    ;  1 MHz.
PCLK            EQU     4000000     ;  4 MHz.
FCLK            EQU     PCLK/2
```

```
TC1             EQU     FCLK/(2*FREQ1)
TC2             EQU     FCLK/(2*FREQ2)

CIO1_SC         EQU     0
CIO_RESET       EQU     1
MICR_CMD        EQU     00000000B               ; Shift left address.

CT1_MSR_CMD     EQU     11000110B               ; Continuous, ext out, sq wave.
CT1_TCR_MSB     EQU     TC1.SR.8                ; MSB of count.
CT1_TCR_LSB     EQU     TC1.AN.0FFH             ; LSB of count.
CT1_CSR_CMD     EQU     00000110B               ; Gate and trigger.
CT1_EN          EQU     01000000B               ; Enable CT #1.

CT2_MSR_CMD     EQU     11000110B               ; Continuous, ext out, sq wave.
CT2_TCR_MSB     EQU     TC2.SR.8                ; MSB of count.
CT2_TCR_LSB     EQU     TC2.AN.0FFH             ; LSB of count.
CT2_CSR_CMD     EQU     00000110B               ; Gate and trigger.
CT2_EN          EQU     00100000B               ; Enable CT #2.

; Port Mode and Status Register field definitions:
BIT_PORT        EQU     00B.SL.6
INPUT_PORT      EQU     01B.SL.6
OUTPUT_PORT     EQU     10B.SL.6
BIDIRECTIONAL   EQU     11B.SL.6
ENABLE_DESKEW   EQU     1B

; Port Command and Status Register field definitions:
CLEAR_IP_IUS    EQU     001B.SL.5
SET_IUS         EQU     010B.SL.5
CLEAR_IUS       EQU     011B.SL.5
SET_IP          EQU     100B.SL.5
CLEAR_IP        EQU     101B.SL.5
SET_IE          EQU     110B.SL.5
CLEAR_IE        EQU     111B.SL.5

; Port Handshake Specification Register field definitions:
INTERLOCKED_HANDSHAKE   EQU     00B.SL.6
STROBED_HANDSHAKE       EQU     01B.SL.6
PULSED_HANDSHAKE        EQU     10B.SL.6
IEEE_HANDSHAKE          EQU     11B.SL.6

PA_MSR          EQU     BIT_PORT                ; Port A = BIT mode.
PB_MSR          EQU     BIT_PORT                ; Port B = BIT mode.
PA_HSR          EQU     STROBED_HANDSHAKE
PA_DDR          EQU     00000000B               ;
PB_DDR          EQU     11100110B               ; PB4 = output.
PC_DDR          EQU     00000110B               ;
PA_EN           EQU     00000100B               ; Port A enable.
PB_EN           EQU     10000000B               ; Port B enable.
PC_EN           EQU     00010000B               ; Port C enable.

MICR_REG        EQU     000000B.SL.1
MCCR_REG        EQU     000001B.SL.1

CT1_MSR_REG     EQU     011100B.SL.1
CT1_CSR_REG     EQU     001010B.SL.1
CT1_TCR_MSB_REG EQU     010110B.SL.1
CT1_TCR_LSB_REG EQU     010111B.SL.1
```

```
CT2_MSR_REG     EQU     011101B.SL.1
CT2_CSR_REG     EQU     001011B.SL.1
CT2_TCR_MSB_REG EQU     011000B.SL.1
CT2_TCR_LSB_REG EQU     011001B.SL.1

PA_MSR_REG      EQU     100000B.SL.1
PA_MSR_REG      EQU     100001B.SL.1
PA_DDR_REG      EQU     100011B.SL.1
PA_IOC_REG      EQU     100100B.SL.1

PB_MSR_REG      EQU     101000B.SL.1
PB_DDR_REG      EQU     101011B.SL.1
PB_IOC_REG      EQU     101100B.SL.1

PC_DDR_REG      EQU     000110B.SL.1
PC_IOC_REG      EQU     000111B.SL.1

PA_CSR_REG      EQU     001000B.SL.1
PB_CSR_REG      EQU     001001B.SL.1

PORT_A          EQU     001101B.SL.1
PORT_B          EQU     001110B.SL.1
PORT_C          EQU     001111B.SL.1

                SKIP
;       Sensor board interface constants:

MASTER_RESET    EQU     0
PSA_ADRS_LSD    EQU     1
PSA_ADRS_MSD    EQU     2
LED_ADRS        EQU     3
LED_SIDE        EQU     4
LED_BRIGHT      EQU     5
PSA_READ        EQU     6
CALIB_READ      EQU     7
MAX_BRIGHT_LEVEL        EQU     15


;       Speaker constants:

SPK1_BIT        EQU     0
SPK2_BIT        EQU     3

                SKIP
*       MAIN ROUTINES:

*****************************************************************
*                                                               *
*    INTERFACE DRIVERS                                          *
*                                                               *
*               R0 = character                                  *
*               R1 = select code                                *
*               R2 = function code                              *
*               R3 = buffer address                             *
*               R5 = device SU number                           *
*                                                               *
*                                                               *
*****************************************************************
```

```
DVR_CIO_1
            PUSH    @SP, R1
            PUSHL   @SP, RR2
            PUSHL   @SP, RR4
            CP      R2, #READ_CODE
            JR      EQ,CIO_IN
            CP      R2, #CALIB_CODE
            JR      EQ,CIO_CALIBRATE
            CP      R2, #SETZ_CODE
            JR      EQ,PSA_SETZ
            CP      R2, #SPKON_CODE
            JP      EQ,CIO_SPKON
            CP      R2, #SPKOFF_CODE
            JP      EQ,CIO_SPKOFF
            CP      R2, #INIT_CODE
            JR      EQ,CIO_INIT
            CP      R2, #CONTROL_CODE
            JR      EQ,PSA_CONTROL
CIO_EXIT_ERR SETFLG V                       ; Show error.
            JR      CIO_EXIT

CIO_EXIT_OK RESFLG  V                       ; No error.
CIO_EXIT    POPL    RR4, @SP
            POPL    RR2, @SP
            POP     R1, @SP
            RET

            SKIP
CIO_INIT
            CALR    INIT_CIO
            CALR    START_CNTR1
            CALR    START_CNTR2
            CALR    ENABLE_OUTPUT
            CALR    PSA_RESET
            JR      CIO_EXIT_OK


PSA_CONTROL
            CALR    INIT_BRIGHTNESS
            JR      CIO_EXIT_OK


PSA_SETZ
            CALR    PSA_RESET
            JR      CIO_EXIT_OK


PSA_RESET
            LDK     R5, #MASTER_RESET
            CALR    OUTPUT_TO_A         ; Master reset of i/f board.
            RET


CIO_CALIBRATE
            JR      CIO_IN
```

```
CIO_IN              ; RH0 = block number, RL0 = sensor number.
                    ; R2 = read/calibrate.
            CALR    SET_PSA_ADRS
            LD      R4, R0                  ; R4 := block & sensor no.
            CALR    READ_CHANNEL            ; Read ch 1.
            LD      R3, R0                  ; Save ch 1 in R3.
            LD      R0, R4                  ; Restore block & sensor no.
            COMB    RH0                     ; Select channel 2.
            CALR    READ_CHANNEL            ; Read ch 2.
            LDB     RH0, RL0                ; RH0 := ch 2.
            LDB     RL0, RL3                ; RL0 := ch 1.
            JR      CIO_EXIT_OK

            SKIP
INIT_CIO
            LDB     RL1, #MICR_REG
            LD      R0, #CIO_RESET
            OUT     @R1, R0
            LD      R0, #MICR_CMD
            OUT     @R1, R0
            RET

START_CNTR1
            LD      R0, #CT1_MSR_CMD
            LDB     RL1, #CT1_MSR_REG
            OUT     @R1, R0
            LD      R2, #TC1
            LDB     RL0, RH2
            LDB     RL1, #CT1_TCR_MSB_REG
            OUT     @R1, R0
            LDB     RL0, RL2
            LDB     RL1, #CT1_TCR_LSB_REG
            OUT     @R1, R0
            LDB     RL1, #MCCR_REG
            IN      R0, @R1
            OR      R0, #CT1_EN
            OUT     @R1, R0
            LD      R0, #CT1_CSR_CMD
            LDB     RL1, #CT1_CSR_REG
            OUT     @R1, R0
;           IN      R0, @R1                 ; FOR TEST ONLY.
            RET
START_CNTR2
            LD      R0, #CT2_MSR_CMD
            LDB     RL1, #CT2_MSR_REG
            OUT     @R1, R0
            LD      R2, #TC2
            LDB     RL0, RH2
            LDB     RL1, #CT2_TCR_MSB_REG
            OUT     @R1, R0
            LDB     RL0, RL2
            LDB     RL1, #CT2_TCR_LSB_REG
            OUT     @R1, R0
            LDB     RL1, #MCCR_REG
            IN      R0, @R1
            OR      R0, #CT2_EN
```

```
                OUT     @R1, R0
                LD      R0, #CT2_CSR_CMD
                LDB     RL1, #CT2_CSR_REG
                OUT     @R1, R0
;               IN      R0, @R1                 ; FOR TEST ONLY.
                RET

                SKIP
ENABLE_OUTPUT
                LD      R0, #PA_MSR
                LDB     RL1, #PA_MSR_REG
                OUT     @R1, R0
                LD      R0, #PA_DDR
                LDB     RL1, #PA_DDR_REG
                OUT     @R1, R0
;               LD      R0, #PA_HSR
;               LDB     RL1, #PA_HSR_REG
;               OUT     @R1, R0
                LD      R0, #PB_MSR
                LDB     RL1, #PB_MSR_REG
                OUT     @R1, R0
                LD      R0, #PB_DDR
                LDB     RL1, #PB_DDR_REG
                OUT     @R1, R0
                LD      R0, #PC_DDR
                LDB     RL1, #PC_DDR_REG
                OUT     @R1, R0
                LDB     RL1, #MCCR_REG
                IN      R0, @R1
                OR      R0, #PA_EN
                OR      R0, #PB_EN
                OR      R0, #PC_EN
                OUT     @R1, R0
                RET

                SKIP
READ_CHANNEL                                    ; R2 = read/calibrate.
                CALR    TURN_ON_LED
                CALR    DELAY
                CALR    READ_PSA                ; RL0 := channel state.
                CALR    DISABLE_LEDS
                CP      R2, #READ_CODE          ; If normal read
                RET     EQ                      ;  then done
                TESTB   RL0                     ;  else if no shadow
                RET     Z                       ;   then done
                CALR    SET_BRIGHTNESS          ;   else adjust brightness.
                RET     Z                       ; Return if max brightness.
                LD      R0, BRIGHT_SENSOR       ; Retrieve block & sensor
                JR      READ_CHANNEL            ;  and loop.


SET_PSA_ADRS
                PUSH    @SP, R0
                CALR    GET_PSA_ADRS
                CALR    PSA_ADRS_OUT
                POP     R0, @SP
                RET
```

```
GET_PSA_ADRS
            PUSH    @SP, R2
            CPB     RH0, #3                 ; Check the block no.
            JR      GE,GET_PSA_AD_1         ; Blocks 0-2 scan
            NEGB    RL0                     ;  down, 3-6 scan up.
GET_PSA_AD_1 LDB    RL2, RH0                ; R2 := block no.
            CLRB    RH2
            ADDB    RL0, PSA_FIRST_TABLE( R2) ; RL0 := psa sensor no.
            POP     R2, @SP
            RET


PSA_ADRS_OUT ; Output the PSA address in RL0.
            PUSH    @SP, R5
            PUSH    @SP, R0                 ; RL0 := A0-A7.
            LDK     R5, #PSA_ADRS_LSD       ; Set A0-A3.
            CALR    OUTPUT_TO_A
            SRLB    RL0, #4
            LDK     R5, #PSA_ADRS_MSD       ; Set A4-A7.
            CALR    OUTPUT_TO_A
            POP     R0, @SP
            POP     R5, @SP
            RET

            SKIP
TURN_ON_LED
            PUSH    @SP, R5
            PUSHL   @SP, RR2
            PUSH    @SP, R0
            LD      R3, R0
            CALR    GET_BRIGHTNESS          ; Set the current brightness.
            LDK     R5, #LED_BRIGHT
            CALR    OUTPUT_TO_A

            LD      R0, R3
            CALR    GET_LED_NBR             ; Get the current LED number.
            LDK     R5, #LED_ADRS
            CALR    OUTPUT_TO_A

            LD      R0, R3
            CALR    GET_LED_SIDE
            LDK     R5, #LED_SIDE
            CALR    OUTPUT_TO_A
            POP     R0, @SP
            POPL    RR2, @SP
            POP     R5, @SP
            RET


DISABLE_LEDS
            PUSH    @SP, R5
            PUSH    @SP, R0
            CLR     R0
            LDK     R5, #LED_SIDE
            CALR    OUTPUT_TO_A
            POP     R0, @SP
            POP     R5, @SP
            RET
```

```
GET_LED_NBR
            PUSH    @SP, R2
            TESTB   RH0
            JR      PL,GET_LED_N_1
            COMB    RH0                     ; Adjust block # for ch 2.
GET_LED_N_1 LDB     RL2, RH0
            CLRB    RH2
            LDB     RL0, LED_NBR_TABLE[ R2]
            POP     R2, @SP
            RET


GET_LED_SIDE
            LDB     RL0, #0001B             ; Blocks 0-2 = side 1.
            TESTB   RH0
            JR      PL,GET_LED_S_1          ; Channel 1.
            COMB    RH0                     ; Channel 2.
            LDB     RL0, #0100B             ; Blocks 0-2 = side 1.
GET_LED_S_1 CPB     RH0, #3
            RET     LT
            SLLB    RL0                     ; Blocks 3-6 = side 2.
            RET
            SKIP
INIT_BRIGHTNESS
            PUSHL   @SP, RR2
            PUSH    @SP, R0
            LDB     RL0, #0                 ; Default to min brightness.
            LDA     R2, CH1_BRIGHT_TABLE-1  ; Index in R3 is [1,.length].
            LD      R3, #2*BRIGHT_TABLE_LEN
INIT_BRIGHT_L LDB   R2[ R3], RL0
            DJNZ    R3,INIT_BRIGHT_L
            POP     R0, @SP
            POPL    RR2, @SP
            RET

GET_BRIGHTNESS      ; On entry: RH0 = block, RL0 = sensor.
            PUSHL   @SP, RR2
            LD      BRIGHT_SENSOR, R0       ; Save block & sensor.
            CALR    GET_BRIGHT_ADDR
            CALR    GET_BRIGHT_VALUE
            POPL    RR2, @SP
            RET
SET_BRIGHTNESS
            PUSHL   @SP, RR2
            PUSH    @SP, R0
            LD      R0, BRIGHT_SENSOR       ; Retrieve block & sensor.
            CALR    GET_BRIGHT_ADDR
            CALR    GET_BRIGHT_VALUE
            CP      R0, #MAX_BRIGHT_LEVEL   ; Check brightness level.
            JR      EQ,SET_BRIGHT_DONE      ; Max brightness already.
            INC     R0                      ; Increase brightness.
            CALR    SET_BRIGHT_VALUE
            DEC     R0                      ; Restore old brightness.
SET_BRIGHT_DONE CP  R0, #MAX_BRIGHT_LEVEL   ; Set flags for return:
            POP     R0, @SP                 ;  Z = max brightness,
            POPL    RR2, @SP                ;  NZ = less than max.
            RET
```

```
                SKIP
GET_BRIGHT_ADDR         ; R2 := byte address, R3 := bit# of lsb.
                PUSH    @SP, R0
                LDA     R2, CH1_BRIGHT_TABLE
                TESTB   RH0
                JR      PL,GET_BRIGHT_A_1
                COMB    RH0
                LDA     R2, CH2_BRIGHT_TABLE
GET_BRIGHT_A_1  LDB     RL3, RH0                ; R3 := block #.
                CLRB    RH3                     ; R3 := offset into table.
                SLL     R3                      ; Table has word values.
                LD      R3, BRIGHT_BLK_TABLE[ R3]
                LDA     R2, R2[ R3]             ; R2 := address of block data.
                CLRB    RH0                     ; R0 := sensor #.
                LD      R3, R0                  ; R3 := sensor #.
                SRL     R0                      ; R0 := R0/2: (2 values per byte).
                ADD     R2, R0                  ; R2 := byte address.
                SLL     R3, #2                  ; R3 := bit offset = 4 * sensor.
                AND     R3, #7                  ; R3 := bit position of lsb.
                POP     R0, @SP
                RET


GET_BRIGHT_VALUE
                LDB     RL0, @R2
                NEG     R3              ; Right shift.
                SDL     R0, R3
                NEG     R3              ; Restore bit offset.
                AND     R0, #0FH        ; Mask the brightness value.
                RET


SET_BRIGHT_VALUE
                PUSH    @SP, R0
                LDB     RH0, #0FH       ; Mask for brightness value.
                ANDB    RL0, RH0
                SDL     R0, R3          ; Position value & mask.
                COMB    RH0             ; Mask out the old value
                ANDB    RH0, @R2        ;  when the byte is retreived.
                ORB     RH0, RL0        ; Merge in the new value.
                LDB     @R2, RH0        ; Save the modified byte.
                POP     R0, @SP
                RET

                SKIP
READ_PSA                                ; R2 = read/calibrate.
                PUSH    @SP, R5
                LDK     R5, #PSA_READ
                CP      R2, #CALIB_CODE
                JR      NE,READ_PSA_1
                LDK     R5, #CALIB_READ
READ_PSA_1      CALR    READ_SENSORS
                POP     R5, @SP
                RET


READ_SENSORS            ; R5 = i/f board address to read from.
```

```
            PUSHL   @SP, RR2            ; On return: RL0 = channel state.
            LDB     RH3, RH0            ; Save ch no in RH3.
            TESTB   RH0                 ; Which channel ?
            JR      PL,READ_SENS_1      ; Ch 1.
            COMB    RH0                 ; Ch 2.
READ_SENS_1 CLR     R2
            CPB     RH0, #3
            TCC     GE, R2              ; R2 := blocks 3-6.
            CALR    INPUT_A
            TESTB   RH3                 ; Which channel ?
            JR      PL,READ_SENS_2      ; Ch 1.
            SRLB    RL0, #2             ; Ch 2: reposition the info.
READ_SENS_2 SDLB    RL0, R2             ; Shift left 0 or 1,
            LD      R2, R0              ;  0-2 = 0, 3-6 = 1.
            CLR     R0
            BIT     R2, #1              ; RL0 := channel state.
            TCCB    NZ, RL0
            POPL    RR2, @SP
            RET


DELAY
            PUSH    @SP, R3
            LD      R3, DELAY_COUNT
            DJNZ    R3,$                ; Wait a while.
            POP     R3, @SP
            RET

            SKIP
OUTPUT_TO_A ; Output RL0 to latch @R5.
            PUSH    @SP, R0
            LDB     RL1, #PORT_A        ; R1 := port A.
            LDB     RH0, RL5
            ANDB    RH0, #7H            ; Mask off address bits.
            SLLB    RH0, #4             ; Shift to upper half byte.
            ANDB    RL0, #0FH           ; Mask off data in lower half.
            ORB     RL0, RH0            ; Merge address and data.
            ORB     RL0, #80H           ; Disable decoder.
            OUT     @R1, R0
            ANDB    RL0, #7FH           ; Enable decoder.
            OUT     @R1, R0
            ORB     RL0, #80H           ; Disable decoder.
            OUT     @R1, R0
            POP     R0, @SP
            RET

INPUT_A     ; Input data from latches @R5 into R0.
            PUSH    @SP, R4
            LDB     RL1, #PORT_A
            IN      R4, @R1             ; Save output data.
            PUSH    @SP, R4
            LDB     RL4, #0FH           ; Set direction to input
            LDB     RL1, #PA_DDR_REG    ;  for lower half byte.
            OUT     @R1, R4
            LDB     RL1, #PA_IOC_REG    ; Set 1's catcher mode.
            OUT     @R1, R4
            LDB     RL0, RL5
```

```
            ANDB    RL0, #7H            ; Mask off address bits.
            SLLB    RL0, #4             ; Shift to upper half byte.
            LDB     RL1, #PORT_A        ; R1 := port A.
            OUT     @R1, R0             ; Set adrs & clear 1's catcher.
            CALR    WAIT                ; Give 1's catcher a chance.
            IN      R4, @R1             ; Input data to R4.
            ORB     RL0, #80H           ; Disable decoder.
            OUT     @R1, R0
            LD      R0, R4              ; R0 := input data.
            POP     R4, @SP             ; Retrieve output data.
            OUT     @R1, R4
            CLR     R4
            LDB     RL1, #PA_IOC_REG    ; Ensure that the output
            OUT     @R1, R4             ;  mode is not open drain.
            LDB     RL1, #PA_DDR_REG    ; Return direction to output.
            OUT     @R1, R4
            POP     R4, @SP
            RET


WAIT
            PUSH    @SP, R3
            LD      R3, WAIT_COUNT
            DJNZ    R3,$                ; Wait a while.
            POP     R3, @SP
            RET

            SKIP
CIO_SPKON   PUSHL   @SP, RR0
            ORB     RL1, #PORT_C        ; R1 := speaker port address.
            LD      R0, #0FFH           ; Output data = high.
            CP      R5, #SPEAKER1_SU
            JR      NE,SPK2_ON
            RES     R0, #SPK1_BIT+4     ; Enable write to Spk1 bit.
            JR      SPKON
SPK2_ON     RES     R0, #SPK2_BIT+4     ; Enable write to Spk2 bit.
SPKON       OUT     @R1, R0
            POPL    RR0, @SP
            JP      CIO_EXIT

CIO_SPKOFF  PUSHL   @SP, RR0
            ORB     RL1, #PORT_C        ; R1 := speaker port address.
            LD      R0, #0F0H           ; Output data = low.
            CP      R5, #SPEAKER1_SU
            JR      NE,SPK2_OFF
            RES     R0, #SPK1_BIT+4     ; Enable write to Spk1 bit.
            JR      SPKOFF
SPK2_OFF    RES     R0, #SPK2_BIT+4     ; Enable write to Spk2 bit.
SPKOFF      OUT     @R1, R0
            POPL    RR0, @SP
            JP      CIO_EXIT

            SKIP
; Constants in ROM:

DELAY_COUNT WVAL    800/4           ;  800 uSec.
WAIT_COUNT  WVAL    28/4            ;   28 uSec.
```

```
PSA_FIRST_TABLE BVAL    191, 127, 63, 0, 32, 96, 160

LED_NBR_TABLE   BVAL    0, 1, 2, 3, 2, 1, 0
                EVEN

BLK0_LEN        EQU     64
BLK1_LEN        EQU     BLK0_LEN
BLK2_LEN        EQU     BLK0_LEN
BLK3_LEN        EQU     32
BLK4_LEN        EQU     BLK0_LEN
BLK5_LEN        EQU     BLK0_LEN
BLK6_LEN        EQU     BLK3_LEN
SIDE_LEN        EQU     BLK0_LEN+BLK1_LEN+BLK2_LEN

BRIGHT_PER_BYTE EQU     8/4             ; 4 bits of brightness = 2 per byte.
D               EQU     BRIGHT_PER_BYTE ; Packing density.

BRIGHT_BLK_TABLE        ; Block offsets into brightness tables - bytes.
                WVAL    (0)/D                                   ; 0.
                WVAL    (BLK0_LEN)/D                            ; 1.
                WVAL    (BLK0_LEN+BLK1_LEN)/D                   ; 2.
                WVAL    (SIDE_LEN)/D                            ; 3.
                WVAL    (SIDE_LEN+BLK3_LEN)/D                   ; 4.
                WVAL    (SIDE_LEN+BLK3_LEN+BLK4_LEN)/D          ; 5.
                WVAL    (SIDE_LEN+BLK3_LEN+BLK4_LEN+BLK5_LEN)/D ; 6.

; Data storage in RAM:
                DATA

BRIGHT_SENSOR   RMB     1*WORDS ; Block & sensor number.


BRIGHT_TABLE_LEN        EQU     2*SIDE_LEN/BRIGHT_PER_BYTE

CH1_BRIGHT_TABLE        RMB     BRIGHT_TABLE_LEN    ; Brightness tables.
CH2_BRIGHT_TABLE        RMB     BRIGHT_TABLE_LEN
                EVEN

                PROG
LAST            EQU     $

                END
                TITLE   " Z8000  CIO 2 DRIVER Routines"
*****************************************************************
*                                                               *
*                  <<<  CIO_2  >>>                              *
*                                                               *
*               CIO #2 DRIVER ROUTINES                          *
*                     for the                                   *
*                     Z82/SBC                                   *
*                                                               *
*****************************************************************
                PROG

                INCLUDE IO_COM
```

```
*        ENTRY POINTS:

                GLB     DVR_CIO_2


*       DRIVER CONSTANTS:

CIO_RESET       EQU     1
MICR_CMD        EQU     00000000B               ; Shift left address.

TC1             EQU     0                       ; Dummy value for this driver.
CT1_MSR_CMD     EQU     11000110B               ; Continuous, ext out, sq wave.
CT1_TCR_MSB     EQU     TC1.SR.8                ; MSB of count.
CT1_TCR_LSB     EQU     TC1.AN.0FFH             ; LSB of count.
CT1_CSR_CMD     EQU     00000110B               ; Gate and trigger.
CT1_EN          EQU     01000000B               ; Enable CT #1.

TC2             EQU     0                       ; Dummy value for this driver.
CT2_MSR_CMD     EQU     11000110B               ; Continuous, ext out, sq wave.
CT2_TCR_MSB     EQU     TC2.SR.8                ; MSB of count.
CT2_TCR_LSB     EQU     TC2.AN.0FFH             ; LSB of count.
CT2_CSR_CMD     EQU     00000110B               ; Gate and trigger.
CT2_EN          EQU     00100000B               ; Enable CT #2.

; Port Mode and Status Register field definitions:
BIT_PORT        EQU     00B.SL.6
INPUT_PORT      EQU     01B.SL.6
OUTPUT_PORT     EQU     10B.SL.6
BIDIRECTIONAL   EQU     11B.SL.6
ENABLE_DESKEW   EQU     1B

; Port Command and Status Register field definitions:
CLEAR_IP_IUS    EQU     001B.SL.5
SET_IUS         EQU     010B.SL.5
CLEAR_IUS       EQU     011B.SL.5
SET_IP          EQU     100B.SL.5
CLEAR_IP        EQU     101B.SL.5
SET_IE          EQU     110B.SL.5
CLEAR_IE        EQU     111B.SL.5

; Port Handshake Specification Register field definitions:
INTERLOCKED_HANDSHAKE   EQU     00B.SL.6
STROBED_HANDSHAKE       EQU     01B.SL.6
PULSED_HANDSHAKE        EQU     10B.SL.6
IEEE_HANDSHAKE          EQU     11B.SL.6

PA_MSR          EQU     BIT_PORT                ; Port A = BIT mode.
PB_MSR          EQU     BIT_PORT                ; Port B = BIT mode.

PA_HSR          EQU     STROBED_HANDSHAKE

PA_DPP          EQU     11111111B               ; PA0-7 = inverted.
PB_DPP          EQU     00000000B               ; PB0-7 = non-invertd.
PC_DPP          EQU     00000000B               ;

PA_DDR          EQU     11111111B               ; PA0-7 = input.
PB_DDR          EQU     11100110B               ; PB4 = output.
PC_DDR          EQU     00000110B               ;
```

```
PA_IOC          EQU     11111111B           ; PA = 1's catcher.
PB_IOC          EQU     00000000B           ; PB = normal.
PC_IOC          EQU     00000000B           ;

PA_EN           EQU     00000100B           ; Port A enable.
PB_EN           EQU     10000000B           ; Port B enable.
PC_EN           EQU     00010000B           ; Port C enable.

MICR_REG        EQU     000000B.SL.1
MCCR_REG        EQU     000001B.SL.1

CT1_MSR_REG     EQU     011100B.SL.1
CT1_CSR_REG     EQU     001010B.SL.1
CT1_TCR_MSB_REG EQU     010110B.SL.1
CT1_TCR_LSB_REG EQU     010111B.SL.1

CT2_MSR_REG     EQU     011101B.SL.1
CT2_CSR_REG     EQU     001011B.SL.1
CT2_TCR_MSB_REG EQU     011000B.SL.1
CT2_TCR_LSB_REG EQU     011001B.SL.1

PA_MSR_REG      EQU     100000B.SL.1
PA_HSR_REG      EQU     100001B.SL.1
PA_DPP_REG      EQU     100010B.SL.1
PA_DDR_REG      EQU     100011B.SL.1
PA_IOC_REG      EQU     100100B.SL.1

PB_MSR_REG      EQU     101000B.SL.1
PB_DPP_REG      EQU     101010B.SL.1
PB_DDR_REG      EQU     101011B.SL.1
PB_IOC_REG      EQU     101100B.SL.1

PC_DPP_REG      EQU     000101B.SL.1
PC_DDR_REG      EQU     000110B.SL.1
PC_IOC_REG      EQU     000111B.SL.1

PA_CSR_REG      EQU     001000B.SL.1
PB_CSR_REG      EQU     001001B.SL.1

PORT_A          EQU     001101B.SL.1
PORT_B          EQU     001110B.SL.1
PORT_C          EQU     001111B.SL.1

                SKIP
*       MAIN ROUTINES:

*****************************************************************
*                                                               *
*    INTERFACE DRIVERS                                          *
*                                                               *
*            R0 = character                                     *
*            R1 = select code                                   *
*            R2 = function code                                 *
*            R3 = buffer address                                *
*            R5 = device SU number                              *
*                                                               *
*                                                               *
*****************************************************************
```

```
DVR_CIO_2
            CP      R2, #READ_CODE
            JR      EQ,SW_READ
            CP      R2, #INIT_CODE
            JR      EQ,INIT
            SETFLG  V
            RET


INIT        PUSHL   @SP, RR0
            CALR    INIT_CIO
            CALR    ENABLE_OUTPUT
            CLR     R0
            LDB     RL1, #PORT_A
            OUT     @R1, R0         ; Clear 1's catcher.
            POPL    RR0, @SP
EXIT_OK     RESFLG  V
            RET


INIT_CIO
            LD      R0, #CIO_RESET
            LDB     RL1, #MICR_REG
            OUT     @R1, R0
            LD      R0, #MICR_CMD
            LDB     RL1, #MICR_REG
            OUT     @R1, R0
            RET


ENABLE_OUTPUT
            LD      R0, #PA_MSR
            LDB     RL1, #PA_MSR_REG
            OUT     @R1, R0
            LD      R0, #PA_DPP
            LDB     RL1, #PA_DPP_REG
            OUT     @R1, R0
            LD      R0, #PA_DDR
            LDB     RL1, #PA_DDR_REG
            OUT     @R1, R0
            LD      R0, #PA_IOC
            LDB     RL1, #PA_IOC_REG
            OUT     @R1, R0
;           LD      R0, #PA_HSR
;           LDB     RL1, #PA_HSR_REG
;           OUT     @R1, R0
            LD      R0, #PB_MSR
            LDB     RL1, #PB_MSR_REG
            OUT     @R1, R0
;           LD      R0, #PB_DPP
;           LDB     RL1, #PB_DPP_REG
;           OUT     @R1, R0
            LD      R0, #PB_DDR
            LDB     RL1, #PB_DDR_REG
            OUT     @R1, R0
;           LD      R0, #PB_IOC
;           LDB     RL1, #PB_IOC_REG
```

```
;               OUT     @R1, R0
;               LD      R0, #PC_DPP
;               LDB     RL1, #PC_DPP_REG
;               OUT     @R1, R0
                LD      R0, #PC_DDR
                LDB     RL1, #PC_DDR_REG
                OUT     @R1, R0
;               LD      R0, #PC_IOC
;               LDB     RL1, #PC_IOC_REG
;               OUT     @R1, R0
                IN      R0, MCCR_REG
                OR      R0, #PA_EN
; Not enabled.  OR      R0, #PB_EN
; Not enabled.  OR      R0, #PC_EN
                LDB     RL1, #MCCR_REG
                OUT     @R1, R0
                RET


SW_READ
                PUSH    @SP, R2
                PUSH    @SP, R1
                LDB     RL1, #PORT_A
                IN      R0, @R1
                CLR     R2
                CLRB    RH0
                OUT     @R1, R2         ; Clear 1's catcher.
                POP     R1, @SP
                POP     R2, @SP
                JR      EXIT_OK


LAST            EQU     $
                END

                TITLE   " MBF  Dartboard Controller Routine"
*************************************************************
*                                                           *
*                        CTL                                *
*                                                           *
*               AUTOMATIC SCORING SYSTEM                    *
*                        for                                *
*                     DARTBOARDS                            *
*                                                           *
*************************************************************


                PROG


*          GLOBAL SYMBOL:

                GLB     PLAY_DARTS


*          EXTERNAL ROUTINES:
```

```
        EXT     COUNT_UP, GAME_301, GAME_501
        EXT     CALIBRATE

        EXT     READ_SWITCH
        EXT     TERM_FUNCTION, APPEND_STR_, COPY_STR_
        EXT     SET_STANDARD
        EXT     DISP_INT, PRT_FPN, PRT_LINE, SPEAK_OUT
        EXT     SCAN, START_SCREEN, PRT_BIG

        EXT     IOC_
        EXT     BUFFER_
        EXT     SWITCH_
        EXT     SCORE
        EXT     RECT
        EXT     ATN_, SIN_, COS_
        EXT     ABS_, INT_
        EXT     IENT_, DINT_
        EXT     IRND_, DRND_
        EXT     NUMBER_FORMAT_
        EXT     FTOD_
        EXT     RTOI_, SQR_
        EXT     FCM_
        EXT     FAD_, FSB_
        EXT     FMP_, FDV_
        EXT     MPY_
        EXT     DFLOAT_, FLOAT_
        EXT     PACK_
        EXT     DFIX_, IFIX_


*       EXTERNAL REFERENCES:

        EXT     STACK
        EXT     FMT_TYPE
        EXT     X_CAL, Y_CAL
        EXT     N_PLAYERS
        EXT     CLEAR, HOME, ERASE_EOS, ERASE_EOL
        EXT     CBLK_CON, CBLK_BIG, CBLK_PSA, CBLK_PBS, CBLK_SPK
        EXT     BFR1, BFR_BIG, BFR_P, BFR_SW, BFR_SPK
        EXT     LAST_SCAN, OLD_SCAN
        EXT     DART1_BEFORE, DART1_AFTER
        EXT     DART2_BEFORE, DART2_AFTER
        EXT     DART3_BEFORE, DART3_AFTER

        SKIP
*       EXTERNAL SYMBOLS:

        EXT     NXT_PLYR_SW, COIN_SW, CAL_SW
        EXT     GAME1_SW, GAME2_SW, GAME3_SW

        EXT     CONSOLE_LU
        EXT     SCREEN0_LU
        EXT     SCREEN1_LU
        EXT     SCREEN2_LU
        EXT     SCREEN3_LU
        EXT     SCREEN4_LU
        EXT     SPEAKER1_LU
```

```
            EXT     SPEAKER2_LU
            EXT     PSA_LU, PBS_LU

            EXT     SOUND1, SOUND2, SOUND3, SOUND4, SOUND5

            EXT     STANDARD_FMT, FLOAT_FMT, GAME_NO
            EXT     GET_NEXT_BFR
            EXT     PUT_CHAR_BFR
            EXT     GET_CHAR_BFR
            EXT     INIT_BFR
            EXT     CLEAR_BFR
            EXT     RESET_BFR
            EXT     SET_PTR_BFR
            EXT     MAX_LEN_BFR
            EXT     CUR_LEN_BFR
            EXT     GET_PTR_BFR
            EXT     BS_LEN_BFR
            EXT     BS_PTR_BFR

            EXT     READ_CODE
            EXT     WRITE_CODE
            EXT     STATUS_CODE
            EXT     INIT_CODE
            EXT     RD_CHAR_CODE
            EXT     WR_CHAR_CODE

            EXT     LEN1, LEN_BIG, LEN_P, LEN_SW, LEN_SPK
            EXT     LEN_LAST, LEN_OLD, LEN_DARTS_BFR
            SKIP
*       REGISTER DEFINITIONS:


FQ1         EQU     RQ0
FR1         EQU     R2
MANTH_FR1   EQU     R2
MANTL_FR1   EQU     R3
MANT_FR1    EQU     RR2
EXP_FR1     EQU     R4
FR2         EQU     R6
MANTH_FR2   EQU     R6
MANTL_FR2   EQU     R7
MANT_FR2    EQU     RR6
EXP_FR2     EQU     R8
FR3         EQU     R10
MANTH_FR3   EQU     R10
MANTL_FR3   EQU     R11
MANT_FR3    EQU     RR10
EXP_FR3     EQU     R12
SP          EQU     R15


            SKIP
*       MACROS:


SCREEN      MACRO   &FUNCTION
```

```
            CALL    TERM_FUNCTION
            WVAL    &FUNCTION
            MEND


SETSRN      MACRO   &SCREEN_NO
            LD      CBLK_CON, #&SCREEN_NO
            LD      CBLK_CON+2, #WRITE_CODE
            MEND

SWITCH      MACRO   &SCREEN_NO
            LD      CBLK_CON, #&SCREEN_NO
            LD      CBLK_CON+2, #CONTROL_CODE
            PUSH    @SP, #CBLK_CON
            CALL    IOC_
            MEND

STRING      MACRO   &STRING
            WVAL    LEN&&&&
STR&&&&     ASCII   &STRING
LEN&&&&     EQU     $-STR&&&&
            EVEN
            MEND

DISP        MACRO   &STRING
            PUSH    @SP, #BFR1
            PUSH    @SP, #STR&&&&
            CALL    APPEND_STR_
            JR      END&&&&
STR&&&&     STRING  &STRING
END&&&&     EQU     $
            MEND

PRINT       MACRO   &STRING
            DISP    &STRING
            CALL    PRT_LINE
            MEND


PRBIG       MACRO   &STRING
            DISP    &STRING
            CALL    PRT_BIG
            MEND


PLINE       MACRO   &LINES
            .IF     &LINES .NE. "" SET CNT
LOOP_CNT    .SET    1
            .GOTO   LOOP_TOP
SET_CNT     .NOP
LOOP_CNT    .SET    &LINES
LOOP_TOP    .NOP
            CALL    PRT_LINE
LOOP_CNT    .SET    LOOP_CNT-1
            .IF     LOOP_CNT .GT. 0 LOOP_TOP
            MEND
```

```
SPEAK           MACRO   &STRING
                PUSH    @SP, #&STRING
                CALL    SPEAK_OUT
                MEND


                SKIP

FLD             MACRO   &FR_DST, &FR_SRC
                LDL     MANT_&FR_DST, MANT_&FR_SRC
                LD      EXP_&FR_DST, EXP_&FR_SRC
                MEND


FEX             MACRO   &FR_DST, &FR_SRC
                EX      MANTH_&FR_DST, MANTH_&FR_SRC
                EX      MANTL_&FR_DST, MANTL_&FR_SRC
                EX      EXP_&FR_DST, EXP_&FR_SRC
                MEND


FLT             MACRO   &INT
                PUSHL   @SP, RR0
                LD      R0, &INT
                CALL    FLOAT_
                POPL    RR0, @SP
                MEND


PUSHF           MACRO   &FR_SRC
                PUSH    @SP, EXP_&FR_SRC
                PUSHL   @SP, MANT_&FR_SRC
                MEND


POPF            MACRO   &FR_DST
                POPL    MANT_&FR_DST, @SP
                POP     EXP_&FR_DST, @SP
                MEND


BUFFER          MACRO   &BFR, &CODE
                PUSH    @SP, &BFR
                CALL    BUFFER_
                WVAL    &CODE
                MEND
                SKIP
***********************************************
*                                             *
*         MAIN PROGRAM:                       *
*                                             *
***********************************************
PLAY_DARTS
                LDA     SP, STACK
                CALL    INITIALIZE
                CALL    CALIBRATE_CHK
                JR      C,NEW_GAME_1            ; If coin inserted, count the players.
```

```
NEW_GAME_0      CALL    WAIT_FOR_MONEY

NEW_GAME_1      CALL    COUNT_PLAYERS
                CALL    PLAY_A_GAME
                WVAL    NEW_GAME_1              ; Abnormal return.
                JP      NEW_GAME_0              ; Normal end of game return.


                SKIP
*********************************************************************
*                                                                   *
*   INITIALIZE    - Initializes the dartboard at power-on.          *
*                                                                   *
*********************************************************************

INITIALIZE      LD      R0, #LEN1               ; Initialize the CONSOLE buffer.
                BUFFER  #BFR1, INIT_BFR

                LD      R0, #LEN_BIG            ; Initialize the CONSOLE buffer.
                BUFFER  #BFR_BIG, INIT_BFR

                LD      R0, #LEN_P              ; Initialize the PSA buffer.
                BUFFER  #BFR_P, INIT_BFR

                LD      R0, #LEN_SW             ; Initialize the SWITCH buffer.
                BUFFER  #BFR_SW, INIT_BFR
                LD      R0, #9                  ; Set 9 switches.
                BUFFER  #BFR_SW, PUT_CHAR_BFR

                LD      R0, #LEN_SPK            ; Initialize the SPEAKER buffer.
                BUFFER  #BFR_SPK, INIT_BFR

                LD      R0, #LEN_LAST           ; Initialize the LAST SCAN buffer.
                BUFFER  #LAST_SCAN, INIT_BFR

                LD      R0, #LEN_OLD            ; Initialize the OLD SCAN buffer.
                BUFFER  #OLD_SCAN, INIT_BFR

                LD      R0, #LEN_DARTS_BFR      ; Initialize the DART buffers.
                BUFFER  #DART1_BEFORE, INIT_BFR
                BUFFER  #DART1_AFTER, INIT_BFR

                BUFFER  #DART2_BEFORE, INIT_BFR
                BUFFER  #DART2_AFTER, INIT_BFR

                BUFFER  #DART3_BEFORE, INIT_BFR
                BUFFER  #DART3_AFTER, INIT_BFR

                CALR    INIT_CBLKS

                LD      CBLK_CON+2, #INIT_CODE  ; Initialize the CONSOLE interface.
                PUSH    @SP, #CBLK_CON
                CALL    IOC_

                LD      CBLK_PSA+2, #INIT_CODE  ; Initialize the PSA interface.
                PUSH    @SP, #CBLK_PSA
                CALL    IOC_
```

```
            LD      CBLK_PBS+2, #INIT_CODE  ; Initialize the SWITCH interface.
            PUSH    @SP, #CBLK_PBS
            CALL    IOC_

            LD      CBLK_SPK+2, #INIT_CODE  ; Initialize the SPEAKER interface
            PUSH    @SP, #CBLK_SPK
            CALL    IOC_

            SCREEN  CLEAR
            CALL    PRT_LINE
            CALL    SET_STANDARD

            CLR     X_CAL                   ; Initialize cal constants to 0.
            CLR     X_CAL+2
            CLR     X_CAL+4
            CLR     Y_CAL
            CLR     Y_CAL+2
            CLR     Y_CAL+4
            RET
            SKIP
*****************************************************************
*                                                               *
*   CALIBRATE_CHK   - Check to see if calibration is desired, or *
*                     if the calibration is ok.                 *
*                     If a coin is dropped in the slot, the carry *
*                     flag is set and the routine is exited.    *
*                     If the Game 1 button is pushed, the calibration *
*                     is performed. After calibration, the carry *
*                     flag is cleared, and the routine is exited. *
*                                                               *
*****************************************************************

CALIBRATE_CHK   PLINE   3
                PRBIG   " * DARTBOARD GAME *"
                PLINE   3
                PRINT   "            COPYRIGHT  1983"
                PLINE   2
                PRINT   "        BY PEOPLE PLEASERS, INC."
                PLINE   2
                PRINT   "           (PATENTS PENDING)"
CHECK_LOOP      CALL    READ_SWITCH
                WVAL    CHECK_LOOP
                WVAL    COIN_SW, CAL_CHK_1      ; Play.
                WVAL    CAL_SW,CAL_CHK_2        ; Calibrate.
                WVAL    -1

CAL_CHK_1
                SETFLG  C                       ; Set carry flag if coin in slot.
                RET

CAL_CHK_2       CALL    CALIBRATE
                RESFLG  C                       ; Clear carry flag.
                RET

                SKIP
*****************************************************************
*                                                               *
*   WAIT_FOR_MONEY  - Wait until a coin is dropped into the slot. *
*                                                               *
*****************************************************************
```

```
WAIT_FOR_MONEY  CALL    START_SCREEN

WAIT_MONEY_1    CALL    READ_SWITCH
                WVAL    WAIT_MONEY_1
                WVAL    COIN_SW, WAIT_MONEY_2
                WVAL    -1

WAIT_MONEY_2
                RET

                SKIP
*********************************************************************
*                                                                   *
*   COUNT_PLAYERS      - Count the number of coins dropped in       *
*                        the slot to determine the number of        *
*                        players.                                   *
*                                                                   *
*                        Select one of the games according to the   *
*                        button pressed.                            *
*                                                                   *
*********************************************************************

COUNT_PLAYERS   EQU     $
                CALL    START_SCREEN
                CLR     N_PLAYERS               ; Clear the previous no. of players.

COUNT_PLYRS0    SPEAK   SOUND1                  ; Generate a sound for COIN switch.

                CP      N_PLAYERS, #PLAYERS     ; At most four players.
                JR      GE,SELEC_A_GAME
                INC     N_PLAYERS
COUNT_PLYRS1
                CALL    READ_SWITCH
                WVAL    COUNT_PLYRS1
                WVAL    COIN_SW, COUNT_PLYRS0
                WVAL    GAME1_SW, SELECT_GAME1
                WVAL    GAME2_SW, SELECT_GAME2
                WVAL    GAME3_SW, SELECT_GAME3
                WVAL    -1

SELECT_GAME1    LD      GAME_NO, #1
                JR      COUNT_PLYRS2

SELECT_GAME2    LD      GAME_NO, #2
                JR      COUNT_PLYRS2

SELECT_GAME3    LD      GAME_NO, #3
                JR      COUNT_PLYRS2

COUNT_PLYRS2
                SPEAK   SOUND2
                RET

SELEC_A_GAME    SCREEN  CLEAR
                PLINE   3
                PRINT   "     PLEASE SELECT A GAME NOW !!"
                PLINE   3
                PRINT   "     FOUR PLAYERS MAX PER GAME."
```

```
                JR      COUNT_PLYRS1

                SKIP
*****************************************************************
*                                                               *
*   PLAY_A_GAME   - Play the game which was selected.           *
*                                                               *
*                                                               *
*****************************************************************

PLAY_A_GAME     PUSH    @SP, R1
                LD      R1, GAME_NO
                DEC     R1
                SLA     R1
                LD      R1, GAME_TABLE[ R1]
                CALL    @R1
                WVAL    PLAY_RET1
                POP     R1, @SP
                INC     @SP, #2                 ; Skip abnormal return address.
                RET

PLAY_RET1       POP     R1, @SP
                EX      R1, @SP
                LD      R1, @R1
                EX      R1, @SP
                RET

GAME_TABLE      WVAL    COUNT_UP
                WVAL    GAME_301
                WVAL    GAME_501

                SKIP

*               Initialize Control Blocks.

INIT_CBLKS      PUSHL   @SP, RR2
                PUSHL   @SP, RR4
                LDA     R2, CBLK_CON
                LD      R3, #5*3                ; 5 blocks * 3 words.
                LDA     R4, CBLK1_INFO
                LDIR    @R2, @R4, R3

                POPL    RR4, @SP
                POPL    RR2, @SP
                RET

*               Control Blocks Definitions :

CBLK1_INFO      WVAL    SCREEN1_LU
                WVAL    0
                WVAL    BFR1

CBLK2_INFO      WVAL    SCREEN1_LU
                WVAL    0
                WVAL    BFR_BIG

CBLK3_INFO      WVAL    PSA_LU
                WVAL    0
                WVAL    BFR_P
```

```
CBLK4_INFO      WVAL    PBS_LU
                WVAL    0
                WVAL    BFR_SW

CBLK5_INFO      WVAL    SPEAKER1_LU
                WVAL    0
                WVAL    BFR_SPK

                SKIP

*               System Constants :

LF              EQU     10
PLAYERS         EQU     4


                END     PLAY_DARTS

               TITLE   " MBF  Dartboard Count-Down Games Routines"
*************************************************************
*                                                           *
*                        C_D                                *
*                                                           *
*              AUTOMATIC SCORING SYSTEM                     *
*                        for                                *
*                     DARTBOARDS                            *
*                                                           *
*************************************************************

               PROG

*          ENTRY POINTS:

               GLB     GAME_301, GAME_501
               GLB     DELAY_3_SEC

*          EXTERNAL ROUTINES:

               EXT     PLAY_A_ROUND
               EXT     SET_PLAYER_1, SET_NEXT_PLAYER
               EXT     READ_SCORE, ADD_SCORE, SET_SCORE
               EXT     INIT_SCORES, UPDATE_SCORE, UPDATE_CP_SCORE
               EXT     SCORE_SCREEN, STATUS_SCREEN, BUSTED_SCREEN
               EXT     MAKE_A_SOUND, SPEAK_OUT, WAIT_HF_SEC
               EXT     TERM_FUNCTION, APPEND_STR_, TRIM_STR
               EXT     DISP_INT, PRT_FPN, PRT_LINE, PRT_BIG

               EXT     IOC_
               EXT     BUFFER_
               EXT     SWITCH_
               EXT     SCORE
               EXT     RECT
               EXT     NUMBER_FORMAT_
               EXT     FTOD_
               EXT     FCM_
               EXT     FAD_, FSB_
               EXT     FMP_, FDV_
               EXT     DFLOAT_, FLOAT_
```

```
*       EXTERNAL REFERENCES:

            EXT     CBLK_CON, CBLK_PSA, CBLK_PBS
            EXT     BFR1, BFR_P, BFR_SW

            EXT     ROUND_NO, PLAYER_NO, DART_NO
            EXT     SCORING, DARTS, ROUND_SCORE
            EXT     CUR_PLYR_SCORE

            SKIP
*       EXTERNAL SYMBOLS:

            EXT     CLEAR, HOME, ERASE_EOS, ERASE_EOL

            EXT     CONSOLE_LU
            EXT     PSA_LU, PBS_LU
            EXT     GET_NEXT_BFR
            EXT     PUT_CHAR_BFR
            EXT     GET_CHAR_BFR
            EXT     INIT_BFR
            EXT     CLEAR_BFR
            EXT     RESET_BFR
            EXT     SET_PTR_BFR
            EXT     MAX_LEN_BFR
            EXT     CUR_LEN_BFR
            EXT     GET_PTR_BFR
            EXT     BS_LEN_BFR
            EXT     BS_PTR_BFR

            EXT     READ_CODE
            EXT     WRITE_CODE
            EXT     STATUS_CODE
            EXT     INIT_CODE
            EXT     RD_CHAR_CODE
            EXT     WR_CHAR_CODE

            EXT     SOUND1, SOUND2, SOUND3, SOUND4, SOUND5
            EXT     SCREEN0, SCREEN1, SCREEN2, SCREEN3, SCREEN4

*       REGISTER DEFINITIONS:

FQ1         EQU     RQ0
FR1         EQU     R2
MANTH_FR1   EQU     R2
MANTL_FR1   EQU     R3
MANT_FR1    EQU     RR2
EXP_FR1     EQU     R4
FR2         EQU     R6
MANTH_FR2   EQU     R6
MANTL_FR2   EQU     R7
MANT_FR2    EQU     RR6
EXP_FR2     EQU     R8
FR3         EQU     R10
MANTH_FR3   EQU     R10
MANTL_FR3   EQU     R11
MANT_FR3    EQU     RR10
EXP_FR3     EQU     R12
SP          EQU     R15
```

```
            SKIP
*       MACROS:

SCREEN      MACRO   &FUNCTION
            CALL    TERM_FUNCTION
            WVAL    &FUNCTION
            MEND

SETSRN      MACRO   &SCREEN_NO
            LD      CBLK_CON, #&SCREEN_NO
            LD      CBLK_CON+2, #WRITE_CODE
            MEND

STRING      MACRO   &STRING
            WVAL    LEN&&&&
STR&&&&     ASCII   &STRING
LEN&&&&     EQU     $-STR&&&&
            EVEN
            MEND

DISP        MACRO   &STRING
            PUSH    @SP, #BFR1
            PUSH    @SP, #STR&&&&
            CALL    APPEND_STR_
            JR      END&&&&
STR&&&&     STRING  &STRING
END&&&&     EQU     $
            MEND

PRINT       MACRO   &STRING
            DISP    &STRING
            CALL    PRT_LINE
            MEND

PRBIG       MACRO   &STRING
            DISP    &STRING
            CALL    PRT_BIG
            MEND

PLINE       MACRO   &LINES
            .IF     &LINES .NE. "" SET_CNT
LOOP_CNT    .SET    1
            .GOTO   LOOP_TOP
SET_CNT     .NOP
LOOP_CNT    .SET    &LINES
LOOP_TOP    .NOP
            CALL    PRT_LINE
LOOP_CNT    .SET    LOOP_CNT-1
            .IF     LOOP_CNT .GT. 0 LOOP_TOP
            MEND
```

```
SPEAK           MACRO   &STRING
                PUSH    @SP, #&STRING
                CALL    SPEAK_OUT
                MEND


FLD             MACRO   &FR_DST, &FR_SRC
                LDL     MANT_&FR_DST, MANT_&FR_SRC
                LD      EXP_&FR_DST, EXP_&FR_SRC
                MEND


FEX             MACRO   &FR_DST, &FR_SRC
                EX      MANTH_&FR_DST, MANTH_&FR_SRC
                EX      MANTL_&FR_DST, MANTL_&FR_SRC
                EX      EXP_&FR_DST, EXP_&FR_SRC
                MEND


FLT             MACRO   &INT
                PUSHL   @SP, RR0
                LD      R0, &INT
                CALL    FLOAT_
                POPL    RR0, @SP
                MEND


PUSHF           MACRO   &FR_SRC
                PUSH    @SP, EXP_&FR_SRC
                PUSHL   @SP, MANT_&FR_SRC
                MEND

POPF            MACRO   &FR_DST
                POPL    MANT_&FR_DST, @SP
                POP     EXP_&FR_DST, @SP
                MEND


BUFFER          MACRO   &BFR, &CODE
                PUSH    @SP, &BFR
                CALL    BUFFER_
                WVAL    &CODE
                MEND

                SKIP
*          MAIN PROGRAM:

*********************************************************************
*                                                                   *
*   301  &  501                                                     *
*                                                                   *
*********************************************************************

GAME_301        PUSH    @SP, R0
                LD      R0, #301
                JR      COUNT_DOWN
```

```
GAME_501        PUSH    @SP, R0
                LD      R0, #501

COUNT_DOWN      CALR    INITIALIZE
COUNT_DN_1      CALL    PLAY_A_ROUND
                WVAL    NEW_GAME                ; New game.
                WVAL    END_OF_GAME             ; No end of game possible during a round.
                JR      COUNT_DN_1              ; Keep playing until end.

END_OF_GAME     CALR    DISPLAY_RESULTS
                POP     R0, @SP
                INC     @SP, #2                 ; Increment return address
                RET                             ;  for a normal return.

NEW_GAME        POP     R0, @SP
                JR      RETURN_1

RETURN_2        INC     @SP, #2
RETURN_1        EX      R1, @SP                 ; Get return address.
                LD      R1, @R1                 ; Get the location stored there,
                EX      R1, @SP                 ;  set it as the new return address
                RET                             ;  and go there.


INITIALIZE      EQU     $
                LD      SCORING, #SCORE_C_D     ; Current scoring routine is for count-up.
                CLR     ROUND_NO                ; Set round 0.
                CALL    INIT_SCORES             ; Init scores to 301 or 501.
                CALL    SCORE_SCREEN
                RET

SCORE_C_D       EQU     $
                CALL    MAKE_A_SOUND
                CALL    UPDATE_CP_SCORE
                CALL    ADD_SCORE
                LD      R0, CUR_PLYR_SCORE      ; R0 := current score.
                CP      R0, #0                  ; Check for bust.
                JR      NE,SCORE_C_D_0          ; If score is equal to points
; No double out!CP      R1, #1                  ;  then check for double or triple out.
;               JR      LE,SCORE_BUST

                CALL    UPDATE_SCORE            ; End of game.
                CALL    SCORE_SCREEN
                CALL    DELAY_3_SEC
                JR      RETURN_1

SCORE_C_D_0   ; DEC     R0                      ; Bust on a remainder of 1 or less.
                CP      R0, #0                  ; Check for bust.
                JR      LT,SCORE_BUST           ; If (points >= (score-1)) AND (points <> score)  then bust.

SCORE_C_D_1     CP      DART_NO, #DARTS
                JR      EQ,END_A_TURN
                JR      GT,A_FALL_DART
                CALL    STATUS_SCREEN
                JR      SCORE_C_D_EX
```

```
END_A_TURN      CALL    STATUS_SCREEN
                CALL    DELAY_3_SEC
                INC     DART_NO
A_FALL_DART     CALL    UPDATE_SCORE
                CALL    SCORE_SCREEN

SCORE_C_D_EX    INC     @SP, #4
                RET


SCORE_BUST
                PUSH    @SP, R0
                CALL    READ_SCORE
                LD      CUR_PLYR_SCORE, R0
                SPEAK   SOUND5
                CALL    STATUS_SCREEN
                CALL    DELAY_3_SEC
                CALL    BUSTED_SCREEN
                CALL    SCORE_SCREEN
                POP     R0, @SP
                JR      RETURN_2


DELAY_3_SEC     PUSH    @SP, R9
                LD      R9, #6
DELAY_LOOP      CALL    WAIT_HF_SEC
                DJNZ    R9,DELAY_LOOP
                POP     R9, @SP
                RET


                SKIP
                                                        40
DISPLAY_RESULTS PUSHL   @SP, RR0
                SETSRN  SCREEN1
                SCREEN  CLEAR
                PLINE   3
                PRBIG   "   THE WINNER IS"
                PLINE   3
                DISP    "     PLAYER #"
                LD      R0, PLAYER_NO
                CALL    DISP_INT
                CALL    PRT_BIG
                CALL    DELAY_3_SEC
                CALL    DELAY_3_SEC
                POPL    RR0, @SP
                RET


                SKIP
;               SYSTEM CONSTANTS :

                END
```

```
            TITLE   " MBF  Dartboard Count-Up Game Routine"
*****************************************************************
*                                                               *
*                          C_U                                  *
*                                                               *
*              AUTOMATIC SCORING SYSTEM                         *
*                          for                                  *
*                       DARTBOARDS                              *
*                                                               *
*****************************************************************

            PROG


*         ENTRY POINTS:

              GLB     COUNT_UP

*         EXTERNAL ROUTINES:

              EXT     PLAY_A_ROUND
              EXT     SET_PLAYER_1, SET_NEXT_PLAYER
              EXT     READ_SCORE, ADD_SCORE, SET_SCORE
              EXT     INIT_SCORES, UPDATE_SCORE, UPDATE_CP_SCORE
              EXT     MAKE_A_SOUND, SCORE_SCREEN, STATUS_SCREEN
              EXT     DELAY_3_SEC
              EXT     TERM_FUNCTION, APPEND_STR_, TRIM_STR
              EXT     DISP_INT, PRT_FPN, PRT_LINE, PRT_BIG

              EXT     IOC_
              EXT     BUFFER_
              EXT     SWITCH_
              EXT     SCORE
              EXT     RECT
              EXT     NUMBER_FORMAT_
              EXT     FTOD_
              EXT     FCM_
              EXT     FAD_, FSB_
              EXT     FMP_, FDV_
              EXT     DFLOAT_, FLOAT_

*         EXTERNAL REFERENCES:

              EXT     CBLK_CON, CBLK_PSA, CBLK_PBS
              EXT     BFR1, BFR_P, BFR_SW

              EXT     ROUND_NO, PLAYER_NO, DART_NO
              EXT     SCORING, DARTS

              SKIP
*         EXTERNAL SYMBOLS:
              EXT     CLEAR, HOME, ERASE_EOS, ERASE_EOL

              EXT     CONSOLE_LU
              EXT     PSA_LU, PBS_LU

              EXT     GET_NEXT_BFR
```

```
            EXT     PUT_CHAR_BFR
            EXT     GET_CHAR_BFR
            EXT     INIT_BFR
            EXT     CLEAR_BFR
            EXT     RESET_BFR
            EXT     SET_PTR_BFR
            EXT     MAX_LEN_BFR
            EXT     CUR_LEN_BFR
            EXT     GET_PTR_BFR
            EXT     BS_LEN_BFR
            EXT     BS_PTR_BFR

            EXT     READ_CODE
            EXT     WRITE_CODE
            EXT     STATUS_CODE
            EXT     INIT_CODE
            EXT     RD_CHAR_CODE
            EXT     WR_CHAR_CODE

            EXT     SOUND1, SOUND2, SOUND3, SOUND4, SOUND5
            EXT     SCREEN0, SCREEN1, SCREEN2, SCREEN3, SCREEN4

*       REGISTER DEFINITIONS:

FQ1         EQU     RQ0
FR1         EQU     R2
MANTH_FR1   EQU     R2
MANTL_FR1   EQU     R3
MANT_FR1    EQU     RR2
EXP_FR1     EQU     R4
FR2         EQU     R6
MANTH_FR2   EQU     R6
MANTL_FR2   EQU     R7
MANT_FR2    EQU     RR6
EXP_FR2     EQU     R8
FR3         EQU     R10
MANTH_FR3   EQU     R10
MANTL_FR3   EQU     R11
MANT_FR3    EQU     RR10
EXP_FR3     EQU     R12
SP          EQU     R15

            SKIP
*       MACROS:

SCREEN      MACRO   &FUNCTION
            CALL    TERM_FUNCTION
            WVAL    &FUNCTION
            MEND

SETSRN      MACRO   &SCREEN_NO
            LD      CBLK_CON, #&SCREEN_NO
            LD      CBLK_CON+2, #WRITE_CODE
            MEND

STRING      MACRO   &STRING
            WVAL    LEN&&&&
STR&&&&     ASCII   &STRING
LEN&&&&     EQU     $-STR&&&&
```

```
            EVEN
            MEND

DISP        MACRO   &STRING
            PUSH    @SP, #BFR1
            PUSH    @SP, #STR&&&&
            CALL    APPEND_STR_
            JR      END&&&&
STR&&&&     STRING  &STRING
END&&&&     EQU     $
            MEND

PRINT       MACRO   &STRING
            DISP    &STRING
            CALL    PRT_LINE
            MEND

PRBIG       MACRO   &STRING
            DISP    &STRING
            CALL    PRT_BIG
            MEND

PLINE       MACRO   &LINES
            .IF     &LINES .NE. "" SET_CNT
LOOP_CNT    .SET    1
            .GOTO   LOOP_TOP
SET_CNT     .NOP
LOOP_CNT    .SET    &LINES
LOOP_TOP    .NOP
            CALL    PRT_LINE
LOOP_CNT    .SET    LOOP_CNT-1
            .IF     LOOP_CNT .GT. 0 LOOP_TOP
            MEND

SPEAK       MACRO   &STRING
            PUSH    @SP, #&STRING
            CALL    SPEAK_OUT
            MEND

FLD         MACRO   &FR_DST, &FR_SRC
            LDL     MANT_&FR_DST, MANT_&FR_SRC
            LD      EXP_&FR_DST, EXP_&FR_SRC
            MEND

FEX         MACRO   &FR_DST, &FR_SRC
            EX      MANTH_&FR_DST, MANTH_&FR_SRC
            EX      MANTL_&FR_DST, MANTL_&FR_SRC
            EX      EXP_&FR_DST, EXP_&FR_SRC
            MEND

FLT         MACRO   &INT
            PUSHL   @SP, RR0
            LD      R0, &INT
            CALL    FLOAT_
            POPL    RR0, @SP
```

```
                MEND

PUSHF           MACRO   &FR_SRC
                PUSH    @SP, EXP_&FR_SRC
                PUSHL   @SP, MANT_&FR_SRC
                MEND


POPF            MACRO   &FR_DST
                POPL    MANT_&FR_DST, @SP
                POP     EXP_&FR_DST, @SP
                MEND

BUFFER          MACRO   &BFR, &CODE
                PUSH    @SP, &BFR
                CALL    BUFFER_
                WVAL    &CODE
                MEND

                SKIP
*********************************************************************
*                                                                   *
*   COUNT - UP    - Play the game of Count - Up.                    *
*                                                                   *
*********************************************************************

COUNT_UP        CALR    INITIALIZE
COUNT_UP_1      CALL    PLAY_A_ROUND
                WVAL    NEW_GAME            ; New game.
                WVAL    $+2                 ; No end of game possible during a round.
                CALR    SET_NEXT_ROUND
                WVAL    COUNT_UP_1
                CALR    DISPLAY_RESULTS
                INC     @SP, #2             ; Increment return address
                RET                         ;  for a normal return.

NEW_GAME        EX      R1, @SP             ; Get return address.
                LD      R1, @R1             ; Get the location stored there,
                EX      R1, @SP             ;  set it as the new return address
                RET                         ;  and go there.

INITIALIZE      PUSH    @SP, R0
                LD      SCORING, #SCORE_C_U ; Current scoring routine is for count-up.
                CLR     ROUND_NO            ; Set current round number := 0.
                CLR     R0
                CALL    INIT_SCORES
                CALL    SCORE_SCREEN        ; Build initial score screen.
                POP     R0, @SP
                RET

SCORE_C_U       EQU     $
                CALL    MAKE_A_SOUND        ; Generate a sound according to score.
                CALL    UPDATE_CP_SCORE     ; Add total score for current player.
                CALL    ADD_SCORE           ; Update round score.
                CP      DART_NO, #DARTS
                JR      EQ,END_A_TURN
                JR      GT,A_FALL_DART
                CALL    STATUS_SCREEN
                JR      SCORE_C_U_EX
```

```
END_A_TURN      CALL    STATUS_SCREEN
                CALL    DELAY_3_SEC
A_FALL_DART     CALL    UPDATE_SCORE
                CALL    SCORE_SCREEN

SCORE_C_U_EX    INC     @SP, #4
                RET

SET_NEXT_ROUND  CP      ROUND_NO, #ROUNDS
                JR      NE,NEXT_ROUND
                INC     @SP, #2                 ; Last round: end of game.
                RET

NEXT_ROUND      EX      R1, @SP
                LD      R1, @R1
                EX      R1, @SP
                RET
                SKIP

DISPLAY_RESULTS PUSHL   @SP, RR0
                SETSRN  SCREEN1
                SCREEN  CLEAR
                PLINE   5
                CALR    GET_RESULTS
                CP      R1, #1
                JR      NE,DISPLAY_TIE
                DISP    "    *** THE WINNER IS PLAYER -) "
                JR      DISPLAY_WIN
DISPLAY_TIE     DISP    " *** IT'S A TIE BETWEEN PLAYERS"
DISPLAY_WIN     LD      R1, R0
                CALL    SET_PLAYER_1
DISP_WIN_1      CALL    READ_SCORE
                CP      R1, R0
                JR      NE,DISP_WIN_2
                DISP    " ( "
                LD      R0, PLAYER_NO
                CALL    DISP_INT
                DISP    " )"
DISP_WIN_2      CALL    SET_NEXT_PLAYER
                WVAL    DISP_SCORE              ; Last player.
                JR      DISP_WIN_1

DISP_SCORE      PLINE   3
                DISP    "        WITH A SCORE OF "
                LD      R0, R1                  ; Print score.
                CALL    DISP_INT
                PLINE   2
                CALL    DELAY_3_SEC
                CALL    DELAY_3_SEC
                POPL    RR0, @SP
                RET
GET_RESULTS     PUSHL   @SP, RR2
                LDK     R3, #1                  ; Set player count to 1.
                CALL    SET_PLAYER_1
                CALL    READ_SCORE              ; R0 := score of current player.
                LD      R2, R0                  ; R2 := score.
GET_RES_1       CALL    SET_NEXT_PLAYER
                WVAL    GET_RES_EXIT            ; Exit on last player.
                CALL    READ_SCORE              ; R0 := score of current player.
```

```
            CALR    COMPARE_SCORES
            JR      GET_RES_1

GET_RES_EXIT LD     R0, R2                  ; R0 := highest score.
            LD      R1, R3                  ; RL1 := no. of winners.
            POPL    RR2, @SP
            RET


COMPARE_SCORES CP   R2, R0
            JR      GT,CP_S_EXIT
            JR      LT,CP_S_1
            INC     R3                      ; Inc no. of ties.
            JR      CP_S_EXIT

CP_S_1      LDK     R3, #1                  ; Set one winner.
            LD      R2, R0                  ; Set new high score.
CP_S_EXIT   RET


            SKIP
*           SYSTEM CONSTANTS :

ROUNDS      EQU     8

            END
           TITLE   " Z8000  Equipment Table"
*****************************************************************
*                                                               *
*                  <<<  EQT  >>>                                *
*                                                               *
*           INPUT / OUTPUT EQUIPMENT TABLE                      *
*                    for the                                    *
*                    Z82/SBC                                    *
*                                                               *
*****************************************************************

            PROG

*       ENTRY POINTS:

            GLB     EQT


*       GLOBAL REFERENCES:

            GLB     EQT_LEN

            GLB     CONSOLE_LU
            GLB     PSA_LU
            GLB     PBS_LU
            GLB     SCREEN0_LU
            GLB     SCREEN1_LU
            GLB     SCREEN2_LU
            GLB     SCREEN3_LU
            GLB     SCREEN4_LU
```

```
            GLB     SPEAKER1_LU
            GLB     SPEAKER2_LU


            GLB     CONSOLE_SC
            GLB     PSA_SC
            GLB     PBS_SC
            GLB     MONITOR_SC
            GLB     SPEAKER_SC

            GLB     CONSOLE_SU
            GLB     PSA_SU
            GLB     PBS_SU
            GLB     SCREEN0_SU
            GLB     SCREEN1_SU
            GLB     SCREEN2_SU
            GLB     SCREEN3_SU
            GLB     SCREEN4_SU
            GLB     SPEAKER1_SU
            GLB     SPEAKER2_SU

            GLB     SCREEN0, SCREEN1, SCREEN2, SCREEN3, SCREEN4
*           SKIP

*       EXTERNAL REFERENCES:

            EXT     DVR_TERMINAL, DVR_PSA, DVR_SWITCHES, DVR_SPEAKER
            EXT     DVR_VDP9918, DVR_CIO_1, DVR_CIO_2
            SKIP
*           SYSTEM CONSTANTS :

CONSOLE_LU      EQU     1
PSA_LU          EQU     2                       ; Photo Sensor Array.
PBS_LU          EQU     3                       ; Push Button Switches.
SCREEN0_LU      EQU     4                       ; Video Screen #1.
SCREEN1_LU      EQU     5                       ; Video Screen #1.
SCREEN2_LU      EQU     6                       ; Video Screen #2.
SCREEN3_LU      EQU     7                       ; Video Screen #3.
SCREEN4_LU      EQU     8                       ; Video Screen #4.
SPEAKER1_LU     EQU     9                       ; Speaker #1.
SPEAKER2_LU     EQU     10                      ; Speaker #2.

CONSOLE_SC      EQU     0300H
PSA_SC          EQU     0000H
PBS_SC          EQU     0100H
MONITOR_SC      EQU     0300H
SPEAKER_SC      EQU     0000H

CONSOLE_SU      EQU     0
PSA_SU          EQU     0
PBS_SU          EQU     0
SCREEN0_SU      EQU     0
SCREEN1_SU      EQU     1
SCREEN2_SU      EQU     2
SCREEN3_SU      EQU     3
SCREEN4_SU      EQU     4
```

```
SPEAKER1_SU     EQU     1
SPEAKER2_SU     EQU     2

SCREEN0         EQU     SCREEN0_LU
SCREEN1         EQU     SCREEN1_LU
SCREEN2         EQU     SCREEN2_LU
SCREEN3         EQU     SCREEN3_LU
SCREEN4         EQU     SCREEN4_LU

                SKIP
*************************************************************
*                                                           *
*            EQT   -   EQUIPMENT TABLE                      *
*                       for the                             *
*                       Z82/SBC                             *
*                                                           *
*                                                           *
*              EQT entry :                                  *
*                                                           *
*                  + 0  = device LU number                  *
*                  + 2  = select_code                       *
*                  + 4  = device SU number                  *
*                  + 6  = device driver                     *
*                  + 8  = interface driver                  *
*                                                           *
*************************************************************

EQT             WVAL    10                      ; No. entries in EQT.
EQT_1           WVAL    CONSOLE_LU              ; First entry.
                WVAL    CONSOLE_SC
                WVAL    CONSOLE_SU
                WVAL    DVR_TERMINAL
                WVAL    DVR_VDP9918
EQT_LEN         EQU     $-EQT_1                 ; Length of an EQT entry.
EQT_2           WVAL    PSA_LU                  ; Second entry.
                WVAL    PSA_SC
                WVAL    PSA_SU
                WVAL    DVR_PSA
                WVAL    DVR_CID_1

EQT_3           WVAL    PBS_LU                  ; Third entry.
                WVAL    PBS_SC
                WVAL    PBS_SU
                WVAL    DVR_SWITCHES
                WVAL    DVR_CID_2

EQT_4           WVAL    SCREEN0_LU              ; Fourth entry.
                WVAL    MONITOR_SC
                WVAL    SCREEN0_SU
                WVAL    DVR_TERMINAL
                WVAL    DVR_VDP9918

EQT_5           WVAL    SCREEN1_LU              ; Fifth entry.
                WVAL    MONITOR_SC
                WVAL    SCREEN1_SU
                WVAL    DVR_TERMINAL
                WVAL    DVR_VDP9918
```

```
EQT_6          WVAL    SCREEN2_LU          ; Sixth entry.
               WVAL    MONITOR_SC
               WVAL    SCREEN2_SU
               WVAL    DVR_TERMINAL
               WVAL    DVR_VDP9918

EQT_7          WVAL    SCREEN3_LU          ; Seventh entry.
               WVAL    MONITOR_SC
               WVAL    SCREEN3_SU
               WVAL    DVR_TERMINAL
               WVAL    DVR_VDP9918

EQT_8          WVAL    SCREEN4_LU          ; Eighth entry.
               WVAL    MONITOR_SC
               WVAL    SCREEN4_SU
               WVAL    DVR_TERMINAL
               WVAL    DVR_VDP9918

EQT_9          WVAL    SPEAKER1_LU         ; Ninth entry.
               WVAL    SPEAKER_SC
               WVAL    SPEAKER1_SU
               WVAL    DVR_SPEAKER
               WVAL    DVR_CIO_1

EQT_10         WVAL    SPEAKER2_LU         ; Tenth entry.
               WVAL    SPEAKER_SC
               WVAL    SPEAKER2_SU
               WVAL    DVR_SPEAKER
               WVAL    DVR_CIO_1

LAST           EQU     $
               END
              TITLE   " MBF  Dartboard Games Routines"
*****************************************************************
*                                                               *
*                          GAMES                                *
*                                                               *
*              AUTOMATIC SCORING SYSTEM                         *
*                          for                                  *
*                       DARTBOARDS                              *
*                                                               *
*****************************************************************
              PROG
*         ENTRY POINTS:

              GLB     PLAY_A_ROUND
              GLB     SET_PLAYER_1, SET_NEXT_PLAYER

              GLB     DARTS

*         EXTERNAL ROUTINES:

              EXT     SCAN
              EXT     READ_SWITCH
              EXT     TERM_FUNCTION, APPEND_STR_, TRIM_STR
```

```
        EXT     COPY_BFR_
        EXT     PRT_INT, PRT_FPN, PRT_LINE, SPEAK_OUT, PRT_BIG
        EXT     GET_N_SHADOWS, CHANNEL_TWO
        EXT     SCORE_SCREEN, STATUS_SCREEN, FLASHING
        EXT     READ_SCORE, SET_SCORE, ADD_SCORE, DELAY_3_SEC
        EXT     INIT_SCORES, UPDATE_SCORE

        EXT     IOC_
        EXT     BUFFER_
        EXT     SWITCH_
        EXT     SCORE
        EXT     RECT
        EXT     NUMBER_FORMAT_
        EXT     FTOD_
        EXT     FCM_
        EXT     FAD_, FSB_
        EXT     FMP_, FDV_
        EXT     DFLOAT_, FLOAT_
```

---

```
*       EXTERNAL REFERENCES:

        EXT     N_PLAYERS, ROUND_SCORE, CUR_PLYR_SCORE
        EXT     CBLK_CON, CBLK_PSA, CBLK_PBS, CBLK_SPK
        EXT     BFR1, BFR_P, BFR_SW, BFR_SPK
        EXT     LAST_SCAN, OLD_SCAN
        EXT     ROUND_NO, PLAYER_NO, DART_NO, DART_MOVEMENT
        EXT     SCORING, SCORES
        EXT     SOUND1, SOUND2, SOUND3, SOUND4, SOUND5
        EXT     SCREEN0, SCREEN1, SCREEN2, SCREEN3, SCREEN4

        SKIP
*       EXTERNAL SYMBOLS:

        EXT     CLEAR, HOME, ERASE_EOS, ERASE_EOL
        EXT     COIN_SW, NXT_PLYR_SW

        EXT     CONSOLE_LU
        EXT     PSA_LU, PBS_LU

        EXT     GET_NEXT_BFR
        EXT     PUT_CHAR_BFR
        EXT     GET_CHAR_BFR
        EXT     INIT_BFR
        EXT     CLEAR_BFR
        EXT     RESET_BFR
        EXT     SET_PTR_BFR
        EXT     MAX_LEN_BFR
        EXT     CUR_LEN_BFR
        EXT     GET_PTR_BFR
        EXT     BS_LEN_BFR
        EXT     BS_PTR_BFR

        EXT     READ_CODE
        EXT     WRITE_CODE
        EXT     STATUS_CODE
        EXT     INIT_CODE
        EXT     RD_CHAR_CODE
        EXT     WR_CHAR_CODE
```

```
*          REGISTER DEFINITIONS:

FQ1          EQU    RQ0
FR1          EQU    R2
MANTH_FR1    EQU    R2
MANTL_FR1    EQU    R3
MANT_FR1     EQU    RR2
EXP_FR1      EQU    R4
FR2          EQU    R6
MANTH_FR2    EQU    R6
MANTL_FR2    EQU    R7
MANT_FR2     EQU    RR6
EXP_FR2      EQU    R8
FR3          EQU    R10
MANTH_FR3    EQU    R10
MANTL_FR3    EQU    R11
MANT_FR3     EQU    RR10
EXP_FR3      EQU    R12
SP           EQU    R15
             SKIP
*          MACROS:

SCREEN       MACRO  &FUNCTION
             CALL   TERM_FUNCTION
             WVAL   &FUNCTION
             MEND

SETSRN       MACRO  &SCREEN_NO
             LD     CBLK_CON, #&SCREEN_NO
             LD     CBLK_CON+2, #WRITE_CODE
             MEND
STRING       MACRO  &STRING
             WVAL   LEN&&&&
STR&&&&      ASCII  &STRING
LEN&&&&      EQU    $-STR&&&&
             EVEN
             MEND

DISP         MACRO  &STRING
             PUSH   @SP, #BFR1
             PUSH   @SP, #STR&&&&
             CALL   APPEND_STR_
             JR     END&&&&
STR&&&&      STRING &STRING
END&&&&      EQU    $
             MEND

PRINT        MACRO  &STRING
             DISP   &STRING
             CALL   PRT_LINE
             MEND

PRBIG        MACRO  &STRING
             DISP   &STRING
             CALL   PRT_BIG
             MEND
```

```
PLINE       MACRO   &LINES
            .IF     &LINES .NE. "" SET_CNT
LOOP_CNT    .SET    1
            .GOTO   LOOP_TOP
SET_CNT     .NOP
LOOP_CNT    .SET    &LINES
LOOP_TOP    .NOP
            CALL    PRT_LINE
LOOP_CNT    .SET    LOOP_CNT-1
            .IF     LOOP_CNT .GT. 0 LOOP_TOP
            MEND
-----------------------------------------------------------
SPEAK       MACRO   &STRING
            PUSH    @SP, #&STRING
            CALL    SPEAK_OUT
            MEND

            SKIP

FLD         MACRO   &FR_DST, &FR_SRC
            LDL     MANT_&FR_DST, MANT_&FR_SRC
            LD      EXP_&FR_DST, EXP_&FR_SRC
            MEND
-----------------------------------------------------------
FEX         MACRO   &FR_DST, &FR_SRC
            EX      MANTH_&FR_DST, MANTH_&FR_SRC
            EX      MANTL_&FR_DST, MANTL_&FR_SRC
            EX      EXP_&FR_DST, EXP_&FR_SRC
            MEND
FLT         MACRO   &INT
            PUSHL   @SP, RR0
            LD      R0, &INT
            CALL    FLOAT_
            POPL    RR0, @SP
            MEND


PUSHF       MACRO   &FR_SRC
            PUSH    @SP, EXP_&FR_SRC
            PUSHL   @SP, MANT_&FR_SRC
            MEND

POPF        MACRO   &FR_DST
            POPL    MANT_&FR_DST, @SP
            POP     EXP_&FR_DST, @SP
            MEND


BUFFER      MACRO   &BFR, &CODE
            PUSH    @SP, &BFR
            CALL    BUFFER_
            WVAL    &CODE
            MEND

            SKIP
*       MAIN ROUTINES:
```

```
*****************************************************************
*                                                               *
*   PLAY_A_ROUND  - Play one round.                             *
*                                                               *
*        Calling sequence:                                      *
*                                                               *
*             LD      SCORING, #scoring routine                 *
*             .       .                                         *
*             CALL    PLAY_A_ROUND                              *
*             WVAL    NEW_GAME                                  *
*             WVAL    END_OF_GAME                               *
*             -)      normal return                             *
*                                                               *
*                                                               *
*****************************************************************

PLAY_A_ROUND    CALR    INIT_ROUND
PLAY_RND_1      CP      ROUND_NO, #3
                JR      NE,PLAY_RND_2
                CALL    DRINK_SCREEN
PLAY_RND_2      CALR    PLAY_A_TURN
                WVAL    RETURN_1                ; New game.
                WVAL    RETURN_2                ; End of game.
                CALL    SET_NEXT_PLAYER
                WVAL    PLAY_RND_EXIT
                JR      PLAY_RND_1

PLAY_RND_EXIT   INC     @SP, #4                 ; Skip over two returns
                RET                             ;  for a normal return.

RETURN_3        INC     @SP, #2                 ; Point to RET+4.
RETURN_2        INC     @SP, #2                 ; Point to RET+2.
RETURN_1        EX      R1, @SP                 ; Return to address @(@SP).
                LD      R1, @R1
                EX      R1, @SP
                RET

INIT_ROUND      INC     ROUND_NO
                CALL    SET_PLAYER_1
                RET

DRINK_SCREEN    SETSRN  SCREEN1
                SCREEN  CLEAR
                PLINE   2
                PRBIG   "** LOSER OF ROUND 3"
                PLINE   2
                PRBIG   "  BUYS DRINK FOR"
                PLINE   2
                PRBIG   "   OTHER PLAYERS !!"
                CALL    DELAY_3_SEC
                RET

                SKIP
*****************************************************************
*                                                               *
*   PLAY_A_TURN   - Play one player's turn.                     *
*                                                               *
*        Calling sequence:                                      *
*                                                               *
```

```
*
*           LD      SCORING, #scoring routine                    *
*           .       .                                            *
*           CALL    PLAY_A_TURN                                  *
*           WVAL    NEW_GAME                                     *
*           WVAL    END_OF_GAME                                  *
*           ->      normal return                                *
*                                                                *
*                                                                *
******************************************************************

PLAY_A_TURN     PUSHL   @SP, RR0
                CALR    INIT_TURN
PLAY_TRN_1      CALR    WAIT_FOR_DART
                WVAL    PLAY_TRN_RET1           ; New game - coin switch.
                WVAL    PLAY_TRN_EXIT           ; Next player.
                CALR    UPDATE_DARTS
                TEST    DART_MOVEMENT           ; Dart went in or out ?
                JR      MI,PLAY_TRN_1           ; Fell out, don't update the score.
                CALR    SCORE_GAME
                WVAL    PLAY_TRN_RET2           ; End of game.
                WVAL    BUSTED_TURN             ; Bust; next player.
                JR      PLAY_TRN_1              ; Next dart.

BUSTED_TURN     LD      DART_NO, #DARTS
                JR      PLAY_TRN_1

PLAY_TRN_RET1   POPL    RR0, @SP
                JP      RETURN_1

PLAY_TRN_RET2   POPL    RR0, @SP
                JP      RETURN_2

PLAY_TRN_EXIT   POPL    RR0, @SP
                INC     @SP, #4                 ; Skip New Game & End of Game returns
                RET                             ;  for a normal return

INIT_TURN       PUSH    @SP, R0
                CLR     ROUND_SCORE
                CALL    READ_SCORE
                LD      CUR_PLYR_SCORE, R0
INIT_TURN_1     CALR    WAIT_DARTS_OUT          ; *** CHECK FOR MONEY HERE ***
                JR      Z,NEW_TURN              ; Wait until the darts are out.
                CALL    FLASHING
                JR      INIT_TURN_1
NEW_TURN        PUSH    @SP, #LAST_SCAN
                PUSH    @SP, #BFR_P
                CALL    COPY_BFR_
                CALL    STATUS_SCREEN
                CLR     DART_NO
                POP     R0, @SP
                RET
UPDATE_DARTS
                TEST    DART_MOVEMENT
                RET     MI                      ; No increment if a dart fell out.
                INC     DART_NO
                RET
                SKIP
```

```
WAIT_FOR_DART   CALL    READ_SWITCH
                WVAL    WAIT_FOR_DART_1
                WVAL    COIN_SW, RETURN_1        ; New game because of coin switch.
                WVAL    NXT_PLYR_SW, WAIT_DART_EXIT
                WVAL    -1

WAIT_FOR_DART_1
                CP      DART_NO, #DARTS
                JR      LT,CHECK_NEW
                CALL    FLASHING
                JR      WAIT_FOR_DART

CHECK_NEW       CALR    CHECK_NEW_DART
                WVAL    WAIT_FOR_DART            ; No change in dartboard status: continue waiting.
                INC     @SP, #4                  ; Skip over New Game & Next Player returns.
                RET                              ; Normal return.

WAIT_DART_EXIT  SPEAK   SOUND2                   ; Make a sound for NXT_PYR switch.
                CALL    UPDATE_SCORE
                CALL    SCORE_SCREEN             ; Build score screen.
                JP      RETURN_2                 ; Next player.

WAIT_DARTS_OUT  PUSHL   @SP, RR0
                LDK     R1, #2
WAIT_D_OUT_2    CALL    SCAN
                PUSH    @SP, #BFR_P
                CALL    GET_N_SHADOWS
                TEST    R0
                JR      NZ,WAIT_D_NOT_OUT
                DJNZ    R1,WAIT_D_OUT_2
WAIT_D_NOT_OUT  POPL    RR0, @SP
                RET                      ; Z/NZ = darts/no darts.

CHECK_NEW_DART
                CLR     DART_MOVEMENT
                CALL    SCAN
                CALR    CMP_SHADOWS
                WVAL    CHK_N_DART_ERR           ; Error in the number of shadows.
                WVAL    RETURN_1                 ; No change.
                WVAL    ONE_LESS_SHADOW
                CP      DART_NO, #DARTS          ; At most three darts.
                JR      GE,CHECK_NEW_DART
                INC     DART_MOVEMENT            ; Dart went in.
                CALL    SCORE                    ; R0 & R1 contain the shadow information.
CHK_N_DART_EXIT INC     @SP, #2                  ; Skip 'No Change' return.
                RET

ONE_LESS_SHADOW
                DEC     DART_MOVEMENT            ; Dart fell out.
                CALL    SCORE                    ; R0 & R1 contain the shadow information.
                NEG     R0                       ; Negative score for missing dart.
                JR      CHK_N_DART_EXIT

CHK_N_DART_ERR  NOP
                JR      CHECK_NEW_DART           ; Loop on error.

                SKIP
```

```
*****************************************************************
*                                                               *
*   CMP_SHADOWS   - Compare the number of shadows in successive *
*                   scans to determine any changes.             *
*                                                               *
*        Calling sequence:                                      *
*                                                               *
*             CALL    PLAY_A_TURN                               *
*             WVAL    ERROR                  ; Too many shadows. *
*             WVAL    NO CHANGE                                 *
*             WVAL    ONE LESS SHADOW                           *
*             -)      ONE MORE SHADOW        ; Normal return    *
*                                                               *
*                                                               *
*****************************************************************


CMP_SHADOWS     CALR    CHK_N_SHADOWS
                WVAL    RETURN_2               ; Number of shadows is the same.
                PUSH    @SP, #OLD_SCAN         ; Save original scan to
                PUSH    @SP, #LAST_SCAN        ;  wait until the dart
                CALL    COPY_BFR_              ;  settles down.
CMP_SHAD_1      CALR    SCAN_                  ; Check the dart.
                CALR    CHK_N_SHADOWS          ; Has it settled ?
                WVAL    CMP_SHAD_2             ; Yes.
                JR      CMP_SHAD_1             ; No, keep checking.
CMP_SHAD_2      PUSH    @SP, #LAST_SCAN        ; Restore original scan
                PUSH    @SP, #OLD_SCAN         ;  to see if this was
                CALL    COPY_BFR_              ;  just noise.
; No need:      CALL    SCAN
                CALR    CHK_N_SHADOWS
                WVAL    RETURN_2               ; Number of shadows is the same.
                JP      OV, RETURN_1           ; Number of shadows difference is greater than 1.
                CALL    FIND_NEW_SHADOW
                JP      MI, RETURN_3           ; Missing shadow.
                INC     @SP, #6                ; Skip 3 returns for new shadow.
                RET

CHK_N_SHADOWS   PUSHL   @SP, RR0                ; Checks for differences between
                PUSHL   @SP, RR2                ;  BFR_P & LAST_SCAN buffers.
                PUSH    @SP, #BFR_P
                CALL    GET_N_SHADOWS
                LD      R3, R0
                PUSH    @SP, #LAST_SCAN
                CALL    GET_N_SHADOWS
                CP      R3, R0
                JR      NE,CHK_N_S_1           ; A change in the number of shadows.
                LDK     R0, #1                 ; No change in the number, check length.
                BUFFER #BFR_P, SET_PTR_BFR
                BUFFER #LAST_SCAN, SET_PTR_BFR
                TESTB   RH3                    ; Check channel 1.
                JR      Z,CHK_N_S_02
CHK_N_S_00
                BUFFER #BFR_P, GET_NEXT_BFR    ; RH2, RL2 := block.
                LDB     RH2, RL0
                BUFFER #LAST_SCAN, GET_NEXT_BFR
                LDB     RL2, RL0
```

```
                BUFFER #BFR_P, GET_NEXT_BFR     ; RH1, RL1 := sensor.
                LDB     RH1, RL0
                BUFFER #LAST_SCAN, GET_NEXT_BFR
                LDB     RL1, RL0
                BUFFER #BFR_P, GET_NEXT_BFR     ; RH0, RL0 := length.
                LDB     RH0, RL0
                BUFFER #LAST_SCAN, GET_NEXT_BFR
                CPB     RH2, RL2                ; If the block is different
                JR      NE,CHK_N_S_DIF          ;  then difference. (Formerly ERROR.)
                SUBB    RL1, RH1                ; Compare start points.
                JR      PL,CHK_N_S_01S
                NEGB    RL1
CHK_N_S_01S     CPB     RL1, #1                 ; +/- 1 sensor tolerance.
                JR      GT,CHK_N_S_DIF
                SUBB    RL0, RH0                ; Compare lengths.
                JR      PL,CHK_N_S_01L
                NEGB    RL0
CHK_N_S_01L     CPB     RL0, #1                 ; +/- 1 sensor tolerance.
                JR      GT,CHK_N_S_DIF
                DBJNZ   RH3,CHK_N_S_00
CHK_N_S_02      EXB     RH3, RL3                ; RH3 := ch.2 shadow count, RL3 := 0.
                BUFFER #BFR_P, GET_NEXT_BFR     ; Skip shadow counts for ch.2.
                BUFFER #LAST_SCAN, GET_NEXT_BFR
                TESTB   RH3
                JR      NZ,CHK_N_S_00
                POPL    RR2, @SP                ; No change.
                POPL    RR0, @SP
                JP      RETURN_1

CHK_N_S_1     ; SUBB    RH0, RH3
              ; JR      PL,CHK_N_S_2
              ; NEGB    RH0
CHK_N_S_2     ; SUBB    RL0, RL3
              ; JR      PL,CHK_N_S_3
              ; NEGB    RL0
CHK_N_S_3     ; CPB     RH0, #1                 ; ( With the new hardware,
              ; JR      GT,CHK_N_S_ERR          ;    there may be more than
              ; CPB     RL0, #1                 ;    one shadow difference. )
              ; JR      GT,CHK_N_S_ERR
CHK_N_S_DIF     RESFLG  V
                JR      CHK_N_S_EXIT

CHK_N_S_ERR     SETFLG  V
CHK_N_S_EXIT    POPL    RR2, @SP
                POPL    RR0, @SP
                INC     @SP, #2                 ; Skip  'equal' return.
                RET

                SKIP
FIND_NEW_SHADOW PUSHL   @SP, RR10
                PUSH    @SP, R9
                CLR     R9                      ; Clear missing shadow flag.
                LD      R10, #BFR_P
                LD      R11, #LAST_SCAN
                BUFFER  R10, RESET_BFR
                BUFFER  R11, RESET_BFR
```

```
            CALL    FIND_NEW_CHANL
            LD      R1, R0
            PUSH    @SP, R10
            CALL    CHANNEL_TWO
            PUSH    @SP, R11
            CALL    CHANNEL_TWO
            CALL    FIND_NEW_CHANL
            EX      R0, R1                  ; R0 := ch.1, R1 := ch.2.
            TEST    R9                      ; Check for missing shadow -
            POP     R9, @SP                 ;  the sign flag is set MINUS.
            POPL    RR10, @SP
            RET


FIND_NEW_CHANL
            PUSHL   @SP, RR10               ; Search a channel for a descripency between
            PUSH    @SP, R8                 ;  old & new readings.
            PUSHL   @SP, RR6
            PUSHL   @SP, RR4
            PUSHL   @SP, RR2
            PUSH    @SP, R1
            RES     R9, #0                  ; ( Clear the swap flag.)
                                            ; For convience, R10 will contain
            BUFFER  R10, GET_NEXT_BFR       ;  the buffer with the most shadows.
            LDB     RH7, RL0                ; If the number of shadows are equal, the search is
            BUFFER  R11, GET_NEXT_BFR       ;  for the greatest length.
            LDB     RL7, RL0
            CPB     RH7, RL7                ; If the lengths are the same, the last shadow in
            JP      EQ,FIND_N_LEN           ;  the channel is used.
            JR      GT,FIND_N_C_0
            EXB     RH7, RL7                ; RL7 := least number of shadows.
            EX      R10, R11                ; R10 := most number of shadows.
            SET     R9, #0                  ; Set the swap flag.
FIND_N_C_0  CPB     RH7, #2                 ; Check for two shadows merged into
            JR      NE,FIND_N_C_1           ;  a single long shadow.
            CPB     RL7, #1
            JR      NE,FIND_N_C_1
*
*       The following section handles the condition whereby one
*       shadow has overlapped two previous shadows, making a single
*       long shadow.  This can only happen within the same block.
*
            BUFFER  R10, GET_NEXT_BFR       ; First shadow: Get block.
            LDB     RH2, RL0                ; Form shadow in RR2.
            BUFFER  R10, GET_NEXT_BFR       ; Get sensor.
            LDB     RL2, RL0
            BUFFER  R10, GET_NEXT_BFR       ; Get length.
            LDB     RL3, RL0
            BUFFER  R10, GET_NEXT_BFR       ; Second shadow: Get block.
            LDB     RH4, RL0                ; Form shadow in RR4.
            BUFFER  R10, GET_NEXT_BFR       ; Get sensor.
            LDB     RL4, RL0
            BUFFER  R10, GET_NEXT_BFR       ; Get length.
            LDB     RL5, RL0
            BUFFER  R10, GET_PTR_BFR        ; Reset buffer pointer.
            SUB     R0, #2*3                ; Backspace 2 shadows.
            BUFFER  R10, SET_PTR_BFR
```

```
            CPB     RH2, RH4            ; The shadows must be
            JR      NE,FIND_N_C_1       ;  in the same block.
            LDB     RL3, RL4            ; Find distance from start of first
            SUBB    RL3, RL2            ;  shadow to start of second shadow.
            ADDB    RL3, RL5            ; RL3 := length of both shadows combined.
            BUFFER  R11, GET_NEXT_BFR   ; Get block.
            LDB     RH4, RL0            ; RR4 := single shadow on new scan.
            BUFFER  R11, GET_NEXT_BFR   ; Get sensor.
            LDB     RL4, RL0
            BUFFER  R11, GET_NEXT_BFR   ; Get length.
            LDB     RL5, RL0
            BUFFER  R11, GET_PTR_BFR    ; Reset buffer pointer.
            SUB     R0, #1*3            ; Backspace 1 shadow.
            BUFFER  R11, SET_PTR_BFR
            LDL     RR0, RR4            ; RR0 := single shadow.
            CPB     RH0, RH2            ; The shadows must be
            JR      NE,FIND_N_C_1       ;  in the same block.
            SUBB    RL0, RL2            ; RL0 := ABS (delta start).
            JR      PL,FIND_N_C_00
            NEGB    RL0
FIND_N_C_00 SUBB    RL1, RL3            ; RL1 := ABS (delta length).
            JR      PL,FIND_N_C_01
            NEGB    RL1
FIND_N_C_01 CPB     RL0, #1             ; +/- 1 sensor tolerence.
            JR      GT,FIND_N_C_1
            CPB     RL1, #1             ; +/- 1 sensor tolerence.
            JR      GT,FIND_N_C_1
            LDL     RR0, RR4            ; R0 := long shadow.
            BIT     R9, #0              ; Check swap flag.
            JR      NZ,FIND_N_C_EXIT    ; If swap, then new shadow
            SET     R9, #15             ;  else flag a missing shadow.
            JR      FIND_N_C_EXIT

FIND_N_C_1  BIT     R9, #0              ; Check swap flag.
            JR      Z,FIND_N_C_10
            SET     R9, #15             ; Flag a missing shadow.
FIND_N_C_10 PUSH    @SP, #OLD_SCAN
            PUSH    @SP, R10
            CALL    COPY_BFR            ; Temp buffer := most shadows.
            BUFFER  R10, GET_PTR_BFR
            LD      R10, #OLD_SCAN      ; Switch over to temp buffer.
            LD      R8, R0              ; R8 := R10 pointer origin.
            LD      R6, R7              ; RH6 := most no., RL6 := least no.

FIND_N_C_L1
            LD      R0, R8
            BUFFER  R10, SET_PTR_BFR
            LDB     RH7, RH6            ; Set counter.

            TESTB   RL7                 ; Last 'old' shadow ?
            JR      Z,FIND_N_C_4        ; Yes, exit loop.
            DECB    RL7                 ; No, update counter.

            BUFFER  R11, GET_NEXT_BFR
            LDB     RH2, RL0            ; R2 := start OLD[i].
            BUFFER  R11, GET_NEXT_BFR
            LDB     RL2, RL0
            BUFFER  R11, GET_NEXT_BFR   ; RL3 := length OLD[i].
            LDB     RL3, RL0
```

```
FIND_N_C_L2
            TESTB   RH7                     ; Last 'new' shadow ?
            JR      Z,FIND_N_C_L1           ; Yes, loop.
            DECB    RH7                     ; No, update counter.

            BUFFER  R10, GET_NEXT_BFR
            LDB     RH4, RL0                ; R4 := start new.
            BUFFER  R10, GET_NEXT_BFR
            LDB     RL4, RL0
            BUFFER  R10, GET_CHAR_BFR
            LDB     RL5, RL0                ; RL5 := length new.
            BUFFER  R10, BS_PTR_BFR
            BUFFER  R10, BS_PTR_BFR
            LDB     RL0, RL4                ; RL0 := start NEW[j].
            SUBB    RL0, RL2
            JR      PL,FIND_N_C_2           ; R0 := ABS (NEW[j] - OLD[i]).
            NEGB    RL0
FIND_N_C_2  CPB     RH2, RH4                ; Check if the block is the same.
            JR      NE,FIND_N_C_3           ; No, not the same shadow.
            CPB     RL0, #1                 ; +/- 1 sensor tolerence.
            JR      GT,FIND_N_C_3           ; The difference is too great: NOT the same shadow.
            CLR     R4                      ; It IS the same shadow:
            CLRB    RL5                     ;  set it to 0.
FIND_N_C_3  LDB     RL0, RH4
            BUFFER  R10, PUT_CHAR_BFR
            LDB     RL0, RL4
            BUFFER  R10, PUT_CHAR_BFR
            LDB     RL0, RL5
            BUFFER  R10, PUT_CHAR_BFR
            JR      FIND_N_C_L2

FIND_N_C_4
            BUFFER  R10, GET_NEXT_BFR
            LDB     RH0, RL0                ; R0 := start new.
            BUFFER  R10, GET_NEXT_BFR
            LD      R1, R0
            BUFFER  R10, GET_NEXT_BFR
            EX      R1, R0
            TESTL   RR0
            JR      NZ,FIND_N_C_EXIT
            DBJNZ   RH7,FIND_N_C_4

FIND_N_C_EXIT
            LDB     RH1, RH0                ; Form block number
            SLLB    RH1, #5                 ;  in RH1.
            AND     R0, #3FH                ; Mask off sensor nbr.
            SLL     R0, #7                  ; Position sensor in R0.
            ORB     RH0, RH1                ; Merge block into R0.
            AND     R1, #3FH                ; Mask off length.
            OR      R0, R1                  ; Merge length into R0.

            POP     R1, @SP
            POPL    RR2, @SP
            POPL    RR4, @SP
            POPL    RR6, @SP
            POP     R8, @SP
            POPL    RR10, @SP
            RET
```

```
FIND_N_LEN      CLR     R2                      ; Init RR2 = 0.
                CLR     R3
                CLR     R4                      ; Init RR4 = 0.
                CLR     R5
FIND_N_L_1      TESTB   RL7                     ; RL7 = no. of shadows
                JR      Z,FIND_N_L_EXIT
                BUFFER  R11, GET_NEXT_BFR       ; RR2 := bfr @R11.
                LDB     RH2, RL0
                BUFFER  R11, GET_NEXT_BFR
                LDB     RL2, RL0
                BUFFER  R11, GET_NEXT_BFR
                LDB     RL3, RL0
                BUFFER  R10, GET_NEXT_BFR       ; RR0 := bfr @R10.
                LDB     RH0, RL0
                BUFFER  R10, GET_NEXT_BFR
                LDB     RL1, RL0
                BUFFER  R10, GET_NEXT_BFR
                EXB     RL1, RL0
                RES     R9, #0                  ; Reset swap flag.
                CPB     RL1, RL3                ; Determine the longest shadow.
                JR      GE,FIND_N_L_2
                LDL     RR0, RR2                ; RR0 := longest of 2 shadows.
                SET     R9, #0                  ; Set swap flag.
FIND_N_L_2      CPB     RL1, RL5                ; Determine the overall
                JR      LT,FIND_N_L_3           ;  longest shadow.
                LDL     RR4, RR0                ; RR4 := longest shadow change.
                BIT     R9, #0                  ; Check swap flag for this shadow.
                JR      Z,FIND_N_L_3
                SET     R9, #15                 ; Flag a missing shadow.
FIND_N_L_3      DECB    RL7
                JR      FIND_N_L_1

FIND_N_L_EXIT   LDL     RR0, RR4                ; RR0 := longest shadow change.
                JR      FIND_N_C_EXIT

                SKIP
SCAN_           PUSH    @SP, #LAST_SCAN
                PUSH    @SP, #BFR_P
                CALL    COPY_BFR_
                CALL    SCAN_
                RET

SCORE_GAME      PUSH    @SP, #SCORE_GAME_1      ; Return address for simulated CALL
                PUSH    @SP, SCORING            ;  to scoring routine.
                RET                             ; This simulates the call.

SCORE_GAME_1    WVAL    RETURN_1                ; Coin switch - new game.
                WVAL    RETURN_2                ; Bust return.
                INC     @SP, #4
                RET

SET_PLAYER_1    LD      PLAYER_NO, #1
                RET

SET_NEXT_PLAYER PUSH    @SP, R1
                LD      R1, PLAYER_NO
                CP      R1, N_PLAYERS
                POP     R1, @SP
```

```
            JR      EQ,SET_PLAYER_LAST
            INC     PLAYER_NO
            INC     @SP, #2                 ; Skip Last Player return.
            RET

SET_PLAYER_LAST CLR     PLAYER_NO
            JP      RETURN_1
*           SYSTEM CONSTANTS :

DARTS       EQU     3

            END

            TITLE   " Z8000  Input/Output Routines"
*****************************************************************
*                                                               *
*                  <<<  IOC  >>>                                *
*                                                               *
*            INPUT / OUTPUT ROUTINES LIBRARY                    *
*                     for the                                   *
*                      Z8002                                    *
*                                                               *
*****************************************************************

            PROG

            INCLUDE IO_COM

            SKIP
*       ENTRY POINTS:

            GLB     IOC_

*       GLOBAL REFERENCES

            GLB     READ_CODE
            GLB     WRITE_CODE
            GLB     STATUS_CODE
            GLB     INIT_CODE
            GLB     RD_CHAR_CODE
            GLB     WR_CHAR_CODE
            GLB     CONTROL_CODE
            GLB     CALIB_CODE

            GLB     BS, CR, LF, ESC, SPACE, RU

*       EXTERNAL REFERENCES:

            EXT     EQT, EQT_LEN

            SKIP
*       MAIN ROUTINES:

*****************************************************************
*                                                               *
*    I O C - I N P U T / O U T P U T  C O N T R O L            *
*                                                               *
*        Calling sequence :                                     *
*                                                               *
```

```
*            PUSH    @SP, control block                    *
*            CALL    IOC_                                  *
*                                                          *
*                                                          *
*        During IOC execution :                            *
*                                                          *
*            R10 = control block                           *
*                  0 [R10] = device LU number              *
*                  2 [R10] = function code                 *
*                  4 [R10] = buffer address                *
*                                                          *
*            R11 = EQT entry                               *
*                  0 [R11] = device LU number              *
*                  2 [R11] = select_code                   *
*                  4 [R11] = device SU number              *
*                  6 [R11] = device driver                 *
*                  8 [R11] = interface driver              *
*                                                          *
*                                                          *
************************************************************

IOC_        EX      R11, @SP            ; Save R11; get return address.
            EX      R11, 2[ SP]         ; Save return address; get control block.
            PUSH    @SP, R10            ; Save R10.
            PUSHL   @SP, RR0
            LD      R10, R11            ; R10 := control block.
            LD      R11, #EQT           ; R11 := EQT.
            LD      R0, @R11
            LD      R1, @R10            ; R1 := LU no.
            INC     R11, #2
IOC_EQT_CHK CP      R1, @R11            ; Is this EQT entry for this LU ?
            JR      EQ,IOC_EXEC         ; Yes; execute function.
            INC     R11, #EQT_LEN       ; Point to next entry.
            DEC     R0                  ; Last entry ?
            JR      NZ,IOC_EQT_CHK      ; No; keep looking.
            JR      IOC_EXIT            ; Not found: no can do.

IOC_EXEC    LD      R1, 6[R11]          ; Effectively: CALL  @6[R11].
            CALL    @R1

IOC_EXIT    POPL    RR0, @SP
            POPL    RR10, @SP
            RET


LAST        EQU     $
            END
            TITLE   " Z8000  I/O Utility Routines"
************************************************************
*                                                          *
*              <<<  IO_UTIL  >>>                           *
*                                                          *
*        INPUT / OUTPUT UTILITY ROUTINES                   *
*                  for the                                 *
*                  Z82_SEC                                 *
*                                                          *
************************************************************
```

```
            PROG

*       ENTRY POINTS:

            GLB     SWITCH_
            GLB     BUFFER_

*       GLOBAL REFERENCES:

            GLB     GET_NEXT_BFR
            GLB     PUT_CHAR_BFR
            GLB     GET_CHAR_BFR
            GLB     INIT_BFR
            GLB     CLEAR_BFR
            GLB     RESET_BFR
            GLB     SET_PTR_BFR
            GLB     MAX_LEN_BFR
            GLB     CUR_LEN_BFR
            GLB     GET_PTR_BFR
            GLB     BS_LEN_BFR
            GLB     BS_PTR_BFR

*       REGISTER DEFINITIONS:

SP          EQU     R15

*           SYSTEM CONSTANTS :

WORDS       EQU     2                   ; Bytes / word.

BS          EQU     8
LF          EQU     10
CR          EQU     13
ESC         EQU     27
SPACE       EQU     32
RU          EQU     127


*       MACROS:

BUFFER      MACRO   &BFR, &CODE
            PUSH    @SP, &BFR
            CALL    BUFFER_
            WVAL    &CODE
            MEND

            SKIP
*       MAIN ROUTINES:

*****************************************************************
*                                                               *
*                   UTILITY ROUTINES                            *
*                       for the                                 *
*                        Z8002                                  *
*                                                               *
*****************************************************************
```

```
*************************************************************
*                                                           *
*    BUFFER_ routine                                        *
*                                                           *
*          Calling sequence :                               *
*                                                           *
*                    PUSH    buffer label                   *
*                    CALL    BUFFER_                        *
*                    WVAL    function code                  *
*                    return is to here                      *
*************************************************************

GET_NEXT_BFR    EQU     1
PUT_CHAR_BFR    EQU     2
GET_CHAR_BFR    EQU     3
INIT_BFR        EQU     4
CLEAR_BFR       EQU     5
RESET_BFR       EQU     6
SET_PTR_BFR     EQU     7
MAX_LEN_BFR     EQU     8
CUR_LEN_BFR     EQU     9
GET_PTR_BFR     EQU     10
BS_LEN_BFR      EQU     11
BS_PTR_BFR      EQU     12

BUFFER_         EX      R3, 2[SP]               ; Swap function code
                EX      R3, @SP                 ;  and return address
                EX      R3, 2[SP]               ;  then put R3 on top of stack
                EX      R3, @SP                 ;  and set R3 to buffer label.
                PUSH    @SP, R2                 ; Top of stack = PUSHL  RR2.
                LD      R2, 4[SP]               ; R2 := return address.
                LD      R2, @R2                 ; R2 := function code.
                INC     4[SP], #2               ; Set proper return address.
                PUSH    @SP, R1                 ; Save R1.
                PUSH    @SP, R2                 ; Set function code as switch variable.
                CALL    SWITCH_
                WVAL    (BFR_SWCH_LAST-($+2))/2 ; No. of labels.
                WVAL    BFR_GET_NEXT
                WVAL    BFR_PUT_CHAR
                WVAL    BFR_GET_CHAR
                WVAL    BFR_INIT
                WVAL    BFR_CLEAR
                WVAL    BFR_RESET
                WVAL    BFR_SET_PTR
                WVAL    BFR_MAX_LEN
                WVAL    BFR_CUR_LEN
                WVAL    BFR_PTR
                WVAL    BFR_BS_LEN
                WVAL    BFR_BS_PTR
BFR_SWCH_LAST   NOP                             ; Switch error return is to here.
BFR_EXIT_ERR    SETFLG  V
                JR      BFR_EXIT
BFR_EXIT_OK     RESFLG  V
BFR_EXIT        POP     R1, @SP
                POPL    RR2, @SP
                RET
```

```
BFR_INIT        LD      @R3, R0             ; Max len := R0.
BFR_CLEAR       CLR     2[R3]               ; Cur len := 0.
BFR_RESET       CLR     4[R3]               ; Pointer := 0.
                JR      BFR_EXIT_OK

BFR_SET_PTR     CP      R0, 2[R3]           ; Is pointer > cur len or < 0 ?
                JR      UGT,BFR_EXIT_ERR    ; Yes; error.
                LD      4[R3], R0           ; No; pointer := R0.
                JR      BFR_EXIT_OK

BFR_MAX_LEN     LD      R0, @R3             ; R0 := max len.
                JR      BFR_EXIT_OK

BFR_CUR_LEN     LD      R0, 2[R3]           ; R0 := cur len.
                JR      BFR_EXIT_OK

BFR_PTR         LD      R0, 4[R3]           ; R0 := pointer.
                JR      BFR_EXIT_OK

BFR_GET_CHAR    CALL    BG_CHAR
                JR      BFR_EXIT

BFR_GET_NEXT    CALL    BG_CHAR
                JR      OV,BFR_EXIT
                INC     4[R3]               ; Inc pointer.
                JR      BFR_EXIT_OK

BG_CHAR         CALL    BG_PTR              ; R2 := pointer.
                LDB     RL0, #RU            ; On buffer empty, char = RU.
                RET     OV
                LDB     RL0, @R2            ; RL0 := char.
                RESFLG  V
                RET

BG_PTR          TEST    2[R3]               ; If the buffer is empty
                JR      Z,BG_EMPTY          ;  then error.
                LD      R2, 4[R3]
                CP      R2, 2[R3]           ; If pointer >= cur len
                JR      GE,BG_EMPTY         ;  then error.
                LDA     R2, 6[R3]           ; R2 := address of first character in buffer.
                ADD     R2, 4[R3]           ; R2 points to current character.
                RESFLG  V
                RET

BG_EMPTY        SETFLG  V
                RET

BFR_PUT_CHAR    CALL    BP_PTR
                JR      OV,BFR_EXIT
                LDB     @R2, RL0            ; Put char in buffer.
                LD      R2, 4[R3]           ; R2 := pointer.
                CP      R2, 2[R3]           ; Is pointer = cur len ?
                JR      NE,BFR_P_C_1        ;  No, length is not affected.
                INC     2[R3]               ;  Yes, increment cur len.
BFR_P_C_1       INC     4[R3]               ; Increment pointer.
                JR      BFR_EXIT_OK
```

```
BP_PTR          LD      R2, 4[R3]           ; R2 := pointer.
                CP      R2, @R3             ; If pointer >= max len
                JR      GE,BP_FULL          ;  then error.
                LDA     R2, 6[R3]           ; R2 := address of first character.
                ADD     R2, 4[R3]           ; R2 points to current location.
                RESFLG  V
                RET

BP_FULL         SETFLG  V
                RET

BFR_BS_LEN      TEST    2[R3]
                JR      Z,BFR_EXIT_ERR
                DEC     2[R3]
                JR      BFR_EXIT_OK

BFR_BS_PTR      TEST    4[R3]
                JR      Z,BFR_EXIT_ERR
                DEC     4[R3]
                JR      BFR_EXIT_OK

                SKIP
*****************************************************************
*                                                               *
*    SWITCH_ routine                                            *
*                                                               *
*         Calling sequence :                                    *
*                                                               *
*                PUSH    switch variable                        *
*                CALL    SWITCH_                                *
*                WVAL    no. of labels                          *
*                WVAL    label_1                                *
*                WVAL    label_2                                *
*                .       .                                      *
*                WVAL    label_n                                *
*                error return is to here                        *
*****************************************************************
SWITCH_         EX      R0, 2[SP]           ; R0 := switch variable.
                EX      R1, @SP             ; R1 := pointer to labels.
                TEST    R0                  ; If R0 = 0
                JR      LE,SWCHX            ;   then error.
                CP      R0, @R1             ; If R0 > no. of labels
                JR      GT,SWCHX            ;  then error.
                RL      R0                  ; R0 := word displacement.
                ADD     R1, R0              ; R1 := proper label address.
                LD      R0, @R1             ; R0 := label to jump to.
                POP     R1, @SP             ; Restore R1.
                EX      R0, @SP             ; Restore R0; set jump label.
                RET                         ; Goto label.
SWCHX           LD      R0, @R1             ; R0 := no. of labels
                INC     R0                  ;       + 1.
                RL      R0                  ; R0 := word displacement.
                ADD     R0, R1              ; R0 := error return address.
                POP     R1, @SP             ; Restore R1.
                EX      R0, @SP             ; Restore R0; set jump label.
                RET                         ; Goto label.
LAST            EQU     $
END
```

```
                TITLE   " Z8002  Floating Point Math Library"
*****************************************************************
*                                                               *
*                  <<<  MATH  >>>                               *
*                                                               *
*              FLOATING POINT MATH LIBRARY                      *
*                      for the                                  *
*                       Z8002                                   *
*                                                               *
*****************************************************************

 *              ENTRY POINTS:

                GLB     ATN_, ATAN_
                GLB     SIN_, COS_
                GLB     SIGN_
                GLB     ABS_, INT_
                GLB     IENT_, DINT_
                GLB     IRND_, DRND_
                GLB     NUMBER_FORMAT_
                GLB     CONVERT, FTOD_
                GLB     RTOI_, SQR_
                GLB     FCM_
                GLB     FAD_, FSB_
                GLB     FMP_, FDV_
                GLB     FDV_A_                  ; Alternate FDV.
                GLB     MPY_
                GLB     DFLOAT_, FLOAT_
                GLB     PACK_
                GLB     DFIX_, IFIX_, FIX_

 *              GLOBAL SYMBOLS:

                GLB     STANDARD_FMT, FLOAT_FMT

 *              EXTERNAL ROUTINES:

                EXT     BUFFER_
                EXT     SWITCH_

 *              EXTERNAL REFERENCES:

                EXT     FMT_TYPE

 *              EXTERNAL SYMBOLS:

                EXT     PUT_CHAR_BFR, GET_NEXT_BFR
                EXT     GET_CHAR_BFR, BS_PTR_BFR
                EXT     GET_PTR_BFR, SET_PTR_BFR
                SKIP
*         REGISTER DEFINITIONS:
*_____________________________________
*       | R0                          |
*  RQ0  | R1    ______________________|
```

```
*       | R2    |s|m....MANT....|        |
*_______|_R3____|...............||  FR1  |
*       | R4    |s|m___EXP___l|_______|
*  RQ4  | R5    _______________________|
*       | R6    |s|m....MANT....|        |
*_______|_R7____|...............||  FR2  |
*       | R8    |s|m....EXP....l|_______|
*  RQ8  | R9    _______________________|
*       | R10   |s|m....MANT....|        |
*_______|_R11___|...............||  FR3  |
*       | R12   |s|m___EXP___l|_______|
*  RQ12 | R13                            |
*       | R14                            |
*_______|_R15__Stack Pointer____________|
```

```
FQ1             EQU     RQ0
FR1             EQU     R2
MANTH_FR1       EQU     R2
MANTL_FR1       EQU     R3
MANT_FR1        EQU     RR2
EXP_FR1         EQU     R4
FR2             EQU     R6
MANTH_FR2       EQU     R6
MANTL_FR2       EQU     R7
MANT_FR2        EQU     RR6
EXP_FR2         EQU     R8
FR3             EQU     R10
MANTH_FR3       EQU     R10
MANTL_FR3       EQU     R11
MANT_FR3        EQU     RR10
EXP_FR3         EQU     R12
SP              EQU     R15

                SKIP
*           MACROS:


FLD             MACRO   &FR_DST, &FR_SRC
                LDL     MANT_&FR_DST, MANT_&FR_SRC
                LD      EXP_&FR_DST, EXP_&FR_SRC
                MEND

LDF             MACRO   &FR_DST, &SRC
                LDL     MANT_&FR_DST, #MANT_&SRC
                LD      EXP_&FR_DST, #EXP_&SRC
                MEND

FEX             MACRO   &FR_DST, &FR_SRC
                EX      MANTH_&FR_DST, MANTH_&FR_SRC
                EX      MANTL_&FR_DST, MANTL_&FR_SRC
                EX      EXP_&FR_DST, EXP_&FR_SRC
                MEND


PUSHF           MACRO   &FR_SRC
                PUSH    @SP, EXP_&FR_SRC
                PUSHL   @SP, MANT_&FR_SRC
                MEND
```

```
POPF        MACRO   &FR_DST
            POPL    MANT_&FR_DST, @SP
            POP     EXP_&FR_DST, @SP
            MEND

BUFFER      MACRO   &BFR, &CODE
            PUSH    @SP, &BFR
            CALL    BUFFER_
            WVAL    &CODE
            MEND

            SKIP
*       MAIN ROUTINES:
*****************************************************************
*                                                               *
* ATN   - Returns ATN (FR1).                                    *
* ATAN  - Returns ATN ( FR1/FR2 ).                              *
*                                                               *
*****************************************************************

ATAN_       TEST    MANTH_FR2           ; FR1 := ATN(y/x): y=FR1, x=FR2.
            JR      NZ,ATAN_1
            CALL    SIGN_               ; If y=0 then
            PUSHF   FR2
            LDF     FR2, N90
            CALL    FMP_                ;  z := SIGN(y)*90 degrees.
            POPF    FR2
            RET

ATAN_1      JR      MI,ATAN_2
            CALL    FDV_                ; If y>0 then
            CALL    ATN_                ;  z := ATN(y/x)
            RET

ATAN_2      PUSHF   FR3
            PUSHF   FR2                 ; Save x.
            PUSHF   FR1                 ; Save y.
            CALL    SIGN_               ; Get SIGN(y).
            LDF     FR2, N180
            CALL    FMP_                ; Calc. SIGN(y)*180.
            FLD     FR3, FR1
            POPF    FR1
            POPF    FR2
            CALL    FDV_
            CALL    ATN_                ; Calc. ATN(y/x).
            FEX     FR2, FR3
            CALL    FAD_                ; Calc. ATN(y/x) + SIGN(y)*180.
            FLD     FR2, FR3
            POPF    FR3
            RET

ATN_        CALL    ATNR_               ; FR1 := ATN (x) in radians.
            PUSHF   FR2
            LDF     FR2, R_2_D          ; FR2 := degrees/radian.
            CALL    FMP_                ; Convert from radians to degrees.
            POPF    FR2
            RET

ATNR_       TEST    MANTH_FR1
```

```
        RET     Z                       ; ATN (0) = 0.

        PUSHF   FR3
        PUSHF   FR2
        PUSH    @SP, R5
        CLR     R5                      ; Clear flags.
        JR      PL,ATN_1
        SET     R5, #0                  ; Set result sign flag := negative.
        CALL    FCM_
ATN_1   FLD     FR2, FR1                ; Save ABS(x) in FR2.
        CALL    IFIX_
        CP      R0, #1                  ; Test for x > 1.
        FLD     FR1, FR2                ; Restore ABS(x).
        JR      LE,ATN_2                ; If x > 1
        SET     R5, #1                  ;  then set the [ x > 45 ] flag
        LDF     FR1, ONE                ;  and
        CALL    FDV_                    ;  z := 1/x;
ATN_2   FLD     FR3, FR1                ;  else z := x.
        LDF     FR2, SQR2M1             ; Calculate [ z - (SQR(2)-1) ].
        CALL    FSB_
        TEST    MANTH_FR1
        FLD     FR1, FR3                ; FR1 := z.
        JR      MI,ATN_3                ; If z > SQR(2) - 1
        JR      Z,ATN_3
        LDF     FR2, TANPI3_16          ;  then v = TAN ( 3*pi/16 )
        LDF     FR3, PI3_16             ;  and  w = 3*pi/16;
        JR      ATN_4
ATN_3   LDF     FR2, TAN_PI16           ;  else v = TAN ( pi/16 )
        LDF     FR3, PI16               ;  and  w = pi/16.
ATN_4   PUSHF   FR3                     ; Save w on stack.
        FLD     FR3, FR1
        CALL    FSB_                    ; ( z - v ).
        PUSHF   FR1                     ; Save (z-v) on stack.
        FLD     FR1, FR3
        CALL    FMP_                    ; (z*v).
        LDF     FR2, ONE
        CALL    FAD_                    ; 1 + z*v
        FLD     FR2, FR1
        POPF    FR1
        CALL    FDV_                    ; t := (z-v)/(1+z*v).
        PUSHF   FR1                     ; Save t on stack.
        FLD     FR2, FR1
        CALL    FMP_                    ; t*t.
        FLD     FR3, FR1                ; FR3 := t^2.
        LDF     FR2, ATN_B3
        CALL    FAD_
        PUSHF   FR1                     ; Save (t^2+B3) on stack.
        FLD     FR1, FR3
        LDF     FR2, ATN_B2
        CALL    FAD_                    ; Calc. (t^2+B2).
        POPF    FR2                     ; Get (t^2+B3)
        PUSHF   FR2                     ;  and resave it.
        CALL    FMP_                    ; Calc. (t^2+B2)*(t^2+B3).
        LDF     FR2, ATN_C3
        CALL    FAD_                    ; Calc. [(t^2+B2)*(t^2+B3)+C3].
        POPF    FR2                     ; FR2 := (t^2+B3)
        PUSHF   FR1                     ; Save [(t^2+B2)*(t^2+B3)+C3].
```

```
            PUSHF   FR2                     ; Re-save (t^2+B3).
            PUSHF   FR1                     ; Save again [(t^2+B2)*(t^2+B3)+C3].
            FLD     FR1, FR3
            LDF     FR2, ATN_B1
            CALL    FAD_                    ; Calc. (t^2+B1).
            POPF    FR2
            CALL    FMP_                    ; Calc. (t^2+B1)*[(t^2+B2)*(t^2+B3)+C3].
            POPF    FR2                     ; Get (t^2+B3).
            PUSHF   FR1                     ; Save (t^2+B1)*[(t^2+B2)*(t^2+B3)+C3].
            LDF     FR1, ATN_C2
            CALL    FMP_                    ; Calc. C2*(t^2+B3).
            POPF    FR2
            CALL    FAD_                    ; Calc. (t^2+B1)*[(t^2+B2)*(t^2+B3)+C3]+C2*(t^2+B3).
            FLD     FR3, FR1                ; Save divisor in FR3.
            POPF    FR1                     ; Get [(t^2+B2)*(t^2+B3)+C3].
            LDF     FR2, ATN_C1
            CALL    FMP_                    ; Calc. C1*[(t^2+B2)*(t^2+B3)+C3].
            FLD     FR2, FR3
            CALL    FDV_
            LDF     FR2, ATN_C0
            CALL    FAD_                    ; Calc. coefficient expression.
            POPF    FR2                     ; Get t.
            CALL    FMP_                    ; Calc. arctan(t).
            POPF    FR2                     ; Get w.
            CALL    FAD_                    ; Calc. w + arctan(t).
            BIT     R5, #1                  ; Is angle GT 45 degrees ?
            JR      Z,ATN_5
            FLD     FR2, FR1
            LDF     FR1, HALF_PI
            CALL    FSB_                    ; Calc. [ pi/2 - atn(z).
ATN_5       BIT     R5, #0                  ; Is answer negative ?
            JR      Z,ATN_6
            CALL    FCM_
ATN_6       POP     R5, @SP
            POPF    FR2
            POPF    FR3
            RET
MANT_PI16       EQU     6487ED53H           ; pi/16.
EXP_PI16        EQU     -2

MANT_TAN_PI16   EQU     65D7D781H           ; TAN (pi/16).
EXP_TAN_PI16    EQU     -2

MANT_PI3_16     EQU     4B65F1FEH           ; 3*pi/16.
EXP_PI3_16      EQU     0

MANT_TANPI3_16  EQU     5586E0ABH           ; TAN (3*pi/16).
EXP_TANPI3_16   EQU     0

MANT_SQR2M1     EQU     6A09E667H           ; SQR(2) - 1.
EXP_SQR2M1      EQU     -1
*               ATN coefficients:

MANT_ATN_C0     EQU     6AFF5F81H           ;  0.208979591837
EXP_ATN_C0      EQU     -2
```

```
MANT_ATN_C1     EQU     5F0F4169H           ;  2.97061224490
EXP_ATN_C1      EQU     2

MANT_ATN_C2     EQU     94CABB4FH           ; -3.35025248131
EXP_ATN_C2      EQU     2

MANT_ATN_C3     EQU     0BE18481EH          ; -0.128720995297
EXP_ATN_C3      EQU     -2
MANT_ATN_B1     EQU     51A5DE6DH           ;  5.10299532839
EXP_ATN_B1      EQU     3

MANT_ATN_B2     EQU     52B197A4H           ;  2.58417875505
EXP_ATN_B2      EQU     2

MANT_ATN_B3     EQU     540556FEH           ;  1.31282591656
EXP_ATN_B3      EQU     1
                SKIP
*****************************************************************
*                                                               *
* SIN -  Returns SIN (FR1).                                     *
* COS -  Returns COS (FR1) = SIN ( FR1 + 90 ).                  *
*                                                               *
*****************************************************************

COS_            PUSHF   FR2
                LDF     FR2, N90
                CALL    FAD_                ; Angle := angle + 90 degrees.
                JR      SIN_COS


SIN_            PUSHF   FR2
SIN_COS         LDF     FR2, D_2_R          ; FR2 := radians/degree.
                CALL    FMP_                ; Convert from degrees to radians.
                POPF    FR2                 ; Fall into SINR routine.

SINR_           PUSHF   FR3
                PUSHF   FR2
                PUSHL   @SP, RR0
                CLRB    RL0                 ; Initialize sign of result := 0.
                TEST    MANTH_FR1
                JR      PL,SIN_1
                CALL    FCM_                ; If x >= 0 then x := |x|
                INCB    RL0                 ;  and sign(z) := NOT sign (z).
SIN_1           FLD     FR3, FR1            ; FR3 := x.
                LDF     FR2, PI
                CALL    FSB_                ; FR1 := x - PI.
                FLD     FR1, FR3            ; Restore FR1 := x.
                JR      MI,SIN_3            ; If x > PI
                CALL    FDV_                ;  then x := x MOD PI.
                CALL    INT_                ; FR1 := INT(x/PI).
                JR      NC,SIN_2            ; If x is an odd multiple of PI
                INCB    RL0                 ;  then sign(z) := NOT sign(z).
SIN_2           CALL    FMP_                ; FR1 := INT(x/PI)*PI.
                FLD     FR2, FR1            ; FR2 := INT(x/PI)*PI.
                FLD     FR1, FR3            ; FR1 := x.
                CALL    FSB_                ; FR1 := x - INT(x/PI)*PI = x MOD PI.
                FLD     FR3, FR1            ; FR3 := x.
```

```
SIN_3       LDF     FR2, HALF_PI        ; FR2 := PI/2.
            CALL    FSB_                ; If x >= PI/2
            FLD     FR1, FR3
            JR      MI,SIN_4
            LDF     FR2, PI
            CALL    FSB_                ;  then x (= x - PI.
            FLD     FR3, FR1
            INCB    RL0                 ; Sign(z) := NOT sign(z).
SIN_4       CALL    ABS_                ; x := ABS(x).
            LDF     FR2, TEN_M6         ; FR2 := 10E-6.
            CALL    FSB_                ; If x < 10E-6
            FLD     FR1, FR3            ;  then SIN(x) := x.
            JR      MI,SIN_EXIT
            FLD     FR2, FR1
            CALL    FMP_                ; FR1 := x * x.
            CALL    POLY_
            WVAL    SIN_COEF
            CALL    FMP_                ; z := POLY(x) * x.
SIN_EXIT    BITB    RL0, #0             ; If sign(z) = 0
            JR      Z,SIN_END           ;  then z := FR1
            CALL    FCM_                ;  else z := -FR1.
SIN_END     POPL    RR0, @SP
            POPF    FR2
            POPF    FR3
            RET


SIN_COEF    WVAL    7
SIN_C1      WVAL     54A9H              ;  0.154 001 500 048 E-9
            WVAL    0C8C9H
            WVAL    0FFE0H
SIN_C2      WVAL     947FH              ; -0.250 294 478 915 E-7
            WVAL    0D4BDH
            WVAL    0FFE7H
SIN_C3      WVAL     5C77H              ;  0.275 569 300 800 E-5
            WVAL     3902H
            WVAL    0FFEEH
SIN_C4      WVAL     97F9H              ; -0.198 412 663 895 E-3
            WVAL     80C8H
            WVAL    0FFF4H
SIN_C5      WVAL     4444H              ;  0.833 333 331 872 E-2
            WVAL     4442H
            WVAL    0FFFAH
SIN_C6      WVAL    0AAAAH              ; -0.166 666 666 667 E0
            WVAL    0AAABH
            WVAL    0FFFEH

            WVAL     4000H              ;  1.0
            WVAL     0000
            WVAL     0001


            SKIP
*****************************************************************
*                                                               *
* POLY -  Returns the polynomial evaluation of the coefficient table *
*         defined by CALL + 2.                                  *
```

```
*                                                                    *
*            CALL    POLY_      | COEF_TABLE:   WVAL   n            *
*            WVAL    COEF_TABLE |               WVAL   c1_manth     *
*         --) normal return     |               WVAL   c1_mantl     *
*                               |               WVAL   c1_exp       *
*                               |               .      .            *
*                               |               WVAL   cn_exp       *
*                                                                    *
*            FR1 = x.                                                *
*                                                                    *
**********************************************************************

POLY_        PUSHF   FR3                  ; SP + 6.
             PUSHF   FR2                  ; SP + 6.
             PUSHL   @SP, RR0             ; SP + 4.
             LD      R1, SP[ #16]         ; R1 := pointer to coefficient pointer.
             POP     R0, @R1              ; R0 := coefficient pointer; R1 := return address.
             LD      SP[ #16], R1         ; Save proper return address.
             LD      R1, R0               ; R1 := coefficient pointer.
             POP     R0, @R1              ; R0 := n ( number of coefficients ).
             FLD     FR3, FR1             ; Save x in FR3.
             LDF     FR1, ZER             ; Initialize z := 0.
             CP      R0, EXP_FR1          ; If n <= 0
             JR      LE,POLY_EXIT         ;  then z := 0.
POLY_LOOP    POPL    MANT_FR2, @R1        ; FR2 := Cn.
             POP     EXP_FR2, @R1
             CALL    FAD_                 ; z := z + Cn.
             DEC     R0                   ; If last coefficient
             JR      Z,POLY_EXIT          ;  then exit.
             FLD     FR2, FR3             ; FR2 := x.
             CALL    FMP_                 ; z := z * x.
             JR      POLY_LOOP

POLY_EXIT    POPL    RR0, @SP
             POPF    FR2
             POPF FR3
             RET

             SKIP
**********************************************************************
*                                                                    *
* ABS -  Returns ABS (FR1).                                          *
*                                                                    *
**********************************************************************

ABS_         TEST    MANTH_FR1
             RET     PL
             JP      FCM_

             SPC     15
**********************************************************************
*                                                                    *
* SIGN -  Returns SIGN (FR1).                                        *
*                                                                    *
**********************************************************************

SIGN_        TEST    MANTH_FR1
```

```
            LDF     FR1, ONE
            JR      PL,SIGN_1
            LDF     FR1, M_ONE
SIGN_1      TEST    MANTH_FR1
            RESFLG  V
            RET

            SKIP
*****************************************************************
*                                                               *
* INT -  Returns INT (FR1);   carry flag := odd/even integer.   *
*                                                               *
*****************************************************************

INT_        PUSHL   @SP, RR0
            CALL    DINT_               ; RR0 := integer (FR1).
            PUSH    @SP, R1             ; Save odd/even.
            CALL    DFLOAT_
            POP     R1, @SP
            RRC     R1                  ; Cy := odd/even.
            POPL    RR0, @SP
            RET
*****************************************************************
*                                                               *
* IRND -  Returns  R0 := INT (FR1 + .5).                        *
* DRND -  Returns RR0 := INT (FR1 + .5).                        *
*                                                               *
*****************************************************************

IRND_       CALL    IENT_
            RET     OV
            RET     NC
            INC     R0
            RET     NOV
            LD      R0, #OVF_POS
            RET

DRND_       CALL    DINT_
            RET     OV
            RET     NC
            ADDL    RR0, #1
            RET     NOV
            LDL     RR0, #OVF_POS_L
            RET
*****************************************************************
*                                                               *
* IENT -  Returns  R0 := INT (FR1).                             *
* DINT -  Returns RR0 := INT (FR1).                             *
*                                                               *
*****************************************************************
IENT_       PUSHF   FR1
            LD      R0, #15
            CALL    ENTIER_
            LD      R0, MANTH_FR1
            RL      MANTL_FR1           ; Set carry for round.
            TEST    R0
            POPF    FR1
            RET
```

```
DINT_          PUSHF   FR1
               LD      R0, #31
               CALL    ENTIER_
               LDL     RR0, MANT_FR1
               POPF    FR1
               RET

ENTIER_        TEST    EXP_FR1
               JR      MI,INT_SMALL
               SUB     EXP_FR1, R0
               JR      GT,INT_OVF
               RESFLG  C
               SDAL    MANT_FR1, EXP_FR1
INT_EXIT       TESTL   MANT_FR1
               RESFLG  V
               RET

INT_SMALL      RESFLG  V
               TEST    MANTH_FR1              ; If 0 <= x < 1
               CLR     MANTH_FR1              ;  then x := 0.
               CLR     MANTL_FR1
               JR      PL,INT_EXIT
               COM     MANTH_FR1              ; If -1 <= x < 0
               COM     MANTL_FR1              ;  then x := -1.
               JR      INT_EXIT

INT_OVF        RESFLG  C                      ; Set overflow conditions.
               SETFLG  V
               TEST    MANTH_FR1
               LDL     MANT_FR1, #OVF_POS_L
               JR      PL,INT_EXIT_ERR
               LDL     MANT_FR1, #OVF_NEG_L
INT_EXIT_ERR   TESTL   MANT_FR1
               SETFLG  V
               RET

               SKIP
*******************************************************************
*                                                                 *
* NUMBER FORMAT  -  Convert a floating point number in FR1        *
*                   first to a BCD number in RQ0, then            *
*                   to an ASCII string in the buffer              *
*                   at 2[ SP].                                    *
*                                                                 *
*******************************************************************

STANDARD_FMT   EQU     1
FLOAT_FMT      EQU     2

NUMBER_FORMAT_ EX      R10, @SP               ; Swap return address and buffer label,
               EX      R10, 2[ SP]            ;  and set R10 = buffer label.
               PUSHL   @SP, RR4
               PUSHL   @SP, RR2
               PUSHL   @SP, RR0

               CALL    FTOD_
```

```
                PUSH    @SP, FMT_TYPE
                CALL    SWITCH_
                WVAL    (NMB_FMT_SW_LST-($+2))/2
                WVAL    FMT_STANDARD
                WVAL    FMT_FLOAT
NMB_FMT_SW_LST  NOP
NMB_FMT_ERR     SETFLG  V
                JR      NMB_FMT_EXIT

NMB_FMT_OK      RESFLG  V
NMB_FMT_EXIT    POPL    RR0, @SP
                POPL    RR2, @SP
                POPL    RR4, @SP
                POP     R10, @SP
                RET

FMT_STANDARD    CPB     RL3, #12
                JP      GT, FMT_FLOAT
                CPB     RL3, #-5
                JP      LT, FMT_FLOAT
                PUSH    @SP, #8                 ; Round to eight places
                CALL    BCD_ROUND               ;  in standard mode.
                LDB     RL5, #20                ; Digit count = 20.
                LDB     RH5, #8                 ; Precision in Standard = 8 digits.
                TEST    R0                      ; If n = 0
                JR      Z,FMT_STD_ZER           ;  then print "0".
                LD      R4, R0                  ; Save ms digits in R4.
                BITB    RH3, #7                 ; If number is negative
                JR      Z,FMT_STD_1
                LDB     RL0, #"-"               ;  then output minus sign.
                CALL    NF_PUT_CHAR
FMT_STD_1       CPB     RL3, #0                 ; If exponent <= 0
                JR      GT,FMT_STD_FIN
                LDB     RL0, #"0"               ;  then output "0."
                CALL    NF_PUT_CHAR
                LDB     RL0, #"."
                CALL    NF_PUT_CHAR
FMT_STD_LP      TESTB   RL3                     ; Output 0's until expon = 0.
                JR      Z,FMT_STD_FIN
                LDB     RL0, #"0"
                CALL    NF_PUT_CHAR
                INCB    RL3                     ; Adjust expon.
                JR      FMT_STD_LP

FMT_STD_FIN     CALL    NF_PUT_NUMB
                CALL    NF_PAD_SPACES
                JP      NMB_FMT_OK

FMT_STD_ZER     LDB     RL0, #"0"
                CALL    NF_PUT_CHAR
                CALL    NF_PAD_SPACES
                JP      NMB_FMT_OK


NF_PUT_NUMB     CALL    NF_DIGIT                ; Get a digit into RL0.
                CALL    NF_PUT_CHAR             ; Put the digit in the buffer.
                DECB    RL3                     ; When expon = 0
```

```
                JR      NZ,NF_PN_1          ; print decimal point
NF_PN_DP        CALL    NF_ZER_TEST         ; unless trailing digits
                RET     Z                   ; are all zeros.

                LDB     RL0, #"."
                CALL    NF_PUT_CHAR
                JR      NF_PN_2

NF_PN_1         JR      PL,NF_PN_2          ; If expon < 0
                CALL    NF_ZER_TEST         ; and if remaining digits = 0
                RET     Z                   ; then return to drop trailing zeros.

NF_PN_2         DBJNZ   RH5,NF_PUT_NUMB     ; Continue until digit count = 0.
                RET


NF_ZER_TEST     TEST    R4                  ; See if the remaining digits
                RET     NZ                  ; are all zeros.
                TEST    R1
                RET     NZ
                TEST    R2
                RET


NF_DIGIT        PUSH    @SP, R5
                LDB     RL5, #4
                CLRB    RL0                 ; Initialize digit in RL0.
NF_DIGIT_LP     SLL     R2
                RLC     R1
                RLC     R4
                RLCB    RL0
                DBJNZ   RL5,NF_DIGIT_LP
                ORB     RL0, #60Q           ; RL0 := ASCII.
                POP     R5, @SP
                RET
NF_PUT_CHAR     TESTB   RL5
                JR      Z,NF_PC_OV
                BUFFER  R10, PUT_CHAR_BFR
                RET     OV
                DECB    RL5                 ; Dec char count.
                RESFLG  V
                RET                         ; If count > 0 then ok.
NF_PC_OV        SETFLG  V                   ; Else flag overflow.
                RET


NF_PAD_SPACES   LDB     RL0, #" "           ; Output spaces until
                CALL    NF_PUT_CHAR
                JR      NOV,NF_PAD_SPACES
                RET


FMT_FLOAT       NOP
                JP      NMB_FMT_ERR
                SKIP
```

```
*****************************************************************
*                                                               *
* BCD ROUND -  Round a BCD  number in RQ0                       *
*              to the number of places defined                  *
*              by the value in 2[ SP].                          *
*                                                               *
*              To call:                                         *
*                 PUSH   @SP, n                                 *
*                 CALL   BCD_ROUND                              *
*                                                               *
*****************************************************************

BCD_ROUND      EX      R2, @SP              ; Swap return address and the number
               EX      R2, 2[ SP]           ;  of places to round with R2.
               PUSHL   @SP, RR0
               LD      R1, R2               ; R1 := index (digit to round off).
               TEST    R1
               JR      LE,END_BCD_RND
               CP      R1, #12
               JR      GE,END_BCD_RND
               SRL     R1                   ; R1 := offset to digit.
               LDB     RL0, #5              ; Round off upper or lower digit
               JR      C,BCD_RND1           ;  according to the carry flag.
               SLLB    RL0, #4              ; RL0 := 50H for upper digit.
BCD_RND1       RESFLG  C
BCD_RND_LOOP   LDB     RH0, R1[ SP]
               ADCB    RL0, RH0
               DAB     RL0
               LDB     R1[ SP], RL0
               CLRB    RL0
               DEC     R1
               JR      PL,BCD_RND_LOOP
               JR      NC,BCD_RND2
               LD      @SP, #1000H
               CLR     2[ SP]
               CLR     4[ SP]
               INCB    RL3                  ; Adjust expon.
BCD_RND2       LD      R1, R2
               SRL     R1                   ; R1 := offset of the first
               LDB     RH0, #0FH            ;  non-significant digit.
               JR      NC,BCD_RND3
               LDB     RL0, R1[ SP]
               ANDB    RL0, RH0
               LDB     R1[ SP], RL0
BCD_RND_LP2    INC     R1
BCD_RND3       CP      R1, #6               ; Any more to clear ?
               JR      GE,END_BCD_RND
               CLRB    RL0
               LDB     R1[ SP], RL0         ; CLRB   R1[ SP].
               JR      BCD_RND_LP2

END_BCD_RND    POPL    RR0, @SP             ; Restore rounded number to RQ0.
               POP     R2, @SP
               RET

               SKIP
```

```
*****************************************************************
*                                                               *
* CONVERT -  Convert an ASCII number in a buffer @R0            *
*            to a floating point real in FR1.                   *
*                                                               *
*****************************************************************

CONVERT     PUSHF   FR2
            PUSHL   @SP, RR0
            PUSH    @SP, R9
            PUSHL   @SP, RR10
            LD      R10, R0             ; R10 := buffer label.
            CLR     R11                 ; Clear the flags.
            CLR     R1                  ; RL1 = exp adj := 0.
            LDF     FR1, ZER            ; Num := 0.
            LDF     FR2, ONE            ; F := 1.
            BUFFER  R10, GET_PTR_BFR
            PUSH    @SP, R0             ; Save pointer in case of error.
            CALL    CNV_GET_CHAR
            CPB     RL0, #"+"           ; If first char is a sign
            JR      EQ,CNV_LP_1         ;  then ignore it if +,
            CPB     RL0, #"-"           ;  else if -, set mant sign flag.
            JR      NE,CNV_1
            SET     R11, #0             ; Set mant sign to -.

CNV_LP_1    CALL    CNV_GET_CHAR        ; Check for leading zeros.
CNV_1       CPB     RL0, #"0"
            JR      NE,CNV_2
            SET     R11, #2             ; Set digit read flag.
            BIT     R11, #3             ; If dec pt flag = false
            JR      Z,CNV_LP_1          ;  then skip leading zeros,
            DECB    RL1                 ;  else decrement exp adj.
            JR      CNV_LP_1

CNV_2       CPB     RL0, #"."           ; Check for dec pt.
            JR      NE,CNV_3
            BIT     R11, #3             ; If dec pt flag true
            JR      NZ,CNV_ERR          ;  then error: 2 dec pts.
            SET     R11, #3             ; Set dec pt flag.
            SET     R11, #2             ; Set digit read flag (dec pt counts as a digit).
            JR      CNV_LP_1

CNV_3       CALL    CNV_DIGIT_CHK
            JR      NE,CNV_6            ; Char is not a digit.
            CALL    CNV_BACKSPACE
CNV_LP_2    LDB     RH1, #4             ; Loop counter := 4.
            CLR     R9                  ; N := 0.
CNV_LP_3    CALL    CNV_GET_CHAR
            CALL    CNV_DIGIT_CHK
            JR      NE,CNV_5            ; Char is not a number.
            CALL    CNV_X10ADD
            SET     R11, #4             ; Set non-zero flag.
            SET     R11, #2             ; Set digit read flag.
            BIT     R11, #3             ; If dec pt flag = false
            JR      NZ,CNV_4
            INCB    RL1                 ;  then inc exp adj.
CNV_4       DBJNZ   RH1,CNV_LP_3
```

```
            CALL    CNV_DBLE
            JR      CNV_LP_2

CNV_5       CPB     RL0, #"."
            JR      NE,CNV_6
            BIT     R11, #3             ; If dec pt flag = true
            JR      NZ,CNV_ERR          ;  then error: 2 dec pts.
            SET     R11, #3             ; Dec pt flag := true.
            JR      CNV_LP_3

CNV_6       CALL    CNV_BACKSPACE
            BIT     R11, #2             ; Check digit read flag; at this point,
            JR      Z,CNV_ERR           ;  no digit means no number error.
            BIT     R11, #4             ; If non-zero flag = false
            JR      Z,CNV_7             ;  then n := 0
            CLR     R0                  ;  else finish number ( digit := 0 );
CNV_LP_4    CALL    CNV_X10ADD
            DBJNZ   RH1,CNV_LP_4
            JR      CNV_8

CNV_7       CLR     R9                  ; N := 0.
CNV_8       CALL    CNV_DBLE
            CLR     R9                  ; Exponent := 0.
            BUFFER  R10, GET_PTR_BFR
            EX      R0, @SP             ; Set pointer to exponent.
            CALL    CNV_GET_CHAR
            CPB     RL0, #"E"           ; If no exponent present
            JR      NE,CNV_FINISH       ;  then finish number
            CALL    CNV_GET_CHAR        ;  else get the exponent first.
            CPB     RL0, #"+"           ; Get exp sign, if present.
            JR      EQ,CNV_9
            CPB     RL0, #"-"
            JR      NE,CNV_10
            SET     R11, #1             ; Exp sign := neg.
CNV_9       CALL    CNV_GET_CHAR
CNV_10      CALL    CNV_DIGIT_CHK
            JR      NE,CNV_EXP_ERR
            CALL    CNV_BACKSPACE
CNV_LP_5    CALL    CNV_GET_CHAR
            CPB     RL0, #"0"
            JR      EQ,CNV_LP_5         ; Skip leading zeros.
            CALL    CNV_BACKSPACE
            LDB     RH1, #2             ; Allow 2 digit exponent: max = 99.
CNV_LP_6    CALL    CNV_GET_CHAR
            CALL    CNV_DIGIT_CHK
            JR      NE,CNV_FIN_EXP
            CALL    CNV_X10ADD
            DBJNZ   RH1,CNV_LP_6
            CALL    CNV_GET_CHAR        ; Check for more than 2 digits in exp.
            CALL    CNV_DIGIT_CHK
            JR      EQ,CNV_EXP_ERR
CNV_FIN_EXP BIT     R11, #1             ; Set exponent ( in R9 )
            JR      Z,CNV_FINISH        ;  to proper sign.
            NEG     R9
CNV_FINISH  CALL    CNV_BACKSPACE
            EXTSB   R1                  ; R1 := exp adj.
            LD      R0, R1              ; R0 := exp adj.
```

```
            ADD     R0, R9          ; R0 := exponent.
            FLD     FR2, FR1        ; Discard factor in FR2; save number.
            LDF     FR1, TEN
            CALL    RTOI_           ; FR1 := 10^R0.
            CALL    FMP_            ; FR1 := Mant * 10 ^ exp.
            BIT     R11, #0         ; Set number to proper sign.
            JR      Z,CNV_11
            CALL    FCM_
CNV_11      POP     R0, @SP         ; Discard old pointer.
            RESFLG  V               ; No error.
CNV_EXIT    TEST    MANTH_FR1
            POPL    RR10, @SP
            POP     R9, @SP
            POPL    RR0, @SP
            POPF    FR2
            RET

CNV_ERR     POP     R0, @SP         ; Restore old buffer pointer.
            BUFFER  R10, SET_PTR_BFR
CNV_NO_NUM  LDF     FR1, ZER
            SETFLG  V
            JR      CNV_EXIT

CNV_EXP_ERR POP     R0, @SP         ; Reset the buffer pointer.
            BUFFER  R10, SET_PTR_BFR ; This is not really an error.
            CALL    CNV_GET_CHAR    ; Offset the backspace at CV_FINISH.
            CLR     R9              ; Exp := 0.
            JR      CNV_FIN_EXP

CNV_X10ADD  AND     R0, #0FH        ; Mask off digit from ascii char.
            PUSH    @SP, R0         ; Save the digit.
            ADD     R9, R9          ; R9 := R9 * 10.
            LD      R0, R9
            ADD     R9, R9
            ADD     R9, R9
            ADD     R9, R0
            POP     R0, @SP
            ADD     R9, R0          ; R9 := R9 * 10 + R0.
            RET
CNV_DBLE    PUSHF   FR3
            PUSHL   @SP, RR0
            FEX     FR1, FR3        ; Save n0 in FR3.
            FLD     FR1, FR2
            LDF     FR2, TEN_4
            CALL    FDV_            ; f := f/10^4.
            FLD     FR2, FR1        ; FR2 := f.
            LD      R0, R9          ; R0 := n'.
            CALL    FLOAT_          ; FR1 := n'.
            CALL    FMP_            ; FR1 = n := n' * f.
            FEX     FR2, FR3        ; Save f in FR3; put n0 in FR2.
            CALL    FAD_            ; FR1 = n := n + n0.
            FEX     FR2, FR3        ; Restore f to FR2.
            POPL    RR0, @SP
            POPF    FR3             ; Restore FR3.
            RET
CNV_DIGIT_CHK CPB   RL0, #"0"
            RET     LT
            CPB     RL0, #"9"
```

```
                RET     GT
                SETFLG  Z
                RET

CNV_GET_CHAR    CALL    CNV_CHAR
                CPB     RL0, #" "
                JR      EQ,CNV_GET_CHAR         ; Skip spaces.
                RET

CNV_CHAR        BUFFER  R10, GET_NEXT_BFR
                RET

CNV_BACKSPACE   NOP
                BUFFER  R10, BS_PTR_BFR
                RET

                SKIP
*******************************************************************
*                                                                 *
* FTOD_   -  Convert a floating point number in FR1               *
*            to a packed decimal number in RQ0.                   *
*                                                                 *
*                      ____________                               *
*                   R0 |_11|_10|_9_|_8_|                          *
*                   R1 |_7_|_6_|_5_|_4_|                          *
*                   R2 |_3_|_2_|_1_|_0_|                          *
*                   R3 |s|____|__exp__|                           *
*             s = sign of number (+ =0, - =1).                    *
*             exp is 10's exponent in 2's complement form.        *
*             decimal point is in front of digit 11.              *
*                                                                 *
*******************************************************************

FTOD_           LDL     RR0, RR2                ; If FR1 = 0, set RQ0 := 0
                TEST    MANTH_FR1               ;  and return.
                RET     Z

                PUSH    @SP, R10
                DEC     SP, #FTD_STK_SPC
                LD      R10, SP                 ; R10 points to stack space for n.
                CALL    FTD_ABS                 ; FR1 := ABS(FR1); Sign is set.
                CLR     R0                      ; Initialize expon in R0.
                TEST    EXP_FR1
                JR      Z,FTOD_1
FTOD_LP1        CALL    MBY10
                DEC     R0
                TEST    EXP_FR1
                JR      MI,FTOD_LP1
                CALL    DBY10                   ; Undo the last multiply.
                INC     R0
FTOD_1          CALL    FTD_0
                CP      R0, #99                 ; Check for exponent out of range.
                JR      GT,FTD_OVF
                CP      R0,#-99
                JR      LT,FTD_ZER
                LDB     7(R10), RL0             ; Save exponent.
                CALL    FTD_1
FTOD_EXIT       INC     SP, #FTD_STK_SPC        ; Reclaim stack space.
```

```
            POP     R10, @SP
            RET

FTD_ZER     CLR     R0                  ; RQ0 := 0.
            CLR     R3
            JR      FTD_CLR
FTD_OVF     LD      R0, 1000H           ; RQ0 := +/- infinity.
            LDB     RL3, #99
FTD_CLR     CLR     R1
            CLR     R2
            JR      FTDD_EXIT

FTD_ABS     CLRB    6[ R10]             ; Set sign positive.
            TEST    MANTH_FR1
            RET     PL
            CALL    FCM_
            SETB    6[ R10], #7
            RET

FTD_0       TEST    EXP_FR1
            RET     MI
            CALL    DBY10
            INC     R0
            JR      FTD_0

FTD_1       PUSH    @SP, R5
            CLR     R1                  ; Set index to 0.
FTD_1_L0    CALL    GETDG               ; Eliminate leading zeros.
            TESTB   RL0
            JR      NZ,FTD_1_A
            DECB    7[ R10]             ; Update the expon.
            JR      FTD_1_L0

FTD_1_LP    CALL    GETDG
FTD_1_A     RLDB    RL0, RL5            ; Put digit in RL5.
            CALL    GETDG
            RLDB    RL0, RL5            ; Put next digit in RL5.
            LDB     R10[R1], RL5        ; Save digits in stack.
            INC     R1                  ; Update index.
            CP      R1, #6              ; End of loop ?
            JR      LT,FTD_1_LP
            CALL    GETDG               ; Get one more to round with.
            LDB     RL5, RL0            ; Save it in RL5.
            LDL     RR0, @R10           ; RQ0 := n.
            LDL     RR2, 4[R10]
            CPB     RL5, #5             ; Round off ?
            JR      LT,FTD_1_EXIT       ; No, go home.
            LD      R5, #1              ; RH5 := 0; RL5 := 1.
            ADDB    RL2, RL5
            DAB     RL2
            ADCB    RH2, RH5
            DAB     RH2

            ADCB    RL1, RH5
            DAB     RL1
            ADCB    RH1, RH5
            DAB     RH1
```

```
        ADCB    RL0, RH5
        DAB     RL0
        ADCB    RH0, RH5
        DAB     RH0
        JR      NC,FTD_1_EXIT           ; Round off did not produce an overflow of the buffer.
        LD      R0, #1000H              ; Correct for buffer overflow.
        INCB    RL3                     ; Adjust the exponent.
        CPB     RL3, #99                ; Expon ovf ?
        JR      LE,FTD_1_EXIT
        LDB     RL3, #99                ; Yes; RQ0 := overflow.
                SETFLG  V
FTD_1_EXIT      RESFLG  V
                POP     R5, @SP
                RET

GETDG           PUSH    @SP, R1
                CALL    MBY10
                LD      R0, MANTH_FR1
                AND     R0, #HIMASK
                LD      R1, EXP_FR1
GETDG_LP1       RL      R0                      ; Normalize to bit 15 on first shift.
                DEC     R1                      ; Rotate left until exp = 0.
                JR      PL,GETDG_LP1            ; This puts integer in R0.
                AND     R0, #M_177
                PUSH    @SP, R0                 ; Save digit.
                LD      R1, EXP_FR1
GETDG_LP2       RR      R0                      ; Reposition digit to
                DEC     R1                      ;  remove it from the mantissa.
                JR      PL,GETDG_LP2
                XOR     MANTH_FR1, R0
                CALL    NRML                    ; Normalize FR1.
                POP     R0, @SP
                POP     R1, @SP
                RET

NRML            TESTL   MANT_FR1
                JR      NZ,NRML_1
                CLR     EXP_FR1
                RET

NRML_LP         DEC     EXP_FR1
NRML_1          SLLL    MANT_FR1
                JR      NOV,NRML_LP
                RRC     MANTH_FR1
                RRC     MANTL_FR1
                RET

MBY10           PUSHF   FR2
                LDF     FR2, TEN
                CALL    FMP_
                POPF    FR2
                RET

DBY10           PUSHF   FR2
                LDF     FR2, TENTH
                CALL    FMP_
                POPF    FR2
                RET
```

```
FTD_STK_SPC     EQU     8       ; bytes.
HIMASK          EQU     174000Q
M_177           EQU     177Q

                SKIP
*****************************************************************
*                                                               *
* RTOI - Raise a floating point real in FR1                     *
*        to an integer power in R0.                             *
*                                                               *
*****************************************************************

RTOI_           PUSHF   FR3
                PUSHF   FR2
                PUSH    @SP, R1
                LDB     RH1, RH0                ; RH1 := sign of R0.
                TEST    MANTH_FR1
                JR      Z,BZERO                 ; Base is 0.
                TEST    R0
                JR      Z,PZERO                 ; Power is 0.
                JR      PL,RTOI_1               ; R0 := abs (R0).
                NEG     R0
RTOI_1          LDF     FR2, ONE                ; FR2 = f := 1.
                FLD     FR3, FR1                ; FR3 := base.
RTOI_LOOP       SRL     R0                      ; If LSB = 1
                JR      NC,RTI_LP_1
                FLD     FR1, FR3                ;  then f := f * x.
                CALL    FMP_
                FLD     FR2, FR1
RTI_LP_1        TEST    R0                      ; When R0 = 0
                JR      Z,RTOI_FIN              ;  then finished.
                FLD     FR1, FR3                ; FR1 := x.
                FEX     FR2, FR3
                CALL    FMP_                    ; FR1 := x * x.
                FEX     FR2, FR3                ; Restore f in FR2.
                FLD     FR3, FR1                ; Save new x.
                JR      RTOI_LOOP

RTOI_FIN        FLD     FR1, FR2                ; Answer = f.
                TESTB   RH1
                JR      PL,RTI_EXIT             ; If power < 0
                LDF     FR1, ONE                ;  then answer := 1/f.
                CALL    FDV_
RTI_EXIT        RESFLG  V
RTI_EXIT_ERR    TEST    MANTH_FR1
                POP     R1, @SP
                POPF    FR2
                POPF    FR3
                RET
BZERO           FLD     FR1, ZER                ; Answer := 0.
                TEST    R0                      ; If 0 ^ i, and i > 0
                JR      GT,RTI_EXIT             ;  then ok
                SETFLG  V                       ;  else error.
                JR      RTI_EXIT_ERR
```

```
*****************************************************************
*                                                               *
* SQR - Calculate the square root of the                        *
*       floating point number in FR1.                           *
*                                                               *
*             Underflow occurs when the number is negative.     *
*                                                               *
*****************************************************************
SQR_        TEST    MANTH_FR1           ; SQR(0) = 0.
            RET     Z
            JR      PL,SQR_1
            CLR     MANTH_FR1           ; If the number is negative
            CLR     MANTL_FR1           ;  then underflow occurred
            CLR     EXP_FR1             ;  so return 0
            TEST    MANTH_FR1           ;  set the flags,
            SETFLG  V                   ;  and set the overflow flag.
            RET

SQR_1       PUSHL   @SP, RR10                           ; RR0 = z
            PUSHL   @SP, RR8                            ; RR2 = x
            PUSH    @SP, R5                             ; R4  = exp
            PUSHL   @SP, RR0                            ; R5  = counters
            LDL     RR0, #1             ; z := 1.       ; RR8 = w
            CLR     R8                  ; w := 0.
            CLR     R9
            LDL     RR10, RR8
            LDB     RH5, #30            ; Loop 30 times - 1 digit is done before loop.
            SRA     EXP_FR1             ; Adjust the exponent.
            JR      C,SQR_OXP           ; If the exponent was even
            SLLL    MANT_FR1            ;  then x := x * 2
            JR      SQR_START

SQR_OXP     INC     EXP_FR1             ;  else increment the exponent.

SQR_START   SLLL    MANT_FR1            ; Shift
            RLC     R11                 ;       w
            SLLL    MANT_FR1            ;          :=
            RLC     R11                 ;              x.
            DEC     R11                 ; w := w - z  ( z = 1 ).
            INC     R1                  ; z := z + 1  ( now z = 2 ).
SQR_LOOP    SLLL    MANT_FR1            ; Shift
            RLC     R11                 ;       w
            RLC     R10                 ;         :=
            RLC     R9                  ;            x
            RLC     R8                  ;              .
            SLLL    MANT_FR1            ; Shift
            RLC     R11                 ;       w
            RLC     R10                 ;         :=
            RLC     R9                  ;            x
            RLC     R8                  ;              .
            SLLL    RR0                 ; Shift left z.
            INC     R1                  ; Compare ( z+1, w).
            TESTL   RR8                 ; If RR8 <> 0
            JR      NZ,SQR_SUB          ;  then w > Z+1: subtract.
            CPL     RR10,RR0
            JR      UGE,SQR_SUB         ; If w > z+1 then subtract.
```

```
            RES     R1, #0              ; New bit in z := 0.
            JR      SQR_LPCHK

SQR_SUB     SUBL    RR10, RR0           ; z := z+1; w := w-z.
            JR      NC,SQR_SUB1
            SUBL    RR8, #1
SQR_SUB1    INC     R1                  ; z := z+1; this inc puts the
SQR_LPCHK   DBJNZ   RH5,SQR_LOOP        ;  new 1 bit in its proper position in z.

            CLR     MANTH_FR1           ; Clear for PACK(z).
            CLR     MANTL_FR1
            SRLL    RR0                 ; Position z.
            RRC     R2                  ; Extra precision.
            CALL    PACK_
            POPL    RR0, @SP
            POP     R5, @SP
            POPL    RR8, @SP
            POPL    RR10, @SP
            RET
            SKIP
*********************************************************************
*                                                                   *
* FCM - Complement a floating point number in FR1.                  *
*                                                                   *
*             Overflow occurs when the negative number:  1 000      *
*               is complemented to:  1 000, which is also negative. *
*               It is right-shifted to produce:  0 100, and the     *
*               exponent is incremented.                            *
*                                                                   *
*             Underflow occurs when the positive number:  0 100     *
*               is complemented to:  1 100.                         *
*               It is left-shifted to produce:  1 000, and the      *
*               exponent is decremented.                            *
*                                                                   *
*********************************************************************
FCM_        RESFLG  V                   ; Clear ovf for quick return on x=0.
            TEST    MANTH_FR1           ; If x=0
            RET     Z                   ;  then return 0.
            COM     MANTH_FR1
            COM     MANTL_FR1
            ADDL    MANT_FR1, #1
            JR      NOV,FCM_UNF         ; If no overflow, then check for underflow
            RR      MANTH_FR1           ;  else adjust mantissa
            INC     EXP_FR1             ;  and exponent.
            CP      EXP_FR1, #MAX_EXP   ; Check for exponent overflow.
            JR      LE,FCM_EXIT         ; If no exp ovf then exit
            DEC     EXP_FR1             ;  else re-adjust the exponent.
            TEST    MANTH_FR1           ; Set flags.
            SETFLG  V
            RET

FCM_UNF     RET     PL                  ; No underflow with positive result.
            BIT     MANTH_FR1, #14      ; If sign () msb
            JR      Z,FCM_EXIT          ;  then no underflow.
            SLA     MANTH_FR1           ; Underflow: adjust mantissa
            DEC     EXP_FR1             ;  and exponent.
            CP      EXP_FR1, #MIN_EXP   ; If exponent is not within range
            JP      LT,PK_UNF           ;  then return 0 as underflow.
```

```
FCM_EXIT        TEST    MANTH_FR1               ; Set flags.
                RESFLG  V
                RET
                SKIP
*****************************************************************
*                                                               *
* FAD - Add floating point numbers  FR1 := FR1 + FR2.           *
*                                                               *
* FSB - Subtract floating point numbers  FR1 := FR1 - FR2       *
*                            Method:  FR1 := FR1 + ( - FR2 ).   *
*                                                               *
*****************************************************************

FSB_            PUSHL   @SP, MANT_FR2
                PUSH    @SP, EXP_FR2
                EX      MANTH_FR1, MANTH_FR2
                EX      MANTL_FR1, MANTL_FR2
                EX      EXP_FR1, EXP_FR2
                CALL    FCM_
                CALL    FAD_
                POP     EXP_FR2, @SP
                POPL    MANT_FR2, @SP
                RET

FAD_            PUSHL   @SP, RR0
                PUSHL   @SP, MANT_FR2
                PUSH    @SP, EXP_FR2
                TEST    MANTH_FR1               ; Is FR1 = 0 ?
                JR      Z,FAD_RET_FR2           ; Yes; return FR2.
                TEST    MANTH_FR2               ; Is FR2 = 0 ?
                JR      Z,FAD_RET_FR1           ; Yes; return FR2.
FAD_SWAP_CHK    CP      EXP_FR1, EXP_FR2        ; FR1 must be <= FR2.
                JR      LE,FAD_ADD              ; It is: do the addition.
                EX      MANTH_FR1, MANTH_FR2    ; It isn't: swap FR1 and FR2.
                EX      MANTL_FR1, MANTL_FR2
                EX      EXP_FR1, EXP_FR2
                JR      FAD_SWAP_CHK

FAD_ADD         SUB     EXP_FR1, EXP_FR2        ; Calculate delta exponent.
                CP      EXP_FR1, #-32           ; If ABS difference is > 32
                JR      LT,FAD_RET_FR2          ;  then return larger number.
                LDL     RR0, MANT_FR1           ; Set up RQ0 for a quad arithmetic shift.
                SDAL    RR0, EXP_FR1            ; SRA upper half of RQ0.
                ADD     EXP_FR1, #32            ; Calculate shift length for lower
                SDLL    MANT_FR1, EXP_FR1       ;  half and shift it.
                LD      EXP_FR1, EXP_FR2        ; Set exponent of result in FR1.
                ADDL    RR0, MANT_FR2           ; Do the addition.
                JR      NOV,FAD_PACK
                RRC     R0                      ; Undo the overflow.
                RRC     R1
                RRC     MANTH_FR1
                RRC     MANTL_FR1
                INC     EXP_FR1

FAD_PACK        CALL    PACK_                   ; PACK_ sets the flags.

FAD_EXIT        POP     EXP_FR2, @SP
```

```
                POPL    MANT_FR2, @SP
                POPL    RR0, @SP
                RET

FAD_RET_FR2     LDL     MANT_FR1, MANT_FR2
                LD      EXP_FR1, EXP_FR2
FAD_RET_FR1     TEST    MANTH_FR1
                RESFLG  V
                JR      FAD_EXIT

                SKIP
*****************************************************************
*                                                               *
* FMP - Multiply floating point numbers  FR1 := FR1 * FR2.      *
*                                                               *
*****************************************************************
FMP_            TEST    MANTH_FR1
                JP      Z,F_RET_0
                TEST    MANTH_FR2
                JP      Z,F_RET_0

                PUSHF   FR2
                PUSHL   @SP, RR0
                LD      R0, R2
                XOR     R0, R6                  ; Sign R0 := sign of result.
                PUSH    @SP, R0
                CALL    ABS_
                FEX     FR1, FR2
                CALL    ABS_
                ADD     EXP_FR1, EXP_FR2
                INC     EXP_FR1

*               MULTL   FQ1, MANT_FR2
                CALL    MPY_                    ; RQ0 := RR2*RR6

                CALL    PACK_
                POP     R0, @SP
                TEST    R0
                JR      PL,FMP_EXIT
                CALL    FCM_

FMP_EXIT        POPL    RR0, @SP
                POPF    FR2
                RET

MPY_            PUSH    @SP, R8                 ; Simulate MULTL  RQ0, RR6.
                PUSH    @SP, R5
                LDL     RR0, RR2
                CLR     R2
                CLR     R3
                CLR     R8                      ; 0 for ADC instructions.
                LDB     RL5, #16                ; 16 loops.
MPY_LOOP        SLLL    RR2
                RLC     R1
                RLC     R0
                JR      NC,MPY_L1
```

```
            ADDL    RR2, RR6
            ADC     R1, R8
            ADC     R0, R8
MPY_L1      SLLL    RR2
            RLC     R1
            RLC     R0
            JR      NC,MPY_L2
            ADDL    RR2, RR6
            ADC     R1, R8
            ADC     R0, R8
MPY_L2      DBJNZ   RL5,MPY_LOOP

            POP     R5, @SP
            POP     R8, @SP
            RET

MPY_A_      PUSHL   @SP, RR10           ; Simulate MULTL.
            PUSHL   @SP, RR6
            LDL     RR10, RR2           ; RR10 := RR2.
            SRL     R7                  ; Position low parts.
            SRL     R11
            PUSH    @SP, R6
            CLR     R1                  ; Clear result.
            CLR     R0
            LDL     RR2, RR0
            MULT    RR6, R10            ; R2 * R7.
            ADD     R2, R7
            ADC     R1, R6
            POP     R7, @SP             ; R7 := R6.
            PUSH    @SP, R7
            MULT    RR6, R11            ; R3 * R6.
            ADD     R2, R7
            ADC     R1, R6
            POP     R7, @SP             ; R7 := R6.
            MULT    RR6, R10            ; R2 * R6.
            LD      R0, R6
            SRL     R7                  ; Position low part.
            ADD     R1, R7              ; Add in cross terms.
            JR      PL,MPY_EXIT
            JR      NOV,MPY_A1
            INC     R0
            JR      MPY_EXIT
MPY_A1      DEC     R0
MPY_EXIT    RLC     R2
            RLC     R1
            POPL    RR6, @SP
            POPL    RR10, @SP
            RET

            SKIP
*****************************************************************
*                                                               *
* FDV - Divide floating point numbers  FR1 := FR1 / FR2.        *
*                                                               *
*****************************************************************
```

```
FDV_ .      PUSHL   @SP, RR0
            PUSHL   @SP, RR10
            TEST    MANTH_FR2               ; Divide by 0 ?
            JR      Z,FDV_ZER
            SUB     EXP_FR1, EXP_FR2        ; Calculate exp(x) - exp(y) + 1 .
            INC     EXP_FR1
            SRAL    MANT_FR1, #2            ; Double arithmetic right shift prevents
            DIV     MANT_FR1, MANTH_FR2     ;  overflow in division.
            LD      R10, MANTL_FR1          ; Save Q.
            CLR     MANTL_FR1
            SRAL    MANT_FR1                ; Position remainder to prevent
            DIV     MANT_FR1, MANTH_FR2     ;  overflow in division.
            LD      R11, MANTL_FR1          ; Save Q1.
            LD      MANTH_FR1, MANTL_FR2
            CLR     MANTL_FR1
            SRLL    MANT_FR1, #3            ; Position low part of FR2 to prevent
            DIV     MANT_FR1, MANTH_FR2     ;  overflow in division.
            NEG     MANTL_FR1               ; -( Q * Q2 ).
            MULT    MANT_FR1, R10
            LD      R1, MANTH_FR1
            LD      MANTL_FR1, R11          ; FR1 := Q1.
            EXTS    MANT_FR1
            CLR     R0                      ; R0 := 0.
            SLA     R1, #2                  ; Cy := sign( R1 ).
            SBC     MANTH_FR1, R0           ; M := neg( M ) - cy.
            ADDL    RR0, MANT_FR1
            SLAL    RR0                     ; Shift to final postion.
            ADD     R0, R10                 ; Add Q.
            CLR     MANTH_FR1
            CLR     MANTL_FR1
FDV_EXIT    CALL    PACK_
            POPL    RR10, @SP
            POPL    RR0, @SP
            RET

FDV_ZER     LD      EXP_FR1, MAX_EXP+100    ; Set FR1 overflow.
            JR      FDV_EXIT
FDV_A_      PUSHL   @SP, RR0
            PUSHL   @SP, RR10
            TEST    MANTH_FR2               ; Divide by 0 ?
            JR      Z,FDV_ZER
            SUB     EXP_FR1, EXP_FR2        ; Calculate exp(x) - exp(y) + 1.
            INC     EXP_FR1
            LDL     RR0, MANT_FR1           ; Set up RQ0 for divide.
            CLR     MANTH_FR1
            CLR     MANTL_FR1
            SRAL    RR0                     ; Double arithmetic right shift
            RRC     R2                      ;  to prevent overflow.
            SRAL    RR0
            RRC     R2
            DIVL    FQ1, MANT_FR2
            LDL     RR10, MANT_FR1          ; Save quotient.
            CLR     MANTH_FR1
            CLR     MANTL_FR1
            SRAL    RR0
            RRC     R2
            DIVL    FQ1, MANT_FR2
```

```
            EXTSL   FQ1                 ; FQ1 := quotient only; no 2nd remainder.
            SLLL    MANT_FR1
            RLC     R1
            RLC     R2
            ADDL    RR0, RR10           ; Add 1st quotient.
            CALL    PACK_
            POPL    RR10, @SP
            POPL    RR0, @SP
            RET


F_RET_0     CLR     MANTH_FR1
            CLR     MANTL_FR1
            CLR     EXP_FR1
            TEST    MANTH_FR1
            RESFLG  V
            RET

            SKIP
DFLOAT_     CLR     MANTH_FR1
            CLR     MANTL_FR1
            LD      EXP_FR1, #31
            JR      PACK_

FLOAT_      CLR     R1                  ; MS mantissa := i.
            CLR     MANTH_FR1
            CLR     MANTL_FR1           ; LS mantissa := 0.
            LD      EXP_FR1, #15        ; Exponent := 15.
            JR      PACK_               ; Pack the number.

PACK_       TESTL   RR0                 ; Is the number 0  (Upper long word) ?
            JR      NZ,PK1
            TESTL   MANT_FR1            ; Is the number 0  (Lower long word) ?
            JR      NZ,PK1
PACK_0      CLR     EXP_FR1             ; Yes: exponent := 0.
            JR      PKEXIT

PKL         DEC     EXP_FR1             ; Update exponent after shift.
PK1         SLLL    MANT_FR1
            RLC     R1
            RLC     R0
            JR      NOV,PKL
            RRC     R0
            RRC     R1
            RRC     MANTH_FR1           ; Restore proper mantissa
            RRC     MANTL_FR1           ;  after shifting.
            TEST    R0                  ; Round off the mantissa.
            JR      MI,PK_NEG_R0
*           ADDL    MANT_FR1, #MAX_NEG_L ; Round-off positive number.
            ADDL    MANT_FR1, #-1       ; Round-off positive number.
            JR      PK_R0

PK_NEG_R0   ADDL    MANT_FR1, #MAX_POS_L ; Round-off negative number.

PK_R0       LDL     MANT_FR1, RR0       ; Mantissa := RR0.
            JR      NC,PK_EXP_CHK
```

```
            ADDL    RR0, #1             ; Round off if carry.
            LDL     MANT_FR1, RR0       ; Mantisa := rounded RR0.
            JR      NOV,PK_3            ; Test for r/o ovf of 011..1 to 100..0 .
            RR      MANTH_FR1           ; Set proper value:   010..0
            INC     EXP_FR1             ;  and adjust the exponent.
            JR      PK_EXP_CHK

PK_3        RL      R0                  ; Test for r/o unf of 101..1 to 110..0 .
            JR      OV,PK_EXP_CHK       ; Mantissa FR1 is o.k.
            SLA     MANTH_FR1           ; It was 110..0 ;  make it 100..0
            DEC     EXP_FR1             ;  and adjust the exponent.

PK_EXP_CHK  CP      EXP_FR1, #MIN_EXP   ; Underflow ?
            JR      LT,PK_UNF           ; Underflow on EXP < min exponent.
            CP      EXP_FR1, #MAX_EXP
            JR      GT,PK_OVF           ; Overflow on EXP > max exponent.
PKEXIT      TEST    MANTH_FR1           ; Set flags.
            RESFLG  V                   ; Clear overflow flag.
            RET

PK_UNF      CLR     MANTH_FR1
            CLR     MANTL_FR1
            CLR     EXP_FR1
            TEST    MANTH_FR1
            SETFLG  V
            RET

PK_OVF      LD      EXP_FR1, MAX_EXP    ; Set exponent to max value.
            TEST    MANTH_FR1
            LDL     MANT_FR1, #OVF_POS_L
            JR      PL,PK_OVF_1
            LDL     MANT_FR1, #OVF_NEG_L
PK_OVF_1    TESTL   MANT_FR1             ; Set flags.
            SETFLG  V                    ; Set overflow flag.
            RET

            SKIP
IFIX_       LD      R0, #15
            CALL    FIX_
            LD      R0, MANTH_FR1
            TEST    R0
            RET

DFIX_       LD      R0, #31
            CALL    FIX_
            LDL     RR0, MANT_FR1
            RET
FIX_        TEST    EXP_FR1             ; If EXP < 0
            JR      MI,FIX_0            ;  then i := 0.
            CP      EXP_FR1, R0         ; If EXP > limit
            JR      GT,FIX_OVF          ;  then overflow.
            SUB     EXP_FR1,R0          ; Get shift count.
            TEST    MANTH_FR1           ; If x >= 0
            JR      PL,FIX_1            ;  then fix as-is;
            PUSH    @SP, R1             ;  else round-down x.
            PUSHL   @SP, RR6
            LD      R1,R0               ; R1 := max shift.
```

```
                ADD     R1, EXP_FR1             ; R1 := original exponent.
                NEG     R1                      ; R1 := mask shift count.
                LDL     RR6, #7FFFFFFFH         ; Set round-off mask in RR0.
                SDAL    RR6, R1                 ; Position mask in RR6.
                AND     R6, MANTH_FR1
                AND     R7, MANTL_FR1
                LD      R0, R6
                OR      R0, R7                  ; R0 := any 1's behind decimal point.
                JR      Z,FIX_NEG_1             ; If no 1's found, then no round-off.
                LDL     RR6,#80000000H          ; Round-off value.
                SDLL    RR6, R1
                ADDL    MANT_FR1, RR6           ; Round-off.
FIX_NEG_1       POPL    RR6, @SP
                POP     R1, @SP

FIX_1           SDAL    MANT_FR1, EXP_FR1       ; Shift x.
FIX_EXIT        TESTL   MANT_FR1                ; Set the flags.
                RESFLG  V                       ; Clear overflow.
                RET

FIX_0           CLR     MANTH_FR1               ; Return 0.
                CLR     MANTL_FR1
                JR      FIX_EXIT

FIX_OVF         TEST    MANTH_FR1               ; Set proper overflow value.
                LDL     MANT_FR1, #OVF_POS_L
                JR      PL,FIX_OVF_EXIT
                LDL     MANT_FR1, #OVF_NEG_L
FIX_OVF_EXIT    TEST    MANTH_FR1               ; Set the flags.
                SETFLG  V                       ; Set overflow.
                RET


                SKIP
*               SYSTEM CONSTANTS:

MAX_EXP         EQU     2000H
MIN_EXP         EQU     -MAX_EXP
OVF_POS         EQU     7FFFH
OVF_NEG         EQU     8000H
MAX_POS_L       EQU     7FFFFFFFH
MAX_NEG_L       EQU     80000000H
OVF_POS_L       EQU     MAX_POS_L
OVF_NEG_L       EQU     MAX_NEG_L

MANT_ZER        EQU     0
EXP_ZER         EQU     0
MANTH_ZER       EQU     0
MANTL_ZER       EQU     0
MANT_ONE        EQU     40000000H
EXP_ONE         EQU     1
MANTH_ONE       EQU     MANT_ONE/10000H
MANTL_ONE       EQU     MANT_ONE.AN.0FFFFH

MANT_M_ONE      EQU     80000000H
EXP_M_ONE       EQU     0
MANTH_M_ONE     EQU     MANT_M_ONE/10000H
MANTL_M_ONE     EQU     MANT_M_ONE.AN.0FFFFH
```

```
MANT_TEN        EQU     50000000H
EXP_TEN         EQU     4
MANTH_TEN       EQU     MANT_TEN/10000H
MANTL_TEN       EQU     MANT_TEN.AN.0FFFFH

MANT_TENTH      EQU     66666667H
EXP_TENTH       EQU     -3
MANTH_TENTH     EQU     MANT_TENTH/10000H
MANTL_TENTH     EQU     MANT_TENTH.AN.0FFFFH

MANT_TEN_4      EQU     4E200000H
EXP_TEN_4       EQU     0EH
MANTH_TEN_4     EQU     MANT_TEN_4/10000H
MANTL_TEN_4     EQU     MANT_TEN_4.AN.0FFFFH

MANT_TEN_M6     EQU     431BDE80H
EXP_TEN_M6      EQU     0FFEDH
MANTH_TEN_M6    EQU     MANT_TEN_M6/10000H
MANTL_TEN_M6    EQU     MANT_TEN_M6.AN.0FFFFH

MANT_N90        EQU     5A000000H
EXP_N90         EQU     7
MANTH_N90       EQU     MANT_N90/10000H
MANTL_N90       EQU     MANT_N90.AN.0FFFFH

MANT_N180       EQU     5A000000H
EXP_N180        EQU     8
MANTH_N180      EQU     MANT_N180/10000H
MANTL_N180      EQU     MANT_N180.AN.0FFFFH

MANT_D_2_R      EQU     477D1A88H
EXP_D_2_R       EQU     0FFFBH
MANTH_D_2_R     EQU     MANT_D_2_R/10000H
MANTL_D_2_R     EQU     MANT_D_2_R.AN.0FFFFH

MANT_R_2_D      EQU     7297706CH
EXP_R_2_D       EQU     6
MANTH_R_2_D     EQU     MANT_R_2_D/10000H
MANTL_R_2_D     EQU     MANT_R_2_D.AN.0FFFFH

MANT_PI         EQU     6487ED53H
EXP_PI          EQU     2
MANTH_PI        EQU     MANT_PI/10000H
MANTL_PI        EQU     MANT_PI.AN.0FFFFH

MANT_HALF_PI    EQU     6487ED53H
EXP_HALF_PI     EQU     1
MANTH_HALF_PI   EQU     MANT_HALF_PI/10000H
MANTL_HALF_PI   EQU     MANT_HALF_PI.AN.0FFFFH

                END
```

```
                TITLE   " Z8000  PBS DRIVER Routines"
*****************************************************************
*                                                               *
*                    <<<  PBS  >>>                              *
*                                                               *
*            PUSHBUTTON SWITCH DRIVER ROUTINES                  *
*                      for the                                  *
*                      Z82/SBC                                  *
*                                                               *
*****************************************************************
                PROG

                INCLUDE IO_COM

*         ENTRY POINTS:

                GLB     DVR_SWITCHES


*               SYSTEM CONSTANTS :

MAX_SW_NO       EQU     5
DEBOUNCE_COUNT  EQU     100

                SKIP
*         MAIN ROUTINES:

*****************************************************************
*                                                               *
*     DEVICE DRIVERS                                            *
*                                                               *
*               R10 = control block                             *
*                     0 [R10] = device LU number                *
*                     2 [R10] = function code                   *
*                     4 [R10] = buffer address                  *
*                                                               *
*               R11 = EQT entry                                 *
*                     0 [R11] = device LU number                *
*                     2 [R11] = select_code                     *
*                     4 [R11] = device SU number                *
*                     6 [R11] = device driver                   *
*                     8 [R11] = interface driver                *
*                                                               *
*               R0 = character                                  *
*               R1 = select code                                *
*               R2 = function code                              *
*               R3 = buffer address                             *
*               R4 = interface driver                           *
*               R5 = device SU number                           *
*                                                               *
*****************************************************************

DVR_SWITCHES
                PUSHL   @SP, RR6
                PUSHL   @SP, RR4
                PUSHL   @SP, RR2
                PUSHL   @SP, RR0
                LD      R1, 2[R11]              ; R1 := select code.
```

```
                LD      R2, 2[R10]          ; R2 := function code.
                LD      R3, 4[R10]          ; R3 := buffer address.
                LD      R4, 8[R11]          ; R4 := interface driver.
                CP      R2, #READ_CODE
                JR      EQ,SW_READ
                CP      R2, #INIT_CODE
                JR      EQ,SW_INIT
DVR_SW_ERR      SETFLG  V
                JR      DVR_SW_EXIT

DVR_SW_OK       RESFLG  V
DVR_SW_EXIT     POPL    RR0, @SP
                POPL    RR2, @SP
                POPL    RR4, @SP
                POPL    RR6, @SP
                RET

SW_INIT
                CLRB    LAST_RDG
                CALL    @R4                 ; Init. interface driver.
                JR      DVR_SW_OK

SW_READ
                BUFFER  R3, CLEAR_BFR
                CALL    @R4                 ; Call the interface driver.
                LDB     RL6, LAST_RDG
                LD      R5, #0              ; Start with switch 0.
                LDB     RL7, RL0
SW_READ_1       BITB    RL7, R5
                JR      Z,SW_CLEAR
                BITB    RL6, R5             ; Was this switch read before ?
                JR      Z,NEW_SWITCH        ; No.
SW_READ_LOOP_1  LDB     RH6, #DEBOUNCE_COUNT ; Wait until switch is released.
SW_READ_LOOP_2  CALL    @R4                 ; Wait until switch is released.
                BITB    RL0, R5
                JR      NZ,SW_READ_LOOP_1
                DBJNZ   RH6,SW_READ_LOOP_2  ; Debounce the switch.
                RESB    RL7, R5             ; Mark switch released.
                JR      SW_CLEAR

NEW_SWITCH      LD      R0, R5
                BUFFER  R3, PUT_CHAR_BFR
SW_CLEAR        INC     R5                  ; Check next switch.
                CP      R5, #MAX_SW_NO      ; Done ?
                JR      LE,SW_READ_1        ; No.
                LDB     LAST_RDG, RL7       ; Save this reading.
                JR      DVR_SW_OK           ; Yes, done.


LAST            EQU     $

                DATA
LAST_RDG        RMB     1
                EVEN

                END
```

```
                TITLE   " Z8000  PSA I/O Routines"
*****************************************************************
*                                                               *
*                    <<<  PSA  >>>                              *
*                                                               *
*            PHOTOSENSOR ARRAY I/O DRIVERS                      *
*                      for the                                  *
*                      Z82/SBC                                  *
*                                                               *
*****************************************************************

                PROG

                INCLUDE IO_COM
*         ENTRY POINTS:

                GLB     DVR_PSA

*               SYSTEM CONSTANTS :

CHAN_SET_LEN    EQU     (2*192)/8               ; Total bytes for 2 sides.

                SKIP
*         MAIN ROUTINES:

*****************************************************************
*                                                               *
*     DEVICE DRIVERS                                            *
*                                                               *
*               R10 = control block                             *
*                     0 [R10] = device LU number                *
*                     2 [R10] = function code                   *
*                     4 [R10] = buffer address                  *
*                                                               *
*               R11 = EQT entry                                 *
*                     0 [R11] = device LU number                *
*                     2 [R11] = select_code                     *
*                     4 [R11] = device SU number                *
*                     6 [R11] = device driver                   *
*                     8 [R11] = interface driver                *
*                                                               *
*               R0 = character                                  *
*               R1 = select code                                *
*               R2 = function code                              *
*               R3 = buffer address                             *
*               R4 = interface driver                           *
*               R5 = device SU number                           *
*                                                               *
*****************************************************************

DVR_PSA         PUSHL   @SP, RR0
                PUSHL   @SP, RR2
                PUSHL   @SP, RR4
                PUSHL   @SP, RR6
                PUSHL   @SP, RR8
                LD      R1, 2[R11]              ; R1 := select code.
                LD      R2, 2[R10]              ; R2 := function code.
```

```
            CP      R2, #READ_CODE
            JR      EQ,READ
            CP      R2, #CALIB_CODE
            JR      EQ,READ
            CP      R2, #INIT_CODE
            JR      EQ,PSA_INIT
            CP      R2, #CONTROL_CODE
            JR      EQ,PSA_CONTROL
PSA_ERR     SETFLG  V
            JR      PSA_EXIT
PSA_OK      RESFLG  V
PSA_EXIT    POPL    RR8, @SP
            POPL    RR6, @SP
            POPL    RR4, @SP
            POPL    RR2, @SP
            POPL    RR0, @SP
            RET
            SKIP
READ
            CALR    PSA_SETZ                ; Reset PSA counter to 0.
            SUB     SP, #2*CHAN_SET_LEN     ; Make room on stack for both channels.
            LD      R6, SP                  ; R6 points to start of stack work area.
            CLR     R8                      ; Ch 1 offset := 0.
            LD      R9, #CHAN_SET_LEN       ; Set Ch 2 offset.
            CLR     R4                      ; Ch bit number := 0.
            CLR     R5                      ; Set block 0 in RH5.
PSA_LP1
            LDB     RL0, RH5                ; RL0 := current block number.
            CALR    SET_BLOCK_LEN           ; R0 := length of current block.
            LDB     RL2, RL0                ; RL2 := length of block.
            CLRB    RL5                     ; RL5 = current sensor := 0.
PSA_LP2
            LD      R0, R5                  ; RH0 := block, RL0 := sensor.
            CALR    PSA_READ
            CALR    SET_CHAN_BITS           ; RH0 := Ch 2, RL0 := Ch 1.
            INC     R4                      ; Update Ch bit no.
            AND     R4, #0FH                ; Max bit is 15.
            JR      NZ,PSA_LP3              ; Check if this word done.
            INC     R8, #2                  ; Update Ch 1 word offset.
            INC     R9, #2                  ; Update Ch 2 word offset.
PSA_LP3
            INCB    RL5                     ; Update sensor number.
            CPB     RL5, RL2                ; Last sensor done ?
            JR      LT,PSA_LP2              ; No, continue this block.
            INCB    RH5                     ; Update block counter.
            CPB     RH5, #7                 ; Last block done ?
            JR      LT,PSA_LP1              ; No, do the next block.
            BUFFER  4[R10], CLEAR_BFR
            CALR    SEND_CHANNEL
            ADD     R6, #CHAN_SET_LEN
            CALR    SEND_CHANNEL
            ADD     SP, #2*CHAN_SET_LEN     ; Reclaim stack work area.
            JR      PSA_OK                  ; Return to IOC.
PSA_INIT    LD      R3, 8[ R11]
            CALL    @R3
            JR      PSA_OK
```

```
PSA_CONTROL     LD      R3, 8[ R11]             ; Reset the brightness levels.
                CALL    @R3
                JR      PSA_OK

PSA_SETZ        PUSHL   @SP, RR2
                LD      R2, #SETZ_CODE
                LD      R3, 8[ R11]
                CALL    @R3
                POPL    RR2, @SP
                RET

PSA_READ        PUSHL   @SP, RR2
                LD      R2, 2[ R10]     ; R2 := function.
                LD      R3, 8[ R11]     ; R3 := interface driver.
                CALL    @R3
                POPL    RR2, @SP
                RET

SET_CHAN_BITS   ; Set the appropriate bits in both channel bit sets.
                PUSH    @SP, R1
                LD      R1, R6[ R8]
                RES     R1, R4
                TESTB   RL0                     ; Check Ch 1.
                JR      Z,PSA_1
                SET     R1, R4
PSA_1           LD      R6[ R8], R1             ; Save Ch 1 data.
                LD      R1, R6[ R9]             ; Get Ch 2 data.
                RES     R1, R4
                TESTB   RH0                     ; Check Ch 2.
                JR      Z,PSA_2
                SET     R1, R4
PSA_2           LD      R6[ R9], R1
                POP     R1, @SP                 ; Restore Select code.
                RET

SEND_CHANNEL
                BUFFER  4[R10], GET_PTR_BFR
                PUSH    @SP, R0                 ; Save pointer to data length location.
                CLR     R7                      ; No. shadows := 0.
                BUFFER  4[R10], PUT_CHAR_BFR    ; Skip to first data byte.
                CLR     R9                      ; Offset := 0.
                CLR     R8                      ; Bit no. := 0.
                CLR     R5                      ; Set block 0 in RH5.
                LDB     RL0, RH5                ; RL0 := current block number.
                CALR    SET_BLOCK_LEN           ; R0 := length of current block.
                LDB     RL2, RL0                ; RL2 := length of block.
                CLRB    RL5                     ; RL5 = current sensor := 0.
SEND_CH_LP      CALR    SHADOW_POS              ; Locate a shadow.
                JR      C,SEND_CH1              ; If no shadow found, finish.
                INC     R7                      ; Increment shadow count.
                EXB     RH0, RL0                ; Put block # in RL0.
                BUFFER  4[R10], PUT_CHAR_BFR    ; Save shadow position (block).
                EXB     RH0, RL0                ; Put sensor # in RL0.
                BUFFER  4[R10], PUT_CHAR_BFR    ; Save shadow position (sensor).
                CALR    SHADOW_LEN              ; Get length of shadow.
                BUFFER  4[R10], PUT_CHAR_BFR    ; Save the length.
                JR      SEND_CH_LP
```

```
SEND_CH1        BUFFER  4[R10], GET_PTR_BFR     ; Set the data length.
                EX      R0, @SP
                BUFFER  4[R10], SET_PTR_BFR
                LD      R0, R7                  ; Set no. of shadows.
                BUFFER  4[R10], PUT_CHAR_BFR
                POP     R0, @SP                 ; Set pointer to end of data.
                BUFFER  4[R10], SET_PTR_BFR
                RET


SHADOW_POS
                LD      R0, R5                  ; Save cur block, sensor in R0.
                CALR    GET_PSA_BIT
                RET     C
                JR      Z,SHADOW_POS
                RET


SHADOW_LEN
                CLR     R0                      ; Length is at least 1.
SHAD_LEN_LP     INC     R0                      ; Increment shadow length.
                CALR    GET_PSA_BIT
                RET     Z                       ; End of shadow.
                RET     C                       ; End of array.
                JR      NOV,SHAD_LEN_LP         ; Not end of block.
                INC     R0                      ; Increment shadow length.
                RET                             ; End of block.


GET_PSA_BIT
                CP      R9, #CHAN_SET_LEN       ; Check for last word done.
                JR      NE,GT_PSA_B_1
                SETFLG  C                       ; End of bit array (set).
                RESFLG  Z, V
                RET
GT_PSA_B_1
                PUSHL   @SP, RR0
                LD      R1, R6[ R9]             ; R1 := current data word.
                CLR     R0                      ; Bit flag := 0.
                BIT     R1, R8                  ; Test current bit.
                TCC     NZ, R0                  ; Set bit flag if current bit = 1.
                INC     R8                      ; Update bit counter,
                AND     R8, #0FH                ;  and don't let it go > 15.
                JR      NZ,GT_PSA_B_2
                INC     R9, #2                  ; When bit 15 done, update offset.
GT_PSA_B_2
                INCB    RL5                     ; Update sensor number.
                CPB     RL5, RL2                ; End of block ?
                JR      LT,GT_PSA_RET_1         ; No, return.
                INCB    RH5                     ; Update block no.
                PUSH    @SP, R0                 ; Save R0.
                LDB     RL0, RH5                ; RL0 := block no.
                CALR    SET_BLOCK_LEN           ; R0 := length of current block.
                LDB     RL2, RL0                ; RL2 := current block length.
                POP     R0, @SP                 ; Restore R0.
                CLRB    RL5                     ; Set sensor = 0.
                TEST    R0
```

```
            RESFLG  C                       ; Show PSA not finished.
            SETFLG  V                       ; End of block.
            POPL    RR0, @SP
            RET

GT_PSA_RET_1
            TEST    R0                      ; Z-flag := current bit.
            RESFLG  C, V                    ; Show PSA, block not finished yet.
            POPL    RR0, @SP
            RET
SET_BLOCK_LEN   ; On entry: RL0 = block #, on exit R0 = length.
            PUSH    @SP, R1
            CLRB    RH0
            LDA     R1, BLOCK_LEN_TABLE
            ADD     R1, R0
            LDB     RL0, @R1
            POP     R1, @SP
            RET

BLOCK_LEN_TABLE BVAL    64, 64, 64, 32, 64, 64, 32, 0
            EVEN

LAST        EQU     $
            END
                                                                "Z8092"
            TITLE   " HBF  Dartboard RAM Space"
*****************************************************************
*                                                               *
*.                <<<   RAM   >>>                              *
*                                                               *
*            DARTBOARD STORAGE ALLOCATION                       *
*                    for the                                    *
*                    Z92/SBC                                    *
*                                                               *
*****************************************************************


            DATA

*           GLOBAL REFERENCES:

            GLB     STACK
            GLB     FMT_TYPE, GAME_NO
            GLB     X_CAL, Y_CAL
            GLB     N_PLAYERS
            GLB     ROUND_NO, PLAYER_NO, DART_NO
            GLB     ROUND_SCORE, CUR_PLYR_SCORE, DART_MOVEMENT
            GLB     SCORING, SCORES
            GLB     CBLK_CON, CBLK_PSA, CBLK_PBS, CBLK_SPK, CBLK_BIG
            GLB     BFR1, LEN1
            GLB     BFR_P, LEN_P
            GLB     BFR_SW, LEN_SW
            GLB     BFR_SPK, LEN_SPK
            GLB     BFR_BIG, LEN_BIG
            GLB     LAST_SCAN, LEN_LAST
            GLB     OLD_SCAN, LEN_OLD
            GLB     LEN_DARTS_BFR
```

```
            GLB     DART1_BEFORE, DART1_AFTER
            GLB     DART2_BEFORE, DART2_AFTER
            GLB     DART3_BEFORE, DART3_AFTER
            SPC     5
DEFBFR      MACRO   &LEN
            RMB     BFR_HEAD+&LEN
            EVEN
            MEND

            SKIP
*           SYSTEM STORAGE:

STACK       EQU     10000H  ; Top of ram.

FMT_TYPE    WVAL    0

X_CAL       LVAL    0
            WVAL    0

Y_CAL       LVAL    0
            WVAL    0

GAME_NO     WVAL    0                   ; 1 = count up, 2 = 301, 3 = 501.
N_PLAYERS   WVAL    0                   ; Number of players.
ROUND_NO    WVAL    0                   ; Current round number.
PLAYER_NO   WVAL    0                   ; Current player number.
DART_NO     WVAL    0                   ; Current dart number.
ROUND_SCORE WVAL    0                   ; Current round score.
CUR_PLYR_SCORE WVAL 0                   ; Current player's score.
DART_MOVEMENT WVAL  0                   ; +1 = went in, -1 = fell out.

SCORING     WVAL    0                   ; Address of current game's scoring routine.

SCORES      WVAL    0                   ; Player 1.
            WVAL    0                   ; Player 2.
            WVAL    0                   ; Player 3.
            WVAL    0                   ; Player 4.

CBLK_CON    WVAL    0                   ; SCREEN1_LU
            WVAL    0
            WVAL    BFR1

CBLK_BIG    WVAL    0                   ; SCREEN1_LU
            WVAL    0
            WVAL    BFR_BIG

CBLK_PSA    WVAL    0                   ; PSA_LU
            WVAL    0
            WVAL    BFR_P

CBLK_PBS    WVAL    0                   ; PBS_LU
            WVAL    0
            WVAL    BFR_SW

CBLK_SPK    WVAL    0                   ; SPEAKER_LU
            WVAL    0
            WVAL    BFR_SPK
```

```
                SKIP
BFR_HEAD        EQU     6

BFR1            EQU     $
LEN1            EQU     80
                RMB     LEN1+BFR_HEAD
                EVEN

BFR_BIG         EQU     $
LEN_BIG         EQU     80
                RMB     LEN_BIG+BFR_HEAD
                EVEN

BFR_P           EQU     $
LEN_P           EQU     200
                RMB     LEN_P+BFR_HEAD
                EVEN

BFR_SW          EQU     $
LEN_SW          EQU     20
                RMB     LEN_SW+BFR_HEAD
                EVEN

BFR_SPK         EQU     $
LEN_SPK         EQU     24
                RMB     LEN_SPK+BFR_HEAD
                EVEN

LAST_SCAN       EQU     $
LEN_LAST        EQU     200
                RMB     LEN_LAST+BFR_HEAD
                EVEN

OLD_SCAN        EQU     $

LEN_OLD         EQU     200
                RMB     LEN_OLD+BFR_HEAD
                EVEN

LEN_DARTS_BFR   EQU     40

DART1_BEFORE    DEFBFR  LEN_DARTS_BFR

DART1_AFTER     DEFBFR  LEN_DARTS_BFR

DART2_BEFORE    DEFBFR  LEN_DARTS_BFR

DART2_AFTER     DEFBFR  LEN_DARTS_BFR

DART3_BEFORE    DEFBFR  LEN_DARTS_BFR

DART3_AFTER     DEFBFR  LEN_DARTS_BFR

LAST            END
```

```
"REAL"   EXPAND
            TITLE   " MBF  Dartboard Real Numbers"

            GLB     D_SIDES
            GLB     CH1_BLK_INFO, CH2_BLK_INFO

            REAL_TYPE       Z82

D_SIDES     REAL    24

CH1_BLK_INFO                                                ; Block #:
            REAL  -12.0,   -6.4,    0,     1,     -3.15   ;  0
            REAL  -12.0,    0.0,    0,     1,     -3.15   ;  1
            REAL  -12.0,   +6.4,    0,     1,     -3.15   ;  2
            REAL  +12.0,   -9.6,  180,    -1,     +0.05   ;  3
            REAL  +12.0,   -3.2,  180,    -1,     -3.15   ;  4
            REAL  +12.0,   +3.2,  180,    -1,     -3.15   ;  5
            REAL  +12.0,   +9.6,  180,    -1,     -3.15   ;  6


CH2_BLK_INFO                                                ; Block #:
            REAL   -6.4,  +12.0,  270,     1,     -3.15   ;  0
            REAL    0.0,  +12.0,  270,     1,     -3.15   ;  1
            REAL   +6.4,  +12.0,  270,     1,     -3.15   ;  2
            REAL   -9.6,  -12.0,   90,    -1,     +0.05   ;  3
            REAL   -3.2,  -12.0,   90,    -1,     -3.15   ;  4
            REAL   +3.2,  -12.0,   90,    -1,     -3.15   ;  5
            REAL   +9.6,  -12.0,   90,    -1,     -3.15   ;  6


            END

"Z8002"
            TITLE   " MBF  Dartboard Scoring Routine"
*************************************************************
*                                                           *
*                  <<<  SCORE  >>>                          *
*                                                           *
*              DARTBOARD SCORING ROUTINE                    *
*                     for the                               *
*                     Z82/SBC                               *
*                                                           *
*************************************************************


            PROG


*           ENTRY POINTS:

            GLB     SCORE, RECT


*           EXTERNAL ROUTINES:

            EXT     ATN_, ATAN_
            EXT     SIN_, COS_
```

```
            EXT     SIGN_
            EXT     ABS_, INT_
            EXT     IENT_, DINT_
            EXT     IRND_, DRND_
            EXT     NUMBER_FORMAT_, FMT_TYPE
            EXT     FTOD_
            EXT     RTOI_, SQR_
            EXT     FCM_
            EXT     FAD_, FSB_
            EXT     FMP_, FDV_
            EXT     MPY_
            EXT     DFLOAT_, FLOAT_
            EXT     PACK_
            EXT     DFIX_, IFIX_, FIX_
            EXT     BUFFER_


*           EXTERNAL REFERENCES:

            EXT     X_CAL, Y_CAL
            EXT     CH1_BLK_INFO, CH2_BLK_INFO
            EXT     D_SIDES


*           EXTERNAL SYMBOLS:

            EXT     STANDARD_FMT, FLOAT_FMT
            EXT     PUT_CHAR_BFR, GET_NEXT_BFR
            EXT     GET_CHAR_BFR, BS_PTR_BFR
            EXT     GET_PTR_BFR, SET_PTR_BFR
            EXT     SWITCH_


            SKIP
*       REGISTER DEFINITIONS:
*_____________________________________
*      | R0                          |
*  RQ0 | R1   ______________________|
*      | R2   |s|m....MANT....|      |
*______|_R3___|.............||  FR1  |
*      | R4   |s|m___EXP___||_______|
*  RQ4 | R5   ______________________|
*      | R6   |s|m....MANT....|      |
*______|_R7___|.............||  FR2  |
*      | R8   |s|m....EXP....||_____|
*  RQ8 | R9   ______________________|
*      | R10  |s|m....MANT....|      |
*______|_R11__|.............||  FR3  |
*      | R12  |s|m___EXP___||_______|
*  RQ12 | R13                        |
*      | R14                         |
*______|_R15__Stack Pointer__________|


FQ1         EQU     RQ0
FR1         EQU     R2
MANTH_FR1   EQU     R2
```

```
MANTL_FR1       EQU     R3
MANT_FR1        EQU     RR2
EXP_FR1         EQU     R4
FR2             EQU     R6
MANTH_FR2       EQU     R6
MANTL_FR2       EQU     R7
MANT_FR2        EQU     RR6
EXP_FR2         EQU     R8
FR3             EQU     R10
MANTH_FR3       EQU     R10
MANTL_FR3       EQU     R11
MANT_FR3        EQU     RR10
EXP_FR3         EQU     R12
SP              EQU     R15


                SKIP
x           MACROS:


RLEN            EQU     6       ; Length of real numbers ( bytes ).


FLD             MACRO   &FR_DST, &FR_SRC
                LDL     MANT_&FR_DST, MANT_&FR_SRC
                LD      EXP_&FR_DST, EXP_&FR_SRC
                MEND


FLDM            MACRO   &FR_DST, &FR_SRC
                LDM     &FR_DST, &FR_SRC, #RLEN/2
                MEND

LDF             MACRO   &FR_DST, &SRC
                LDL     MANT_&FR_DST, #MANT_&SRC
                LD      EXP_&FR_DST, #EXP_&SRC
                MEND


FEX             MACRO   &FR_DST, &FR_SRC
                EX      MANTH_&FR_DST, MANTH_&FR_SRC
                EX      MANTL_&FR_DST, MANTL_&FR_SRC
                EX      EXP_&FR_DST, EXP_&FR_SRC
                MEND


PUSHF           MACRO   &FR_SRC
                PUSH    @SP, EXP_&FR_SRC
                PUSHL   @SP, MANT_&FR_SRC
                MEND


POPF            MACRO   &FR_DST
                POPL    MANT_&FR_DST, @SP
                POP     EXP_&FR_DST, @SP
                MEND
```

```
RVAL            MACRO   &LABEL          ; Allocate storage for reals.
MANT_&LABEL     RMB     4
EXP_&LABEL      RMB     2
                MEND


RINDEX          MACRO   &LABEL, &BASE   ; Create indexed real labels.
MANT_&LABEL     EQU     $-&BASE
EXP_&LABEL      EQU     $-(&BASE+4)
                MEND


BUFFER          MACRO   &BFR, &CODE
                PUSH    @SP, &BFR
                CALL    BUFFER_
                WVAL    &CODE
                MEND

                SKIP
*         MAIN ROUTINES:


*********************************************************************
*                                                                   *
*     SCORE  -  Converts the two angles from the lights to the dart *
*               to a score in R0 and a single, double, or triple    *
*               factor in R1.                                       *
*                                                                   *
*               Calling sequence:                                   *
*                       R0   := psa_1                               *
*                       R1   := psa_2                               *
*                       CALL    SCORE                               *
*                       ->                                          *
*                       R0   =  points                              *
*                       R1   =  factor                              *
*                                                                   *
*********************************************************************


SCORE           PUSHF   FR2
                PUSHF   FR1
                CALR    POLAR
                CALR    POINTS
SCORE_EXIT      POPF    FR1
                POPF    FR2
                RET


*********************************************************************
*                                                                   *
*     POINTS -  Converts the polar coordinates of the dart to       *
*               a score in R0 and a single, double, or triple       *
*               factor in R1.                                       *
*                                                                   *
*               Calling sequence:                                   *
*                       FR1  := a = distance                        *
*                       FR2  := T = angle                           *
```

```
*                    CALL    POINTS                          *
*                    ->                                      *
*                    R0   =  points                          *
*                    R1   =  factor                          *
*                                                            *
**************************************************************


POINTS          PUSHF   FR3
                PUSHF   FR2
                PUSHF   FR1
                FLD     FR3, FR1                ; Save distance.
                LDF     FR1, N9
                CALL    FAD_                    ; FR1 := T + 9 degrees.
                TEST    MANTH_FR1
                JR      PL,POINTS_1
                LDF     FR2, N360               ; If T+9 < 0
                CALL    FAD_                    ;  then FR1 := T+9 + 360.

POINTS_1         LDF     FR2, N18
                CALL    FDV_                    ; FR1 := (T+9)/18.
                CALL    IFIX_                   ; R0 := INT (T+9)/18.

                LD      R1, R0                  ; R1 := offset into table.
                LDB     RL0, [R1I #PTS_TABLE]   ; R0 := points scored.

                FLD     FR1, FR3                ; FR1 := distance.
                LDF     FR2, N_625
                CALL    FSB_
                TEST    MANTH_FR1               ; If a < 0.625
                JR      MI,BULLS_EYE            ;  then bull's eye !!!!

                FLD     FR1, FR3                ; FR1 := distance.
                LDF     FR2, N6_625
                CALL    FSB_
                TEST    MANTH_FR1               ; If a > 6.625
                JR      PL,NO_POINTS            ;  then missed :  no score.

                FLD     FR1, FR3
                LDF     FR2, N6_25
                CALL    FSB_
                TEST    MANTH_FR1               ; If a > 6.25
                JR      PL,DOUBLE_PTS           ;  then double !!

                FLD     FR1, FR3
                LDF     FR2, N4_125
                CALL    FSB_
                TEST    MANTH_FR1               ; If a > 4.125
                JR      PL,SINGLE_PTS           ;  then single !

                FLD     FR1, FR3
                LDF     FR2, N3_75
                CALL    FSB_
                TEST    MANTH_FR1               ; If a > 3.75
                JR      PL,TRIPLE_PTS           ;  then triple !!!

                JR      SINGLE_PTS
```

```
BULLS_EYE       NOP
                LD      R0, #25                 ; R0 := points for bull's eye.
                FLD     FR1, FR3                ; Get distance.
                LDF     FR2, N_25
                CALL    FSB_
                TEST    MANTH_FR1
                JR      MI,DOUBLE_PTS           ; Double points.
                JR      SINGLE_PTS

NO_POINTS       CLR     R0
                CLR     R1
                JR      POINTS_EXIT

SINGLE_PTS      LD      R1, #1
                JR      POINTS_EXIT

DOUBLE_PTS      SLA     R0                      ; Double points.
                LD      R1, #2                  ; Show double.
                JR      POINTS_EXIT

TRIPLE_PTS      LD      R1, R0
                SLA     R0
                ADD     R0, R1
                LD      R1, #3

POINTS_EXIT     POPF    FR1
                POPF    FR2
                POPF    FR3
                RET


PTS_TABLE       BVAL    6,13,4,18,1
                BVAL    20,5,12,9,14
                BVAL    11,8,16,7,19
                BVAL    3,17,2,15,10
                EVEN

                SKIP
*********************************************************************
*                                                                   *
*     POLAR  -  Converts the two angles from the lights to the dart *
*               to a distance and an angle from the center of the   *
*               dartboard.                                          *
*                                                                   *
*               Calling sequence:                                   *
*                       R0  := psa_1                                *
*                       R1  := psa_2                                *
*                       CALL    POLAR                               *
*                       ->                                          *
*                       FR1  =  a  =  distance                      *
*                       FR2  =  T  =  angle                         *
*                                                                   *
*********************************************************************


POLAR           CALR    RECT
                CALR    ADJUST
```

```
            CALR    RECT_2_POLAR
            RET

            SKIP
*****************************************************************
*                                                               *
* RECT_2_POLAR  -  Converts the x and y distances from the center *
*                  of the dartboard to an angle and a distance  *
*                  from the center of the dartboard.            *
*                                                               *
*            Calling sequence:                                  *
*                   FR1  := x                                   *
*                   FR2  := y                                   *
*                   CALL    RECT_2_POLAR                        *
*                   ->                                          *
*                   FR1  =  a  =  distance                      *
*                   FR2  =  T  =  angle                         *
*                                                               *
*****************************************************************


RECT_2_POLAR    PUSHF   FR3
                FEX     FR1, FR2            ; FR1 := y, FR2 := x.
                FLD     FR3, FR1            ; Save y.
                CALL    ATAN_               ; FR1 := T = ATAN ( y, x ).
                PUSHF   FR1                 ; Save T on stack.
                FLD     FR1, FR2
                CALL    FMP_                ; FR1 := x^2.
                FEX     FR1, FR3            ; Save x^2, get y.
                FLD     FR2, FR1
                CALL    FMP_                ; FR1 := y^2.
                FLD     FR2, FR3            ; FR2 := x^2.
                CALL    FAD_                ; FR1 := x^2 + y^2.
                CALL    SQR_                ; FR1 := a'' = SQR (x^2 + y^2).
                POPF    FR2                 ; FR2 := T.
                POPF    FR3
                RET

            SKIP
*****************************************************************
*                                                               *
*   ADJUST   -  Converts the  x, y  distances from the center of *
*               backboard to an  x, y  distance from the center *
*               of the dartboard by applying previously calculated *
*               calibration values,  xcal and ycal.             *
*                                                               *
*            Calling sequence:                                  *
*                   FR1  := x'                                  *
*                   FR2  := y'                                  *
*                   CALL    ADJUST                              *
*                   ->                                          *
*                   FR1  =  x''                                 *
*                   FR2  =  y''                                 *
*                                                               *
*****************************************************************
```

```
ADJUST          PUSHF   FR3
                FLD     FR3, FR2                ; Save y' in FR3.
                LDM     FR2, X_CAL, #3
                CALL    FAD_                    ; FR1 := x''.
                FEX     FR3, FR1                ; Save x''; get y'.
                LDM     FR2, Y_CAL, #3
                CALL    FAD_                    ; FR1 := y''.
                FLD     FR2, FR1                ; FR2 := y''.
                FLD     FR1, FR3                ; FR1 := x''.
                POPF    FR3
                RET

                SKIP
*********************************************************************
*                                                                   *
*     RECT   -  Converts the two angles from the lights to the dart *
*               to an  x, y  distance from the center of the        *
*               dartboard.                                          *
*                                                                   *
*               Calling sequence:                                   *
*                       R0   := psa_1                               *
*                       R1   := psa_2                               *
*                       CALL   RECT                                 *
*                       -)                                          *
*                       FR1  =  x                                   *
*                       FR2  =  y                                   *
*                                                                   *
*********************************************************************


RECT            PUSHF   FR3
                CALR    DEGREES                 ; FR1 := T1, FR2 := T2.
                FLD     FR3, FR2                ; FR3 := T2.
                CALL    FAD_                    ; FR1 := T1 + T2.
                FLD     FR2, FR1                ; FR2 := T1.
                LDF     FR1, N180               ; FR1 := 180 degrees.
                CALL    FSB_                    ; FR1 := 180 - (T1 + T2).
                CALL    SIN_                    ; FR1 := SIN (180 - (T1 + T2)).
                PUSHF   FR1                     ; Save divisor.
                FLD     FR1, FR3
                CALL    SIN_                    ; FR1 := SIN (T2).
                FLDM    FR2, C_DISTANCE         ; FR2 := c.
                CALL    FMP_                    ; FR1 := c * SIN (T2).
                POPF    FR2                     ; Retrieve divisor.
                CALL    FDV_                    ; FR1 := c*SIN(T2)/SIN(180-(T1+T2)).
                FLD     FR3, FR1                ; FR3 := a.
                FLDM    FR1, CH1_ANGLE          ; FR1 := A1.
                FLD     FR2, FR1                ; Save A1 in FR2.
                CALL    SIN_                    ; FR1 := SIN (A1).
                FEX     FR1, FR2                ; FR2 := SIN (A1), FR1 := A1.
                CALL    COS_                    ; FR1 := COS (A1).
                PUSHF   FR1                     ; Save COS (A1) on stack.
                FLD     FR1, FR3                ; FR1 := a.
                CALL    FMP_                    ; FR1 := y = a * SIN (A1).
                FEX     FR1, FR3                ; Save y, get a.
                POPF    FR2                     ; FR2 := COS (A1).
                CALL    FMP_                    ; FR1 := x = a * COS (A1).
```

```
            FLDM    FR2, CH1_X
            CALL    FAD_                    ; FR1 := x' = x + x0.
            FEX     FR1, FR3                ; Save x', get y.
            FLDM    FR2, CH1_Y              ; FR2 := height.
            CALL    FAD_                    ; FR1 := y' = y + y0.
            FLD     FR2, FR1                ; FR2 := y'.
            FLD     FR1, FR3                ; FR1 := x'.
            POPF    FR3
            RET

            SKIP
*****************************************************************
*                                                               *
*   DEGREES  -  Converts the two angles from the lights to the dart  *
*               from a position on the PSA's to an angle in degrees.  *
*                                                               *
*               Calling sequence:                               *
*                       R0   := psa_1                           *
*                       R1   := psa_2                           *
*                       CALL    DEGREES                         *
*                       -)                                      *
*                       FR1  =  T1                              *
*                       FR2  =  T2                              *
*                       CH1_INFO = CH1_BLK_INFO[ b1 ]           *
*                       CH2_INFO = CH2_BLK_INFO[ b2 ]           *
*                                                               *
*****************************************************************


DEGREES
            PUSH    @SP, R9
            PUSH    @SP, R5
            LDA     R5, CH1_INFO
            LDA     R9, CH1_BLK_INFO
            CALR    ANGLE
            EX      R0, R1
            FEX     FR1, FR2
            LDA     R5, CH2_INFO
            LDA     R9, CH2_BLK_INFO
            CALR    ANGLE
            EX      R0, R1
            FEX     FR1, FR2
            CALR    GET_C_DISTANCE
            FLDM    FR1, CH1_Ta
            FLDM    FR2, CH2_Ta
            POP     R5, @SP
            POP     R9, @SP
            RET

            SKIP
*****************************************************************
*                                                               *
*     ANGLE  -  Converts the position of the shadow on the PSA to  *
*               an angle (in degrees) from the light source to the  *
*               dart.                                           *
*                                                               *
```

```
*           Calling sequence:                                   *
*                   R0   := psa_n   ( bbbs ssss sxll llll )     *
*                                   b = block, s = sensor of start *
*                                   l = length of shadow        *
*                                   x = not used                *
*                   R5   := pointer to channel n's parameter area *
*                   R9   := pointer to channel n's block info area *
*                                                               *
*                   CALL    ANGLE                               *
*                   ->                                          *
*                   FR1  =  Tn                                  *
*                   CHn_INFO = CHn_BLK_INFO[ b ]                *
*                                                               *
*****************************************************************


ANGLE
            PUSHF   FR2
            PUSH    @SP, R9
            PUSHL   @SP, RR0                ; Save RR0 from FLOAT.
            CALR    SET_CH_INFO
            LD      R9, R0                  ; Save psa data.
            LDB     RL0, RH0                ; RL0 := start of shadow.
            CLRB    RH0
            CALL    FLOAT_
            FLD     FR2, FR1
            LD      R0, R9                  ; Restore psa data.
            CLRB    RH0
            DEC     R0                      ; Float (length - 1).
            CALL    FLOAT_
            DEC     EXP_FR1                 ; FR1 := (length - 1) / 2 .
            CALL    FAD_                    ; FR1 := center = (l-1)/2 + start.
            LDF     FR2, TENTH              ; FR1 := center / 10.
            CALL    FMP_                    ; Convert to inches.
            FLDM    FR2, CH_OFFSET[R5]
            CALL    FAD_                    ; FR1 := y = (Gcenter + offset).
            FLDM    FR2, D_SIDES            ; FR2 := distance between the sides.
            CALL    ATAN_                   ; FR1 := T0 = ATN( FR1/FR2 ) = ATN( y/x ).
            FLDM    FR2, CH_Tsign[R5]
            CALL    FMP_                    ; FR1 := T0 * Tsign.
            FLDM    FR2, CH_Tbase[R5]
            CALL    FAD_                    ; FR1 := T = T0 + Tbase.
            CALR    POS_ANGLE               ; Ensure that CH_ANGLE > 0.
            FLDM    CH_ANGLE[R5], FR1
            POPL    RR0, @SP
            POP     R9, @SP
            POPF    FR2
            RET


            SKIP
*****************************************************************
*                                                               *
*    GET_C_DISTANCE  -  Calculates the distance between the channel *
*                       1 LED and the channel 2 LED, and the direc- *
*                       tion ( angles ) from  led 1 - led 2.    *
*                                                               *
```

```
*            Calling sequence:                                  *
*                    CALL    GET_C_DISTANCE                     *
*                    ->                                         *
*                    C_DISTANCE = c                             *
*                    CH1_T      = Ch1_T                         *
*                    CH2_T      = Ch2_T                         *
*                                                               *
*****************************************************************


GET_C_DISTANCE
            PUSHF   FR3
            PUSHF   FR2
            PUSHF   FR1
            PUSH    @SP, R0
            FLDM    FR1, CH2_Y
            FLDM    FR2, CH1_Y
            CALL    FSB_            ; FR1 := Dy = y2 - y1.
            PUSHF   FR1             ; Save Dy on stack.
            LD      R0, #2
            CALL    RTOI_           ; FR1 := Dy^2.
            FLD     FR3, FR1
            FLDM    FR1, CH2_X
            CALL    FSB_            ; FR1 := Dx = x2 - x1.
            PUSHF   FR1             ; Save Dx on stack.
            LD      R0, #2
            CALL    RTOI_           ; FR1 := Dx^2.
            FLD     FR2, FR3        ; FR2 := Dy^2.
            CALL    FAD_            ; FR1 := ( Dx^2 + Dy^2 ).
            CALL    ABS_
            CALL    SQR_            ; FR1 := c = SQR( ABS( Dx^2 + Dy^2 ) ).
            FLDM    C_DISTANCE, FR1 ; Store c.
            POPF    FR2             ; FR2 := x.
            POPF    FR1             ; FR1 := y.
            CALL    ATAN_           ; FR1 := ATN( y/x ).
            CALR    POS_ANGLE       ; Ensure that CH1_ANGLE > 0.
            FLDM    CH1_T, FR1
            FLDM    FR2, CH1_ANGLE  ; FR2 := A1.
            CALL    FSB_            ; FR1 := T1 - A1.
            CALR    ACUTE_ANGLE     ; Ensure that Ta <= 180.
            CALL    ABS_
            FLDM    CH1_Ta, FR1
            FLDM    FR1, CH1_T      ; FR1 := Ch1_T.
            LDF     FR2, N180
            CALL    FSB_            ; FR1 := Ch2_T = ( Ch1_T - 180 ).
            CALR    POS_ANGLE       ; Ensure that CH2_ANGLE > 0.
            FLDM    CH2_T, FR1
            FLDM    FR2, CH2_ANGLE  ; FR2 := A2.
            CALL    FSB_            ; FR1 := T2 - A2.
            CALR    ACUTE_ANGLE     ; Ensure that Ta <= 180.
            CALL    ABS_
            FLDM    CH2_Ta, FR1
            POP     R0, @SP
            POPF    FR1
            POPF    FR2
            POPF    FR3
            RET
```

```
            SKIP
*****************************************************************
*                                                               *
*    SET_CH_INFO  -  Sets up the channel information table at R5 *
*                    from the block in R0 and the channel block *
*                    table in R9.                               *
*                                                               *
*            Calling sequence:                                  *
*                    R0   := psa_n   ( bbbs ssss sxll llll )    *
*                                    b = block, s = sensor of start *
*                                    l = length of shadow       *
*                                    x = not used               *
*                    R5   := pointer to channel n's parameter area *
*                    R9   := pointer to channel n's block info area *
*                                                               *
*                    CALL    SET_CH_INFO                        *
*                    ->                                         *
*                    RH0      = start                           *
*                    RL0      = length                          *
*                    CHn_INFO = CHn_BLK_INFO[ b ]               *
*                                                               *
*****************************************************************


SET_CH_INFO
            PUSHF   FR2
            PUSHF   FR1
            PUSH    @SP, R9
            PUSH    @SP, R5
            PUSH    @SP, R1
            PUSH    @SP, R0
            LD      R1, R0
            SRL     R1, #13                 ; R1 := block #.
            MULT    RR0, #CH_INFO_LEN
            LDA     R9, R9[ R1]             ; R9 := info for this block.
            LD      R1, #CH_INFO_LEN
            LDIR    @R5, @R9, R1

            POP     R0, @SP                 ; R0 := start, length.
            LDB     RL1, RL0
            SLL     R0, #1                  ; Position start in RH0.
            LDB     RL0, RL1                ; Restore length to RL0.
            AND     R0, #3F3FH              ; Mask off start & length.

            POP     R1, @SP
            POP     R5, @SP
            POP     R9, @SP
            POPF    FR1
            POPF    FR2
            RET

            SKIP
*****************************************************************
*                                                               *
*    ACUTE_ANGLE - Convert the angle in FR1 to an acute angle   *
*                  between  -180  and  +180  degrees.           *
*                                                               *
```

```
*           Calling sequence:                                   *
*                 FR1  := angle                                 *
*                                                               *
*                 CALL    ACUTE_ANGLE                           *
*                 -)                                            *
*                 FR1   = angle (modified)                      *
*                                                               *
*****************************************************************


ACUTE_ANGLE
            PUSHF   FR3
            PUSHF   FR2
            CALR    POS_ANGLE       ; Ensure that angle > 0.
            FLD     FR3, FR1
            LDF     FR2, N180       ; Check for angle > 180.
            CALL    FSB_            ; FR1 := angle - 180.
            FEX     FR1, FR3
            TEST    MANTH_FR3       ; If angle < 180
            JR      MI,ACU_ANG_1    ;  then exit.
            LDF     FR2, N360       ; Angle :- 360.
            CALL    FSB_
ACU_ANG_1
            POPF    FR2
            POPF    FR3
            RET

            SKIP
*****************************************************************
*                                                               *
*    POS_ANGLE - Convert the angle in FR1 to a positive angle   *
*                between  0  and  360  degrees.                 *
*                                                               *
*           Calling sequence:                                   *
*                 FR1  := angle                                 *
*                                                               *
*                 CALL    POS_ANGLE                             *
*                 -)                                            *
*                 FR1   = angle (modified)                      *
*                                                               *
*****************************************************************


POS_ANGLE
            PUSHF   FR2
            TEST    MANTH_FR1       ; Ensure that angle > 0.
            JR      PL,POS_ANG_1
            LDF     FR2, N360       ; Angle :+ 360.
            CALL    FAD_
POS_ANG_1
            POPF    FR2
            RET

            SKIP
*           SYSTEM STORAGE:
            DATA
CH1_INFO
```

```
CH1_X          RMB    RLEN
CH1_Y          RMB    RLEN
CH1_Tbase      RMB    RLEN
CH1_Tsign      RMB    RLEN
CH1_OFFSET     RMB    RLEN
CH_INFO_LEN    EQU    $-CH1_INFO
CH1_ANGLE      RMB    RLEN

CH2_INFO
CH2_X          RMB    RLEN
CH2_Y          RMB    RLEN
CH2_Tbase      RMB    RLEN
CH2_Tsign      RMB    RLEN
CH2_OFFSET     RMB    RLEN
CH2_ANGLE      RMB    RLEN


CH_X           EQU    CH1_X-CH1_INFO
CH_Y           EQU    CH1_Y-CH1_INFO
CH_Tbase       EQU    CH1_Tbase-CH1_INFO
CH_Tsign       EQU    CH1_Tsign-CH1_INFO
CH_OFFSET      EQU    CH1_OFFSET-CH1_INFO
CH_ANGLE       EQU    CH1_ANGLE-CH1_INFO

CH1_T          RMB    RLEN          ; Angle from led 1 - led 2.
CH2_T          RMB    RLEN          ; Angle from led 2 - led 1.
C_DISTANCE     RMB    RLEN          ; Distance from led 1 - led 2.
CH1_Ta         RMB    RLEN          ; T1 - A1.
CH2_Ta         RMB    RLEN          ; T2 - A2.

*              SYSTEM CONSTANTS:

MANT_ZER       EQU    0                     ;  0.0
EXP_ZER        EQU    0

MANT_ONE       EQU    40000000H             ;  1.0
EXP_ONE        EQU    1

MANT_M_ONE     EQU    80000000H             ; -1.0
EXP_M_ONE      EQU    0
MANT_TEN       EQU    50000000H             ;  10.0
EXP_TEN        EQU    4

MANT_TENTH     EQU    66666667H             ;  0.1
EXP_TENTH      EQU    -3

MANT_ONE_4     EQU    4E200000H             ;  1.0 E+4
EXP_ONE_4      EQU    0EH

MANT_ONE_M6    EQU    431BDE80H             ;  1.0 E-6
EXP_ONE_M6     EQU    0FFEDH

MANT_N_25      EQU    40000000H             ;  0.25
EXP_N_25       EQU    -1

MANT_N_625     EQU    50000000H             ;  0.625
EXP_N_625      EQU    0
```

```
MANT_N3_75      EQU     78000000H           ;  3.75
EXP_N3_75       EQU     2

MANT_N4_125     EQU     42000000H           ;  4.125
EXP_N4_125      EQU     3

MANT_N6_25      EQU     64000000H           ;  6.25
EXP_N6_25       EQU     3

MANT_N6_625     EQU     6A000000H           ;  6.625
EXP_N6_625      EQU     3

MANT_N9         EQU     48000000H           ;  9.0
EXP_N9          EQU     4

MANT_N15        EQU     78000000H           ;  15.0
EXP_N15         EQU     4

MANT_N18        EQU     48000000H           ;  18.0
EXP_N18         EQU     5

MANT_N30        EQU     78000000H           ;  30.0
EXP_N30         EQU     5

MANT_N90        EQU     5A000000H           ;  90.0
EXP_N90         EQU     7

MANT_N180       EQU     5A000000H           ;  180.0
EXP_N180        EQU     8

MANT_N360       EQU     5A000000H           ;  360.0
EXP_N360        EQU     9

MANT_N136_5     EQU     44400000H           ;  136.5
EXP_N136_5      EQU     8                   ;    = position of center shadow.

MANT_Sdeg       EQU     6BA72A33H           ;  0.2102597414
EXP_Sdeg        EQU     0FFFEH              ;    = psa space in degrees.

MANT_H0         EQU     44259B41H           ;  8.518362519
EXP_H0          EQU     4                   ;    = height of center from baseline.

MANT_Alpha      EQU     765E0CD5H           ;  27.59184579
EXP_Alpha       EQU     5                   ;    = angle from baseline to 136.5 spaces.
MANT_PI         EQU     6487ED53H           ;  3.141592654
EXP_PI          EQU     2

MANT_HALF_PI    EQU     6487ED53H           ;  pi / 2
EXP_HALF_PI     EQU     1


                END

                                                        "Z8002"
                TITLE   " Z8000  Speaker I/O Routines"
*************************************************************
*                                                           *
```

```
*                  <<<  SPK  >>>                          *
*                                                         *
*              SPEAKER  I / O  ROUTINES                   *
*                     for the                             *
*                     Z82/SBC                             *
*                                                         *
***********************************************************

            PROG

            INCLUDE IO_COM


*       ENTRY POINTS:

            GLB     DVR_SPEAKER


            SKIP
*       MAIN ROUTINES:

DVR_SPEAKER     PUSHL   @SP, RR0
                PUSHL   @SP, RR2
                PUSHL   @SP, RR4
                PUSHL   @SP, RR6
                PUSHL   @SP, RR8
                PUSHL   @SP, RR10
                LD      R1, 2[ R11]             ; R1 := select code.
                LD      R2, 2[ R10]             ; R2 := function code.
                LD      R3, 4[ R10]             ; R3 := buffer address.
                LD      R4, 8[ R11]             ; R4 := interface driver.
                LD      R5, 4[ R11]             ; R5 := device SU number.
                CP      R2, #INIT_CODE
                JR      EQ,SPEAKER_INIT
                CP      R2, #WRITE_CODE
                JR      EQ,GENERATE_SOUND
                SETFLG  V
                JP      SPEAKER_EXIT_

SPEAKER_INIT    CALL    @R4
                JP      SPEAKER_EXIT_OK

GENERATE_SOUND  BUFFER  R3, RESET_BFR

MAIN_LOOP       CALR    GET_PARMS
                JR      OV,SPEAKER_EXIT_OK
                TEST    R6                      ; If FREQUENCY is zero,
                JR      Z,PAUSE                 ;  it means a PAUSE.
                CALR    CALCULATE_PARMS
GEN_LOOP        LD      R2, #SPKON_CODE
                CALL    @R4
                LD      R9, R7
                CALR    WAIT_A_WHILE            ; Last for ON time in u seconds.
                LD      R2, #SPKOFF_CODE
                CALL    @R4
                LD      R9, R6
                CALR    WAIT_A_WHILE            ; Last for OFF time in u seconds.
                DJNZ    R0,GEN_LOOP
```

```
            JR      MAIN_LOOP

PAUSE       MULT    RR8, #1000          ; Convert to micro seconds.
            CALR    WAIT_A_WHILE
            JR      SPEAKER_EXIT_OK

GET_PARMS   BUFFER  R3, GET_NEXT_BFR
            RET     OV                  ; Ran out of buffer.
            LDB     RH6, RL0
            BUFFER  R3, GET_NEXT_BFR
            LDB     RL6, RL0            ; R6 := FREQUENCY of sound.
            BUFFER  R3, GET_NEXT_BFR
            LDB     RH7, RL0
            BUFFER  R3, GET_NEXT_BFR
            LDB     RL7, RL0            ; R7 := ON time percentage.
            BUFFER  R3, GET_NEXT_BFR
            LDB     RH0, RL0            ; R9 := DURATION time in m seconds.
            BUFFER  R3, GET_NEXT_BFR
            RET     OV                  ; Abnormal out of buffer.
            LD      R9, R0
            RET

CALCULATE_PARMS LDL RR10, #1000000
            DIV     RR10, R6            ; R11 := PERIOD time in u seconds.
            MULT    RR6, R11
            DIV     RR6, #100           ; R7 := ON time in u seconds.
            LD      R6, R11
            SUB     R6, R7              ; R6 := OFF time in u seconds.
            MULT    RR8, #1000          ; Change DURATION time into u seconds.
            DIV     RR8, R11
            LD      R0, R9              ; R0 := # of cycles.
            RET

WAIT_A_WHILE CLR    R8
            DIV     RR8, #3
            RET     LE
WAIT_LOOP   DJNZ    R9,WAIT_LOOP        ; Loop as many times as needed.
            RET

SPEAKER_EXIT_OK RESFLG V
SPEAKER_EXIT_ POPL  RR10, @SP
            POPL    RR8, @SP
            POPL    RR6, @SP
            POPL    RR4, @SP
            POPL    RR2, @SP
            POPL    RR0, @SP
            RET

            SKIP

LAST        EQU     $
            END

                                                    "Z8002"
            TITLE   " Z8000  Terminal Driver Routine"
*************************************************************
*                                                           *
```

```
*                <<<  TERM  >>>                          *
*                                                        *
*             TERMINAL DRIVER ROUTINES                   *
*                    for the                             *
*                    Z82/SBC                             *
*                                                        *
**********************************************************

            PROG

            INCLUDE IO_COM

*       ENTRY POINTS:

            GLB     DVR_TERMINAL


            SKIP
*       MAIN ROUTINES:

**************************************************************
*                                                            *
*    DEVICE DRIVERS                                          *
*                                                            *
*           R10 = control block                              *
*                 0 [R10] = device LU number                 *
*                 2 [R10] = function code                    *
*                 4 [R10] = buffer address                   *
*                                                            *
*           R11 = EQT entry                                  *
*                 0 [R11] = device LU number                 *
*                 2 [R11] = select_code                      *
*                 4 [R11] = device SU number                 *
*                 6 [R11] = device driver                    *
*                 8 [R11] = interface driver                 *
*                                                            *
*           R0 = character                                   *
*           R1 = select code                                 *
*           R2 = function code                               *
*           R3 = buffer address                              *
*           R4 = interface driver                            *
*           R5 = device SU number                            *
*                                                            *
**************************************************************

DVR_TERMINAL    PUSHL   @SP, RR0
                PUSHL   @SP, RR2
                PUSHL   @SP, RR4
                PUSHL   @SP, RR6
                PUSHL   @SP, RR8
                LD      R1, 2[R11]          ; R1 := select code.
                LD      R2, 2[R10]          ; R2 := function code.
                LD      R3, 4[R10]          ; R3 := buffer address.
                LD      R4, 8[R11]          ; R4 := interface driver.
                LD      R5, 4[R11]          ; R5 := device SU number.
                CP      R2, #READ_CODE
                JR      EQ,TERM_IN
                CP      R2, #WRITE_CODE
```

```
                JR      EQ,TERM_OUT
                CP      R2, #CONTROL_CODE
                JR      EQ,TERM_CONTROL
                CP      R2, #INIT_CODE
                JR      EQ,TERM_INIT
DVR_TERM_EX_ER  SETFLG  V
                JR      DVR_TERM_EXIT

TERM_INIT       CALL    @R4                     ; Call interface driver.
                JR      DVR_TERM_EX_OK

TERM_CONTROL    CALL    @R4                     ; Call interface driver.
                JR      DVR_TERM_EX_OK

TERM_IN_0       CALR    TERM_CHAR_OUT           ; Print RU/DEL.
                CALR    TERM_CR_LF

TERM_IN         PUSH    @SP, 4[R10]             ; Select buffer.
                CALL    BUFFER_
                WVAL    CLEAR_BFR
TERM_IN_NXT     CALL    @R4                     ; Call interface driver.
                AND     R0, #PARITY_MASK
                CPB     RL0, #ESC
                JR      EQ,TERM_ESCAPE
                CPB     RL0, #RU
                JR      EQ,TERM_IN_0
                CPB     RL0, #BS
                JR      NE,TERM_IN_1

                BUFFER  4[R10], BS_PTR_BFR

                JR      OV,TERM_IN_NXT
                LDB     RL0, #BS
                CALR    TERM_CHAR_OUT
                LDB     RL0, #SPACE
                CALR    TERM_CHAR_OUT
                LDB     RL0, #BS
                CALR    TERM_CHAR_OUT
                JR      TERM_IN_NXT

TERM_IN_1       CPB     RL0, #CR
                JR      EQ,TERM_IN_EOL

                PUSH    @SP, 4[R10]
                CALL    BUFFER_
                WVAL    PUT_CHAR_BFR

                JR      OV,TERM_IN_NXT          ; No echo if buffer full.
                CALR    TERM_CHAR_OUT
                JR      TERM_IN_NXT

TERM_IN_EOL     LDB     RL0, #CR
                CALR    TERM_CHAR_OUT
                LDB     RL0, #LF
                CALR    TERM_CHAR_OUT
                JR      DVR_TERM_EX_OK
TERM_OUT        LD      R2, #WR_CHAR_CODE

                PUSH    @SP, R3
```

```
                CALL    BUFFER_
                WVAL    RESET_BFR
TERM_OUT_NXT    PUSH    @SP, R3
                CALL    BUFFER_
                WVAL    GET_NEXT_BFR

                JR      OV,TERM_IN_EOL
*               JR      OV,DVR_TERM_EX_OK
                CALL    @R4
                JR      TERM_OUT_NXT

DVR_TERM_EX_OK  RESFLG  V
DVR_TERM_EXIT   POPL    RR8, @SP
                POPL    RR6, @SP
                POPL    RR4, @SP
                POPL    RR2, @SP
                POPL    RR0, @SP
                RET

TERM_CHAR_OUT   PUSH    @SP, R2
                LD      R2, #WR_CHAR_CODE
                CALL    @R4
                POP     R2, @SP
                RET

TERM_CR_LF      PUSH    @SP, R0
                LD      R0, #CR
                CALR    TERM_CHAR_OUT
                LD      R0, #LF
                CALR    TERM_CHAR_OUT
                POP     R0, @SP
                RET

TERM_ESCAPE     BUFFER  R3, BS_PTR_BFR
                JR      OV,PUT_ESC              ; #ESC is the first char.
                BUFFER  R3, GET_NEXT_BFR        ; Get previous char.
                CPB     RL0, #ESC
                JR      EQ,DEBUG                ; Double #ESC's, go to debug.
PUT_ESC         LD      R0, #ESC
                JP      TERM_IN_1               ; Put the #ESC char into buffer.
DEBUG           CALR    TERM_CR_LF
                SC      #27H                    ; Return to debug.


LAST            EQU     $
                END

                                                        "Z8002"
                TITLE   " MBF  Dartboard Utility Routines"
*************************************************************
*                                                           *
*                        UT                                 *
*                                                           *
*               AUTOMATIC SCORING SYSTEM                    *
*                        for                                *
*                     DARTBOARDS                            *
*                                                           *
*************************************************************
```

```
        PROG

*       ENTRY POINTS:

        GLB     SCAN, CAL_SCAN, CAL_RESET, DISPLAY_SHADOWS
        GLB     READ_SWITCH, CHECK_BREAK
        GLB     TERM_FUNCTION
        GLB     SET_STANDARD
        GLB     DISP_INT, PRT_INT, PRT_FPN, PRT_LINE
        GLB     PRT_BIG, SPEAK_OUT
        GLB     COPY_BFR_, APPEND_BFR_
        GLB     COPY_STR_, APPEND_STR_, TRIM_STR
        GLB     GET_N_SHADOWS, CHANNEL_TWO
        GLB     INIT_SCORES, SET_SCORE, READ_SCORE
        GLB     ADD_SCORE, UPDATE_SCORE, UPDATE_CP_SCORE
        GLB     MAKE_A_SOUND, START_SCREEN, STATUS_SCREEN
        GLB     SCORE_SCREEN, GOOD_S_SCREEN, BUSTED_SCREEN
        GLB     FLASHING, WAIT_HF_SEC

*       GLOBAL REFERENCES:

        GLB     CLEAR, HOME, ERASE_EOS, ERASE_EOL
        GLB     SOUND1, SOUND2, SOUND3, SOUND4, SOUND5

*       GLOBAL SYMBOLS:

        GLB     NXT_PLYR_SW, COIN_SW, CAL_SW
        GLB     GAME1_SW, GAME2_SW, GAME3_SW

        SKIP
*       EXTERNAL ROUTINES:

        EXT     IOC_
        EXT     BUFFER_
        EXT     SWITCH_
        EXT     SCORE
        EXT     RECT
        EXT     NUMBER_FORMAT_
        EXT     FTOD_
        EXT     FAD_, FSB_
        EXT     FMP_, FDV_
        EXT     DFLOAT_, FLOAT_

*       EXTERNAL REFERENCES:

        EXT     FMT_TYPE
        EXT     N_PLAYERS
        EXT     GAME_NO
        EXT     PLAYER_NO
        EXT     ROUND_NO
        EXT     ROUND_SCORE
        EXT     SCORES, CUR_PLYR_SCORE
        EXT     CBLK_CON, CBLK_PSA, CBLK_PBS, CBLK_SPK, CBLK_BIG
        EXT     BFR1, BFR_P, BFR_SW, BFR_SPK, BFR_BIG
```

```
*         EXTERNAL SYMBOLS:

              EXT     CONSOLE_LU
              EXT     PSA_LU, PBS_LU

              EXT     STANDARD_FMT, FLOAT_FMT
              EXT     GET_NEXT_BFR
              EXT     PUT_CHAR_BFR
              EXT     GET_CHAR_BFR
              EXT     INIT_BFR
              EXT     CLEAR_BFR
              EXT     RESET_BFR
              EXT     SET_PTR_BFR
              EXT     MAX_LEN_BFR
              EXT     CUR_LEN_BFR
              EXT     GET_PTR_BFR
              EXT     BS_LEN_BFR
              EXT     BS_PTR_BFR

              EXT     INIT_CODE
              EXT     READ_CODE
              EXT     WRITE_CODE
              EXT     STATUS_CODE
              EXT     CONTROL_CODE
              EXT     CALIB_CODE
              EXT     RD_CHAR_CODE
              EXT     WR_CHAR_CODE

              EXT     LEN1, LEN_P, LEN_SW
              EXT     SPACE, CR, LF, BS, ESC

              EXT     SCREEN0, SCREEN1, SCREEN2, SCREEN3, SCREEN4
              EXT     SWITCH_ON, SWITCH_OFF, GRAPHIC_TABLE

              SKIP
*         REGISTER DEFINITIONS:


FQ1           EQU     RQ0
FR1           EQU     R2
MANTH_FR1     EQU     R2
MANTL_FR1     EQU     R3
MANT_FR1      EQU     RR2
EXP_FR1       EQU     R4
FR2           EQU     R5
MANTH_FR2     EQU     R6
MANTL_FR2     EQU     R7
MANT_FR2      EQU     RR6
EXP_FR2       EQU     R8
FR3           EQU     R10
MANTH_FR3     EQU     R10
MANTL_FR3     EQU     R11
MANT_FR3      EQU     RR10
EXP_FR3       EQU     R12
SP            EQU     R15
```

```
*               SYSTEM CONSTANTS:


NXT_PLYR_SW     EQU     0
GAME3_SW        EQU     1
GAME2_SW        EQU     2
GAME1_SW        EQU     3
CAL_SW          EQU     GAME1_SW
COIN_SW         EQU     4
BREAK_SW        EQU     5

                SKIP

*           MACROS:


SCREEN          MACRO   &FUNCTION
                CALL    TERM_FUNCTION
                WVAL    &FUNCTION
                MEND


SETSRN          MACRO   &SCREEN_NO
                LD      CBLK_CON, #&SCREEN_NO
                LD      CBLK_CON+2, #WRITE_CODE
                MEND


SWITCH          MACRO   &SCREEN_NO
                LD      CBLK_CON, #&SCREEN_NO
                LD      CBLK_CON+2, #CONTROL_CODE
                PUSH    @SP, #CBLK_CON
                CALL    IOC_
                MEND


STRING          MACRO   &STRING
                WVAL    LEN&&&&
STR&&&&         ASCII   &STRING
LEN&&&&         EQU     $-STR&&&&
                EVEN
                MEND


DISP            MACRO   &STRING
                PUSH    @SP, #BFR1
                PUSH    @SP, #STR&&&&
                CALL    APPEND_STR_
                JR      END&&&&
STR&&&&         STRING  &STRING
END&&&&         EQU     $
                MEND


PRINT           MACRO   &STRING
                DISP    &STRING
                CALL    PRT_LINE
```

```
            MEND

PRBIG       MACRO   &STRING
            DISP    &STRING
            CALL    PRT_BIG
            MEND

PLINE       MACRO   &LINES
            .IF     &LINES .NE. "" SET_CNT
LOOP_CNT    .SET    1
            .GOTO   LOOP_TOP
SET_CNT     .NOP
LOOP_CNT    .SET    &LINES
LOOP_TOP    .NOP
            CALL    PRT_LINE
LOOP_CNT    .SET    LOOP_CNT-1
            .IF     LOOP_CNT .GT. 0 LOOP_TOP
            MEND

SPEAK       MACRO   &STRING
            PUSH    @SP, #&STRING
            CALL    SPEAK_OUT
            MEND

FLD         MACRO   &FR_DST, &FR_SRC
            LDL     MANT_&FR_DST, MANT_&FR_SRC
            LD      EXP_&FR_DST, EXP_&FR_SRC
            MEND

FEX         MACRO   &FR_DST, &FR_SRC
            EX      MANTH_&FR_DST, MANTH_&FR_SRC
            EX      MANTL_&FR_DST, MANTL_&FR_SRC
            EX      EXP_&FR_DST, EXP_&FR_SRC
            MEND

FLT         MACRO   &INT
            PUSHL   @SP, RR0
            LD      R0, &INT
            CALL    FLOAT_
            POPL    RR0, @SP
            MEND

PUSHF       MACRO   &FR_SRC
            PUSH    @SP, EXP_&FR_SRC
            PUSHL   @SP, MANT_&FR_SRC
            MEND

POPF        MACRO   &FR_DST
            POPL    MANT_&FR_DST, @SP
```

```
            POP     EXP_&FR_DST, @SP
            MEND


BUFFER      MACRO   &BFR, &CODE
            PUSH    @SP, &BFR
            CALL    BUFFER_
            WVAL    &CODE
            MEND

            SKIP
*       MAIN PROGRAM:

*****************************************************************
*                                                               *
*  SCAN        - Read the Photo-Sensor Array.                   *
*                                                               *
*                                                               *
*****************************************************************


SCAN        BUFFER  #BFR_P, CLEAR_BFR       ; Clear buffer to read PSA.

            LD      CBLK_PSA+2, #READ_CODE  ; Read the PSA.
            PUSH    @SP, #CBLK_PSA
            CALL    IOC_

            BUFFER  #BFR_P, RESET_BFR       ; Reset buffer to read shadow information.

            RET

            SPC     5
*****************************************************************
*                                                               *
*  CAL_RESET    - Reset the brightness levels of the LEDs to     *
*                 the minimum brightness in preperation for     *
*                 the calibration scan.                         *
*                                                               *
*****************************************************************


CAL_RESET
            LD      CBLK_PSA+2, #CONTROL_CODE       ; Reset the brightness.
            PUSH    @SP, #CBLK_PSA
            CALL    IOC_
            RET

            SPC     5
*****************************************************************
*                                                               *
*  CAL_SCAN     - Calibrate the Photo-Sensor Array.              *
*                 Automatically adjusts the brightness for each *
*                 sensor.                                       *
*                                                               *
*****************************************************************
```

```
CAL_SCAN        BUFFER  #BFR_P, CLEAR_BFR       ; Clear buffer to read PSA.

                LD      CBLK_PSA+2, #CALIB_CODE ; Calibrate the PSA.
                PUSH    @SP, #CBLK_PSA
                CALL    IOC_

                BUFFER  #BFR_P, RESET_BFR       ; Reset buffer to read shadow information.

                RET

                SKIP
*****************************************************************
*                                                               *
*   DISPLAY SHADOWS - Display the results of the PSA scan       *
*                     for diagnostic purposes.                  *
*                                                               *
*****************************************************************


DISPLAY_SHADOWS PUSHL   @SP, RR0
                BUFFER  #BFR_P, RESET_BFR

                LDB     RL1, #2

D_SHAD_LP1      CALL    PRT_LINE                ; Print the number of shadows.
                DISP    "     CHANNEL "

                CPB     RL1, #2
                JR      NE,D_SHAD_1
                DISP    "ONE"
                JR      D_SHAD_2

D_SHAD_1        DISP    "TWO"

D_SHAD_2        DISP    " NUMBER OF SHADOWS = "
                CALL    PRT_NUM
                CALL    PRT_LINE
                LDB     RH1, RL0
                TESTB   RH1
                JR      Z,D_SHAD_3

                PRINT   "START:             LENGTH:     "

D_SHAD_LP2      CALL    PRT_POSITION            ; Read the shadow position PSA Channel.
                CALL    PRT_NUM                 ; Read the shadow length PSA Channel.
                CALL    PRT_LINE

;               CALL    CHECK_BREAK             ; Pause on break switch.
                DBJNZ   RH1,D_SHAD_LP2

D_SHAD_3      ; CALL    PRT_LINE

                DBJNZ   RL1,D_SHAD_LP1          ; Do both channels.

                POPL    RR0, @SP
                RET
```

```
                SKIP
*****************************************************************
*                                                               *
*   READ SWITCH    -- Read the pushbutton switches and pass control   *
*                     to one of a list of addresses, according to     *
*                     which switch, if any, is pressed.               *
*                                                               *
*               CALL    READ_SWITCHES                           *
*               WVAL    transfer_address  ; No switch in list pressed. *
*               WVAL    switch_no, address                      *
*               .                                               *
*               WVAL    switch_no, address                      *
*               WVAL    -1                ; End of list.        *
*                                                               *
*****************************************************************
READ_SWITCH
                EX      R1, @SP                 ; R1 := pointer to xfer address.
                PUSH    @SP, R0
                PUSHL   @SP, RR2
                CALL    PBS_SCAN
                BUFFER  #BFR_SW, RESET_BFR
READ_SW_1       LD      R3, R1                  ; R3 := pointer to xfer address.
                BUFFER  #BFR_SW, GET_NEXT_BFR
                JR      OV,READ_SW_EXIT         ; End of buffer.
READ_SW_2       INC     R3, #2                  ; Point to switch # in list.
                POP     R2, @R3                 ; R2 := switch #.
                CPB     RL2, #-1                ; Check for end of list.
                JR      EQ,READ_SW_1            ; End: get next switch from buffer.
                CPB     RL2, RL0                ; Check for switch match.
                JR      NE,READ_SW_2            ; Not match: check next in list.
READ_SW_EXIT    LD      R1, @R3                 ; R1 := GOTO address.
                POPL    RR2, @SP
                POP     R0, @SP
                EX      R1, @SP
                RET


PBS_SCAN        LD      CBLK_PBS+2, #READ_CODE
                PUSH    @SP, #CBLK_PBS
                CALL    IOC_
                RET


                SKIP
*****************************************************************
*                                                               *
*   TRIM_STR      - Trim trailing zeros off of the buffer.      *
*                                                               *
*                                                               *
*        Calling sequence :                                     *
*                                                               *
*               PUSH    @SP, #BUFFER                            *
*               CALL    TRIM_STR                                *
*                                                               *
*****************************************************************
```

```
TRIM_STR        EX      R10, @SP
                EX      R10, 2[ SP]
                PUSHL   @SP, RR0
TRIM_STR_L      BUFFER  R10, GET_PTR_BFR
                TEST    R0
                JR      Z,TRIM_STR_EXIT
                BUFFER  R10, BS_PTR_BFR
                BUFFER  R10, GET_NEXT_BFR
                CPB     RL0, #" "
                JR      NE,TRIM_STR_EXIT
                BUFFER  R10, BS_PTR_BFR
                BUFFER  R10, BS_LEN_BFR
                JR      TRIM_STR_L

TRIM_STR_EXIT   POPL    RR0, @SP
                POP     R10, @SP
                RET

                SKIP
*******************************************************************
*                                                                 *
*   COPY_BFR_     - Copy source buffer to destination buffer.     *
*                                                                 *
*   APPEND_BFR_   - Append source buffer to destination buffer.    *
*                                                                 *
*                                                                 *
*        Calling sequence :                                       *
*                                                                 *
*               PUSH    @SP, DST_BFR                              *
*               PUSH    @SP, SRC_BFR                              *
*               CALL    COPY_BFR_ or APPEND_BFR_                  *
*                                                                 *
*******************************************************************


COPY_BFR_       BUFFER  4[SP], CLEAR_BFR
APPEND_BFR_     EX      R10, @SP                ; Change stack from :
                EX      R11, 2[ SP]             ;  (dst, src, ret) to:
                EX      R10, 4[ SP]             ;  (ret, RR10).
                EX      R10, R11                ; R10 := src, R11 := dst.
                PUSHL   @SP, RR0                ; Save RR0.
                BUFFER  R10, CUR_LEN_BFR
                TEST    R0
                JR      Z,COPY_BFR_EXIT         ; Exit if source buffer is empty.
                LD      R1, R0
                BUFFER  R10, GET_PTR_BFR
                PUSH    @SP, R0                 ; Save source pointer.
                BUFFER  R10, RESET_BFR
COPY_BFR_1      BUFFER  R10, GET_NEXT_BFR       ; Get a character from the source.
                BUFFER  R11, PUT_CHAR_BFR       ; Save the character in the destination.
                DJNZ    R1,COPY_BFR_1
                POP     R0, @SP                 ; Restore the source pointer.
                BUFFER  R10, SET_PTR_BFR
COPY_BFR_EXIT   POPL    RR0, @SP
                POPL    RR10, @SP
                RET
```

```
                SKIP
*****************************************************************
*                                                               *
*   COPY_STR_     - Copy source string to destination buffer.   *
*                                                               *
*   APPEND_STR_   - Append source string to destination buffer.  *
*                                                               *
*                                                               *
*        Calling sequence :                                     *
*                                                               *
*                PUSH    @SP, DST_BFR                           *
*                PUSH    @SP, SRC_STR                           *
*                CALL    COPY_STR_ or APPEND_STR_               *
*                                                               *
*****************************************************************


COPY_STR_       BUFFER  4[SP], CLEAR_BFR
APPEND_STR_     EX      R10, @SP                ; Change stack from :
                EX      R11, 2[ SP]             ;  (dst, src, ret) to:
                EX      R10, 4[ SP]             ;  (ret, RR10).
                EX      R10, R11                ; R10 := src, R11 := dst.
                PUSHL   @SP, RR0                ; Save RR0.
                POP     R1, @R10                ; R1 := string length.
                TEST    R1
                JR      Z,COPY_STR_EXIT         ; Exit if source string is empty.
COPY_STR_1      LDB     RL0, @R10               ; Get a character from the source.
                BUFFER  R11, PUT_CHAR_BFR       ; Save the character in the destination.
                INC     R10
                DJNZ    R1,COPY_STR_1
COPY_STR_EXIT   POPL    RR0, @SP
                POPL    RR10, @SP
                RET


                SKIP
*****************************************************************
*                                                               *
*   TERM_FUNCTION - Perform the desired operation on the        *
*                   system terminal.                            *
*                                                               *
*                                                               *
*        Calling sequence :                                     *
*                                                               *
*                CALL    TERM_FUNCTION                          *
*                WVAL    function code                          *
*                                                               *
*                                                               *
*        Functions provided :                                   *
*                                                               *
*                HOME        ( ESC.H )                          *
*                CLEAR       ( ESC.L )                          *
*                ERASE_EOL   ( ESC.I )                          *
*                ERASE_EOS   ( ESC.J )                          *
*                                                               *
*****************************************************************
```

```
TERM_FUNCTION   EX      R1, @SP
                PUSH    @SP, R0
                POP     R0, @R1                 ; R0 := function code.
                EXB     RL0, RH0
                BUFFER  #BFR1, PUT_CHAR_BFR
                EXB     RL0, RH0
                BUFFER  #BFR1, PUT_CHAR_BFR
                POP     R0, @SP
                EX      R1, @SP
                RET

ESC_            EQU     27*100H
HOME            EQU     ESC_+"H"
CLEAR           EQU     ESC_+"L"
ERASE_EOL       EQU     ESC_+"I"
ERASE_EOS       EQU     ESC_+"J"

                SKIP
*****************************************************************
*                                                               *
*   GET_N_SHADOWS - Get the number of shadows in the PSA buffer.  *
*                                                               *
*        Calling sequence :                                     *
*                                                               *
*               PUSH    @SP, BFR                                *
*               CALL    GET_N_SHADOWS                           *
*               -)      RH0 = ch. 1, RL0 = ch. 2.               *
*                                                               *
*****************************************************************

GET_N_SHADOWS   EX      R10, @SP
                EX      R10, 2[ SP]
                BUFFER  R10, RESET_BFR
                BUFFER  R10, GET_CHAR_BFR
                LDB     RH0, RL0
                PUSH    @SP, R10
                CALL    CHANNEL_TWO
                BUFFER  R10, GET_CHAR_BFR
                POP     R10, @SP
                RET

                SKIP
*****************************************************************
*                                                               *
*   CHANNEL_TWO   - Set the desired buffer pointer to the       *
*                   PSA Channel Two information.                *
*                                                               *
*        Calling sequence :                                     *
*                                                               *
*               PUSH    @SP, BFR                                *
*               CALL    CHANNEL_TWO                             *
*                                                               *
*****************************************************************


CHANNEL_TWO     EX      R10, @SP
                EX      R10, 2[ SP]
```

```
            PUSHL   @SP, RR0
            BUFFER  R10, RESET_BFR
            BUFFER  R10, GET_NEXT_BFR
            LDB     RL1, RL0                ; R1 := no of shadows
            CLRB    RH1                     ;  for channel 1.
            BUFFER  R10, GET_PTR_BFR        ; R0 := pointer.
            ADD     R0, R1                  ; R0 := pointer + 3 * no. of shadows.
            ADD     R0, R1
            ADD     R0, R1
            BUFFER  R10, SET_PTR_BFR        ; Set pointer to channel 2 data.
            POPL    RR0, @SP
            POP     R10, @SP
            RET

            SKIP
*****************************************************************
*                                                               *
*   SCORE ROUTINES - Initialize, add, read, reset, and display  *
*                    the score(s).                              *
*                                                               *
*                                                               *
*****************************************************************

INIT_SCORES     LD      SCORES, R0
                LD      SCORES+2, R0
                LD      SCORES+4, R0
                LD      SCORES+6, R0
                RET

SET_SCORE       PUSH    @SP, R1
                CALR    GET_PLYR_SCORE
                CLR     @R1
                POP     R1, @SP
                RET

READ_SCORE      PUSH    @SP, R1
                CALR    GET_PLYR_SCORE
                LD      R0, @R1
                POP     R1, @SP
                RET

ADD_SCORE       PUSHL   @SP, RR0
                LDA     R1, ROUND_SCORE
                ADD     R0, @R1
                LD      @R1, R0
                POPL    RR0, @SP
                RET

UPDATE_CP_SCORE                         ; Update the current player's score.
                TEST    R0              ; Score is in R0.
                RET     Z
                PUSH    @SP, R0
                CP      GAME_NO, #1     ; Is it COUNT-UP game ?
                JR      EQ,UPDATE_CP_
                NEG     R0              ; No, subtract the score in 301 & 501.
UPDATE_CP_      ADD     R0, CUR_PLYR_SCORE
                LD      CUR_PLYR_SCORE, R0
```

```
            POP     R0, @SP
            RET

UPDATE_SCORE
            PUSHL   @SP, RR0
            CALR    GET_PLYR_SCORE
            LD      R0, CUR_PLYR_SCORE
            LD      @R1, R0                 ; Update the total score.
            CLR     ROUND_SCORE
            POPL    RR0, @SP
            RET

GET_PLYR_SCORE LD   R1, PLAYER_NO           ; R1 := address of current player's score.
            DEC     R1
            SLA     R1
            LDA     R1, SCORES[ R1]
            RET


            SKIP
*****************************************************************
*                                                               *
*   MAKE_A_SOUND  - Generate a sound for certain score.         *
*                                                               *
*           At entry: R0 := the score of this throw.            *
*                                                               *
*****************************************************************

MAKE_A_SOUND CP     R0, #50
            JR      LT,NEXT
            SPEAK   SOUND3                  ; Good shot !!
            CALL    GOOD_S_SCREEN
            RET
NEXT        TEST    R0
            JR      Z,NEXT1                 ; Dart is off the board.
            JR      MI,NEXT2                ; Dart fell out of the board.
            SPEAK   SOUND3                  ; Dart goes into the board.
            RET
NEXT1       SPEAK   SOUND5
            RET
NEXT2       SPEAK   SOUND5
            RET
            SKIP
*****************************************************************
*                                                               *
*   CHECK_BREAK   - Check the break switch.                     *
*                                                               *
*           Assume that the break switch has been pressed.      *
*           Pause until break switch is depressed again.        *
*                                                               *
*****************************************************************

CHECK_BREAK
            CALR    READ_SWITCH
            WVAL    CHECK_BREAK             ; Wait until pressed again.
            WVAL    BREAK_SW, CHK_BRK_EXIT  ; Exit when pressed.
            WVAL    -1
```

```
CHK_BRK_EXIT    RET


                SKIP
*****************************************************************
*                                                               *
*   SCREEN ROUTINES - To build and display screens; also provide *
*                     FLASHING function.                        *
*                                                               *
*                                                               *
*****************************************************************


START_SCREEN    SETSRN  SCREEN1
                SCREEN  CLEAR
*               CALL    TURNOFF
                PLINE   2
                PRINT   "          DARTBOARD GAME"
                PLINE   2
                PRINT   "1. TO PLAY DARTS, DEPOSIT PROPER NUMBER"
                PRINT   "   OF COINS AND THEN SELECT A GAME."
                PLINE   2
                PRINT   "2. DEPOSIT 25 CENTS PER PLAYER TO PLAY"
                PRINT   "   'COUNT-UP' OR '301 COUNT-DOWN' GAME."
                PLINE   2
                PRINT   "3. DEPOSIT 50 CENTS PER PLAYER TO PLAY"
                PRINT   "   'REGULATION 501'. SINGLE IN - DOUBLE"
                PRINT   "   OUT."
                PLINE   2
                PRINT   "4. FOUR PLAYERS MAXIMUM PER GAME."
                PLINE   2
                PRINT   "5. HIGH SCORE ON COUNT-UP IS 1000."
                SWITCH  SCREEN1
                RET

STATUS_SCREEN   PUSHL   @SP, RR0
                PUSHL   @SP, RR8
*               CALL    TURNOFF
                SETSRN  SCREEN1
                SCREEN  CLEAR
                PLINE
                CLR     R1                      ; R1 := score table index.
                LDK     R8, #1                  ; R8 := player index.
                LD      R9, N_PLAYERS
DISP SCORES     DISP    "  * PLAYER # "
                LD      R0, R8
                CALL    DISP_INT
                DISP    "'S SCORE IS "
                LD      R0, SCORES[ R1]
                CALL    DISP_INT
                PLINE   2
                INC     R1, #2
                INC     R8
                DJNZ    R9,DISP_SCORES

                PLINE
                DISP    " ROUND NUMBER : "
```

```
                LD      R0, ROUND_NO
                CALL    DISP_INT
                CALL    PRT_BIG
                PLINE
                PLINE
                DISP    " PLAYER  UP   : "
                LD      R0, PLAYER_NO
                CALL    DISP_INT
                CALL    PRT_BIG
                PLINE
;               DISP    " ROUND SCORE  : "
;               LD      R0, ROUND_SCORE
;               CALL    DISP_INT
;               CALL    PRT_BIG
;               PLINE
                DISP    " CURRENT SCORE: "
                LD      R0, CUR_PLYR_SCORE
                CALL    DISP_INT
                CALL    PRT_BIG
                POPL    RR8, @SP
                POPL    RR0, @SP
                SWITCH  SCREEN1
                RET

SCORE_SCREEN
*               CALL    TURNOFF
                SETSRN  SCREEN1
                CALR    BUILD_SCORE_SCREEN
                SWITCH  SCREEN1

                SETSRN  SCREEN2
                CALR    BUILD_SCORE_SCREEN
                PLINE
                PRBIG   "   REMOVE DARTS"
                RET

BUILD_SCORE_SCREEN
                PUSHL   @SP, RR0
                PUSHL   @SP, RR8
                SCREEN  CLEAR
                PLINE   2
                CLR     R1                      ; R1 := score table index.
                LDK     R8, #1                  ; R8 := player index.
                LD      R9, N_PLAYERS
BLD_SCORE_1     DISP    "   PLAYER "
                LD      R0, R8
                CALL    DISP_INT
                DISP    "  "
                LD      R0, SCORES[ R1]
                CALL    DISP_INT
                CALL    PRT_BIG
                PLINE
                INC     R1, #2
                INC     R8
                DJNZ    R9,BLD_SCORE_1
                POPL    RR8, @SP
                POPL    RR0, @SP
                RET
```

```
GOOD_S_SCREEN   PUSH    @SP, R9
*               CALL    TURNOFF
                SETSRN  SCREEN1
                SCREEN  CLEAR
                PLINE   5
                PRBIG   "     JOLLY "
                PLINE   3
                PRBIG   "     GOOD  "
                PLINE   3
                PRBIG   "     SHOT  "
*               CALL    TURNON
                LD      R9, #5
DELAY_3_SEC     CALL    WAIT_HF_SEC
                DJNZ    R9,DELAY_3_SEC
                POP     R9, @SP
                RET

BUSTED_SCREEN   PUSH    @SP, R9
*               CALL    TURNOFF
                SETSRN  SCREEN1
                SCREEN  CLEAR
                PLINE   4
                PRBIG   "     AW    "
                PLINE   2
                PRBIG   "     S**T  "
                PLINE   2
                PRBIG   "     YOU   "
                PLINE   2
                PRBIG   "     BUSTED "
*               CALL    TURNON
                CALL    WAIT_HF_SEC
                SETSRN  SCREEN2
                SCREEN  CLEAR
                PLINE
                LD      R9, #5
FLASH_5_SEC     CALL    FLASHING
                DJNZ    R9,FLASH_5_SEC
                POP     R9, @SP
                RET


FLASHING        SWITCH  SCREEN2
                CALL    WAIT_HF_SEC
                SWITCH  SCREEN1
                CALL    WAIT_HF_SEC
                RET

WAIT_HF_SEC     EQU     $
                LDL     RR12, #500000   ; 500 mSec.
                DIV     RR12, #60/4     ; 60 cycles/4 MHz = 15 uSec/loop.
WAIT_LOOP       NOP                     ; Delay 7+1 cycles.
                NOP                     ; Delay 7+1 cycles.
                NOP                     ; Delay 7+1 cycles.
                NOP                     ; Delay 7+1 cycles.
```

```
            NOP                     ; Delay 7+1 cycles.
            NOP                     ; Delay 7+1 cycles.
            DJNZ   R13,WAIT_LOOP    ; Delay 11+1 cycles.
            RET

TURNON      LD     R0, #SWITCH_ON
            JR     TURN_
TURNOFF     LD     R0, #SWITCH_OFF
TURN_       BUFFER #BFR1, PUT_CHAR_BFR     ; Put control value into buffer.
            LDL    RR12, CBLK_CON          ; Keep LU number and function code.
            LD     CBLK_CON, #SCREEN0
            LD     CBLK_CON+2, #CONTROL_CODE
            PUSH   @SP, #CBLK_CON
            CALL   IOC_
            BUFFER #BFR1, CLEAR_BFR
            LDL    CBLK_CON, RR12          ; Restore LU number and function code.
            RET

            SKIP

*           SUBROUTINES:

SET_STANDARD LD    FMT_TYPE, #STANDARD_FMT
            RET

PRT_POSITION
            BUFFER #BFR_P, GET_NEXT_BFR    ; Read number.
            CALL   DISP_INT
            DISP   ", "
            CALL   PRT_NUM
            LD     R0, #15
            BUFFER #BFR1, SET_PTR_BFR
            RET

PRT_NUM     BUFFER #BFR_P, GET_NEXT_BFR    ; Read number.
            CALL   PRT_INT
            RET

DISP_INT    CALL   PRT_INT
            PUSH   @SP, #BFR1
            CALL   TRIM_STR
            RET

PRT_INT     NOP
            FLT    R0
            CALR   PRT_FPN
            RET

PRT_FPN     PUSH   @SP, #BFR1
            CALL   NUMBER_FORMAT_
            RET

PRT_LINE    SCREEN ERASE_EOL
            LD     CBLK_CON+2, #WRITE_CODE
            PUSH   @SP, #CBLK_CON
            CALL   IOC_
            BUFFER #BFR1, CLEAR_BFR
            RET
```

```
SKIP

Convert to big characters and print.

PRT_BIG         PUSH    @SP, R0
                PUSHL   @SP, RR8
                PUSHL   @SP, RR10
                LDA     R10, BFR1
                LDA     R11, BFR_BIG
                BUFFER  R10, CUR_LEN_BFR
                CP      R0, #19                 ; Should not be more than 19 chars.
                JR      GT,PRINT_BIG_EXIT
                CLR     R0
                BUFFER  R11, CLEAR_BFR
                BUFFER  R10, RESET_BFR
PRO_LINE_1      BUFFER  R10, GET_NEXT_BFR
                JR      OV,NXT_LINE
                LD      R9, R0
                SUB     R9, #SPACE              ; Convert character into index.
                LDB     RL0, GRAPHIC_TABLE[ R9]
                ADDB    RL0, #SPACE             ; Later will be subtracted.
                BUFFER  R11, PUT_CHAR_BFR
                INCB    RL0
                BUFFER  R11, PUT_CHAR_BFR
                JR      PRO_LINE_1

NXT_LINE        LDB     RL0, #CR
                BUFFER  R11, PUT_CHAR_BFR
                LDB     RL0, #LF
                BUFFER  R11, PUT_CHAR_BFR
                BUFFER  R10, RESET_BFR

PRO_LINE_2      BUFFER  R10, GET_NEXT_BFR
                JR      OV,PRINT_2_LINES
                LD      R9, R0
                SUB     R9, #SPACE              ; Convert character into index.
                LDB     RL0, GRAPHIC_TABLE[ R9]
                ADDB    RL0, #SPACE             ; Later will be subtracted.
                INCB    RL0, #2
                BUFFER  R11, PUT_CHAR_BFR
                INCB    RL0
                BUFFER  R11, PUT_CHAR_BFR
                JR      PRO_LINE_2

PRINT_2_LINES   LDB     RL0, #LF
                BUFFER  R11, PUT_CHAR_BFR
                LD      R8, CBLK_CON
                LD      CBLK_BIG, R8
                LD      CBLK_BIG+2, #WRITE_CODE
                PUSH    @SP, #CBLK_BIG
                CALL    IOC_

PRINT_BIG_EXIT  BUFFER  R10, CLEAR_BFR
                POPL    RR10, @SP
                POPL    RR8, @SP
                POP     R0, @SP
                RET

                SKIP
```

```
*           Generate Sound routine.

SPEAK_OUT   EX      R10, @SP
            EX      R11, 2[ SP]
            PUSH    @SP, #BFR_SPK
            PUSH    @SP, R11
            CALL    COPY_STR_
            LD      CBLK_SPK+2, #WRITE_CODE
            PUSH    @SP, #CBLK_SPK
            CALL    IOC_
            LD      R11, R10
            POP     R10, @SP
            EX      R11, @SP
            RET

            SKIP

*           Sound Strings Definitions :

SOUND1      WVAL    SND_END1-($+2)          ; String length.
            WVAL     750, 25, 10
            WVAL    1000, 15, 10
            WVAL     750, 25, 20
            WVAL    1000, 15, 10
            WVAL     750, 25, 10            ; String for COIN switch.
            WVAL    1000, 15, 20
            WVAL     750, 25, 10
            WVAL    1000, 15, 10
            WVAL     750, 25, 20
            WVAL    1000, 15, 10
            WVAL     750, 25, 10
            WVAL    1000, 15, 20
SND_END1    EQU     $

SOUND2      WVAL    SND_END2-($+2)          ; String length.
            WVAL    1250, 30, 30
            WVAL     500, 15, 30            ; String for GAME SELECT and
            WVAL    1250, 30, 30            ;  NEXT PLAYER switches.
SND_END2    EQU     $

SOUND3      WVAL    SND_END3-($+2)          ; String length.
            WVAL     400, 20,  5
            WVAL    2000, 20,  5            ; Dart goes into the board.
            WVAL    4000, 20, 15
SND_END3    EQU     $

SOUND4      WVAL    SND_END4-($+2)          ; String length.
            WVAL    2000, 40, 30
            WVAL    1500, 40, 30
            WVAL    1250, 40, 30
            WVAL    1000, 40, 30
            WVAL     750, 40, 30            ; Dart is off the board.
            WVAL     500, 40, 30
            WVAL     250, 40, 30
SND_END4    EQU     $

SOUND5      WVAL    SND_END5-($+2)          ; String length.
            WVAL    2000, 50, 10
```

```
            WVAL    1250, 25, 10
            WVAL    1500, 50, 20
            WVAL    1000, 25, 10
            WVAL    1250, 50, 10          ; Dart fell out of the board.
            WVAL     800, 25, 20
            WVAL    1000, 50, 10
            WVAL     600, 25, 10
            WVAL     750, 50, 20
            WVAL     500, 25, 10
            WVAL     600, 50, 10
            WVAL     200, 25, 20
            WVAL     400, 50, 10
            WVAL     200, 25, 10
            WVAL     300, 50, 20
SND_END5    EQU     $


            END

                                                        "Z8002"
            TITLE   " Z8000  VDP 9918 Driver Routine"
*************************************************************
*                                                           *
*                 <<<  VDP  >>>                             *
*                                                           *
*               VDP DRIVER ROUTINES                         *
*                    for the                                *
*                    Z82/SBC                                *
*                                                           *
*************************************************************

            PROG

            INCLUDE IO_COM

*       ENTRY POINTS:

            GLB     DVR_VDP9918


*       GLOBAL REFERENCES:

            GLB     SWITCH_ON, SWITCH_OFF
            GLB     GRAPHIC_TABLE


*       EXTERNAL REFERENCES:

            EXT     CONSOLE_LU
            EXT     SCREEN0_LU
            EXT     SCREEN1_LU
            EXT     SCREEN2_LU
            EXT     SCREEN3_LU
            EXT     SCREEN4_LU

            EXT     SCREEN0_SU
```

```
                SKIP
*               SYSTEM CONSTANTS :

CURSOR          EQU     127
SWITCH_ON       EQU     1
SWITCH_OFF      EQU     0

TURNON_MASK     EQU     40H                     ; Bit one of Control Register #1.
TURNOFF_MASK    EQU     0BFH

                SKIP
*         MAIN ROUTINES:

*****************************************************************
*                                                               *
*     INTERFACE DRIVERS                                         *
*                                                               *
*               R0 = character                                  *
*               R1 = select code                                *
*               R2 = function code                              *
*               R3 = buffer address                             *
*               R5 = device SU number                           *
*                                                               *
*                                                               *
*****************************************************************


DVR_VDP9918     CP      R2, #INIT_CODE
                JR      EQ,VIDEO_INIT
                CP      R2, #WR_CHAR_CODE
                JR      EQ,SCREEN_DISP
                CP      R2, #CONTROL_CODE
                JP      EQ, VIDEO_CNTL
                SETFLG  V                       ; Undefined Control Code.
                RET

VIDEO_INIT      PUSHL   @SP, RR0
                OR      R1, #9                  ; R1 := reset port address.
                OUT     @R1, R0                 ; Reset TMS 9918 VDP.
                POPL    RR0, @SP

                PUSHL   @SP, RR0
                PUSHL   @SP, RR2
LD_REG_VAL      LDA     R2, REGVALS             ; Load source data address.
                CLR     R3                      ; R3 :=  Control Register index.
LD_REG_LOOP     LDB     RH0, RL3                ; RH0 := Control Register index.
                LDB     RL0, @R2                ; RL0 := Control Register value.
                CALR    WR_REG_VDP
                LDB     REG_TBL[ R3], RL0
                INC     R2
                INC     R3
                CP      R3, #7                  ; Is it finished ?
                JP      LE, LD_REG_LOOP

LD_GEN_TBL      LD      R0, PTGENADR            ; Set Pattern Generator table base address.
                CALR    WR_ADDR_SET
                LDA     R2, PTGENTBL            ; R2 := source table address.
```

```
            LD      R3, PTGENLEN            ; R3 := table size.
*           OTIRB   @R1, @R2, R3            ; Load whole table.
            CALL    VDP_OTIRB

LD_SCR_TBL  LDA     R2, SCREEN_TBL
            LDA     R3, SCREEN_INFO
            LDA     R0, SCR_TBL_LEN         ; Initialize screen table in RAM.
            LDIRB   @R2, @R3, R0

INIT_SCREEN CLR     R9
            CALR    CLEAR_SCREEN

            POPL    RR2, @SP                ; End of initialization.
            POPL    RR0, @SP
            RET

            SKIP

*           Screen Processor for TMS 9918 VDP.

SCREEN_DISP CP      R5, #1
            JR      LT,ILL_SCREEN           ; Check for illegal screen.
            CP      R5, #4
            JR      GT,ILL_SCREEN
*           CALR    ERASE_CURSOR
            LD      R9, R5                  ; R5 := device SU number.
            DEC     R9                      ; R9 := displacement of the screen tables.
            SLL     R9
            CPB     RL0, #ESC
            JR      EQ,SCREEN_FUNC          ; Call screen function.
            CPB     RL0, #CR
            JR      EQ,CHAR_CR              ; Carriage return.
            CPB     RL0, #LF
            JR      EQ,CHAR_LF              ; Line Feed.
            CPB     RL0, #BS
            JR      EQ,CHAR_BS              ; Back Space.
            CALR    WR_CHAR_SCRN
            JP      SCREEN_EXIT

ILL_SCREEN  SETFLG  V
            RET

CHAR_CR     CLR     COL[ R9]                ; Reset column index.
            JP      SCREEN_EXIT_C

CHAR_LF     INC     ROW[ R9]
            CP      ROW[ R9], #24
            JP      LT, SCREEN_EXIT_C
            CLR     ROW[ R9]                ; Reset row index.
            JP      SCREEN_EXIT_C

CHAR_BS     TEST    COL[ R9]
            JP      Z, SCREEN_EXIT
            DEC     COL[ R9]                ; Reset column index.
            DEC     CURSOR_POS[ R9]
            JP      SCREEN_EXIT
```

```
WR_CHAR_SCRN    PUSH    @SP, R0
                CALR    SET_DISP_ADDR
                SUB     R0, #SPACE
                OUT     @R1, R0                 ; Output a char to screen.
                CALR    NEXT_POS
                POP     R0, @SP
                RET

                SKIP

*               Screen Processor routines.

NEXT_POS        INC     COL[ R9]
                CP      COL[ R9], #40
                JR      GE,RESET_COL
                INC     CURSOR_POS[ R9]         ; Update cursor index.
                RET
RESET_COL       CLR     COL[ R9]
                INC     ROW[ R9]
                CP      ROW[ R9], #24
                JR      GE,RESET_ROW
                INC     CURSOR_POS[ R9]         ; Update cursor index.
                RET
RESET_ROW       CLR     ROW[ R9]
                CLR     CURSOR_POS[ R9]
                RET

SET_DISP_ADDR   PUSH    @SP, R0
                LD      R0, SCREEN_BASE[ R9]    ; Load base address for current screen.
                ADD     R0, CURSOR_POS[ R9]
                CALR    WR_ADDR_SET             ; Set up address for write.
                POP     R0, @SP
                RET

WRITE_CURSOR    CALR    SET_DISP_ADDR
                PUSH    @SP, R0
                LD      R0, #CURSOR
                OUT     @R1, R0
                POP     R0, @SP
                RET

ERASE_CURSOR    CALR    SET_DISP_ADDR
                PUSH    @SP, R0
                LD      R0, #SPACE
                OUT     @R1, R0
                POP     R0, @SP
                RET

                SKIP

*               Screen Function Jump Table.

SCREEN_FUNC     BUFFER  R3, GET_NEXT_BFR
                RET     OV
                CPB     RL0, #"H"               ; Cursor Home ?
                JP      EQ, CURSOR_HOME
                CPB     RL0, #"I"               ; Clear the rest of current line ?
```

```
            JP      EQ, CLEAR_EOL
            CPB     RL0, #"J"           ; Clear the rest of the screen ?
            JP      EQ, CLEAR_EOS
            CPB     RL0, #"L"           ; Clear the whole screen ?
            JP      EQ, CLEAR_SCREEN
            CPB     RL0, #"Y"           ; Set the cursor position ?
            JR      EQ,CURSOR_SET

SCRN_EXIT_ERR SETFLG V                  ; Undefined control code.
*           CALR    WRITE_CURSOR
            SC      #81H
            RET

CURSOR_HOME CLR     ROW[ R9]
            CLR     COL[ R9]
            CLR     CURSOR_POS[ R9]
            JR      SCREEN_EXIT

CURSOR_SET  BUFFER  R3, GET_NEXT_BFR    ; Get row index.
            SUBB    RL0, #SPACE
            CPB     RL0, #0
            JR      LT,SCRN_EXIT_ERR
            CPB     RL0, #23
            JR      GT,SCRN_EXIT_ERR
            CLRB    RH0
            LD      ROW[ R9], R0
            BUFFER  R3, GET_NEXT_BFR    ; Get column index.
            SUBB    RL0, #SPACE
            CPB     RL0, #0
            JR      LT,SCRN_EXIT_ERR
            CPB     RL0, #39
            JR      GT,SCRN_EXIT_ERR
            LD      COL[ R9], R0
            JR      SCREEN_EXIT_C

CLEAR_SCREEN CLR    ROW[ R9]
            CLR     COL[ R9]
            CLR     CURSOR_POS[ R9]     ; Reset cursor position.
            CALR    SET_DISP_ADDR
            LD      R7, #960
            CLR     R0
CLR_LOOP    OUT     @R1, R0
            DJNZ    R7,CLR_LOOP
            JR      SCREEN_EXIT

CLEAR_EOL   CALR    SET_DISP_ADDR
            LD      R7, #40
            SUB     R7, COL[ R9]        ; R7 := # of bytes to clear.
            CLR     R0
EOL_LOOP    OUT     @R1, R0
            DJNZ    R7,EOL_LOOP
            JR      SCREEN_EXIT

CLEAR_EOS   CALR    SET_DISP_ADDR
            LD      R7, #960
            SUB     R7, CURSOR_POS[ R9] ; R7 := # of bytes to clear.
            CLR     R0
```

```
EOS_LOOP        OUT     @R1, R0
                DJNZ    R7,EOS_LOOP
                JR      SCREEN_EXIT

CALCULATE_POS   PUSH    @SP, R8
                PUSHL   @SP, RR6
                LD      R8, ROW[ R9]
                LD      R7, #40                 ; R7 := # of chars per row.
                MULT    RR6, R8
                ADD     R7, COL[ R9]
                LD      CURSOR_POS[ R9], R7
                POPL    RR6, @SP
                POP     R8, @SP
                RET

SCREEN_EXIT_C   CALR    CALCULATE_POS
SCREEN_EXIT     EQU     $
*               CALR    WRITE_CURSOR
                RESFLG  V
                RET

                SKIP

*               Video Control Functions.

VIDEO_CNTL      PUSHL   @SP, RR6
                PUSH    @SP, R0
                CP      R5, #SCREEN0_SU
                JR      NE,SWITCH_SCRN
                BUFFER  R3, GET_NEXT_BFR
                CPB     RL0, #SWITCH_ON
                JR      NE,TURNOFF_VDO

TURNON_VDO      LDB     RL0, REG1
                ORB     RL0, #TURNON_MASK
ON_OFF          LDB     REG1, RL0
                LDB     RH0, #1                 ; Control register #1.
                CALR    WR_REG_VDP
                JR      CNTL_EXIT

TURNOFF_VDO     LDB     RL0, REG1
                ANDB    RL0, #TURNOFF_MASK
                JR      ON_OFF

SWITCH_SCRN     CP      R5, #1
                JR      LT,CNTL_EXIT
                CP      R5, #4
                JR      GT,CNTL_EXIT
                CP      R5, ACTIVE_SCREEN
                JR      EQ,TURNON_VDO
                LD      ACTIVE_SCREEN, R5       ; Update active screen.
                LD      R7, R5
                DEC     R7
                SLL     R7                      ; R9 := screen table displacement.
                CLR     R6
                LD      R7, SCREEN_BASE[ R7]
                DIV     RR6, #400H
```

```
            LDB     REG2, RL7
            LDB     RL0, RL7
            LDB     RH0, #2                 ; Control register #2.
            CALR    WR_REG_VDP
            JR      TURNON_VDO

CNTL_EXIT   POP     R0, @SP
            POPL    RR6, @SP
            RET
            SKIP

*           Basic TMS 9918 VDP I/O function routines.

WR_REG_VDP  PUSHL   @SP, RR0
            OR      R1, #2                  ; R1 := output port address.
            OUT     @R1, R0                 ; Write data byte.
            LDB     RL0, RH0
            ORB     RL0, #80H
            OUT     @R1, R0                 ; Write register index.
            POPL    RR0, @SP
            RET

WR_ADDR_SET PUSHL   @SP, RR0
            OR      R1, #2                  ; R1 := output port address.
            OUT     @R1, R0                 ; Write low order byte of address.
            LDB     RL0, RH0
            ORB     RL0, #40H
            OUT     @R1, R0                 ; Write high order byte of address.
            POPL    RR0, @SP
            RET

*WR_CHAR_VRAM  OUT  @R1, R0                 ; Output a character.
*           RET

RD_STATUS_VDP PUSH  @SP, R1
            OR      R1, #6                  ; R1 := input port address.
            IN      R0, @R1                 ; R0 := STATUS of Video Display Processor.
            POP     R1, @SP
            RET

RD_ADDR_SET PUSHL   @SP, RR0
            OR      R1, #2                  ; R1 := output port address.
            OUT     @R1, R0                 ; Write low order byte of address.
            LDB     RL0, RH0
            OUT     @R1, R0                 ; Write high order byte of address.
            POPL    RR0, @SP
            RET

RD_CHAR_VRAM OR     R1, #4                  ; R1 := input port address.
            IN      R0, @R1
            RET

VDP_OTIRB   OUTIB   @R1, @R2, R3
            TEST    R3
            JR      NZ,VDP_OTIRB
            RET

            SKIP
```

```
*               SYSTEM TABLES :

PT_NAM_ADDR1    EQU     2048            ; On 1K boundary.
PT_NAM_ADDR2    EQU     3072            ; On 1K boundary.
PT_NAM_ADDR3    EQU     4096            ; On 1K boundary.
PT_NAM_ADDR4    EQU     5120            ; On 1K boundary.

PT_GEN_ADDR     EQU     0000            ; On 2K boundary.
SP_GEN_ADDR     EQU     0               ; On 2K boundary.
PT_CLR_ADDR     EQU     0               ; On 40H boundary.
SP_NAM_ADDR     EQU     0               ; On 80H boundary.

REGVALS         BVAL    0,0D0H          ; Video attributes definition.
                BVAL    PT_NAM_ADDR1/400H       ; Pattern Name table base address definition.
                BVAL    PT_CLR_ADDR/40H         ; Pattern Color table base address definition.
                BVAL    PT_GEN_ADDR/800H        ; Pattern Generator table base address definition.
                BVAL    SP_NAM_ADDR/80H         ; Sprite Name table base address definition.
                BVAL    SP_GEN_ADDR/800H        ; Sprite Generator table base address definition.
                BVAL    0FCH            ; Text Mode color definition.
                                        ;  1F = bk/wh, FC = wh/gn.
PTGENADR        WVAL    PT_GEN_ADDR
PTGENLEN        WVAL    PTGENEND-PTGENTBL
PTGENTBL        BVAL    00H,00H,00H,00H,00H,00H,00H,0           ;  0 - space.
                BVAL    10H,10H,10H,10H,10H,00H,10H,0           ;  1 - character "!".
                BVAL    28H,28H,28H,00H,00H,00H,00H,0           ;  2 - character "*".
                BVAL    28H,28H,7CH,28H,7CH,28H,28H,0           ;  3 - character "#".
                BVAL    10H,3CH,50H,38H,14H,78H,10H,0           ;  4 - character "$".
                BVAL    60H,64H,08H,10H,20H,4CH,0CH,0           ;  5 - character "%".
                BVAL    20H,50H,50H,20H,54H,48H,34H,0           ;  6 - character "&".
                BVAL    10H,10H,10H,00H,00H,00H,00H,0           ;  7 - character "'".
                BVAL    10H,20H,40H,40H,40H,20H,10H,0           ;  8 - character "(".
                BVAL    10H,08H,04H,04H,04H,08H,10H,0           ;  9 - character ")".
                BVAL    10H,54H,38H,10H,38H,54H,10H,0           ; 10 - character "*".
                BVAL    00H,10H,10H,7CH,10H,10H,00H,0           ; 11 - character "+".
                BVAL    00H,00H,00H,00H,10H,10H,20H,0           ; 12 - character ",".
                BVAL    00H,00H,00H,7CH,00H,00H,00H,0           ; 13 - character "-".
                BVAL    00H,00H,00H,00H,00H,00H,10H,0           ; 14 - character ".".
                BVAL    00H,04H,08H,10H,20H,40H,00H,0           ; 15 - character "/".
                BVAL    38H,44H,4CH,54H,64H,44H,38H,0           ; 16 - character "0".
                BVAL    10H,30H,10H,10H,10H,10H,38H,0           ; 17 - character "1".
                BVAL    38H,44H,04H,38H,40H,40H,7CH,0           ; 18 - character "2".
                BVAL    7CH,04H,08H,18H,04H,44H,38H,0           ; 19 - character "3".
                BVAL    08H,18H,28H,48H,7CH,08H,08H,0           ; 20 - character "4".
                BVAL    7CH,40H,78H,04H,04H,44H,38H,0           ; 21 - character "5".
                BVAL    1CH,20H,40H,78H,44H,44H,38H,0           ; 22 - character "6".
                BVAL    7CH,04H,04H,08H,10H,20H,40H,0           ; 23 - character "7".
                BVAL    38H,44H,44H,38H,44H,44H,38H,0           ; 24 - character "8".
                BVAL    38H,44H,44H,3CH,04H,08H,70H,0           ; 25 - character "9".
                BVAL    00H,00H,10H,00H,10H,00H,00H,0           ; 26 - character ":".
                BVAL    00H,00H,10H,00H,10H,10H,20H,0           ; 27 - character ";".
                BVAL    08H,10H,20H,40H,20H,10H,08H,0           ; 28 - character "<".
                BVAL    00H,00H,3CH,00H,3CH,00H,00H,0           ; 29 - character "=".
                BVAL    20H,10H,08H,04H,08H,10H,20H,0           ; 30 - character ">".
                BVAL    38H,44H,04H,08H,10H,00H,10H,0           ; 31 - character "?".
                BVAL    10H,28H,44H,44H,7CH,44H,44H,0           ; 32 - character "@".
                BVAL    10H,28H,44H,44H,7CH,44H,44H,0           ; 33 - character "A".   &&&&
                BVAL    78H,24H,24H,36H,24H,24H,78H,0           ; 34 - character "B".
                BVAL    38H,44H,40H,40H,40H,44H,38H,0           ; 35 - character "C".
                BVAL    78H,24H,24H,24H,24H,24H,78H,0           ; 36 - character "D".
```

```
BVAL    7CH,40H,40H,78H,40H,40H,7CH,0        ; 37 - character "E".
BVAL    7CH,40H,40H,78H,40H,40H,40H,0        ; 38 - character "F".
BVAL    3CH,40H,40H,40H,4CH,44H,3CH,0        ; 39 - character "G".
BVAL    44H,44H,44H,7CH,44H,44H,44H,0        ; 40 - character "H".
BVAL    38H,10H,10H,10H,10H,10H,38H,0        ; 41 - character "I".
BVAL    04H,04H,04H,04H,04H,44H,38H,0        ; 42 - character "J".
BVAL    44H,48H,50H,60H,50H,48H,44H,0        ; 43 - character "K".
BVAL    40H,40H,40H,40H,40H,40H,7CH,0        ; 44 - character "L".
BVAL    44H,6CH,54H,54H,54H,44H,44H,0        ; 45 - character "M".
BVAL    44H,44H,64H,54H,4CH,44H,44H,0        ; 46 - character "N".
BVAL    38H,44H,44H,44H,44H,44H,38H,0        ; 47 - character "O".
BVAL    78H,44H,44H,78H,40H,40H,40H,0        ; 48 - character "P".
BVAL    38H,44H,44H,44H,54H,48H,34H,0        ; 49 - character "Q".
BVAL    78H,44H,44H,78H,50H,48H,44H,0        ; 50 - character "R".
BVAL    38H,44H,40H,38H,04H,44H,38H,0        ; 51 - character "S".
BVAL    7CH,10H,10H,10H,10H,10H,10H,0        ; 52 - character "T".
BVAL    44H,44H,44H,44H,44H,44H,38H,0        ; 53 - character "U".
BVAL    44H,44H,44H,28H,28H,10H,10H,0        ; 54 - character "V".
BVAL    44H,44H,44H,54H,54H,54H,6CH,0        ; 55 - character "W".
BVAL    44H,44H,28H,10H,28H,44H,44H,0        ; 56 - character "X".
BVAL    44H,44H,28H,10H,10H,10H,10H,0        ; 57 - character "Y".
BVAL    7CH,04H,08H,10H,20H,40H,7CH,0        ; 58 - character "Z".
BVAL    7CH,60H,60H,60H,60H,60H,7CH,0        ; 59 - character "[".
BVAL    00H,40H,20H,10H,08H,04H,00H,0        ; 60 - character "\".
BVAL    7CH,0CH,0CH,0CH,0CH,0CH,7CH,0        ; 61 - character "]".
BVAL    00H,10H,38H,44H,00H,00H,00H,0        ; 62 - character "^".
BVAL    00H,00H,00H,00H,00H,00H,7CH,0        ; 63 - character "_".
BVAL    00H,04H,08H,08H,08H,08H,08H,08H      ; 64 - part 1 of graphic "0".
BVAL    0F0H,08H,04H,04H,04H,04H,04H,04H     ; 65 - part 2 of graphic "0".
BVAL    08H,08H,08H,04H,00H,00H,00H,00H      ; 66 - part 3 of graphic "0".
BVAL    04H,04H,04H,08H,0F0H,00H,00H,00H     ; 67 - part 4 of graphic "0".
BVAL    00H,00H,04H,00H,00H,00H,00H,00H      ; 68 - part 1 of graphic "1".
BVAL    40H,0C0H,40H,40H,40H,40H,40H,40H     ; 69 - part 2 of graphic "1".
BVAL    00H,00H,00H,00H,04H,00H,00H,00H      ; 70 - part 3 of graphic "1".
BVAL    40H,40H,40H,40H,0F0H,00H,00H,00H     ; 71 - part 4 of graphic "1".
BVAL    00H,04H,08H,00H,00H,00H,00H,00H      ; 72 - part 1 of graphic "2".
BVAL    0F0H,08H,04H,04H,04H,08H,10H,60H     ; 73 - part 2 of graphic "2".
BVAL    00H,04H,08H,08H,0CH,00H,00H,00H      ; 74 - part 3 of graphic "2".
BVAL    80H,00H,00H,00H,0FCH,00H,00H,00H     ; 75 - part 4 of graphic "2".
BVAL    00H,04H,08H,00H,00H,00H,00H,00H      ; 76 - part 1 of graphic "3".
BVAL    0F0H,08H,04H,04H,04H,08H,70H,08H     ; 77 - part 2 of graphic "3".
BVAL    00H,00H,08H,04H,00H,00H,00H,00H      ; 78 - part 3 of graphic "3".
BVAL    04H,04H,04H,08H,0F0H,00H,00H,00H     ; 79 - part 4 of graphic "3".
BVAL    00H,00H,00H,00H,00H,04H,08H,10H      ; 80 - part 1 of graphic "4".
BVAL    10H,10H,30H,50H,90H,10H,10H,10H      ; 81 - part 2 of graphic "4".
BVAL    10H,1CH,00H,00H,00H,00H,00H,00H      ; 82 - part 3 of graphic "4".
BVAL    10H,0FCH,10H,10H,10H,00H,00H,00H     ; 83 - part 4 of graphic "4".
BVAL    0CH,08H,08H,08H,08H,0CH,00H,00H      ; 84 - part 1 of graphic "5".
BVAL    0F8H,00H,00H,00H,00H,0F0H,08H,04H    ; 85 - part 2 of graphic "5".
BVAL    00H,00H,00H,08H,04H,00H,00H,00H      ; 86 - part 3 of graphic "5".
BVAL    04H,04H,04H,08H,0F0H,00H,00H,00H     ; 87 - part 4 of graphic "5".
BVAL    00H,04H,08H,08H,08H,08H,0CH,08H      ; 88 - part 1 of graphic "6".
BVAL    0F0H,08H,04H,00H,00H,0F0H,08H,04H    ; 89 - part 2 of graphic "6".
BVAL    08H,08H,08H,04H,00H,00H,00H,00H      ; 90 - part 3 of graphic "6".
BVAL    04H,04H,04H,08H,0F0H,00H,00H,00H     ; 91 - part 4 of graphic "6".
BVAL    0CH,08H,08H,00H,00H,00H,00H,00H      ; 92 - part 1 of graphic "7".
BVAL    0FCH,04H,04H,04H,08H,10H,20H,20H     ; 93 - part 2 of graphic "7".
BVAL    00H,00H,00H,00H,00H,00H,00H,00H      ; 94 - part 3 of graphic "7".
```

```
BVAL    40H,40H,80H,8CH,8CH,00H,00H,00H      ;  95 - part 4 of graphic "7".
BVAL    00H,04H,08H,08H,08H,04H,00H,04H      ;  96 - part 1 of graphic "8".
BVAL    0F0H,08H,04H,04H,04H,08H,0F0H,08H    ;  97 - part 2 of graphic "8".
BVAL    08H,08H,08H,04H,00H,00H,00H,00H      ;  98 - part 3 of graphic "8".
BVAL    04H,04H,04H,08H,0F0H,00H,00H,00H     ;  99 - part 4 of graphic "8".
BVAL    00H,04H,08H,08H,08H,08H,04H,00H      ; 100 - part 1 of graphic "9".
BVAL    0F0H,08H,04H,04H,04H,04H,0CH,0F4H    ; 101 - part 2 of graphic "9".
BVAL    00H,00H,08H,04H,00H,00H,00H,00H      ; 102 - part 3 of graphic "9".
BVAL    04H,04H,04H,08H,0F0H,00H,00H,00H     ; 103 - part 4 of graphic "9".
BVAL    00H,00H,00H,00H,04H,04H,04H,0CH      ; 104 - part 1 of graphic "A".
BVAL    40H,40H,0A0H,0A0H,10H,10H,10H,0F8H   ; 105 - part 2 of graphic "A".
BVAL    08H,08H,10H,10H,10H,00H,00H,00H      ; 106 - part 3 of graphic "A".
BVAL    08H,08H,04H,04H,04H,00H,00H,00H      ; 107 - part 4 of graphic "A".
BVAL    1CH,08H,08H,08H,08H,08H,0CH,08H      ; 108 - part 1 of graphic "B".
BVAL    0F8H,04H,04H,04H,04H,08H,0F0H,08H    ; 109 - part 2 of graphic "B".
BVAL    08H,08H,08H,08H,1CH,09H,00H,00H      ; 110 - part 3 of graphic "B".
BVAL    04H,04H,04H,04H,0F8H,00H,00H,00H     ; 111 - part 4 of graphic "B".
BVAL    00H,04H,08H,10H,10H,10H,10H,10H      ; 112 - part 1 of graphic "C".
BVAL    0F0H,08H,04H,00H,00H,00H,00H,00H     ; 113 - part 2 of graphic "C".
BVAL    10H,10H,08H,04H,00H,00H,00H,00H      ; 114 - part 3 of graphic "C".
BVAL    00H,00H,04H,08H,0F0H,00H,00H,00H     ; 115 - part 4 of graphic "C".
BVAL    1CH,08H,08H,08H,08H,08H,08H,08H      ; 116 - part 1 of graphic "D".
BVAL    0F0H,08H,04H,04H,04H,04H,04H,04H     ; 117 - part 2 of graphic "D".
BVAL    08H,08H,08H,08H,1CH,00H,00H,00H      ; 118 - part 3 of graphic "D".
BVAL    04H,04H,04H,08H,0F0H,00H,00H,00H     ; 119 - part 4 of graphic "D".
BVAL    0CH,08H,08H,08H,08H,08H,0CH,08H      ; 120 - part 1 of graphic "E".
BVAL    0FCH,00H,00H,00H,00H,00H,0F0H,00H    ; 121 - part 2 of graphic "E".
BVAL    08H,08H,08H,08H,0CH,00H,00H,00H      ; 122 - part 3 of graphic "E".
BVAL    00H,00H,00H,00H,0FCH,00H,00H,00H     ; 123 - part 4 of graphic "E".
BVAL    0CH,08H,08H,08H,08H,08H,0CH,08H      ; 124 - part 1 of graphic "F".
BVAL    0FCH,00H,00H,00H,00H,00H,0F0H,00H    ; 125 - part 2 of graphic "F".
BVAL    08H,08H,08H,08H,08H,00H,00H,00H      ; 126 - part 3 of graphic "F".
BVAL    00H,00H,00H,00H,00H,00H,00H,00H      ; 127 - part 4 of graphic "F".
BVAL    00H,04H,08H,10H,10H,10H,10H,10H      ; 128 - part 1 of graphic "G".
BVAL    0F0H,08H,04H,00H,00H,00H,00H,3CH     ; 129 - part 2 of graphic "G".
BVAL    10H,10H,08H,04H,00H,00H,00H,00H      ; 130 - part 3 of graphic "G".
BVAL    04H,04H,04H,08H,0F0H,00H,00H,00H     ; 131 - part 4 of graphic "G".
BVAL    08H,08H,08H,08H,08H,08H,0CH,08H      ; 132 - part 1 of graphic "H".
BVAL    04H,04H,04H,04H,04H,04H,0FCH,04H     ; 133 - part 2 of graphic "H".
BVAL    08H,08H,08H,08H,08H,00H,00H,00H      ; 134 - part 3 of graphic "H".
BVAL    04H,04H,04H,04H,04H,00H,00H,00H      ; 135 - part 4 of graphic "H".
BVAL    04H,00H,00H,00H,00H,00H,00H,00H      ; 136 - part 1 of graphic "I".
BVAL    0F0H,40H,40H,40H,40H,40H,40H,40H     ; 137 - part 2 of graphic "I".
BVAL    00H,00H,00H,00H,04H,00H,00H,00H      ; 138 - part 3 of graphic "I".
BVAL    40H,40H,40H,40H,0F0H,00H,00H,00H     ; 139 - part 4 of graphic "I".
BVAL    00H,00H,00H,00H,00H,00H,00H,00H      ; 140 - part 1 of graphic "J".
BVAL    10H,10H,10H,10H,10H,10H,10H,10H      ; 141 - part 2 of graphic "J".
BVAL    00H,00H,10H,08H,04H,00H,00H,00H      ; 142 - part 3 of graphic "J".
BVAL    10H,10H,10H,20H,0C0H,00H,00H,00H     ; 143 - part 4 of graphic "J".
BVAL    08H,08H,08H,08H,08H,08H,0CH,08H      ; 144 - part 1 of graphic "K".
BVAL    04H,08H,10H,20H,40H,80H,00H,80H      ; 145 - part 2 of graphic "K".
BVAL    08H,08H,08H,08H,08H,00H,00H,00H      ; 146 - part 3 of graphic "K".
BVAL    40H,20H,10H,08H,04H,00H,00H,00H      ; 147 - part 4 of graphic "K".
BVAL    08H,08H,08H,08H,08H,08H,08H,08H      ; 148 - part 1 of graphic "L".
BVAL    00H,00H,00H,00H,00H,00H,00H,00H      ; 149 - part 2 of graphic "L".
BVAL    08H,08H,08H,08H,0CH,00H,00H,00H      ; 150 - part 3 of graphic "L".
BVAL    00H,00H,00H,00H,0FCH,00H,00H,00H     ; 151 - part 4 of graphic "L".
BVAL    10H,18H,14H,10H,10H,10H,10H,10H      ; 152 - part 1 of graphic "M".
BVAL    04H,0CH,14H,0A4H,44H,44H,04H,04H     ; 153 - part 2 of graphic "M".
```

```
BVAL    10H,10H,10H,10H,10H,00H,00H,00H      ; 154 - part 3 of graphic "M".
BVAL    04H,04H,04H,04H,04H,00H,00H,00H      ; 155 - part 4 of graphic "M".
BVAL    08H,08H,0CH,08H,08H,08H,08H,08H      ; 156 - part 1 of graphic "N".
BVAL    04H,04H,04H,84H,84H,44H,24H,24H      ; 157 - part 2 of graphic "N".
BVAL    08H,08H,08H,08H,08H,00H,00H,00H      ; 158 - part 3 of graphic "N".
BVAL    14H,14H,0CH,04H,04H,00H,00H,00H      ; 159 - part 4 of graphic "N".
BVAL    04H,08H,10H,10H,10H,10H,10H,10H      ; 160 - part 1 of graphic "O".
BVAL    0F0H,08H,04H,04H,04H,04H,04H,04H     ; 161 - part 2 of graphic "O".
BVAL    10H,10H,10H,08H,04H,00H,00H,00H      ; 162 - part 3 of graphic "O".
BVAL    04H,04H,04H,08H,0F0H,00H,00H,00H     ; 163 - part 4 of graphic "O".
BVAL    1CH,08H,08H,08H,08H,08H,0CH,08H      ; 164 - part 1 of graphic "P".
BVAL    0F8H,04H,04H,04H,04H,04H,0F8H,00H    ; 165 - part 2 of graphic "P".
BVAL    08H,08H,08H,08H,08H,00H,00H,00H      ; 166 - part 3 of graphic "P".
BVAL    00H,00H,00H,00H,00H,00H,00H,00H      ; 167 - part 4 of graphic "P".
BVAL    04H,08H,10H,10H,10H,10H,10H,10H      ; 168 - part 1 of graphic "Q".
BVAL    0F0H,08H,04H,04H,04H,04H,04H,04H     ; 169 - part 2 of graphic "Q".
BVAL    10H,10H,10H,08H,04H,00H,00H,00H      ; 170 - part 3 of graphic "Q".
BVAL    44H,24H,14H,08H,0F4H,00H,00H,00H     ; 171 - part 4 of graphic "Q".
BVAL    1CH,08H,08H,08H,08H,08H,0CH,08H      ; 172 - part 1 of graphic "R".
BVAL    0F0H,08H,04H,04H,04H,08H,0F0H,80H    ; 173 - part 2 of graphic "R".
BVAL    08H,08H,08H,08H,08H,00H,00H,00H      ; 174 - part 3 of graphic "R".
BVAL    40H,20H,10H,08H,04H,00H,00H,00H      ; 175 - part 4 of graphic "R".
BVAL    04H,08H,10H,10H,10H,08H,04H,00H      ; 176 - part 1 of graphic "S".
BVAL    0F0H,08H,04H,00H,00H,00H,0F0H,08H    ; 177 - part 2 of graphic "S".
BVAL    00H,00H,10H,08H,04H,00H,00H,00H      ; 178 - part 3 of graphic "S".
BVAL    04H,04H,04H,08H,0F0H,00H,00H,00H     ; 179 - part 4 of graphic "S".
BVAL    1CH,00H,00H,00H,00H,00H,00H,00H      ; 180 - part 1 of graphic "T".
BVAL    0FCH,40H,40H,40H,40H,40H,40H,40H     ; 181 - part 2 of graphic "T".
BVAL    00H,00H,00H,00H,00H,00H,00H,00H      ; 182 - part 3 of graphic "T".
BVAL    40H,40H,40H,40H,40H,00H,00H,00H      ; 183 - part 4 of graphic "T".
BVAL    10H,10H,10H,10H,10H,10H,10H,10H      ; 184 - part 1 of graphic "U".
BVAL    04H,04H,04H,04H,04H,04H,04H,04H      ; 185 - part 2 of graphic "U".
BVAL    10H,10H,10H,08H,04H,00H,00H,00H      ; 186 - part 3 of graphic "U".
BVAL    04H,04H,04H,08H,0F0H,00H,00H,00H     ; 187 - part 4 of graphic "U".
BVAL    10H,10H,10H,08H,08H,08H,04H,04H      ; 188 - part 1 of graphic "V".
BVAL    04H,04H,04H,08H,08H,08H,10H,10H      ; 189 - part 2 of graphic "V".
BVAL    04H,00H,00H,00H,00H,00H,00H,00H      ; 190 - part 3 of graphic "V".
BVAL    10H,0A0H,0A0H,40H,40H,00H,00H,00H    ; 191 - part 4 of graphic "V".
BVAL    10H,10H,10H,10H,10H,10H,10H,10H      ; 192 - part 1 of graphic "W".
BVAL    04H,04H,04H,04H,04H,04H,04H,44H      ; 193 - part 2 of graphic "W".
BVAL    10H,10H,14H,18H,10H,00H,00H,00H      ; 194 - part 3 of graphic "W".
BVAL    44H,0A4H,14H,0CH,04H,00H,00H,00H     ; 195 - part 4 of graphic "W".
BVAL    10H,10H,08H,08H,04H,00H,00H,00H      ; 196 - part 1 of graphic "X".
BVAL    04H,04H,08H,08H,10H,0E0H,40H,0E0H    ; 197 - part 2 of graphic "X".
BVAL    04H,08H,08H,10H,10H,00H,00H,00H      ; 198 - part 3 of graphic "X".
BVAL    10H,08H,08H,04H,04H,00H,00H,00H      ; 199 - part 4 of graphic "X".
BVAL    10H,10H,08H,04H,00H,00H,00H,00H      ; 200 - part 1 of graphic "Y".
BVAL    04H,04H,08H,10H,0E0H,40H,40H,40H     ; 201 - part 2 of graphic "Y".
BVAL    00H,00H,00H,00H,00H,00H,00H,00H      ; 202 - part 3 of graphic "Y".
BVAL    40H,40H,40H,40H,40H,00H,00H,00H      ; 203 - part 4 of graphic "Y".
BVAL    0CH,00H,00H,00H,00H,00H,00H,00H      ; 204 - part 1 of graphic "Z".
BVAL    0FCH,08H,10H,10H,20H,20H,40H,40H     ; 205 - part 2 of graphic "Z".
BVAL    00H,00H,04H,0CH,0CH,00H,00H,00H      ; 206 - part 3 of graphic "Z".
BVAL    80H,80H,00H,00H,0FCH,00H,00H,00H     ; 207 - part 4 of graphic "Z".
BVAL    00H,00H,00H,00H,00H,00H,00H,00H      ; 208 - part 1 of graphic " ".
BVAL    00H,00H,00H,00H,00H,00H,00H,00H      ; 209 - part 2 of graphic " ".
BVAL    00H,00H,00H,00H,00H,00H,00H,00H      ; 210 - part 3 of graphic " ".
BVAL    00H,00H,00H,00H,00H,00H,00H,00H      ; 211 - part 4 of graphic " ".
```

```
            BVAL    00H,00H,00H,00H,00H,00H,00H,00H         ; 212 - part 1 of graphic "!".
            BVAL    00H,40H,40H,40H,40H,40H,40H,40H         ; 213 - part 2 of graphic "!".
            BVAL    00H,00H,00H,00H,00H,00H,00H,00H         ; 214 - part 3 of graphic "!".
            BVAL    40H,40H,00H,00H,40H,00H,00H,00H         ; 215 - part 4 of graphic "!".
            BVAL    00H,04H,04H,04H,1CH,04H,04H,04H         ; 216 - part 1 of graphic "‡".
            BVAL    00H,10H,10H,10H,0FCH,10H,10H,10H        ; 217 - part 2 of graphic "‡".
            BVAL    1CH,04H,04H,04H,00H,00H,00H,00H         ; 218 - part 3 of graphic "‡".
            BVAL    0FCH,10H,10H,10H,00H,00H,00H,00H        ; 219 - part 4 of graphic "‡".
            BVAL    00H,00H,10H,08H,04H,00H,00H,00H         ; 220 - part 1 of graphic "*".
            BVAL    00H,40H,44H,48H,50H,0E0H,40H,0E0H       ; 221 - part 2 of graphic "*".
            BVAL    04H,08H,10H,00H,00H,00H,00H,00H         ; 222 - part 3 of graphic "*".
            BVAL    50H,48H,44H,40H,00H,00H,00H,00H         ; 223 - part 4 of graphic "*".
            BVAL    00H,00H,00H,00H,00H,00H,1CH,00H         ; 224 - part 1 of graphic "_".
            BVAL    00H,00H,00H,00H,00H,00H,0FCH,00H        ; 225 - part 2 of graphic "_".
            BVAL    00H,00H,00H,00H,00H,00H,00H,00H         ; 226 - part 3 of graphic "_".
            BVAL    00H,00H,00H,00H,00H,00H,00H,00H         ; 227 - part 4 of graphic "_".
            BVAL    00H,00H,00H,00H,00H,00H,00H,00H         ; 228 - part 1 of graphic ":".
            BVAL    00H,00H,00H,0C0H,0C0H,00H,00H,00H       ; 229 - part 2 of graphic ":".
            BVAL    00H,00H,00H,00H,00H,00H,00H,00H         ; 230 - part 3 of graphic ":".
            BVAL    0C0H,0C0H,00H,00H,00H,00H,00H,00H       ; 231 - part 4 of graphic ":".
            BVAL    00H,00H,00H,00H,1CH,00H,00H,00H         ; 232 - part 1 of graphic "=".
            BVAL    00H,00H,00H,00H,0FCH,00H,00H,00H        ; 233 - part 2 of graphic "=".
            BVAL    1CH,00H,00H,00H,00H,00H,00H,00H         ; 234 - part 3 of graphic "=".
            BVAL    0FCH,00H,00H,00H,00H,00H,00H,00H        ; 235 - part 4 of graphic "=".
PTGENEND    EQU     $

GRAPHIC_TABLE BVAL  208,212,0,216,0,0,0,0,0,0,220,0,0,224,0,0
            BVAL    64,68,72,76,80,84,88,92,96,100          ; Digits.
            BVAL    228,0,0,232,0,0,0
            BVAL    104,108,112,116,120,124,128,132,136     ; Letters.
            BVAL    140,144,148,152,156,160,164,168,172
            BVAL    176,180,184,188,192,196,200,204
            BVAL    0,0,0,0,0,0,0
            EVEN

SCREEN_INFO EQU     $
            WVAL    PT_NAM_ADDR1            ; Base VRAM address for screen #1.
            WVAL    PT_NAM_ADDR2            ; Base VRAM address for screen #2.
            WVAL    PT_NAM_ADDR3            ; Base VRAM address for screen #3.
            WVAL    PT_NAM_ADDR4            ; Base VRAM address for screen #4.

            EQU     $
            WVAL    0                       ; Cursor position of screen #1.
            WVAL    0                       ; Cursor position of screen #2.
            WVAL    0                       ; Cursor position of screen #3.
            WVAL    0                       ; Cursor position of screen #4.

            EQU     $
            WVAL    0                       ; Cursor row index of screen #1.
            WVAL    0                       ; Cursor row index of screen #2.
            WVAL    0                       ; Cursor row index of screen #3.
            WVAL    0                       ; Cursor row index of screen #4.

            EQU     $
            WVAL    0                       ; Cursor column index of screen #1.
            WVAL    0                       ; Cursor column index of screen #2.
            WVAL    0                       ; Cursor column index of screen #3.
            WVAL    0                       ; Cursor column index of screen #4.
```

```
                WVAL    1                       ; Active screen index.

SCR_TBL_LEN     EQU     $-SCREEN_INFO

LAST            EQU     $
                SKIP
                DATA
REG_TBL         EQU     $
REG0            BVAL    0                       ; Value of VDP Control Register #0.
REG1            BVAL    0                       ; Value of VDP Control Register #1.
REG2            BVAL    0                       ; Value of VDP Control Register #2.
REG3            BVAL    0                       ; Value of VDP Control Register #3.
REG4            BVAL    0                       ; Value of VDP Control Register #4.
REG5            BVAL    0                       ; Value of VDP Control Register #5.
REG6            BVAL    0                       ; Value of VDP Control Register #6.
REG7            BVAL    0                       ; Value of VDP Control Register #7.
STATUS          BVAL    0                       ; Value of VDP Status Register.
                EVEN
SCREEN_TBL      EQU     $

SCREEN_BASE     EQU     $
                WVAL    0                       ; Base VRAM address for screen #1.
                WVAL    0                       ; Base VRAM address for screen #2.
                WVAL    0                       ; Base VRAM address for screen #3.
                WVAL    0                       ; Base VRAM address for screen #4.

CURSOR_POS      EQU     $
                WVAL    0                       ; Cursor position of screen #1.
                WVAL    0                       ; Cursor position of screen #2.
                WVAL    0                       ; Cursor position of screen #3.
                WVAL    0                       ; Cursor position of screen #4.

ROW             EQU     $
                WVAL    0                       ; Cursor row index of screen #1.
                WVAL    0                       ; Cursor row index of screen #2.
                WVAL    0                       ; Cursor row index of screen #3.
                WVAL    0                       ; Cursor row index of screen #4.

COL             EQU     $
                WVAL    0                       ; Cursor column index of screen #1.
                WVAL    0                       ; Cursor column index of screen #2.
                WVAL    0                       ; Cursor column index of screen #3.
                WVAL    0                       ; Cursor column index of screen #4.

ACTIVE_SCREEN   WVAL    0                       ; Active screen index.

LAST_DATA       END
```

What is claimed is:

1. An apparatus for locating a dart embedded in a dart board comprising:

a housing for supporting the dart board;

means within said housing for illuminating a space adjacent a surface of the dart board supported within said housing;

means within said housing for detecting the presence of at least two shadows created by the presence of the dart within said illuminated space when said dart is embedded in said surface of the dart board supported within said housing;

means for utilizing the location of said shadows created by the presence of said dart within said illuminated space to calculate the location of said dart embedded in said dart board;

said means within said housing for detecting the presence of at least two shadows comprising a plurality of light detecting elements for monitoring the intensity of the illumination within said illuminated space, said plurality of light detecting elements being located along a side of said dart board opposite from said means within said housing for illuminating said illuminated space; and each of said plurality of light detecting elements being capable of detecting a reduced level of illumination incident on said light detecting element when said light detecting element is within a shadow created by the presence of said dart within said illuminated space adjacent said surface of said dart board.

2. An apparatus as claimed in claim 1 wherein said means for utilizing the detection of said shadows created by the presence of said dart within said illuminated space adjacent to a surface of said dart board to calculate the location of said dart embedded in said dart board comprises:

a microprocessor responsive to a set of machine instructions for calculating the location of said dart embedded in said dart board, said set of machine instructions utilizing as input the output of said plurality of light detecting elements; and electronic circuitry associated with said microprocessor for transmitting the output of each of said plurality of light detecting elements to said microprocessor to enable said microprocessor to identify which light detecting elements of said plurality of light detecting elements are detecting a reduced level of illumination indicative of the presence of a shadow on that particular light detecting element.

3. An apparatus for locating a dart embedded in a dart board comprising:

a housing for enclosing a dart board;

first means within said housing for illuminating a space adjacent to a surface of a dart board enclosed within said housing;

second means within said housing for illuminating said space adjacent to a surface of a dart board enclosed within said housing;

a first plurality of light detecting elements within said housing for monitoring the intensity of the illumination within said illuminated space adjacent to a surface of a dart board enclosed within said housing, said first plurality of light detecting elements being located on a side of said dart board and oppositely located from said first means within said housing for illuminating said space adjacent to a surface of said dart board, each of said first plurality of light detecting elements being capable of detecting a reduced level of illumination on said light detecting element when said light detecting element is within a shadow created by the presence of a dart within said illuminated space adjacent to a surface of said dart board when said dart is embedded in said surface of said dart board;

a second plurality of light detecting elements within said housing for monitoring the intensity of the illumination within said illuminated space adjacent to a surface of a dart board enclosed within said housing, said second plurality of light detecting elements being located on a side of said dart board oppositely located from said second means within said housing for illuminating said space adjacent to the surface of said dart board, each of said second plurality of light detecting elements being capable of detecting a reduced level of illumination on said light detecting element when said light detecting element is within a shadow created by the presence of a dart within said illuminated space adjacent to a surface of said dart board;

means for utilizing the detection of a shadow on said first plurality of light detecting elements and the detection of a shadow on said second plurality of light detecting element created by the presence of a dart within said illuminated space adjacent to a surface of said dart board when said dart is embedded in said surface of said dart board to calculate the location of said dart embedded in said dart board;

said means for utilizing the detection of a shadow on said first plurality of light detecting elements and the detection of a shadow on said second plurality of light detecting elements to calculate the location of said dart embedded in said dart board comprising a microprocessor responsive to a set of machine instructions for calculating the location of said dart embedded in said dart board, said set of machine instructions utilizing as input the output of said first plurality of light detecting elements and the output of said second plurality of light detecting elements; and electronic circuitry associated with said microprocessor for transmitting the output of each of said first plurality of light detecting elements to said microprocessor and for transmitting the output of each of said second plurality of light detecting elements to said microprocessor to enable said microprocessor to identify which light detecting elements of said first plurality of light detecting elements and which light detecting elements of said second plurality of light detecting elements are detecting a reduced level of illumination indicative of the presence of a shadow on that particular light detecting elements.

4. An apparatus for locating a dart embedded in a dart board comprising:

a housing for enclosing a dart board;

first means within said housing for illuminating a space adjacent to a surface of a dart board enclosed within said housing;

second means within said housing for illuminating said space adjacent to a surface of a dart board enclosed within said housing;

third means within said housing for illuminating said space adjacent to a surface of a dart board enclosed within said housing;

a first plurality of light detecting elements within said housing for monitoring the intensity of the illumination within said illuminated space adjacent to a surface of a dart board enclosed within said housing, said first plurality of light detecting elements being located on a side of said dart board and oppositely located from said first means within said housing for illuminating said space adjacent to a surface of said dart board, each of said first plurality of light detecting elements being capable of detecting a reduced level of illumination on said light detecting elements when said light detecting element is within a shadow created by the presence of a dart within said illuminated space adjacent to a surface of said dart board when said dart is embedded in said surface of said dart board;

a second plurality of light detecting elements within said housing for monitoring the intensity of the illumination with said illuminated space adjacent to a surface of a dart board enclosed within said housing, said second plurality of light detecting elements being located on a side of said dart board and oppositely located from said second means within said housing for illuminating said space adjacent to a surface of said dart board, each of said second plurality of light detecting elements being capable of detecting a reduced level of illumination on said light detecting elements when said light detecting element is within a shadow created by the presence of a dart within said illuminated space adjacent to a surface of said dart board;

a third plurality of light detecting elements within said housing for monitoring the intensity of the illumination within said illuminated space adjacent to a surface of a dart board enclosed within said housing, said third plurality of light detecting elements being located on a side of said dart board and oppositely located from said third means within said housing for illuminating said space adjacent to a surface of said dart board, each of said third plurality of light detecting elements being capable of detecting a reduced level of illumination on said light detecting elements when said light detecting element is within a shadow created by the presence of a dart within said illuminated space adjacent to a surface of said dart board;

means for utilizing the detection of a shadow on said first plurality of light detecting elements and the detection of a shadow on said second plurality of light detecting elements and the detection of a shadow on said third plurality of light detecting elements created by the presence of a dart within said illuminated space adjacent to a surface of said dart board when said dart is embedded in said surface of said dart board to calculate the location of said dart embedded in said dart board;

said means for utilizing the detection of a shadow on said first plurality of light detecting elements and the detection of a shadow on said second plurality of light detecting elements and the detection of a shadow on said third plurality of light detecting elements to calculate the location of a dart embedded in said dart board comprising a microprocessor responsive to a set of machine instructions for calculating the location of said dart embedded in said dart board, said set of machine instructions utilizing as input the output of said first plurality of light detecting elements and the output of said second plurality of light detecting elements and the output of said third plurality of light detecting elements; and electronic circuitry associated with said microprocessor for transmitting the output of each of said first plurality of light detecting elements to said microprocessor and for transmitting the output of each of said second plurality of light detecting elements to said microprocessor and for transmitting the output of each of said third plurality of light detecting elements to said microprocessor to enable said microprocessor to identify which light detecting elements of said first plurality of light detecting elements and which light detecting elements of said second plurality of light detecting elements and which light detecting elements of said third plurality of light detecting elements are detecting a reduced level of illumination indicative of the presence of a shadow on that particular light detecting element.

5. An apparatus for automatically scoring a dart game comprising:

a housing for enclosing a dart board adapted to receive darts therein;

a pair of light source within said housing for illuminating a space adjacent to the outer surface of the dart board;

a plurality of photoelectric cells arranged within said housing along a side of said dart board opposite said light sources for detecting the presence of at least two shadows created by the presence of a dart within said illuminated space adjacent to the outer surface of the dart board when said dart is embedded in said surface of the dart board enclosed within said housing, each of said shadows extending across more than one photoelectric cell;

electronic means responsive to the light intensity of said photoelectric cells created by the presence of said dart within said illuminated space adjacent to the outer surface of said dart board to calculate the location of said dart embedded in said dart board; and means for automatically calculating the score of said dart embedded in said surface of said dart board from the location of said dart therein.

6. An apparatus as claimed in claim 5 wherein said means for automatically calculating the score of said dart embedded in said dart board comprising a microprocessor responsive to a set of machine instructions for calculating the score of said dart embedded in said dart board, said set of machine instructions utilizing as input the location of said dart embedded in said dart board.

7. A method for locating a dart embedded in a circular dart board comprising the steps of:

illuminating a space closely adjacent to the outer surface of the dart board in which the dart is embedded with at least two spaced light sources along a side of the dart board;

monitoring the intensity of the illumination within said illuminated space with a plurality of light detecting elements located along a side of said circular dart board opposed from the light sources;

detecting a reduced level of illumination incident on at least one light detecting element of said plurality of light detecting elements when said light detecting element is within a shadow created by the presence of said dart within said illuminated space; and calculating the location of said dart embedded in said dart board from the detection of said shadows created by the presence of said dart within said illuminated space adjacent to the surface of said dart board.

8. A method as claimed in claim 7 where the step of calculating the location of said dart embedded in said dart board from the detection of said shadows created by the presence of said dart within said illuminated space adjacent to the surface of said dart board comprises the steps of:

transmitting the output of each of said plurality of light detecting elements to a microprocessor;

identifying by said microprocessor which light detecting elements of said plurality of light detecting elements are detecting a reduced level of illumination indicative of the presence of a shadow on that particular light detecting element; and calculating by said microprocessor the location of said dart embedded in said dart board from the shadow location information.

9. A method for locating a dart embedded in a dart board comprising the steps of:

illuminating a space closely adjacent to the outer surface of the dart board in which the dart is embedded with a first illuminating means;

monitoring the intensity of the illumination from said first illumination means within said illuminated space with a first plurality of light detecting elements located along a first side of said dart board;

detecting the presence of the center of at least one shadow on said first plurality of light detecting elements created by the presence of the dart within said illuminated space when said dart is embedded in said surface of said dart board, said shadow extending across more than one light detecting element;

illuminating said space closely adjacent to the outer surface of the dart board in which the dart is embedded with a second illuminating means;

monitoring the intensity of the illumination from said second illumination means with a second plurality of light detecting elements located along a second side of said dart board;

detecting the presence of the center of at least one shadow on said second plurality of light detecting elements created by the presence of the dart within said illuminated space when said dart is embedded in said surface of said dart board, said shadow extending across more than one light detecting element; and calculating the location of said dart embedded in said dart board from the detection of a shadow on said first plurality of light detecting elements and from the detection of a shadow on said second plurality of light detecting elements created by the presence of a dart within said illuminated space closely adjacent to the outer surface of said dart board when said dart is embedded in said surface of said dart board.

10. A method as claimed in claim 9 where the step of calculating the location of said dart embedded in said dart board from the detection of a shadow on said first plurality of light detecting elements and from the detection of a shadow on said second plurality of light detecting elements created by the presence of a dart within said illuminated space adjacent to a surface of said dart board when said dart is embedded in said surface of said dart board comprises the steps of:

transmitting the output of each of said first plurality of light detecting elements to a microprocessor;

transmitting the output of each of said second plurality of light detecting elements to said microprocessor;

identifying by said microprocessor which light detecting elements of said first plurality of light detecting elements and which light detecting elements of said second plurality of light detecting elements are detecting a reduced level of illumination indicative of the presence of a shadow on those particular light detecting elements; and calculating by said microprocessor the location of said dart embedded in said dart board from the shadow location information.

11. A method for locating a dart embedded in a dart board comprising the steps of:

illuminating a space adjacent to the surface of the dart board in which the dart is embedded with a first illuminating means;

monitoring the intensity of the illumination from said first illumination means within said illuminated space with a first plurality of light detecting elements located along a first side of said dart board;

detecting the presence of at least one shadow on said first plurality of light detecting elements created by the presence of the dart within said illuminated space when said dart is embedded in said surface of said dart board;

illuminating said space adjacent to the surface of the dart board in which the dart is embedded with a second illuminating means;

monitoring the intensity of the illumination from said second illumination means with a second plurality of light detecting elements located along a second side of said dart board;

detecting the presence of at least one shadow on said second plurality of light detecting elements created by the presence of the dart within said illuminated space when said dart is embedded in said surface of said dart board;

illuminating said space adjacent to the surfaces of the dart board in which the dart is embedded with a third illuminating means;

monitoring the intensity of the illumination from said third illumination means with a third plurality of light detecting elements located along a third side of said dart board;

detecting the presence of at least one shadow on said third plurality of light detecting elements created by the presence of the dart within said illuminated space when said dart is embedded in said surface of said dart board; and calculating the location of said dart embedded in said dart board from the detection of a shadow on said first plurality of light detecting elements and from the detection of a shadow on said second plurality of light detecting elements and from the detection of a shadow on said third plurality of light detecting elements created by the presence of a dart within said illuminated space adjacent to a surface of said dart board when said dart is embedded in said surface of said dart board.

12. A method as claimed in claim 11 where the step of calculating the location of said dart embedded in said dart board from the detection of a shadow on said first plurality of light detecting elements and from the detection of a shadow on said second plurality of light detecting elements and from the detection of a shadow on said third plurality of light detecting elements created by the presence of a dart within said illuminated space adjacent to a surface of said dart board when said dart is embedded in said surface of said dart board comprises the steps of:

transmitting the output of each of said first plurality of light detecting elements to a microprocessor;

transmitting the output of each of said second plurality of light detecting elements to said microprocessor;

transmitting the output of each of said third plurality of light detecting elements to said microprocessor;

identifying by said microprocessor which light detecting elements of said first plurality of light detecting elements and which light detecting elements of said second plurality of light detecting elements and which light detecting elements of said third plurality of light detecting elements are detecting a reduced level of illumination indicative of the presence of a shadow on those particular light detecting elements; and calculating by said microprocessor the location of said dart embedded in said dart board from the shadow location information.

13. An electronic dart game apparatus for locating a dart embedded in a dart board and displaying a score calculated from the location of the dart comprising:

a housing having a central opening therein;

a dart board mounted within said central opening and having an exposed outer surface to receive darts thrown at said dart board;

light source means within said housing adjacent one side of the dart board for illuminating a space adjacent the exposed outer surface of said dart board and directing a light across the outer surface of the dart board;

a plurality of light detecting elements within said housing adjacent an opposite side of said dart board for monitoring the intensity of the illumination from said light source means within said illuminated space adjacent said outer surface of said dart board and detecting the presence of at least two shadows created by the presence of a dart within said illuminated space when said dart is embedded in said dart board adjacent the outer surface thereof;

means responsive to said light detecting elements to calculate the location of said dart embedded in said dart board;

means to calculate automatically the score of said dart embedded in said dart board from the location of said embedded dart; and means on said apparatus to display visually the score calculated by the calculating means.

14. An electronic dart game apparatus for locating a dart embedded in a dart board and displaying a score calculated from the location of the dart comprising;

a generally rectangular box-like housing having a central circular opening in an outer wall of said housing;

a circular dart board mounted within said circular opening inwardly of said outer wall to define a space between said wall and an exposed outer surface of the dart board, said exposed outer surface adapted to receive darts thrown at said dart board through said circular opening and embedded therein;

a pair of light sources spaced from each other about the periphery of the dart board for illuminating said space adjacent the exposed outer surface of said dart board and directing light across said exposed outer surface of the dart board;

a plurality of light detecting elements within said housing for each of the light sources and positioned adjacent the periphery of the dart board opposite the associated light source for receiving light from said associated light source directed across the outer surface of the dart board, said light detecting elements monitoring the intensity of the illumination from said light source means and detecting the presence of at least two shadows created by the presence of a dart within said illuminated space when said dart is embedded in said dart board adjacent the outer surface thereof;

a microprocessor responsive to said light detecting elements to calculate the location of said dart embedded in said dart board;

electronic circuitry associated with said microprocessor for transmitting the output of each of said plurality of light detecting elements to said microprocessor to enable said microprocessor to identify which light detecting elements of said plurality of light detecting elements are detecting a reduced level of illumination indicating the presence of a shadow on that particular light detecting element;

means associated with said circuitry to automatically calculate the score of said dart embedded in said dart board from the location of said embedded dart; and means associated with said calculating means to display visually the score calculated by the calculating means.

15. An electric dart game apparatus as set forth in claim 14 wherein each of said light sources directs light in a fan-like beam across the surface of the dart board on its associated plurality of light detecting elements, the associated plurality of light detecting elements being arranged generally in a row of continuous adjacent light detecting elements extending along a portion of the periphery of the dart board.

16. An electronic dart board apparatus as set forth in claim 14 wherein said light detecting elements are photoelectric cells.

17. An electronic dart board apparatus as set forth in claim 14 wherein said display means comprises a cathode ray tube screen.

18. An electronic dart game apparatus for locating a dart embedded in a circular dart board and displaying a score calculated from the location of the dart comprising:

a housing having a generally circular central opening therein;

a circular dart board mounted within said circular opening and having an exposed outer surface inset inwardly from the adjacent outer surface of the housing to form a space between the outer surface of the housing and the outer surface of the dart board through which darts are thrown at said dart board;

a pair of light sources spaced from each other about the periphery of the dart board and directing light beams across the outer surface of the dart board for illuminating said space;

a plurality of photoelectric cells for each of the light sources positioned in a continuous row adjacent the periphery of the dart board opposite the associated light source for receiving light from said associated light source directed across the outer surface of the dart board, said photoelectric cells monitoring the intensity of the illumination from said light source means and detecting the presence of at least two shadows created by the presence of a dart within said illuminated space when said dart is embedded in said dart board adjacent the outer surface thereof;

a microprocessor responsive to said photoelectric cells to calculate the location of said dart embedded in said dart board;

electronic circuitry associated with said microprocessor for transmitting the output of each of said plurality of photoelectric cells to said microprocessor to enable said microprocessor to identify which photoelectric cells of said plurality are detecting a reduced level of illumination indicating the presence of a shadow on that particular photoelectric cell;

means associated with said circuitry to automatically calculate the score of said dart embedded in said dart board from the location of said embedded dart; and means associated with said calculating means to display visually the score calculated by the calculating means.

19. An electronic dart game as set forth in claim 18 wherein the shadow formed by a dart embedded in said dart board eclipses and extends across more than one photoelectric cell, and said microprocessor and associated circuitry determine the center of the shadow extending across a plurality of adjacent photoelectric cells.

20. An electronic system for locating the position of a dart embedded in a dart board for calculating the score obtained by such embedded dart, said system comprising:

a pair of light sources positioned adjacent said dart board at a known location and spaced from each other a known distance for directing light beams over the outer surface of the dart board in a closely spaced relation thereto along a generally vertical plane;

a plurality of adjacent light detecting elements for the light sources positioned in a generally continuous line along a generally vertical plane on a side of said dart board opposite the associated light sources for receiving light therefrom; and electronic means including associated circuitry responsive to said light detecting elements for detecting the presence of at least two shadows created by the presence of an embedded dart extending through the light beams directed by said pair of spaced light sources, each of said shadows created by said dart extending across a plurality of light detecting sources, said electronic means and associated circuitry determining the center of the shadow extending across said plurality of light detecting elements from the variation in light intensity from said associated light sources.

21. An electronic system as set forth in claim 20 wherein said electronic means and associated circuitry calculates the angle formed at each light source between a known line extending from the respective light source and a line extending from the respective light source to the embedded dart.

22. An electronic system as set forth in claim 21 wherein said electronic means and associated circuitry calculates the distance from each light source to the embedded dart thereby to calculate the score obtained by such embedded dart.

23. An electronic system for locating the position of a dart embedded in a dart board for calculating the score obtained by such embedded dart; said system comprising:

at least three light sources positioned at known locations about said dart for directing light beams in a generally vertical plane over the outer surface of the dart board closely spaced relation thereto;

a plurality of contiguous light detecting elements for the light sources positioned in a generally continuous line along a generally vertical plane on a side of the dart board opposite the associated light sources for receiving light therefrom directed across and in closely spaced relation to the outer surface of said dart board; and electronic means including associated circuitry responsive to said light detecting elements for detecting the presence of at least three shadows created by the presence of an embedded dart adjacent the outer surface of the dart board extending through the light beams directed by said at least three light sources, said electronic means and associated circuitry determining the center of such shadows from the variation in light intensity from the associated light sources;

said electronic means and associated circuitry further calculating the distance from each light source to the embedded dart, and the angle between a known line extending from each light source and another line extending from the light source to the embedded dart thereby accurately locating the exact position of the dart for calculating the score therefrom.

24. A method of calibrating a microprocessor for locating a dart board accurately with respect to a housing on which the dart board is mounted for determining the accurate location of darts embedded in the dart board and the calculation of a score based on such location; said method comprising the steps of:

initially positioning the circular dart board in a centered position within a circular aperture in the housing;

positioned a pair of calibration pins at known locations on the dart board and at a known spacing between the pins;

positioning a pair of spaced light sources on the housing at known locations adjacent said dart board for directing light beams across the outer surface of the dart board, said light sources being spaced from each other a known distance;

positioning a plurality of light detecting elements on the housing adjacent said dart board for each light source on a side of said dart board opposite the associated light source for receiving light thereof, each of said plurality of light detecting elements being positioned in a generally continuous row facing the associated light source across the outer surface of the dart board, said calibration pins interrupting said light beams from said light sources and forming a shadow on the associated plurality of light detecting elements; and providing a microprocessor and associated circuitry responsive to said light detecting elements to determine the angle formed at each light source between known lines extending from the associated light source and lines extending from the associated light source to the two calibration pins thereby to calibrate the microprocessor.

25. The method of calibrating a microprocessor as set forth in claim 24 further including the steps of:

positioning one calibration pin at the extent center of the dart board and positioning the other calibration pin at the bottom edge of the dart board; and positioning said pair of spaced light sources below said other pin along a common generally horizontal plane, said microprocessor and associated circuitry determining the vertical distance said other pin is positioned above said light sources.

26. A method of calibrating a microprocessor for locating the exact position of a dart board with respect to a support for the dart board thereby to permit the accurate location of darts embedded in the dart board for calculating a score based on such location; said calibration method comprising the steps of:

positioning the dart board at a generally centered position on the support;

positioning a pair of calibration pins on the dart board at known locations on the dart board and at a known spacing between the pins;

positioning a pair of spaced light sources on the support at known locations adjacent said dart board for directing light beams across the outer surface of the dart board in closely spaced relation thereto, said light sources being spaced from each other a known distance;

positioning a plurality of contiguous light detecting elements for the light sources in a generally continuous row on a side of the dart board opposite the light sources for receiving light therefrom directed across and in closely spaced relation to the outer surface of said dart board, said calibration pins extending through and interrupting said light beams and forming shadows on certain of the light detecting elements; and providing a microprocessor and associated circuitry responsive to said light detecting elements and the shadows formed by said calibration pins to determine the angle formed between lines extending from each light source to the pair of calibration pins thereby to calibrate the microprocessor for accurately locating the exact position of embedded darts to calculate the score therefrom.

* * * * *